US007122299B2

(12) United States Patent
Suzuki et al.

(10) Patent No.: US 7,122,299 B2
(45) Date of Patent: Oct. 17, 2006

(54) SILVER HALIDE PHOTOGRAPHIC LIGHT-SENSITIVE MATERIAL

(75) Inventors: Makoto Suzuki, Minami-ashigara (JP); Takanori Hioki, Minami-ashigara (JP); Naoto Matsuda, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/701,386

(22) Filed: Nov. 5, 2003

(65) Prior Publication Data

US 2004/0185392 A1 Sep. 23, 2004

(30) Foreign Application Priority Data

Nov. 6, 2002 (JP) ..... 2002-323127
Mar. 11, 2003 (JP) ..... 2003-065565

(51) Int. Cl.

| | |
|---|---|
| ***G03C 1/12*** | (2006.01) |
| ***G03C 1/29*** | (2006.01) |
| ***G03C 1/43*** | (2006.01) |
| ***G03C 7/26*** | (2006.01) |
| ***G03C 7/392*** | (2006.01) |

(52) U.S. Cl. ..... 430/551; 430/372; 430/377; 430/429; 430/463; 430/606; 430/570; 430/572

(58) Field of Classification Search ..... 430/570, 430/572, 372, 377, 551, 606, 429, 463
See application file for complete search history.

(56) References Cited

U.S. PATENT DOCUMENTS

| | | | | |
|---|---|---|---|---|
| 5,068,171 | A * | 11/1991 | Morigaki et al. | 430/551 |
| 5,108,888 | A * | 4/1992 | Ikegawa et al. | 430/570 |
| 5,192,646 | A * | 3/1993 | Merkel et al. | 430/377 |
| 5,395,742 | A | 3/1995 | Deguchi et al. | |
| 5,478,712 | A * | 12/1995 | Singer et al. | 430/551 |
| 6,117,629 | A | 9/2000 | Yamashita et al. | |
| 6,153,364 | A | 11/2000 | Goswami et al. | |
| 6,361,932 | B1 * | 3/2002 | Parton et al. | 430/572 |
| 6,555,305 | B1 * | 4/2003 | Vargas et al. | 430/543 |
| 6,632,594 | B1 | 10/2003 | Nakai et al. | |
| 6,686,134 | B1 * | 2/2004 | Suzuki et al. | 430/429 |
| 6,841,344 | B1 * | 1/2005 | Gibson et al. | 430/558 |
| 2003/0198902 | A1 * | 10/2003 | Suzuki et al. | 430/449 |
| 2005/0169859 | A1 * | 8/2005 | Toan et al. | 424/59 |

FOREIGN PATENT DOCUMENTS

| | | | |
|---|---|---|---|
| EP | 277589 | * | 8/1988 |
| WO | WO 03/035734 | * | 5/2003 |

* cited by examiner

*Primary Examiner*—Richard L. Schilling
(74) *Attorney, Agent, or Firm*—Sughrue Mion, PLLC

(57) ABSTRACT

A silver halide photographic photosensitive material, containing at least one residual-color-reducing agent having at least one aromatic ring or aromatic heterocycle in its molecule; a processing method thereof; and an image-forming method.

3 Claims, No Drawings

SILVER HALIDE PHOTOGRAPHIC LIGHT-SENSITIVE MATERIAL

FIELD OF THE INVENTION

The present invention relates to a silver halide photographic photosensitive material (preferably a silver halide color photographic photosensitive material), a processing method of the photosensitive material, and an image-forming method using the same. In detail, the present invention relates to a photographic photosensitive material that has high sensitivity and is able to reduce generation of stain resulting from a residual (retained) sensitizing dye in the photosensitive material after processing (hereinafter the stain is referred to as a residual color), a processing method of the photosensitive material, and an image-forming method using the same.

BACKGROUND OF THE INVENTION

For many years, great effort has been made to increase photographic sensitivity of silver halide photographic photosensitive materials (hereinafter referred to as "photosensitive material"). In a silver halide photographic emulsion, a sensitizing dye, adsorbed on the surface of silver halide grains, absorbs a light irradiated into a photosensitive material, and the absorbed light energy is transmitted to the silver halide grains, displaying photosensitivity. Accordingly, in spectral sensitization for the silver halide, it is assumed that the light energy transmitted to the silver halide can be increased by increasing the light absorption rate per unit of grain surface area of silver halide grains, thereby leading to increased spectral sensitivity. The light absorption rate on the surface of silver halide grains can be enhanced by increasing the quantity of a spectral sensitizing dye adsorbed per unit of grain surface area.

However, there is a limit to the quantity of a spectral sensitizing dye that can be adsorbed on the surface of silver halide grains, such that it is difficult to adsorb a larger quantity of dye chromophore than a mono-layer-saturated adsorption; namely, a single-layer adsorption. Accordingly, at the present time, the absorption rate of incident photons by individual silver halide grains in the spectral sensitization region is still unsatisfactory.

As a method to solve these problems, there are many proposals for adsorbing a grater quantity of sensitizing dyes than a single-layer adsorption. For example, in the Description of the Conventional Art of JP-A-2002-23294 ("JP-A" means unexamined published Japanese patent application), prior art documents and patents related to the afore-mentioned method are described. Recently, in particular, advances in photographic sensitivity by a multi-layer adsorption, owing to a combination of a specific cationic dye and a specific anionic dye, have been tried (see, for example, JP-A-10-239789, JP-A-10-171058, and EP0985965). However, these methods tend to increase residual color resulting from sensitizing dyes.

In addition, in the remarkable progress of digital cameras and color printers, processing of a silver halide photographic photosensitive material (especially a silver halide color photographic photosensitive material) that is able to rapidly provide a high-quality image to users has been demanded. However, if the processing time in the conventional processing method is simply reduced, the processing terminates before sensitizing dyes in the photosensitive material are sufficiently washed out thereof. Accordingly, there is a problem that the image becomes unacceptably colored (stained) by a substantial amount of sensitizing dyes that remains in the white ground portion of a color print (this stain is called residual color). Further, also in color negative films, increased density in the minimum density area, owing to residual color, breaks color balance and makes providing a proper print difficult.

Further, the use of tabular silver halide grains, is an important fundamental technology in a high-sensitivity photosensitive material for shooting in recent years. If tabular silver halide grains, particularly tabular silver halide grains having a high aspect ratio (hereinafter referred to as tabular grains), are used, as their photographic property, they have a high ratio of surface area to volume, and therefore, the quantity of sensitizing dyes used per unit volume can be increased. This results in effects of enhanced sensitivity and ratio of sensitivity to granularity, and thereby higher color sensitization sensitivity can be obtained (see, for example, U.S. Pat. No. 5,494,789). The term "aspect ratio" used herein refers to the ratio of diameter to thickness of the tabular grain. "Diameter of the tabular grain" refers to the diameter of a circle having an area equivalent to the projected area of the said grain, when an emulsion is observed with optical or electronic microscope. Further, the thickness of the tabular grain refers to the distance between two parallel planes that constitute the said grain.

However, the use of tabular grains increases the quantity of sensitizing dyes remaining in the photosensitive material after processing. As such, depending on the processing conditions, the quantity of residual sensitizing dyes sometimes increases to an extent that it cannot be neglected, and which causes phenomena in which the density of the minimum density area of a color negative film increases, and the highlight area of a color reversal film becomes colored.

Additionally, selenium sensitization of a silver halide emulsion is also useful for advances in photographic sensitivity, and many selenium compounds are known as selenium-sensitizing agents (see, for example, JP-A-4-109240). However, also in this method, there is a problem resulting from the residual sensitizing dyes.

As an example of the method of eliminating residual color resulting from a sensitizing dye, for example, there is disclosed a method of using a bistriazinyl aminostylbene disulfonic acid compound. This method has been used over a wide range in the processing of color photographic photosensitive material (for example, see Research Disclosure (hereinafter abbreviated as RD) No. 20733). Further, for example, there is disclosed a bistriazinylaminostylbene disulfonic acid compound that is excellent in solubility and able to reduce residual color even in time-reduced processing (for example, see JP-A-6-329936).

As shown in the above, as a method of reducing a residual color, there are known methods of adding a particular compound to a processing solution. However, there is no known method in which a silver halide photographic photosensitive material, having a dye chromophore that is multilayer-adsorbed on the silver halide, is processed with such a processing solution.

Further the bistriazinylaminostylbene disulfonic acid compound is generally added to a developing solution, to thereby obtain a residual-color reducing effect. However, when added to a fixing solution, the said compound deteriorates in the presence of components in the fixing solution, such that it is difficult to maintain performance stably.

In addition, the bistriazinylaminostylbene disulfonic acid compound, which is originally a fluorescent brightening agent, sometimes imparts an unnecessary fluorescent whitening property to a photosensitive material after processing.

Further, as compounds other than the bistriazinylaminostylbene disulfonic acid compound, for example, these are disclosed bisarylaminotriazine compounds (for example, see U.S. Pat. No. 6,153,364). However, because these compounds are added to a developing solution, a bleaching solution, or a fixing solution, deterioration of the components resulting from long-term usage makes it difficult to maintain image quality.

As mentioned above, there is a demand for a silver halide photosensitive material that has high sensitivity and low residual color, and a processing method of the photosensitive material, or an image-forming method using the photosensitive material.

SUMMARY OF THE INVENTION

The present invention resides in a silver halide photographic photosensitive material containing at least one residual-color-reducing agent having at least one aromatic ring or aromatic heterocycle.

Further, the present invention resides in a silver halide photographic photosensitive material containing at least one compound represented by the following formula (I):

$$A_1\text{-}(X_1)n_1\text{-}B_1\text{-}(X_2)n_2\text{-}A_2\ Mdmd \qquad \text{Formula (I)}$$

(wherein, in formula, $A_1$ and $A_2$ represent an aryl group or an aromatic heterocyclic group; $B_1$ represents an atomic group having a $\pi$ electron; $X_1$ and $X_2$ represent a linking group; $n_1$ and $n_2$ each represent 0 or 1; Md represents a counter ion for balancing a charge; and md represents a number of 1 or more required for neutralizing a charge on the molecule.)

Further, the present invention resides in a silver halide photographic photosensitive material containing a dye chromophore that is multilayer-adsorbed on the surface of silver halide grains, and at least one residual-color-reducing agent containing one or more aromatic ring or aromatic heterocycle in its molecule.

Further, the present invention resides in an image-forming method, having a step of contacting a silver halide photographic photosensitive material, in which a dye chromophore is multilayer-adsorbed on silver halide grain surfaces, with at least one residual-color-reducing agent having at least one aromatic ring or aromatic heterocycle in its molecule.

Further, the present invention resides in a processing method of a silver halide photographic photosensitive material, having a step of contacting said silver halide photographic photosensitive material, in which a dye chromophore is multilayer-adsorbed on silver halide grain surfaces, with at least one residual-color-reducing agent having at least one aromatic ring or aromatic heterocycle in its molecule.

Other and further features and advantages of the invention will appear more fully from the following description.

DETAILED DESCRIPTION OF THE INVENTION

According to the present invention, there are provided the following means.

(1) A silver halide photographic photosensitive material, containing at least one residual-color-reducing agent having at least one aromatic ring or aromatic heterocycle in its molecule.

(2) A silver halide photographic photosensitive material, containing at least one residual-color-reducing agent having at least one aromatic ring or aromatic heterocycle, to reduce residual color due to the sensitizing dye.

(3) The silver halide photographic photosensitive material as described in the above item (1) or (2), wherein the residual-color-reducing agent described in the above item (1) or (2) is a compound represented by the following formula (I):

$$A_1\text{-}(X_1)n_1\text{-}B_1\text{-}(X_2)n_2\text{-}A_2\ Mdmd \qquad \text{Formula (I)}$$

(wherein, in formula, $A_1$ and $A_2$ represent an aromatic group or an aromatic heterocyclic group; $B_1$ represents an atomic group having a $\pi$ electron; $X_1$ and $X_2$ represent a linking group; $n_1$ and $n_2$ represent 0 or 1; Md represents a counter ion for balancing a charge; and md represents a number of 0 or more required for neutralizing a charge on the molecule.)

(4) A silver halide photographic photosensitive material, containing at least one compound represented by the following formula (I):

$$A_1\text{-}(X_1)n_1\text{-}B_1\text{-}(X_2)n_2\text{-}A_2\ Mdmd \qquad \text{Formula (I)}$$

(wherein, in formula, $A_1$ and $A_2$ represent an aromatic group or an aromatic heterocyclic group; $B_1$ represents an atomic group having a $\pi$ electron; $X_1$ and $X_2$ represent a linking group; $n_1$ and $n_2$ represent 0 or 1; Md represents a counter ion for balancing a charge; and md represents a number of 0 or more required for neutralizing a charge on the molecule.)

(5) The silver halide photographic photosensitive material as described in the above item (1) or (2), wherein said silver halide photographic photosensitive material is a color photographic photosensitive material.

(6) The silver halide photographic photosensitive material as described in the above item (1), (2) or (5), wherein said residual-color-reducing agent is a compound represented by the following formula (IV):

$$A_1\text{-}X_1\text{-}L\text{-}X_2\text{-}A_2 \qquad \text{Formula (IV)}$$

(wherein, in formula, $A_1$ and $A_2$ each represent an aromatic group or an aromatic heterocyclic group; L represents a divalent group derived from compounds having a $\pi$ electron; and $X_1$ and $X_2$ each represent a divalent linking group.)

(7) The silver halide photographic photosensitive material as described in the above item (6), wherein, in formula (IV), L represents a divalent, aromatic group or aromatic heterocyclic group; and $X_1$ and $X_2$ each represent $—CR_1{=}CR_1—$, —O—, $—NR_1—$, —S—, $—CONR_1—$, $—SO_2NR_1—$, $—CO_2—$, or >C=O, in which $R_1$ represents a hydrogen atom or an alkyl group having 1 to 6 carbon atoms.

(8) The silver halide photographic photosensitive material as described in the above item (6) or (7), wherein, in formula (IV), a substituent in the molecule represented by formula (IV) contains at least two groups represented by $—SO_3M$ or $—CO_2M$, in which M represents a hydrogen atom, an alkali metal, an alkali earth metal, an ammonium or a pyridinium.

(9) The silver halide photographic photosensitive material as described in the above item (3), (4), (6), (7) or (8), wherein, in the compound represented by formula (I) or (IV) described in the above item (3), (4), (6), (7) or (8), $A_1$ and $A_2$ each are a substituted or unsubstituted naphthyl group.

(10) The silver halide photographic photosensitive material as described in the above item (3), (4), (6), (7) or (8), wherein, in the compound represented by formula (I) or (IV) described in the above item (3), (4), (6), (7) or (8), $A_1$ and $A_2$ each are a naphthyl group having at least one carboxy group.

(11) The silver halide photographic photosensitive material as described in any one of the preceding (1) to (10), wherein at least one silver halide emulsion incorporated in said silver halide photographic photosensitive material contains dye chromophores being multilayer-adsorbed on the surface of silver halide grains.

(Hereinafter, a first embodiment of the present invention means to include the silver halide photographic photosensitive material described in the items (1) to (11) above.)

(12) A silver halide photographic photosensitive material, containing a dye chromophore that is multilayer-adsorbed on the surface of silver halide grains, and at least one residual-color-reducing agent containing one or more aromatic ring or aromatic heterocycle in its molecule.

(13) The silver halide photographic photosensitive material as described in the above item (12), wherein the residual-color-reducing agent as described in the item (12) contains 5 to 10 aromatic rings or aromatic heterocycles.

(14) The silver halide photographic photosensitive material as described in the above item (12) or (13), wherein the residual-color-reducing agent is a compound represented by the following formula (I):

$$A_1\text{-}(X_1)n_1\text{-}B_1\text{-}(X_2)n_2\text{-}A_2\ Mdmd \qquad \text{Formula (I)}$$

(wherein, in formula, $A_1$ and $A_2$ represent an aromatic group or an aromatic heterocyclic group; $B_1$ represents an atomic group having a $\pi$ electron; $X_1$ and $X_2$ represent a linking group; $n_1$ and $n_2$ represent 0 or 1; Md represents a counter ion for balancing a charge; and md represents a number of 0 or more required for neutralizing a charge on the molecule.)

(15) The silver halide photographic photosensitive material as described in any one of the above items (12) to (14), wherein a compound containing the dye chromophore as described in the above item (12) to (14), and another dye compound are mutually connecting by an attractive force, except for a covalent bond.

(16) The silver halide photographic photosensitive material as described in any one of the above item (12) to (15), containing a compound comprising a plurality of dye chromophores.

(17) The silver halide photographic photosensitive material as described in any one of the above items (12) to (16), containing a dye having a divalent or more multivalent charge.

(18) The silver halide photographic photosensitive material as described in any one of the above items (12) to (17), wherein the compound containing the dye chromophore, and a dye compound other than the compound containing the dye chromophore, have opposite charges.

(19) The silver halide photographic photosensitive material as described in any one of the above items (12) to (18), wherein the compound containing the dye chromophore has an aromatic group.

(20) The silver halide photographic photosensitive material as described in the above item (15), wherein the dye compound other than the compound containing the dye chromophore has an aromatic group.

(21) The silver halide photographic photosensitive material as described in any one of the above items (12) to (20), containing a dye having a hydrogen bonding group.

(22) The silver halide photographic photosensitive material as described in any one of the above items (12) to (21), containing silver halide grains having light absorption strength of 60 or more when a spectral absorption maximum wavelength is shorter than 500 nm, or alternatively light absorption strength of 100 or more when a spectral absorption maximum wavelength is 500 nm or longer.

(23) The silver halide photographic photosensitive material as described in any one of the above items (12) to (22), wherein when the maximum value of spectral absorptance of the silver halide grains owing to the sensitizing dye is taken as Amax, the wavelength distance between the shortest wavelength and the longest wavelength, each of which attains 50% of Amax, is 120 nm or less.

(24) The silver halide photographic photosensitive material as described in any one of the above items (12) to (22), wherein when the maximum value of spectral sensitivity of the silver halide grains owing to the sensitizing dye is taken as Smax, the wavelength distance between the shortest wavelength and the longest wavelength, each of which attains 50% of Smax, is 120 nm or less.

(25) The silver halide photographic photosensitive material as described in any one of the above items (12) to (24), wherein, when the maximum value of spectral absorptance owing to a dye chromophore of the first layer on the silver halide grains is taken as A1max, and the maximum value of spectral absorptance owing to a dye chromophore of the second and higher order layers is taken as A2max, and the maximum value of spectral sensitivity owing to a dye chromophore of the first layer on the silver halide grains is taken as S1max, and the maximum value of spectral sensitivity owing to a dye chromophore of the second layer and the higher order layers is taken as S2max, then, A1max and A2max, or S1max and S2max are in the range of from 400 nm to 500 nm, or from 500 nm to 600 nm, or from 600 nm to 700 nm, or from 700 nm to 1000 nm.

(26) The silver halide photographic photosensitive material as described in any one of the above items (12) to (25), wherein the longest wavelength at which the spectral absorptance is 50% of Amax or Smax is in the range of from 460 nm to 510 nm, or from 560 nm to 610 nm, or from 640 nm to 730 nm.

(27) The silver halide photographic photosensitive material as described in any one of the above items (12) to (26), wherein excitation energy of the dye chromophore of the second layer and the higher order layers on the silver halide grains transfers to the dye chromophore of the first layer at efficiency of 10% or more.

(28) The silver halide photographic photosensitive material as described in any one of the above items (12) to (27), wherein the dye chromophore of the first layer, and the dye chromophore of the second layer and the higher order layers, on the silver halide grains, each show a J band absorption.

(29) The silver halide photographic photosensitive material as described in any one of the above items (12) to (28), wherein a silver halide photographic emulsion in the photosensitive material is an emulsion in which tabular grains having an aspect ratio of at least 2 occupy 50% or more by area of the total silver halide grains in the emulsion.

(30) The silver halide photographic photosensitive material as described in any one of the above items (12) to (29), comprising a selenium-sensitized silver halide photographic emulsion.

(31) An image-forming method, comprising a step of contacting a silver halide photographic photosensitive material, in which a dye chromophore is multilayer-adsorbed on silver halide grains, with at least one residual-color-reducing agent having at least one aromatic ring or aromatic heterocycle in its molecule.

(32) A processing method of a silver halide photographic photosensitive material, comprising a step of contacting a silver halide photographic photosensitive material, in which a dye chromophore is multilayer-adsorbed on silver halide grains, with at least one residual-color-reducing agent having at least one aromatic ring or aromatic heterocycle in its molecule.

(Hereinafter, a second embodiment of the present invention means to include the silver halide photographic photosensitive material described in the items (12) to (30) above, the image-forming method described in the item (31) above, and the processing method described in the item (32) above.)

Herein, the present invention means to include both of the above first and second embodiments, unless otherwise specified.

The present inventors have made intensive studies to solve the above-mentioned problems, and have found that generation of stain (residual color) resulting from sensitizing dyes remained in the photosensitive material after processing can be reduced by using a residual-color-reducing agent having at least one aromatic ring or aromatic heterocycle in its molecule. The present invention has been made on the basis of this knowledge.

The present invention is explained in detail below.

In the case where a specific portion is mentioned as a "group" in the present invention, said specific portion means a group that may be substituted with at least one (up to the possible highest number of) substituent, even though the specific portion itself is not substituted. For example, the term "alkyl group" is used to mean a substituted or unsubstituted alkyl group. Further, as a substituent that can be used for a compound in the present invention, there is no particular limitation regardless of existence or absence of a substituent thereon.

These substituents are referred to as "W". The substituent represented by W may be any substituent, and is not particularly limited. Examples include a halogen atom, an alkyl group (including a cycloalkyl group, a bicycloalkyl group, and a tricycloalkyl group), an alkenyl group (including a cycloalkenyl group, a bicycloalkenyl group), an alkynyl group, an aryl group, a heterocyclic group (also referred to as a hetero ring group), a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an alkylamino group, an arylamino group, and a heterocyclic amino group), an ammonio group, an acylamino group, an aminocarbonylamino group, an alkoxycarbonylamino group, an aryloxycarbonylamino group, a sulfamoyl amino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an aryloxycarbonyl group, an alkoxycarbonyl group, a carbamoyl group, an aryl- or heterocyclic-azo group, an imido group, a phosphino group, a phosphinyl group, a phosphinyloxy group, a phosphinylamino group, a phosphono group, a silyl group, a hydrazino group, an ureido group, a boronic acid group (—$B(OH)_2$), a phosphato group (—$OPO(OH)_2$), a sulfato group (—$OSO_3H$), and other known substituents.

In more detail, examples of W include a halogen atom (e.g., fluorine atom, chlorine atom, bromine atom, and iodine atom); an alkyl group [which represents a straight-chain, branched-chain or cyclic and substituted or unsubstituted alkyl group, such as an alkyl group (preferably an alkyl group having 1 to 30 carbon atoms, e.g., methyl, ethyl, n-propyl, isopropyl, t-butyl, n-octyl, eicosyl, 2-chloroethyl, 2-cyanoethyl, 2-ethylhexyl), a cycloalkyl group (preferably a substituted or unsubstituted cycloalkyl group having 3 to 30 carbon atoms, e.g., cyclohexyl, cyclopentyl, 4-n-dodecyl cyclohexyl), a bicycloalkyl group (preferably a substituted or unsubstituted bicycloalkyl group having 5 to 30 carbon atoms, that is, a monovalent group obtained by removing one hydrogen atom from a bicycloalkane having 5 to 30 carbon atoms, e.g., bicyclo[1,2,2]heptane-2-yl, bicyclo[2,2,2]octane-3-yl); and a tricyclo structure and the like, which has a larger number of rings; and alkyl groups included as a part of substituents explained below (e.g., the alkyl group of an alkylthio group) have the same meaning as described herein, but the alkyl groups in this meaning also include alkenyl groups and alkynyl groups]; an alkenyl group [which represents a straight-chain, branched-chain or cyclic and substituted or unsubstituted alkenyl group, such as an alkenyl group (preferably a substituted or unsubstituted alkenyl group having 2 to 30 carbon atoms; e.g., vinyl, allyl, prenyl, geranyl, oleyl), a cycloalkenyl group (preferably a substituted or unsubstituted cycloalkenyl group having 3 to 30 carbon atoms, that is, a monovalent group obtained by removing one hydrogen atom from a cycloalkene having 3 to 30 carbon atoms; e.g., 2-cyclopentene-1-yl, 2-cyclohexene-1-yl), a bicycloalkenyl group (a substituted or unsubstituted bicycloalkenyl group, preferably a substituted or unsubstituted bicycloalkenyl group having 5 to 30 carbon atoms, that is, a monovalent group obtained by removing one hydrogen atom from a bicycloalkene having one double bond; e.g., bicyclo[2,2,1]hepto-2-ene-1-yl, bicyclo[2,2,2]octo-2-ene-4-yl)]; an alkynyl group (preferably a substituted or unsubstituted alkynyl group having 2 to 30 carbon atoms; e.g., ethynyl, propargyl, trimethylsilylethynyl); an aryl group (preferably a substituted or unsubstituted aryl group having 6 to 30 carbon atoms; e.g., phenyl, p-tolyl, naphthyl, m-chlorophenyl, o-hexadecanoylaminophenyl); a heterocyclic group (preferably a monovalent group obtained by removing one hydrogen atom from a substituted or unsubstituted and aromatic or non-aromatic 5- or 6-membered heterocyclic group, more preferably a 5- or 6-membered aromatic heterocyclic group having 3 to 30 carbon atoms; e.g., 2-furyl, 2-thienyl, 2-pyrimidinyl, 2-benzothiazolyl; in addition, it may be a cationic heterocyclic group, such as 1-methyl-2-pyridinio and 1-methyl-2-quinolinio); a cyano group; a hydroxyl group; a nitro group; a carboxyl group; an alkoxy group (preferably a substituted or unsubstituted alkoxy group having 1 to 30 carbon atoms; e.g., methoxy, ethoxy, isopropoxy, t-butoxy, n-octyloxy, 2-methoxyethoxy); an aryloxy group (preferably a substituted or unsubstituted aryloxy group having 6 to 30 carbon atoms; e.g., phenoxy, 2-methylphenoxy, 4-t-butylphenoxy, 3-nitrophenoxy, 2-tetradecanoylaminophenoxy); a silyloxy group (preferably a silyloxy group having 3 to 20 carbon atoms; e.g., trimethylsilyloxy, t-butyldimethylsilyloxy); a heterocyclic oxy group (preferably a substituted or unsubstituted heterocyclic oxy group having 2 to 30 carbon atoms; e.g., 1-phenyltetrazole-5-oxy, 2-tetrahydropyranyloxy); an acyloxy group (preferably a formyloxy group, a substituted or unsubstituted alkylcarbonyloxy group having 2 to 30 carbon atoms, and a substituted or unsubstituted arylcarbonyloxy group having 6 to 30 carbon atoms; e.g., formyloxy, acetyloxy, pivaloyloxy, stealoyloxy, benzoyloxy, p-methoxyphenylcarbonyloxy); a carbamoyloxy group (preferably a substituted or unsubstituted carbamoyloxy group having 1 to 30 carbon atoms; e.g., N,N-dimethylcarbamoyloxy, N,N-diethylcarbamoyloxy, morpholinocarbonyloxy, N,N-di-n-octylaminocarbonyloxy, N-n-octylcarbamoyloxy); an alkoxycarbonyloxy group (preferably a substituted or unsubstituted alkoxycarbonyloxy group having 2 to 30 carbon atoms; e.g., methoxycarbonyloxy, ethoxycarbonyloxy, t-butoxycarbonyloxy, and n-octylcarbonyloxy); an aryloxycarbonyloxy group (preferably a substituted or unsubstituted aryloxycarbonyloxy group having 7 to 30 carbon atoms; e.g., phenoxycarbonyloxy, p-methoxyphenoxycarbonyloxy, p-n-hexadecyloxyphenoxycarbonyloxy); an amino group (preferably an amino group, a substituted or unsubstituted alkylamino group having 1 to 30 carbon atoms, and a substituted or unsubstituted arylamino group having 6 to 30 carbon atoms; e.g., amino, methylamino, dimethylamino, anilino, N-methyl-anilino, diphenylamino); an ammonio group (preferably, an ammonio group, and an ammonio group substituted with an alkyl, aryl or heterocyclic group having 1 to 30 carbon atoms; e.g., trimethylammonio, triethylammonio, diphenylmethylammonio); an acylamino group (preferably a formylamino group, a substituted or unsubstituted alkylcarbonylamino group having 1 to 30 carbon atoms, and a substituted or unsubstituted arylcarbonylamino group having 6 to 30 carbon atoms; e.g., formylamino, acetylamino, pivaloylamino, lauroylamino, benzoylamino, 3,4,5-tri-n-octyloxyphenylcarbonylamino); an aminocarbonylamino group (preferably a substituted or unsubstituted aminocarbonylamino group having 1 to 30 carbon atoms; e.g., carbamoylamino, N,N-dimethylaminocarbonylamino, N,N-diethylamino carbonylamino, morpholinocarbonylamino); an alkoxycarbonylamino group (preferably a substituted or unsubstituted alkoxycarbonylamino group having 2 to 30 carbon atoms; e.g., methoxycarbonylamino, ethoxycarbonylamino, t-butoxycarbonylamino, n-octadecyloxycarbonylamino, N-methyl-methoxycarbonylamino); an aryloxycarbonylamino group (preferably a substituted or unsubstituted aryloxycarbonylamino group having 7 to 30 carbon atoms; e.g., phenoxycarbonylamino, p-chlorophenoxycarbonylamino, m-n-octyloxyphenoxycarbonylamino); a sulfamoyl amino group (preferably a substituted or unsubstituted sulfamoylamino group having 0 (zero) to 30 carbon atoms; e.g., sulfamoylamino, N,N-dimethylaminosulfonylamino, N-n-octyl aminosulfonylamino); an alkyl- or aryl-sulfonylamino group (preferably a substituted or unsubstituted alkyl sulfonylamino group having 1 to 30 carbon atoms and a substituted or unsubstituted aryl sulfonylamino group having 6 to 30 carbon atoms; e.g., methyl sulfonylamino, butylsulfonylamino, phenylsulfonylamino, 2,3,5-trichlorophenylsulfonylamino, p-methylphenylsulfonylamino); a mercapto group; an alkylthio group (preferably a substituted or unsubstituted alkylthio group having 1 to 30 carbon atoms, e.g., methylthio, ethylthio, n-hexadecylthio); an arylthio group (preferably a substituted or unsubstituted arylthio group having 6 to 30 carbon atoms, e.g., phenylthio, p-chlorophenylthio, m-methoxyphenylthio); a heterocyclic thio group (preferably a substituted or unsubstituted heterocyclic thio group having 2 to 30 carbon atoms, e.g., 2-benzothiazolylthio, 1-phenyltetrazol-5-yl thio); a sulfamoyl group (preferably a substituted or unsubstituted sulfamoyl group having 0 (zero) to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl); a sulfo group; an alkyl- or aryl-sulfinyl group (preferably a substituted or unsubstituted alkylsulfinyl group having 1 to 30 carbon atoms and a substituted or unsubstituted arylsulfinyl group having 6 to 30 carbon atoms; e.g., methylsulfinyl, ethylsulfinyl, phenylsulfinyl, p-methylphenylsulfinyl); an alkyl- or aryl-sulfonyl group (preferably a substituted or unsubstituted alkylsulfonyl group having 1 to 30 carbon atoms and a substituted or unsubstituted arylsulfonyl group having 6 to 30 carbon atoms; e.g., methylsulfonyl, ethylsulfonyl, phenylsulfonyl, p-methylphenylsulfonyl); an acyl group (preferably a formyl group, a substituted or unsubstituted alkylcarbonyl group having 2 to 30 carbon atoms, a substituted or unsubstituted arylcarbonyl group having 7 to 30 carbon atoms, and a substituted or unsubstituted heterocyclic carbonyl group having 4 to 30 carbon atoms in which the carbonyl group is bonded to a carbon atom in the heterocycle moiety; e.g., acetyl, pivaloyl, 2-chloroacetyl, stearoyl, benzoyl, p-n-octyloxyphenylcarbonyl, 2-pyridylcarbonyl, 2-furylcarbonyl); an aryloxycarbonyl group (preferably a substituted or unsubstituted aryloxycarbonyl group having 7 to 30 carbon atoms, e.g., phenoxycarbonyl, o-chlorophenoxycarbonyl, m-nitrophenoxycarbonyl, p-t-butylphenoxycarbonyl); an alkoxycarbonyl group (preferably a substituted or unsubstituted alkoxycarbonyl group having 2 to 30 carbon atoms, e.g., methoxycarbonyl, ethoxycarbonyl, t-butoxycarbonyl, n-octadecyloxycarbonyl); a carbamoyl group (preferably a substituted or unsubstituted carbamoyl group having 1 to 30 carbon atoms; e.g., carbamoyl, N-methylcarbamoyl, N,N-dimethylcarbamoyl, N,N-di-n-octylcarbamoyl, N-(methylsulfonyl)carbamoyl); an aryl- or heterocyclic-azo group (preferably a substituted or unsubstituted aryl azo group having 6 to 30 carbon atoms, and a substituted or unsubstituted heterocyclic azo group having 3 to 30 carbon atoms; e.g., phenylazo, p-chlorophenylazo, 5-ethylthio-1,3,4-thiadiazole-2-yl azo); an imido group (preferably N-succinimido, N-phthalimido); a phosphino group (preferably a substituted or unsubstituted phosphino group having 2 to 30 carbon atoms, e.g., dimethylphosphino, diphenylphosphino, methylphenoxyphosphino); a phosphinyl group (preferably a substituted or unsubstituted phosphinyl group having 2 to 30 carbon atoms, e.g., phosphinyl, dioctyloxyphosphinyl, diethoxyphosphinyl); a phosphinyloxy group (preferably a substituted or unsubstituted phosphinyloxy group having 2 to 30 carbon atoms, e.g., diphenoxyphosphinyloxy, dioctyloxyphosphinyloxy); a phosphinylamino group (preferably a substituted or unsubstituted phosphinylamino group having 2 to 30 carbon atoms, e.g., dimethoxyphosphinylamino, dimethylaminophosphinylamino); a phosphono group; a silyl group (preferably a substituted or unsubstituted silyl group having 3 to 30 carbon atoms, e.g., trimethylsilyl, t-butyldimethylsilyl, phenyldimethylsilyl); a hydrazino group (preferably a substituted or unsubstituted hydrazino group having 0 to 30 carbon atoms, e.g., trimethylhydrazino); and an ureido group (preferably a substituted or unsubstituted ureido group having 0 to 30 carbon atoms, e.g., N,N-dimethylureido).

Further, two W's may be connected with each other to form a ring (such as an aromatic or non-aromatic hydrocarbon ring or heterocyclic ring, and these rings may be combined to form a polycyclic condensed ring; examples of the ring include rings of benzene, naphthalene, anthracene, phenanthrene, fluorene, triphenylene, naphthacene, biphenyl, pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthyridine, quinoxaline, quinoxazoline, isoquinoline, carbazole, phenanthridine, acridine, phenanthroline, thianthrene, chromene, xanthene, phenoxathiin, phenothiazine, and phenazine.

Among the above-mentioned substituent W, a substituent having a hydrogen atom may be further substituted with the above-described group in place of the hydrogen atom. Examples of such a substituent include —$CONHSO_2$— group (a sulfonylcarbamoyl group or a carbonylsulfamoyl group), —CONHCO— group (a carbonylcarbamoyl group), and —$SO_2NHSO_2$— group (a sulfonylsulfamoyl group).

In more detail, examples include an alkylcarbonylaminosulfonyl group (e.g., acetylaminosulfonyl), an arylcarbonylaminosulfonyl group (e.g., benzoylaminosulfonyl), an alkylsulfonylaminocarbonyl group (e.g., methylsulfonylaminocarbonyl), and an arylsulfonylaminocarbonyl group (e.g., p-methylphenylsulfonylaminocarbonyl).

The residual-color-reducing agent for use in the present invention is explained in detail below.

The compound that is used to reduce residual color in the present invention is characterized in that it reduces generation of stain (residual color) resulting from a sensitizing dye remaining in the photosensitive material after processing. Hereinafter, this compound is referred to as a residual-color-reducing agent (hereinafter also referred to as a compound according to the present invention.).

The term "reduction of residual color" used in the present invention means that reduction of occurrence of stain, and preferable is a case where the stain is reduced to the level of preferably 90% or less, more preferably 80% or less, further more preferably 60% or less, still further more preferably 50% or less, especially preferably 40% or less, and most preferably 20% or less, compared to the case free of a residual-color-reducing agent, respectively.

Among these residual-color-reducing agent compounds for use in the present invention, better effects are observed with compounds having strong interaction with a sensitizing dye and having appropriate water-solubility.

In order to cause an interaction with a sensitizing dye, a compound having at least one aromatic hydrocarbon ring (herein also referred to simply as aromatic ring) or aromatic heterocycle in its molecule is preferable. A compound having at least three aromatic hydrocarbon rings or aromatic heterocycles is more preferable. A compound having at least five aromatic hydrocarbon rings or aromatic heterocycles is particularly preferable. As to the number of the aromatic hydrocarbon ring or aromatic heterocycle, there is no particular upper limit, but the number is preferably 10 rings or less, more preferably 8 rings or less, particularly preferably 6 rings or less. Herein, in the condensed ring system, the number of rings therein is counted. For example, the naphthalene ring is counted as two rings.

The residual-color-reducing agent for use in the present invention may have a substituent. As the substituent, it is possible to employ any kind of substituents that are used by a person skilled in the art to impart desired photographic properties for a particular use. Examples include a hydrophobic group (ballasting group), a solubilizing group, a blocking group, or a releasing or releasable group. Of these, those having a solubilizing group, a blocking group, or a releasing or releasable group are preferable. Further, those having a solubilizing group are more preferable.

Generally, these groups have preferably 1 to 60 carbon atoms, and more preferably 1 to 50 carbon atoms.

The residual-color-reducing agent for use in the present invention may contain, in its molecule, a hydrophobic group or ballasting group having a high molecular weight, or a polymer main chain, in order to control its mobility in the photosensitive material.

As to the solubilizing group, there is no particular limitation, but preferred are a sulfo group, a carboxy group, a hydroxy group and an ether group, more preferred are a carboxy group, a hydroxy group and an ether group, especially preferred are a carboxy group and a hydroxy group, and most preferred is a carboxyl group.

As to the blocking group and the releasing or releasable group, can be mentioned are those mentioned in the multilayer adsorption-relating literature (3) that will be described later.

The number of carbon atoms in typical ballasting groups is preferably 8 to 60, more preferably from 10 to 57, especially preferably from 12 to 55, and most preferably from 16 to 53. Examples of these groups include a substituted or unsubstituted alkyl, aryl or heterocyclic group each having carbon atoms of from 8 to 60, preferably from 10 to 57, more preferably from 13 to 55, especially preferably from 16 to 53, and most preferably 20 to 50. Further, it is preferable that these groups contain a branch. Typical examples of the substituent on these groups include an alkyl group, an aryl group, an alkoxy group, an aryloxy group, an alkylthio group, a hydroxyl group, a halogen atom, an alkoxycarbonyl group, an aryloxycarbonyl group, a carboxy group, an acyl group, an acyloxy group, an amino group, an anilino group, a carbonamide group, a carbamoyl group, an alkylsulfonyl group, an arylsulfonyl group, a sulfonamido group and a sulfamoyl group. These substituents generally have 1 to 42 carbon atoms. Specifically, the above-mentioned W may be examples of these substituents. In addition, these substituents may be further substituted.

The ballasting groups are further explained in detail below. Specifically, preferred are an alkyl group (preferably an alkyl group having 1 to 60 carbon atoms, e.g., methyl, ethyl, propyl, iso-butyl, t-butyl, t-octyl, 1-ethylhexyl, nonyl, cyclohexyl, undecyl, pentadecyl, n-hexadecyl, 3-decanamidopropyl), an alkenyl group (preferably an alkenyl group having 2 to 60 carbon atoms, e.g., vinyl, allyl, oleyl), a cyclo alkyl group (preferably a cyclo alkenyl group having 5 to 60 carbon atoms, e.g., cyclopentyl, cyclohexyl, 4-t-butylcyclohexyl, 1-indanyl, cyclododecyl), an aryl group (preferably an aryl group having 6 to 60 carbon atoms, e.g., phenyl, p-tolyl, naphthyl), an acylamino group (preferably an acylamino group having 2 to 60 carbon atoms, e.g., acetylamino, n-butanamido, octanoylamino, 2-hexyldecanamido, 2-(2',4'-di-t-amyl phenoxy)butanamido, benzoylamino, nicotinamido), a sulfonamido group (preferably a sulfonamido group having 1 to 60 carbon atoms, e.g., methane sulfonamido, octane sulfonamido, benzene sulfonamido), a ureido group (preferably a ureido group having 2 to 60 carbon atoms, e.g., decylaminocarbonylamino, di-n-octylamino carbonylamino), a urethane group (preferably a urethane group having 2 to 60 carbon atoms, e.g., dodecyloxycarbonylamino, phenoxycarbonylamino, 2-ethylhexyloxycarbonylamino), an alkoxy group (preferably an alkoxy group having 1 to 60 carbon atoms, e.g., methoxy, ethoxy, butoxy, n-octyloxy, hexadecyloxy, methoxyethoxy), an aryloxy group (preferably an aryloxy group having 6 to 60 carbon atoms, e.g., phenoxy, 2,4-di-t-amyl phenoxy, 4-t-octyl phenoxy, naphthoxy), an alkylthio group (preferably an alkylthio group having 1 to 60 carbon atoms, e.g., methylthio, ethylthio, butylthio, hexadecylthio), an arylthio group (preferably an arylthio group having 6 to 60 carbon atoms, e.g., phenylthio, 4-dodecyloxyphenylthio), an acyl group (preferably an acyl group having 1 to 60 carbon atoms, e.g., acetyl, benzoyl, butanoyl, dodecanoyl), a sulfonyl group (preferably a sulfonyl group having 1 to 60 carbon atoms, e.g., methanesulfonyl, butane sulfonyl, toluenesulfonyl), a cyano group, a carbamoyl group (preferably a carbamoyl group having 1 to 60 carbon atoms, e.g., N,N-dicyclohexyl carbamoyl), a sulfamoyl group (preferably a sulfamoyl group having 0 to 60 carbon atoms, e.g., N,N-dimethylsulfamoyl), a hydroxyl group, a sulfo group, a carboxyl group, a nitro group, an alkylamino group (preferably an alkylamino group having 1 to 60 carbon atoms, e.g., methylamino, diethylamino, octylamino, octadecylamino), an arylamino group (preferably an arylamino group having 6 to 60 carbon atoms, e.g., phenylamino, naphthylanino, N-methyl-N-phenylamino), a heterocyclic group (preferably a heterocyclic group having 0 to 60 carbon atoms, more preferably those having a ring-constituting heteroatom selected from nitrogen, oxygen and sulfur atoms, and further preferably those having a carbon atom as a ring-constituting atom, besides heteroatoms; said ring being a 3- to 8-membered ring, more preferably a 5- or 6-membered ring, for example those illustrated in W mentioned above) and an acyloxy group (preferably an acyloxy group having 1 to 60 carbon atoms, e.g., formyloxy, acetyloxy, myristoyloxy, benzoyloxy).

These ballasting groups may be further substituted with a substituent, if possible. Of these ballasting groups, for example, an alkyl group, a cycloalkyl group, an aryl group, an acylamino group, an ureido group, a urethane group, an alkoxy group, an aryloxy group, an alkylthio group, an arylthio group, an acyl group, a sulfonyl group, a cyano group, a carbamoyl group and a sulfamoyl group may be further substituted. Examples of the substituent include an alkyl group, a cycloalkyl group, an aryl group, an acylamino group, an ureido group, a urethane group, an alkoxy group, an aryloxy group, an alkylthio group, an arylthio group, an acyl group, a sulfonyl group, a cyano group, a carbamoyl group, a sulfamoyl group, and a halogen atom.

Of these substituents, an alkyl group, an aryl group, an alkoxy group, and an aryloxy group are preferable. An alkyl group, an alkoxy group, and an aryloxy group are more preferable. A branched alkyl group is particularly preferable.

The total sum of the number of carbon atoms in these substituents is not particularly limited, but preferably in the range of from 8 to 60, more preferably in the range of from 10 to 57, particularly preferably in the range of from 12 to 55 and most preferably in the range of from 16 to 53.

In the case where a residual-color-reducing agent according to the present invention is incorporated in a silver halide photographic photosensitive material, it is preferable to use a compound that is capable of being fixed in a specific layer during a storage, but diffuses at a proper time of photographic processing, and, further, elutes from the photosensitive material. Any compounds and methods can be used to fix a residual-color-reducing agent according to the present invention during storage thereby preventing it from diffusing, but the following compounds and methods are preferred. Note that even though the following references exemplify fixation of a dye, the residual-color-reducing agent according to the present invention can be also similarly used in place of the dye.

(1) A method of allowing the compound according to the present invention to dissociate at the time of development and to elute from an oil, comprising adding a compound having a particular pKa, with emulsifying and dispersing it together with a high-boiling point organic solvent, etc., which will be described later.

The pKa value of the compound according to the present invention is preferably 5.5 or greater, more preferably in the range of from 6.0 to 10.0, particularly preferably in the range of from 6.5 to 8.4 and most preferably in the range of from 6.9 to 8.3.

The dissociating group is not particularly limited, but preferably a carboxyl group, a —$CONHSO_2$— group (i.e., a sulfonylcarbamoyl group or a carbonylsulfamoyl group), a —CONHCO— group (i.e., a carbonylcarbamoyl group), a —$SO_2NHSO_2$— group (i.e., a sulfonylsulfamoyl group), a sulfonamide group, a sulfamoyl group, and a phenolic hydroxyl group, more preferably a carboxyl group, a —$CONHSO_2$— group, a —CONHCO— group, a —$SO_2NHSO_2$— group, particularly preferably a carboxyl group and a —$CONHSO_2$— group, and most preferably a carboxyl group.

(2) A method in which a ballasting group is introduced into the compounds according to the present invention to make it nondiffusible.

(3) A method in which a blocking group is used. In this method, compounds whose properties change (e.g., become diffusible) upon a chemical reaction such as nucleophilic reaction, electrophilic reaction, oxidation reaction, or reduction reaction, in the course of photographic processing may be used, and any methods known in the chemical and photographic field relating such compounds can be used.

As an example, the nucleophilic reaction is explained in detail. The nucleophilic reaction is possible in any conditions, but it is accelerated by a base or heating, particularly accelerated in the presence of a base. As to the base, there is no particular limitation on the kind, and they can be selected from inorganic bases and organic bases. Example thereof include tertiary amines such as triethylamine; aromatic heterocyclic amines such as pyridine; and bases having OH anion such as sodium hydroxide and potassium hydroxide. Particularly, in the present invention, the nucleophilic reaction is preferably used, since the reaction is accelerated by a photographic processing of high pH such as a developing solution among photographic processes.

The term "nucleophilic agent" herein is used to mean a chemical species having a property of being able to attack an atom of low electronic density such as a carbonyl carbon contained in the atoms forming a group that splits-off upon attack of the nucleophilic agent, thereby giving or sharing an electron. As to the nucleophilic agent, there is no particular limitation on its structure, but preferable examples include reagents giving a hydroxide ion (e.g., sodium hydroxide, potassium hydroxide, lithium hydroxide, sodium carbonate, potassium carbonate), reagents giving a sulfite ion (e.g., sodium sulfite, potassium sulfite), reagents giving a hydroxylamido ion (e.g., hydroxylamine), reagents giving a hydrazide ion (e.g., hydrazine hydrate, dialkylhydrazines), reagents giving a hexacyanoferrate (II) ion (e.g., yellow prussiate), and reagents giving a cyanide ion, a tin (II) ion, an ammonium ion or an alkoxy ion (e.g., sodium methoxide). Example of the group that split-off upon attack of the nucleophilic agent include a group using a reverse Michel Model reaction, as described, for example, in Can. J. Chem. Vol. 44, p. 2315 (1966), JP-A-59-137945 and JP-A-60-41034; a group using a nucleophilic reaction, as described, for example, in Chem. Lett., p. 585 (1988), JP-A-59-218439 and JP-B-5-78025 ("JP-B" means examined Japanese patent application); and a group using a hydrolytic reaction of an ester bond or an amide bond.

In order to impart the above-mentioned functions, the compound according to the present invention may be substituted with a blocking group capable of releasing the compound according to the present invention during photographic processing. As to the blocking group, there can be employed known blocking groups. Examples include blocking groups such as an acyl group and a sulfonyl group, as described in, for example, JP-B-48-9968, JP-A-52-8828, JP-A-57-82834, U.S. Pat. No. 3,311,476 and JP-B-47-44805 (U.S. Pat. No. 3,615,617); blocking groups utilizing the reverse Michael reaction, as described in, for example, JP-B-55-17369 (U.S. Pat. No. 3,888,677), JP-B-55-9696 (U.S. Pat. No. 3,791,830), JP-B-55-34927 (U.S. Pat. No. 4,009,029), JP-A-56-77842 (U.S. Pat. No. 4,307,175), JP-A-59-105640, JP-A-59-105641 and JP-A-59-105642; blocking groups utilizing the formation of a quinone methide or quinone methide analogue through intramolecular electron transfer as described in, for example, JP-B-54-39727, U.S. Pat. Nos. 3,674,478, 3,932,480, 3,993,661, JP-A-57-135944, JP-A-57-135945 (U.S. Pat. No. 4,420,554), JP-A-57-136640, JP-A-61-196239, JP-A-61-196240 (U.S. Pat. No. 4,702,999), JP-A-61-185743, JP-A-61-124941 (U.S. Pat. No. 4,639,408) and JP-A-2-280140; blocking groups utilizing an intramolecular nucleophilic substitution reaction as described in, for example, U.S. Pat. Nos. 4,358,525, 4,330,617, JP-A-55-53330 (U.S. Pat. No. 4,310,612), JP-A-59-121328, JP-A-59-218439 and JP-A-63-318555 (EP No. 0295729); blocking groups utilizing a ring cleavage reaction of 5- or 6-membered ring, as described in, for example, JP-A-57-76541 (U.S. Pat. No. 4,335,200), JP-A-57-135949 (U.S. Pat. No. 4,350,752), JP-A-57-179842, JP-A-59-137945, JP-A-59-140445, JP-A-59-219741, JP-A-59-202459, JP-A-60-41034 (U.S. Pat. No. 4,618,563), JP-A-62-59945 (U.S. Pat. No. 4,888,268), JP-A-62-65039 (U.S. Pat. No. 4,772,537), JP-A-62-80647, JP-A-3-236047 and JP-A-3-238445; blocking groups utilizing an addition reaction of nucleophilic agent to conjugated unsaturated bond, as described in, for example, JP-A-59-201057 (U.S. Pat. No. 4,518,685), JP-A-61-43739 (U.S. Pat. No. 4,659,651), JP-A-61-95346 (U.S. Pat. No. 4,690,885), JP-A-61-95347 (U.S. Pat. No. 4,892,811), JP-A-64-7035, JP-A-4-42650 (U.S. Pat. No. 5,066,573), JP-A-1-245255, JP-A-2-207249, JP-A-2-235055 (U.S. Pat. No. 5,118,596) and 4-186344; blocking groups utilizing a β-elimination reaction, as described in, for example, JP-A-59-93442, JP-A-61-32839, JP-A-62-163051 and JP-B-5-37299; blocking groups utilizing a nucleophilic substitution reaction of diarylmethans, as described in JP-A-61-188540; blocking groups utilizing Lossen rearrangement reaction, as described in JP-A-62-187850; blocking groups utilizing a reaction between an N-acyl derivative of thiazolidine-2-thione and an amine, as described in, for example, JP-A-62-80646, JP-A-62-144163 and JP-A-62-147457; blocking groups having two electrophilic groups and capable of reacting with a binucleophilic agent, as described in, for example, JP-A-2-296240 (U.S. Pat. No. 5,019,492), JP-A-4-177243, JP-A-4-177244, JP-A-4-177245, JP-A-4-177246, JP-A-4-177247, JP-A-4-177248, JP-A-4-177249, JP-A-4-179948, JP-A-4-184337, JP-A-4-184338, WO 92/21064, JP-A-4-330438, WO 93/03419 and JP-A-5-45816; and blocking groups of JP-A-3-236047 and JP-A-3-238445. Of these blocking groups, blocking groups having two electrophilic groups and capable of reacting with a binucleophilic agent, as described in, for example, JP-A-2-296240 (U.S. Pat. No. 5,019,492), JP-A-4-177243, JP-A-4-177244, JP-A-4-177245, JP-A-4-177246, JP-A-4-177247, JP-A-4-177248, JP-A-4-177249, JP-A-4-179948, JP-A-4-184337 and JP-A-4-184338, WO 92/21064, JP-A-4-330438, WO 93/03419 and JP-A-5-45816, are especially preferred. These blocking groups may be a group containing a timing group capable of inducing a cleavage reaction with the use of electron transfer reaction, as described in U.S. Pat. Nos. 4,409,323 and 4,421,845. In this case, the blocking group is preferably a group having a timing group whose terminal capable of inducing an electron transfer reaction is blocked.

(4) A method of employing a polymer compound including a dimer or trimer or higher multimer that has a partial structure of the compound according to the present invention.

(5) A method of fixing the compound according to the present invention, which is water-insoluble (solid dispersion). As mentioned in (1), preferable is the case where the compound according to the present invention has a particular pKa, because the said compound is able to dissolve only at the time of development. Examples of this method are disclosed in JP-A-56-12639, JP-A-55-155350, JP-A-55-155351, JP-A-63-27838, JP-A-63-197943 and European Patent 15,601.

The detailed method of conducting solid dispersion is described later.

(6) A method of letting a polymer, for example, a hydrophilic polymer, having a charge reverse to the compound according to the present invention, be present together as a mordant, thereby fixing the compound according to the present invention by the interaction with the compound according to the present invention. Examples of this method are disclosed, for example, in U.S. Pat. Nos. 2,548,564, 4,124,386 and 3,625,694.

(7) Further, a method of fixing the compound according to the present invention by letting the compound to adsorb on the surface of a metal salt, such as silver halide. Examples of this method are disclosed, for example, in U.S. Pat. Nos. 2,719,088, 2,496,841 and 2,496,843, and JP-A-60-45237.

As adsorbing groups onto silver halide that can be used for the compound according to the present invention, those groups described in JP-A-2003-156823, from page 16, line 1 to page 17, line 12 are typical examples.

As the adsorbing groups, preferred are a mercapto-substituted nitrogen-containing heterocyclic group (for example, 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzthiazole group, 1,5-dimethyl-1,2,4-triazolium-3-thiolate group), and a nitrogen-containing heterocyclic group having, as a partial structure of said heterocycle, a —NH— group capable of forming an imino silver (>NAg) (for example, benzotriazole group, benzimidazole group, indazole group). 5-mercaptotetrazole group, 3-mercapto-1,2,4-triazole group and benzotriazole group are particularly preferable. Further, 3-mercapto-1,2,4-triazole group and 5-mercapto tetrazole group are most preferable.

It is also particularly preferable that the adsorbing group has at least two mercapto groups as a partial structures in its molecule. Herein, the mercapto group (—SH), if it is possible to form a tautomer, may be existed as a thione group. As preferable examples of said adsorbing group having at least two mercapto groups as partial structures (for example, a mercapto-substituted nitrogen-containing heterocyclic group), there are 2,4-dimercaptopyrimidine group, 2,4-dimercaptotriazine group and 3,5-dimercapto-1,2,4-triazole group.

Further, as an adsorbing group, quaternary salt structures of nitrogen or phosphorus are also preferably used. Specific examples of the quaternary salt structure of nitrogen include an ammonio group (e.g., trialkyl ammonio, dialkylaryl (or heteroaryl) ammonio, alkyldiaryl (or heteroaryl) ammonio), and a group containing a nitrogen-containing heterocyclic group having a quaternary nitrogen atom. Specific examples of the quaternary salt structure of phosphorus include a phosphonio group (e.g., trialkyl phosphonio, dialkylaryl (or heteroaryl) phosphonio, alkyldiaryl (or heteroaryl) phosphonio, triaryl (or heteroaryl) phosphonio). More preferably a quaternary salt structure of nitrogen is used, and furthermore preferably a 5- or 6-membered nitrogen-containing aromatic heterocyclic group having a quaternary nitrogen atom. Particularly preferably a pyridinio group, a quinolinio group and an isoquinolinio group are used. These nitrogen-containing heterocyclic groups having a quaternary nitrogen atom may have an arbitrary substituent.

Examples of counter anions of the quaternary salt include a halogen ion, a carboxylate ion, a sulfonate ion, a sulfate ion, a perchlorate ion, a carbonate ion, a nitrate ion, $BF_4^-$, $PF_6^-$ and $Ph_4B^-$. When a group having a negative charge, such as a carboxylate group, exists in the molecule, the quaternary nitrogen atom may form an inner salt together with said group having a negative charge. As the counter anions that exist outside the molecule, a chlorine ion, a bromine ion and a methane sulfonate ion are particularly preferable.

Among the above methods, preferable methods of fixing the compound according to the present invention are (1) a method of employing a compound having a particular pKa, (3) a method of employing a compound having a blocking group, and (5) a method of employing a solid dispersion. Accordingly, it is preferable to employ compounds suitable for respective methods. More preferred are the methods and compounds according to the above-mentioned (1) or (5). It is particularly preferable to employ the methods (1) and (5) at the same time. In other words, a solid dispersion of the compound according to the present invention having a particular pKa is particularly preferably used. It is not preferable for the compound according to the present invention to elute too rapidly from the photosensitive material at the time of photographic processing, but elution can be controlled by these preferable methods mentioned above.

As the skeleton of the residual-color-reducing agent that can be preferably used in the present invention, the compounds described in the following Reference (1) are exemplified.

Reference (1)

Bistriazinyl-substituted stilbene compounds (skeletons of these compounds are described, for example, in JP-A-6-329936, JP-A-7-140625, JP-A-10-104809, JP-A-2001-281823, and *Sensyoku Nouto* (*Dyeing Note*), Vol. 19 (Irozomesya), pp. 165–168); bisaryl-substituted triazine compounds (skeletons of these compounds are described, for example, in U.S. Pat. No. 6,153,364); bistriazinyl-substituted arylene compounds (skeletons of these compounds are described, for example, in JP-A-2002-139822); bisaryl-substituted arylene compounds (skeletons of these compounds are described, for example, in Japanese patent application Nos. 2002-352759, 2002-355512, and 2002-60245); bispyrimidyl-substituted stilbene compounds (skeletons of these compounds are described, for example, in JP-A-6-161017, and U.S. Pat. No. 4,596,767.)

Among the above compounds, preferred are bistriazinyl-substituted stilbene compounds, bisaryl-substituted triazine compounds, bisaryl-substituted arylene compounds and bispyrimidyl-substituted stilbene compounds. Bisaryl-substituted triazine compounds and bisaryl-substituted arylene compounds are more preferable, and bisaryl-substituted arylene compounds are particularly preferable.

As the residual-color-reducing agent for use in the present invention, the compounds represented by the afore-mentioned formula (I) in particular can be preferably used.

The compounds represented by formula (I) are explained in detail.

$A_1$ and $A_2$ each represent an aryl group or an aromatic heterocyclic group. As the aryl group, substituted or unsubstituted aryl groups preferably having 6 to 20 carbon atoms, more preferably having 6 to 10 carbon atoms are exemplified. (As the substituent of said substituted aryl groups, the afore-mentioned W is exemplified, and a sulfo group, a carboxy group, a hydroxy group, and an ether group are preferable; a carboxy group, a hydroxy group, and an ether group are more preferable; a carboxy group and a hydroxy group are particularly preferable; and a carboxy group is most preferable. Specific examples of the aryl group include phenyl, 3-carboxyphenyl, 4-carboxyphenyl group, 3,5-dicarboxyphenyl group, 4-methoxyphenyl group, 2-sulfophenyl group, 4-sulfophenyl group, 3-hydroxyphenyl, 3-hydroxyethoxyethoxyphenyl, 1-naphthyl, 2-naphthyl, 5-sulfo-2-naphthyl, 1-sulfo-2-naphthyl, 5-carboxy-2-naphthyl, 6-carboxy-2-naphthyl, 3-carboxy-2-naphthyl, 6-sulfo-2-naphthyl, 6-carboxy-1-naphthyl, 6-sulfo-1-naphthyl, 8-sulfo-1-naphthyl, 5,7-disulfo-2-naphthyl, 3,6-disulfo-2-naphthyl, 7-hydroxy-2-naphthyl, 7-methoxy-2-naphthyl, 7-hydroxyethoxyethoxy-2-naphthyl, 1-anthryl, and 5-phenanthryl groups.) As the aromatic heterocyclic group, substituted or unsubstituted 5- or 6-membered heterocyclic groups preferably having 2 to 20 carbon atoms, more preferably having 2 to 10 carbon atoms, and especially preferably having 2 to 8 carbon atoms are exemplified. (As the substituent of said substituted heterocyclic groups, the afore-mentioned W is exemplified, and a sulfo group, a carboxy group, a hydroxy group, and an ether group are preferable; a carboxy group, a hydroxy group, and an ether group are more preferable; a carboxy group and a hydroxy group are particularly preferable; and a carboxyl group is most preferable. Specific examples of the aromatic heterocyclic group include 2-furyl, 2-pyridyl, 2-pyrimidinyl, and 2-benzothiazolyl groups.) Of these, preferred are substituted or unsubstituted naphthyl groups; more preferred are naphthyl groups having at least one sulfo group (including a salt thereof), carboxy group (including a salt thereof), hydroxy group, or ether group; furthermore preferred are naphthyl groups having at least one carboxy group (including a salt thereof), hydroxyl group, or ether group; particularly preferred are naphthyl groups having at least one carboxyl group (including a salt thereof), or hydroxyl group; and most preferably a naphthyl group having at least one carboxyl group (including a salt thereof). Further, it is preferable that at least one of $A_1$ and $A_2$ is a naphthyl group having at least one carboxy group (including a salt thereof), and it is more preferable that each of $A_1$ and $A_2$ is a naphthyl group having at least one carboxy group (including a salt thereof).

$B_1$ represents an atomic group having a $\pi$ electron, and is preferably a carbonyl, a double bond (e.g., a double bond between carbon and carbon, a double bond between carbon and nitrogen), a triple bond (e.g., a triple bond between carbon and carbon, a triple bond between carbon and nitrogen), an aromatic hydrocarbon ring or an aromatic heterocycle.

$B_1$ is preferably an aromatic hydrocarbon ring or an aromatic heterocycle. Examples thereof include benzene, naphthalene, anthracene, phenanthrene, fluorene, triphenylene, naphthacene, biphenyl, pyrrole, furan, thiophene, imidazole, oxazole, thiazole, pyridine, pyrazine, pyrimidine, triazine, pyridazine, indolizine, indole, benzofuran, benzothiophene, isobenzofuran, quinolizine, quinoline, phthalazine, naphthyridine, quinoxaline, quinoxazoline, isoquinoline, carbazole, phenanthridine, acridine, phenanthroline, thianthrene, chromene, xanthene, phenoxathiin, phenothiazine, and phenazine rings, as described in the fore-going W.

Among these, preferred are benzene, naphthalene, pyridine, pyrimidine and triazine rings having 2 to 20 carbon atoms, more preferably 3 to 15 carbon atoms; more preferred are benzene, naphthalene, pyrimidine and triazine rings; more preferred are benzene, naphthalene, pyrimidine rings; particularly preferred are benzene and naphthalene rings; and most preferred is a benzene ring. These rings may have a substituent (such as the W described above). Benzene and triazine rings are preferable.

$B_1$ may be additionally substituted with —$(X_3)n_3$-$A_3$.

Herein $X_3$ has the same meaning as $X_1$ or $X_2$. Examples and a preferable range of $X_3$ are identical to those of $X_1$ or $X_2$. $A_3$ has the same meaning as $A_1$ or $A_2$. Examples and a preferable range of $A_3$ are identical to those of $A_1$ or $A_2$. $n_3$ represents 0 or 1, and $n_3$ is preferably 1. In particular, when $B_1$ is a pyrimidine ring or a triazine ring, $B_1$ is preferably further substituted with —$(X_3)n_3$-$A_3$.

$X_1$ and $X_2$ represent a linking group (preferably a divalent linking group). The linking group preferably consists of an atom or atomic group containing at least one atom selected from carbon, nitrogen, sulfur and oxygen atoms. Preferable examples of the linking group are groups having from 0 to 100 carbon atoms, preferably from 1 to 20 carbon atoms that are composed of, solely or in combination of two or more of, an alkylene group (e.g., methylene, ethylene, trimethylene, tetramethylene, pentamethylene), an arylene group (e.g., phenylene, naphthylene), an alkenylene group (e.g., ethenylene, propenylene), an alkynylene group (e.g., ethynylene, propynylene), an amido group, an ester group, a sulfonamido group, a sulfonic acid ester group, an ureido group, a sulfonyl group, a sulfinyl group, a thioether group, an ether group, a carbonyl group, a —N(Va)- group (Va represents a hydrogen atom or a monovalent substituent; examples of the monovalent substituent are those described in the aforementioned W), and a divalent group of a heterocycle (e.g., 6-chloro-1,3,5-triazine-2,3-diyl, pyrimidine-2,4-diyl, quinoxaline-2,3-diyl groups).

The above linking group may further have a substituent represented by the afore-mentioned W. Further, these linking groups may have a ring (aromatic or non-aromatic hydrocarbon ring or heterocycle).

Preferable examples of the linking group are —$CHR_1$—, —$CR_1$═$CR_1$—, —$NR_1$—, —O—, —S—, —(C═O)—, —$CONR_1$—, —$SO_2NR_1$—, and —$CO_2$—, (wherein $R_1$ represents a hydrogen atom or a substituent; examples of the substituent are those recited in the above-mentioned W, and preferably an alkyl group, an aryl group, or a heterocyclic group, more preferably an alkyl group, and furthermore preferably an alkyl group having 1 to 6 carbon atoms; as $R_1$, a hydrogen atom, a methyl group, an ethyl group, an i-propyl group, and a n-propyl group are especially preferable, and a hydrogen atom is most preferable.) More preferable examples of the linking group are —$NR_1$—, —O—, —S—, —(C═O)—, —$CONR_1$—, —$SO_2NR_1$— and —$CO_2$—, especially preferably —$NR_1$— and —$CONR_1$—, and most preferably —$CONR_1$—. It should be noted that the direction of these linking groups can be altered.

$n_1$ and $n_2$ represents 0 or 1. Preferably each of them is 1. Md represents a counter ion for balancing a charge. Md is included in formula (I) so as to show the presence of cation or anion when required for neutralizing the charge of the compound represented by formula (I). Typical examples of the cation include inorganic cation such as hydrogen ion ($H^+$), alkali metal ion (e.g., sodium ion, potassium ion, lithium ion) and alkaline earth metal ion (e.g., calcium ion), and organic ion such as ammonium ion (e.g., ammonium ion, tetraalkylammonium ion, triethylammonium ion, pyridinium ion, ethylpyridinium ion, 1,8-diazabicyclo[5.4.0]-7-undecenium ion). The anion may be either inorganic anion or organic anion, and examples thereof include halide ion (e.g., fluoride ion, chloride ion, iodide ion), substituted arylsulfonate ion (e.g., p-toluenesulfonate ion, p-chlorobenzenesulfonate ion), aryldisulfonate ion (e.g., 1,3-benzenesulfonate ion, 1,5-naphthalenedisulfonate ion, 2,6-naphthalenedisulfonate ion), alkylsulfate ion (e.g., methylsulfate ion), sulfate ion, thiocyanate ion, perchlorate ion, tetrafluoroborate ion, picrate ion, acetate ion and trifluoromethanesulfonate ion. Also, an ionic polymer or another dye having a charge opposite the dye may be used. When $CO_2^-$ and $SO_3^-$ have a hydrogen atom as a counter ion, they may be illustrated as $CO_2H$ and $SO_3H$, respectively. Md is preferably an anion, more preferably a sodium ion or a potassium ion, and especially preferably a sodium ion. md represents a number of 0 or more required for neutralizing a charge on the molecule, preferably a number of 0 to 4, more preferably a number of 0 to 2.

It is preferable that the compound represented by formula (I) has, in its molecule, at least one sulfo group (including a salt thereof), carboxy group (including a salt thereof), hydroxy group, or ether group, more preferably at least one carboxy group (including a salt thereof), hydroxy group, or ether group, further preferably at least one carboxy group (including a salt thereof), or hydroxy group, furthermore preferably at least one carboxy group (including a salt thereof), particularly preferably at least two carboxy groups (including salts thereof), and most preferably two to four carboxy groups (including salts thereof). Further, it is preferable that the group represented by —N═N— or —SH is absent in the molecule of the compound represented by formula (I).

Preferable examples of the compound represented by formula (I) are a combination of the above-mentioned individual preferable components (particularly a combination of individual most preferable components).

Further, the above-said sulfo group or carboxy group may be protected with a group that is decomposed by attack of a nucleophilic agent such as a hydroxide ion. The nucleophilic agent is mentioned above.

Among the compound represented by formula (I), the compound represented by formula (II) is more preferable.

Formula (II)

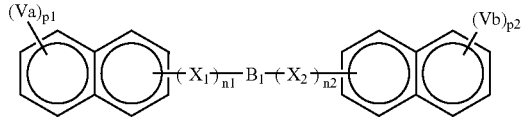

Mdmd

In formula, Va and Vb each represent a substituent. p1 and p2 each represent an integer of from 0 to 7. $B_1$, $X_1$, $X_2$, n1, n2, Md, and md have the same meanings as those in formula (I), respectively.

Formula (II) is explained in more detail below. Va and Vb may be any substituent, for example the above-mentioned W, preferably a sulfo group (including a salt thereof), a carboxy group (including a salt thereof), a hydroxy group, or an ether group, more preferably a carboxy group (including a salt thereof), a hydroxy group, or an ether group, particularly preferably a carboxy group (including a salt thereof), or a hydroxy group, and most preferably a carboxy group (including a salt thereof). p1 and p2 are preferably 1 or 2.

When p1 or p2 are 2 or more, plural Va or Vb are present in the molecule. But, these plural Va's or Vb's are not necessary to be the same. As $X_1$, $X_2$, n1, n2, Md, and md, the same examples as those in the above-mentioned formula (I) can be included, and preferable ranges are also the same as those in the formula (I). The substitution position of Va, Vb, $X_1$ and $X_2$ may be anywhere.

Among compounds represented by formula (II), those represented by formula (III) are further preferred.

Formula (III)

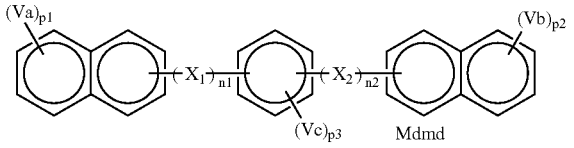

In formula, Vc represents a substituent. p3 represents an integer of from 0 to 4. $X_1$, $X_2$, n1, n2, Md, md, $V_a$, $V_b$, $X_1$, $p_1$, and $p_2$ have the same meanings as those in formula (II), respectively.

Formula (III) is explained in more detail below. Vc may be any substituent, for example the above-mentioned W, preferably a sulfo group (including a salt thereof), a carboxy group (including a salt thereof), a hydroxy group, or an ether group, more preferably a carboxy group (including a salt thereof), a hydroxy group, or an ether group, particularly preferably a carboxy group (including a salt thereof), or a hydroxy group, and most preferably a carboxy group (including a salt thereof). p3 is preferably 0 or 1. When p3 is 2 or more, plural Vc's are present in the molecule. But, these plural Vc's are not necessary to be the same. As $X_1$, $X_2$, n1, n2, Md, md, Va, Vb, p1 and p2, the same examples as those in the above-mentioned formula (II) can be included, and preferable ranges are also the same as those in the formula (II).

The substitution position of each of Va, Vb, Vc, $X_1$ and $X_2$ may be anywhere.

As a residual-color-reducing agent according to the present invention, the compound represented by formula (IV) is also preferably used.

The compounds represented by formula (IV) are explained in detail below.

$A_1$, $A_2$, $X_1$ and $X_2$ have the same meanings, the same preferable ranges, and the same examples as those in formula (I), respectively.

L represents a divalent group derived from compounds having a π electron, and represents, for example, >C═O, —CH═CH—, an arylene group, or a divalent aromatic heterocyclic group. The arylene group is one having preferably 6 to 20 carbon atoms, further preferably 6 to 10 carbon atoms. Examples of the arylene group include phenylene group, naphthylene group, anthranilene group, 3-carboxyphenylene group, 4-carboxyphenylene group, 3,5-dicarboxyphenylene group, 4-methoxyphenylene group, 2-sulfophenylene group, 4-sulfophenylene group, and 5,7-disulfo-2-naphthylene group. The heterocyclic group is preferably a substituted or unsubstituted, 5- or 6-membered heterocyclic group (including benzo-condensed one), having 2 to 20 carbon atoms, more preferably 2 to 10 carbon atoms, and especially preferably 2 to 8 carbon atoms. Examples of the heterocyclic group include 3,5-(1,2,4-triazole)-diyl group, 3,5-isothiazolediyl group, 2,6-pyridinediyl group, 2,6-pyrazinediyl group, 2,6-pyrimidinediyl group, 3,6-pyridazinediyl group, 2,4-(1,3,5-triazine)-diyl group, and 1,4-phthalazinediyl group.

The compound represented by formula (IV) preferably has at least two carboxy groups or sulfo groups. These groups may be a free form or a salt. When these groups are salts, counter ions of said salts are preferably alkali metals, alkali earth metals, ammonium, or pyridium. As the alkali metals and the alkali earth metals, Na and K are exemplified. Examples of the ammonium include ammonium, triethylammonium, trioctylammonium, and tetrabutylammonium.

Further, it is preferable to contain neither —N═N— group nor —SH group in the molecule of formula (IV).

Next, among the compound represented by any one of formulae (I) to (IV), especially preferable specific examples are shown below. However, the present invention is not limited to these compounds.

(A-1)

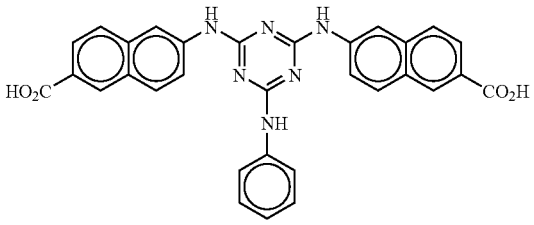

(A-2)

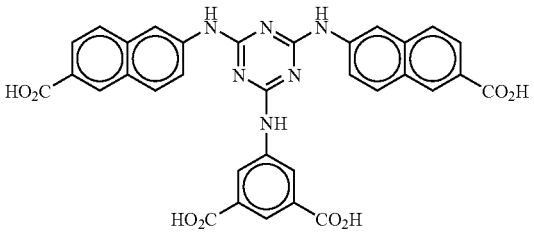

(A-3)

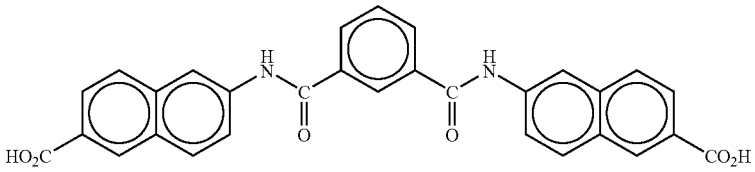

-continued
(A-4)
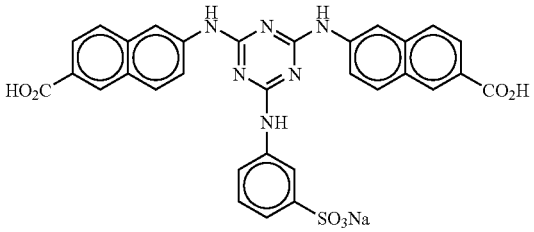
(A-6)
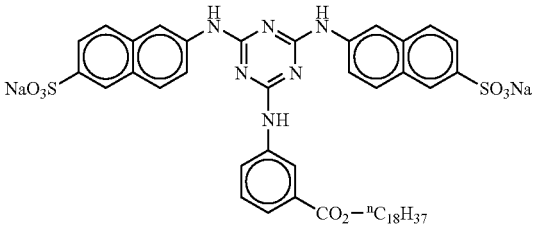
(A-7)
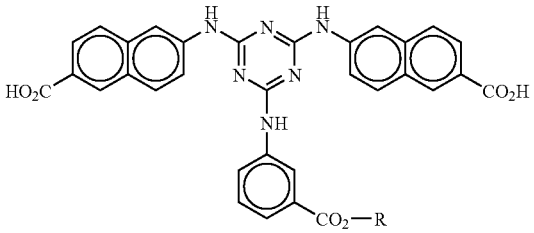
R =
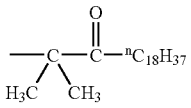
(A-8)
R =
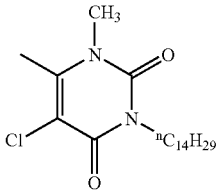
(A-9)
R =
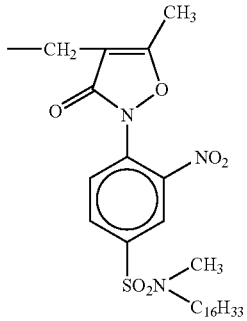
(A-10)
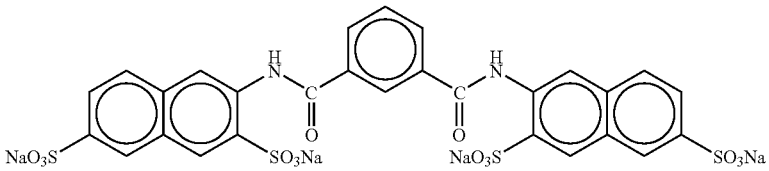
B-1)
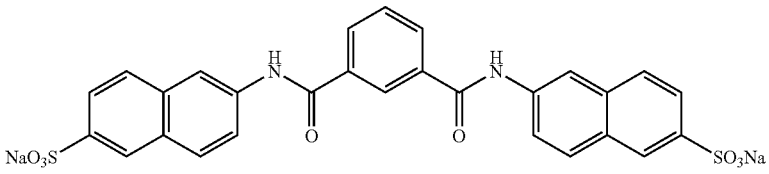
B-2)
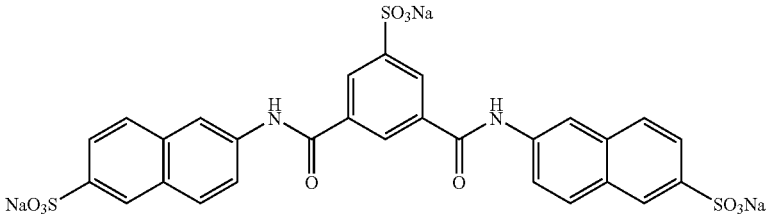

-continued
B-3)
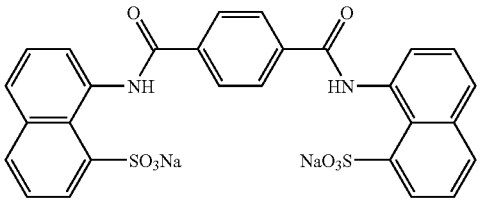
B-4)
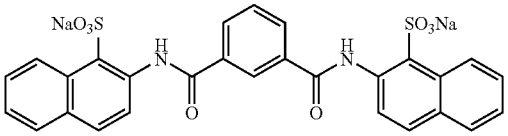
B-5)
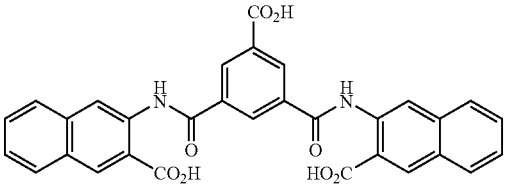
B-6)
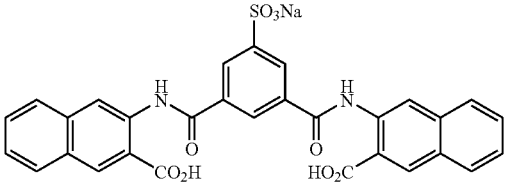
B-7)
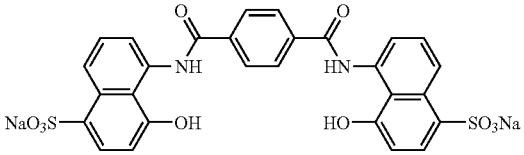
B-8)
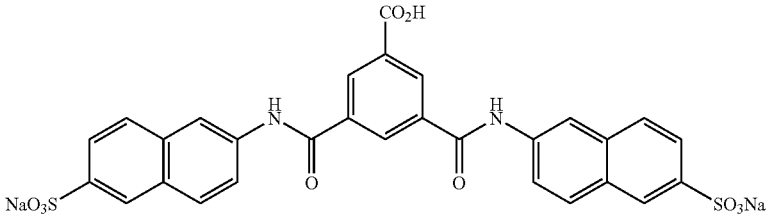
B-9)
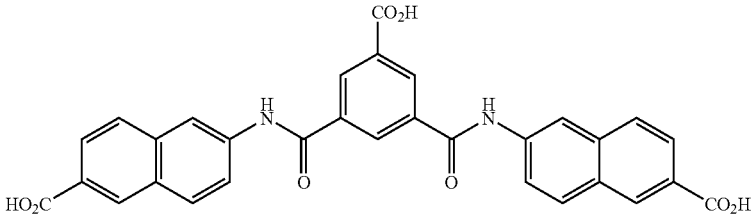
B-10)
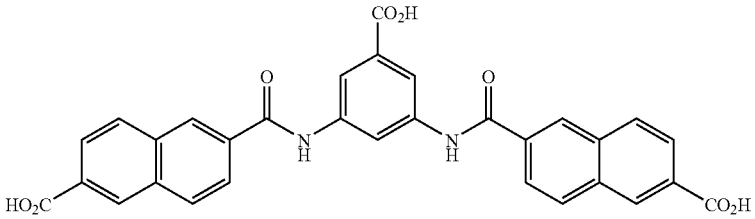
B-11)
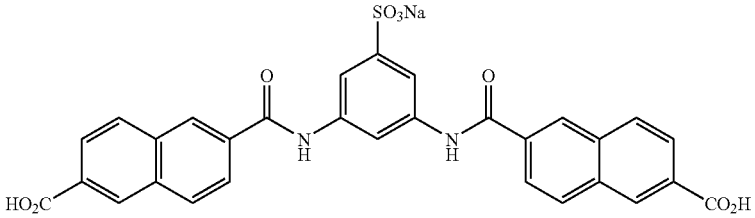

-continued
B-12)
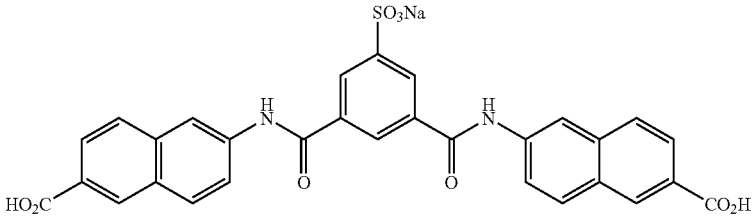
B-13)
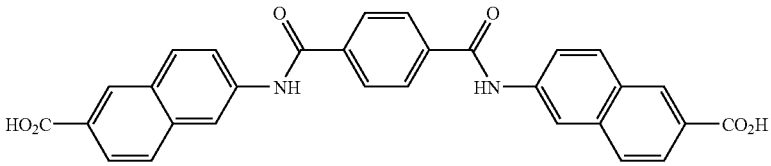
B-14)
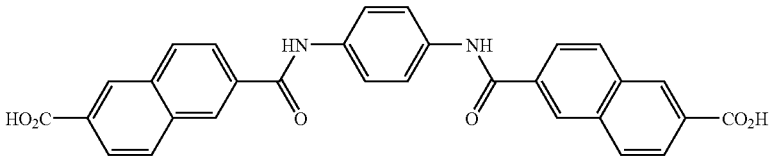
B-15)
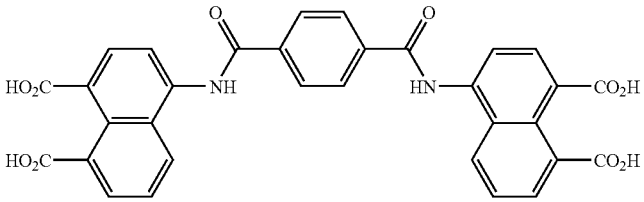
B-16)
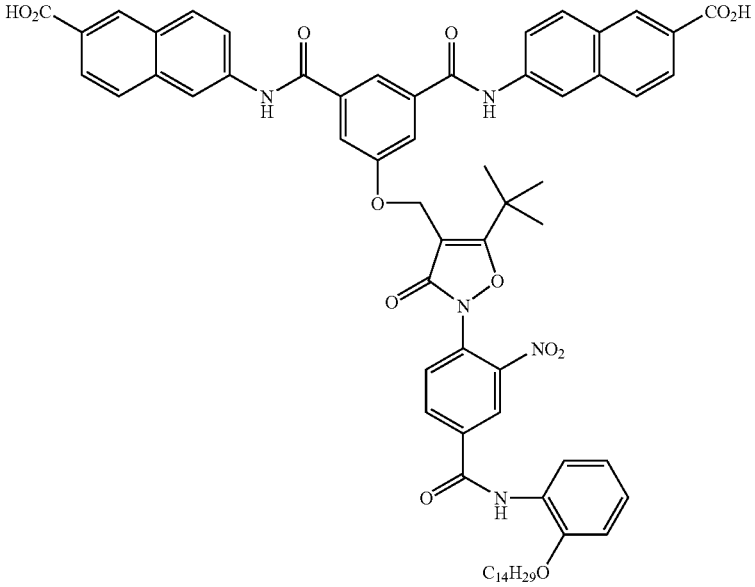

-continued
B-17)
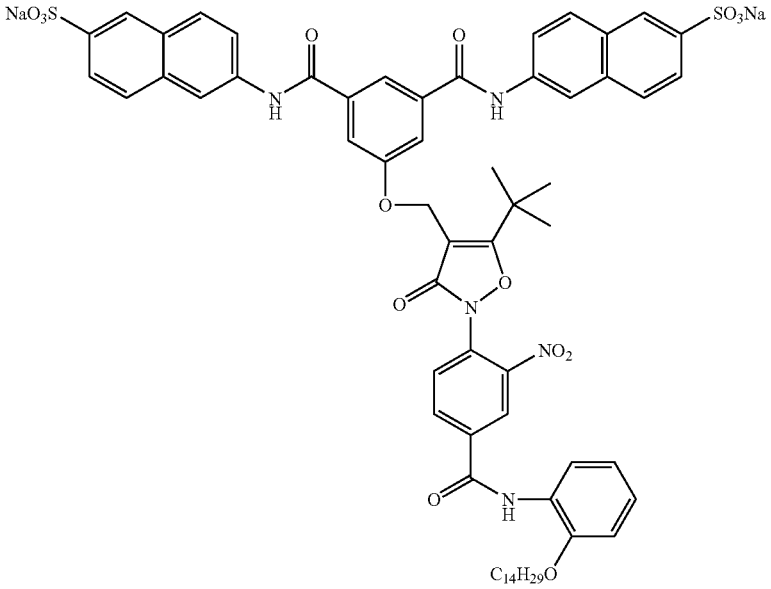
B-18)
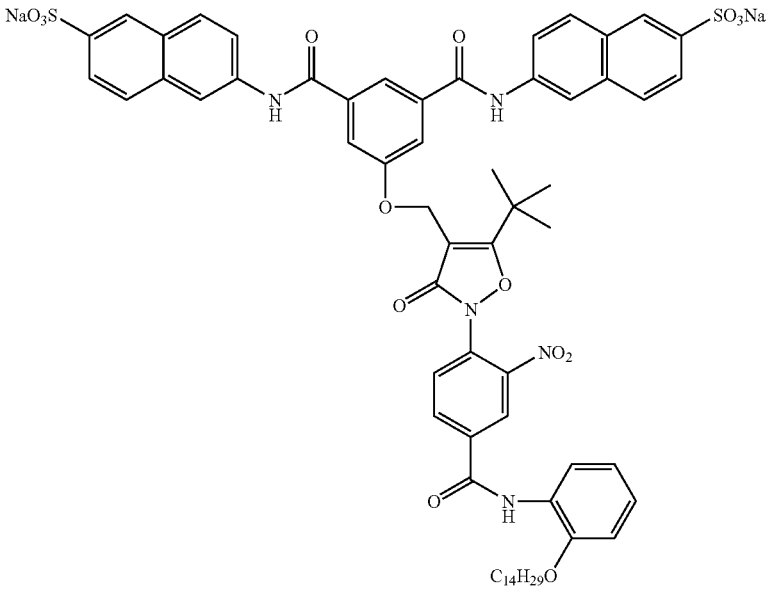

-continued
B-19)
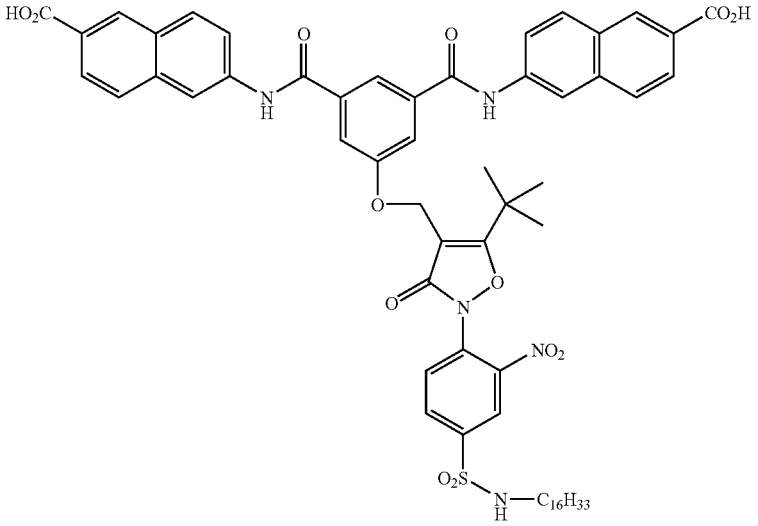
B-20)
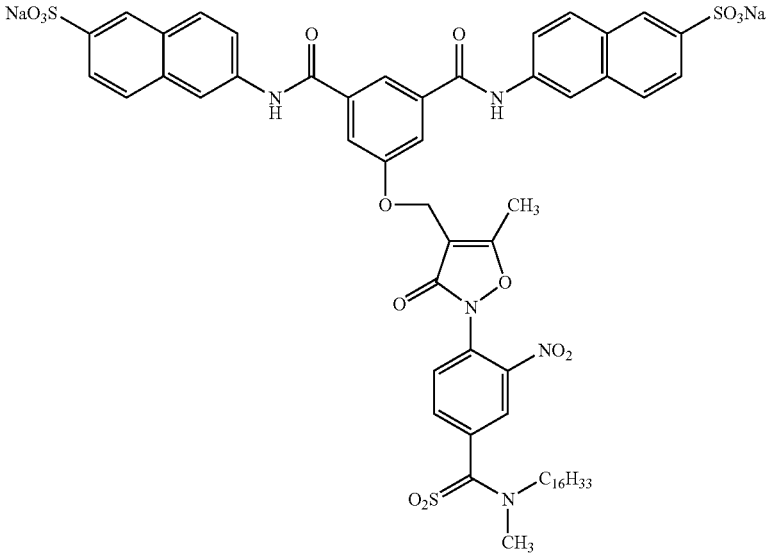
B-21)
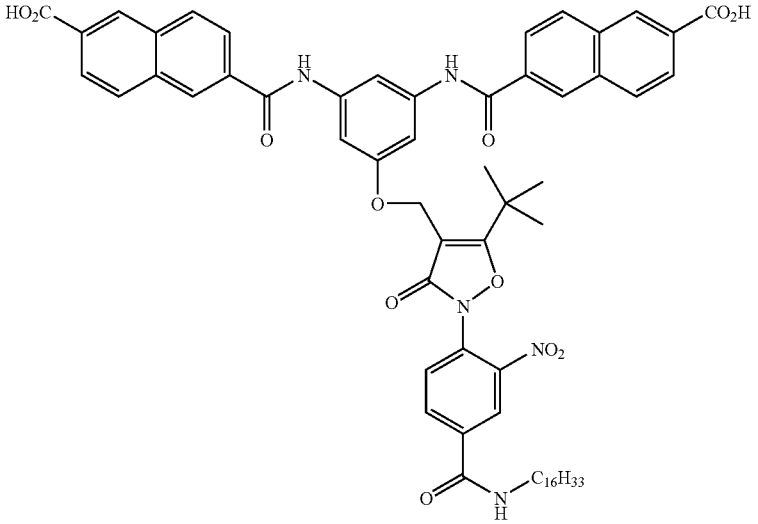

-continued
B-22)
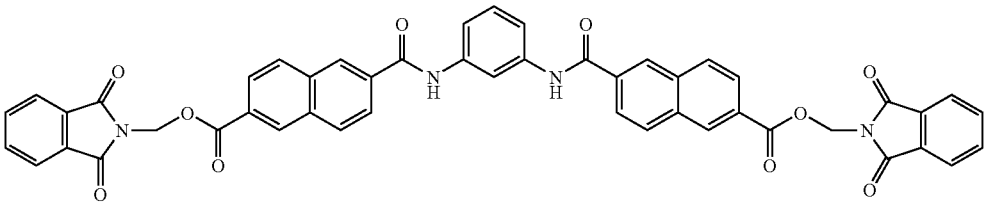
B-23)
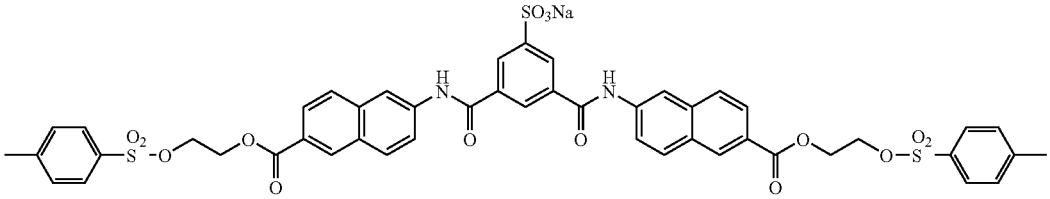
B-24)
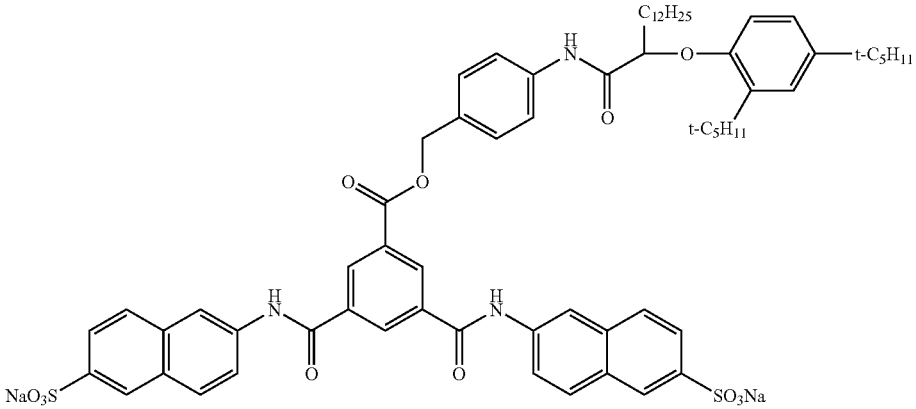
B-25)
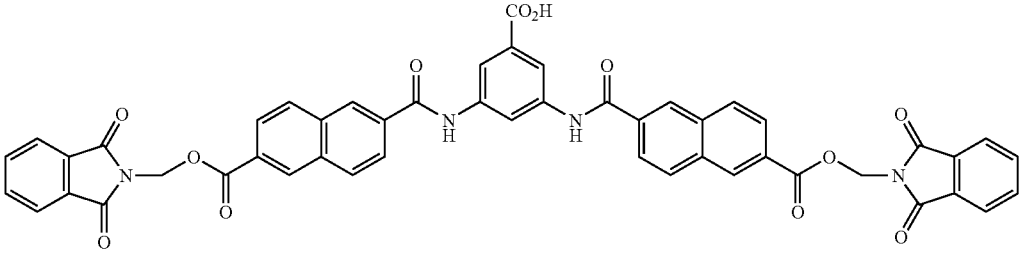
B-26)
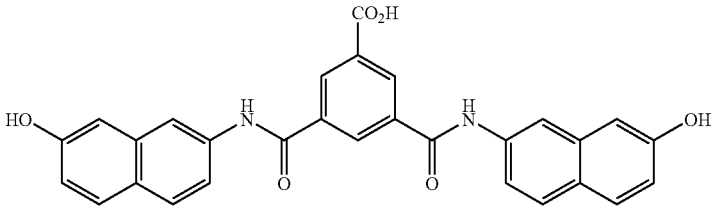
B-27)
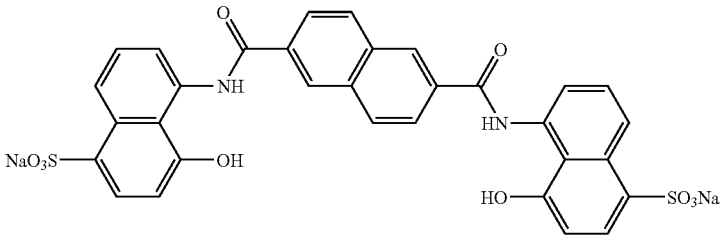

-continued
B-28)
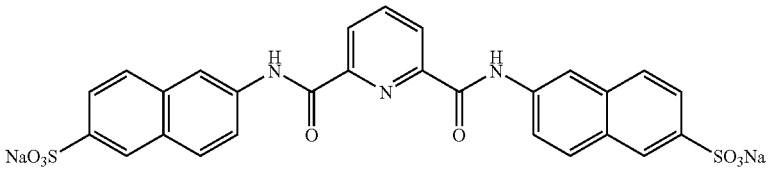
B-29)
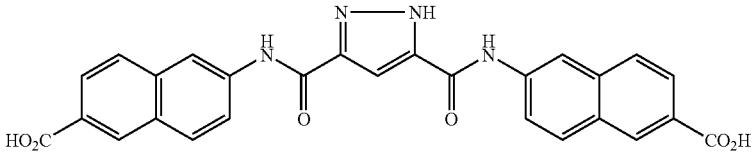
B-30)
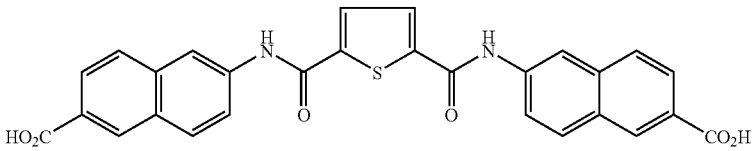
C-1)
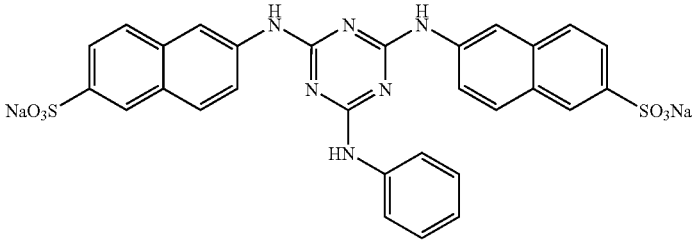
C-2)
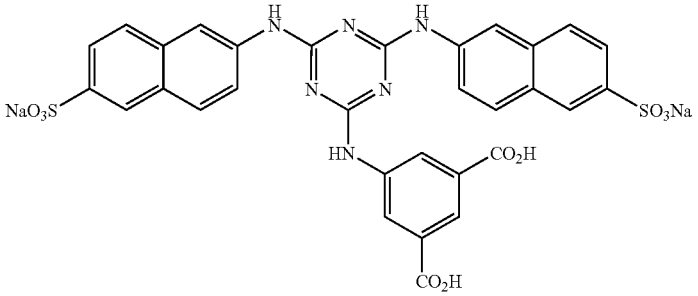
C-3)
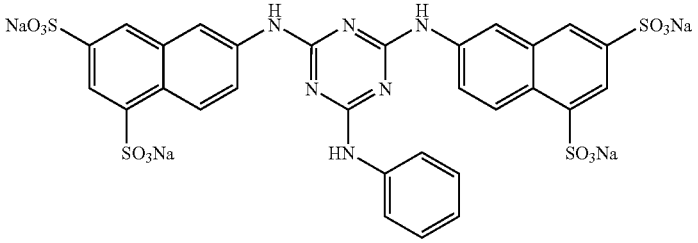
C-4)
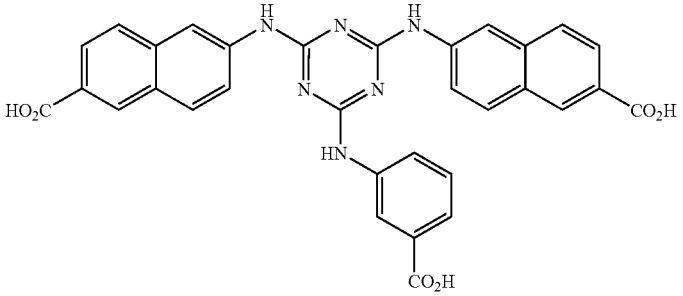

-continued
C-5)
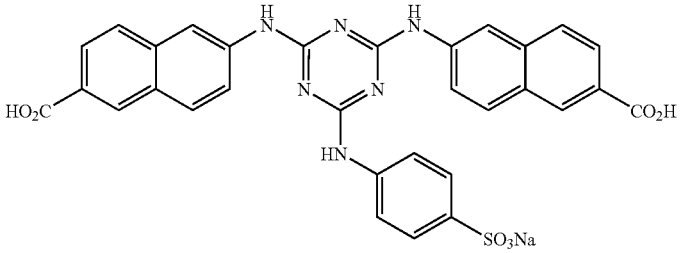
C-6)
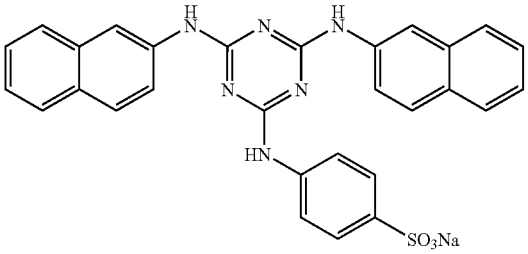
C-7)
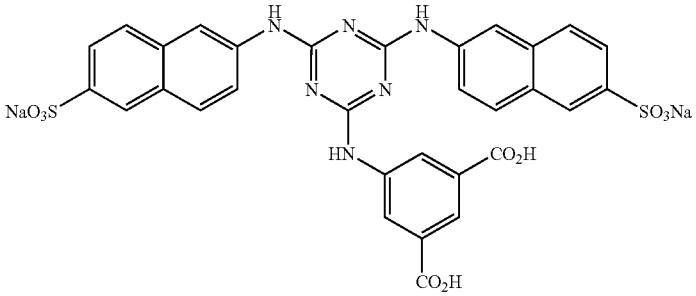
C-8)
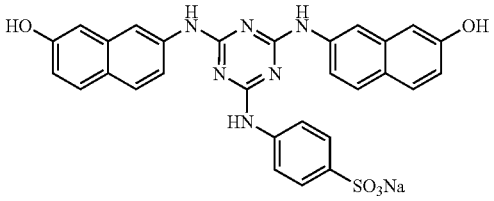
C-9)
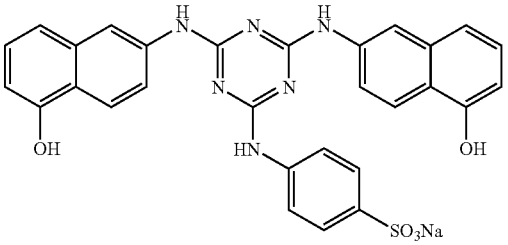
C-10)
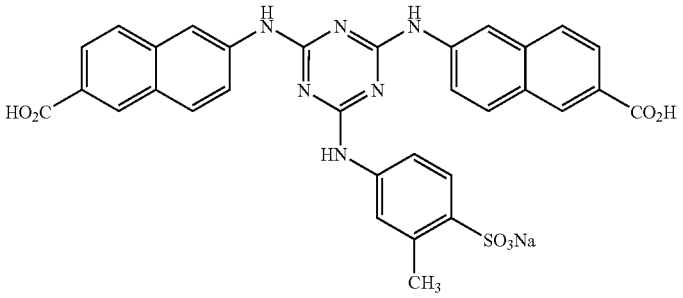

-continued
C-11)
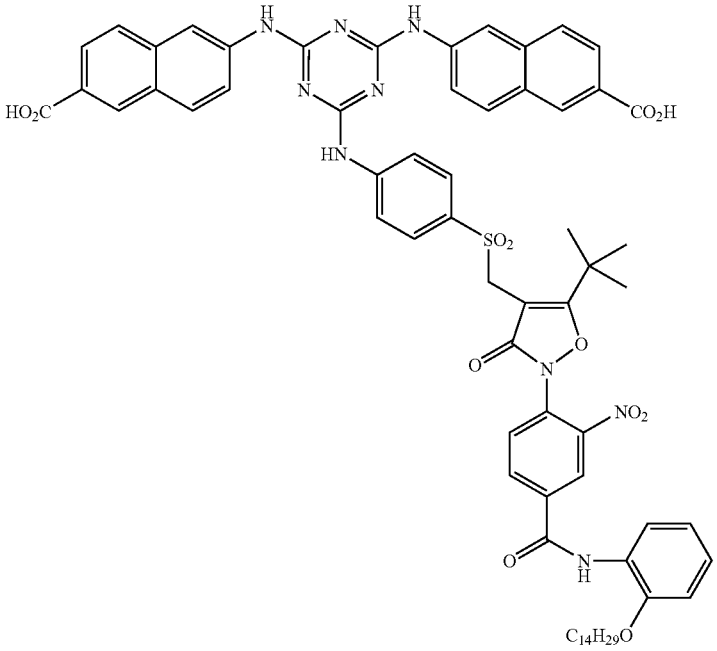
C-12)
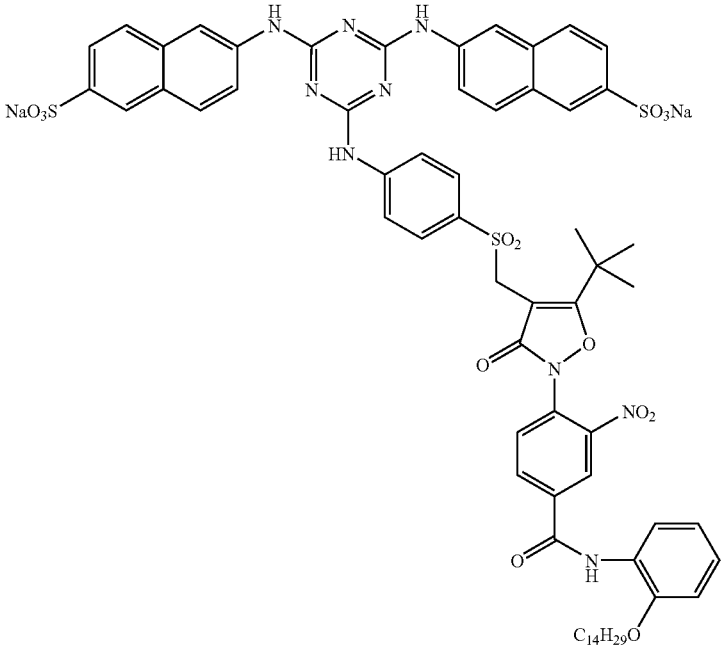

-continued
C-13)
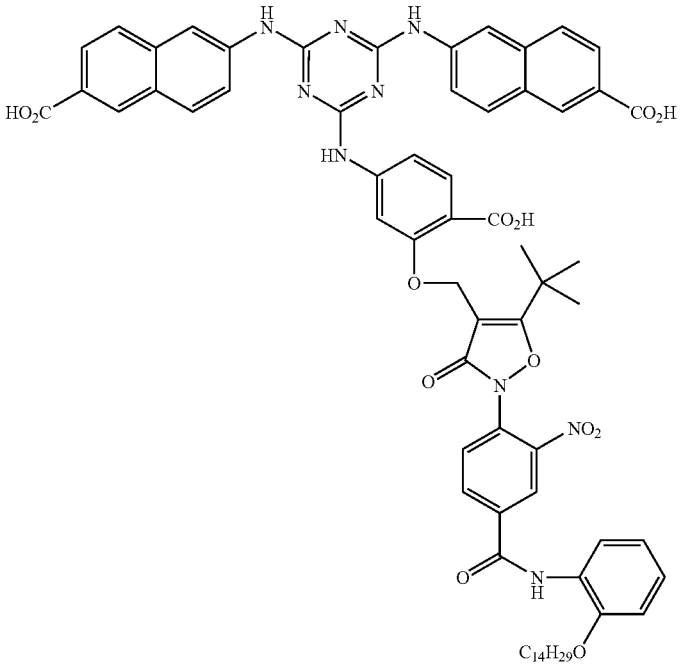
C-14)
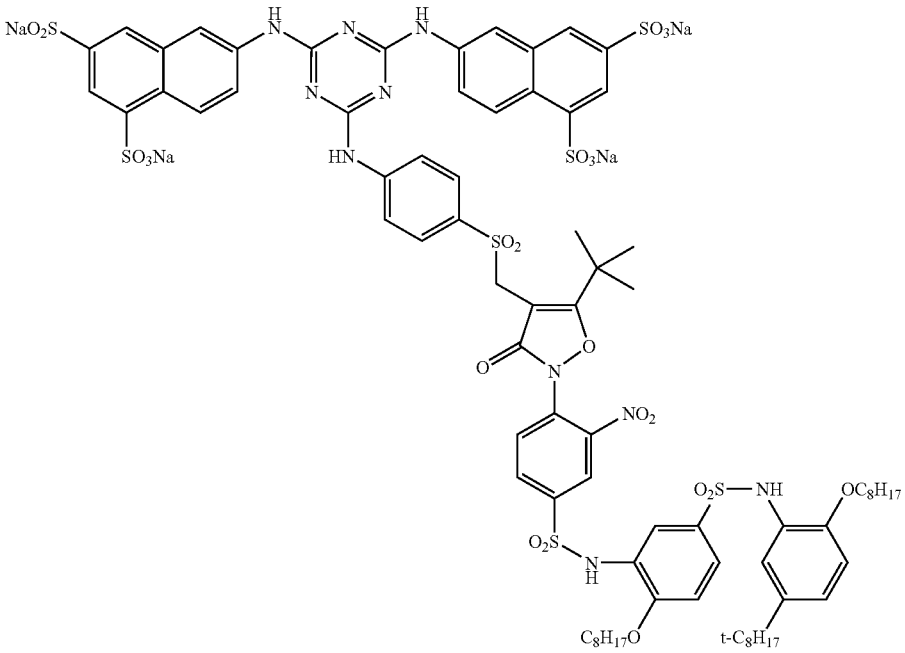

-continued
C-15)
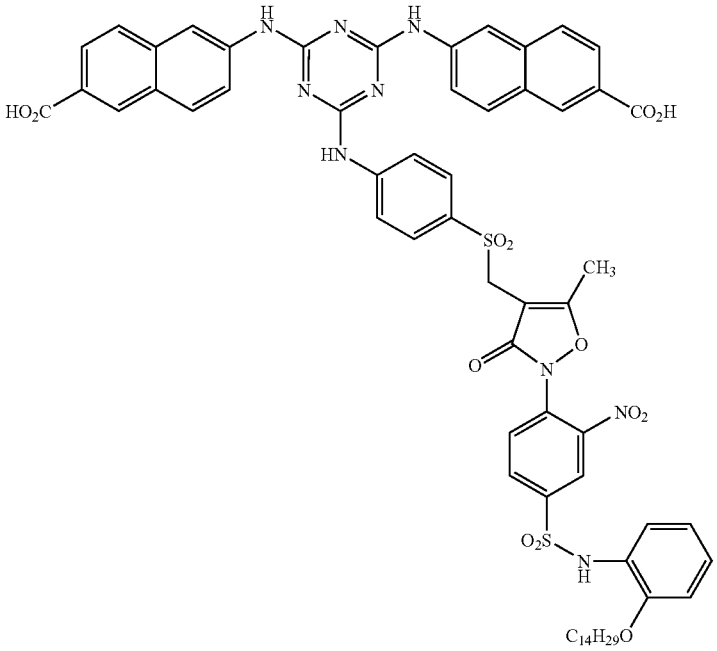
C-16)
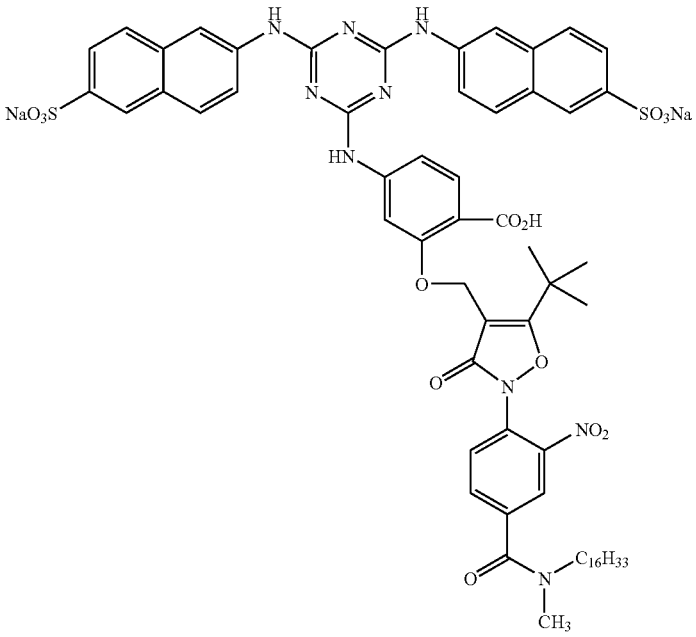
C-17)
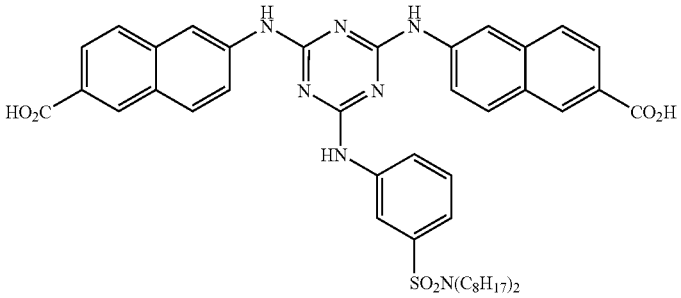

-continued
C-18)
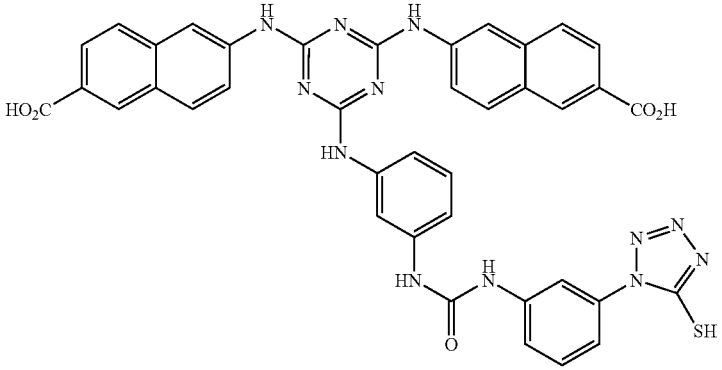
C-19)
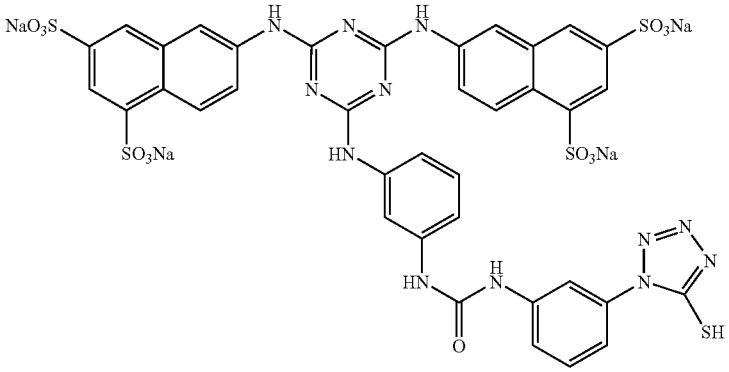
C-20)
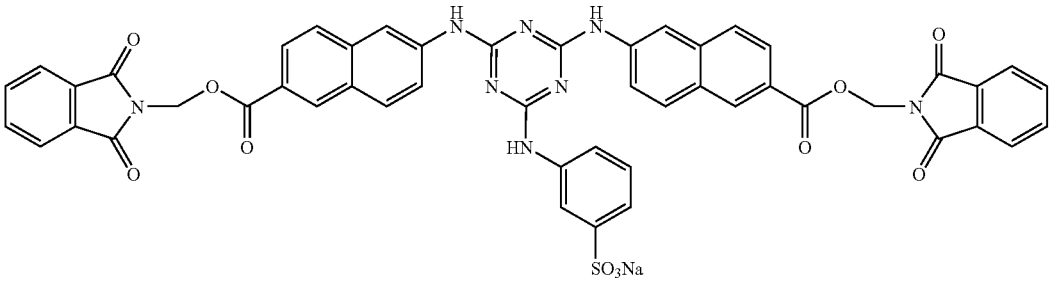
D-1)
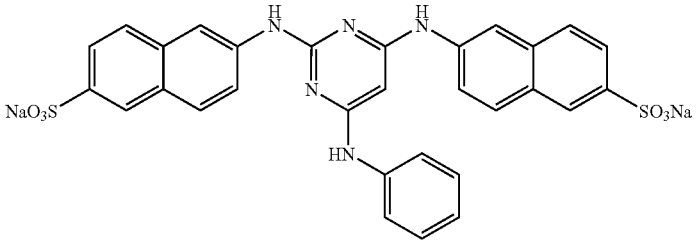
D-2)
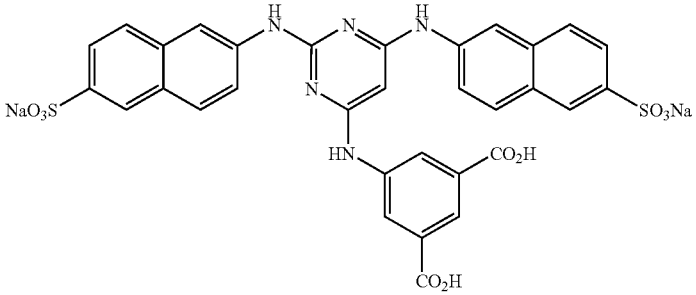

-continued
D-3)
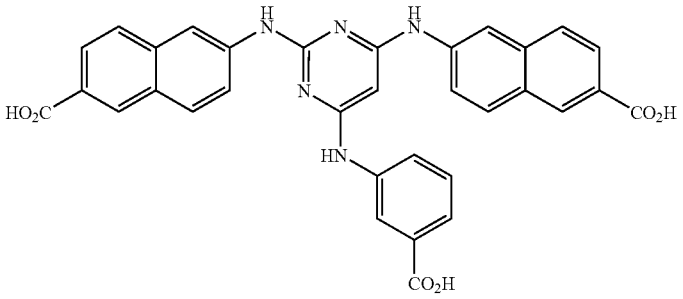
D-4)
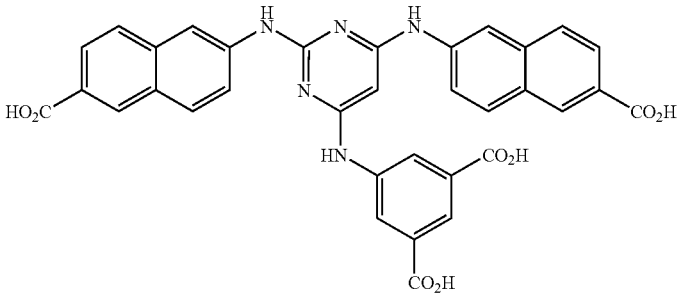
D-5)
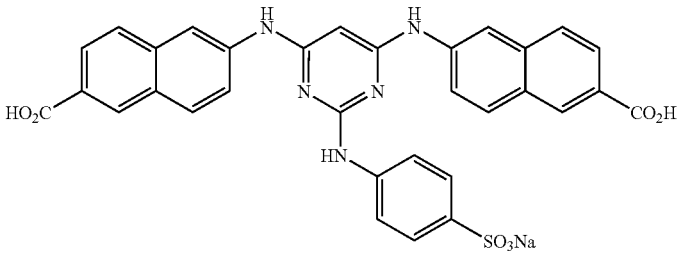
E-1)
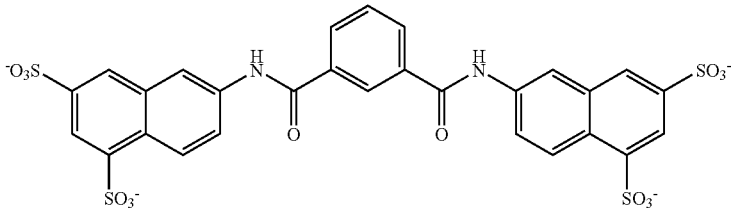
4 $HN^+(n\text{-}C_8H_{17})_3$
E-2)
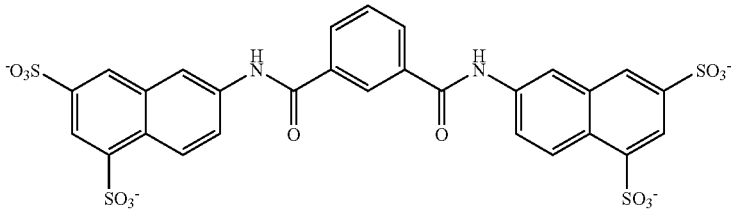
4 $HN^+(n\text{-}C_8H_{17})_3$
E-3)
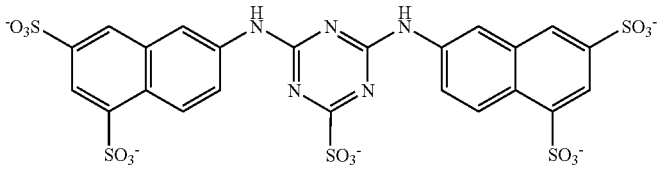
$5HN^+(n\text{-}C_8H_{17})_3$ -continued
E-4)
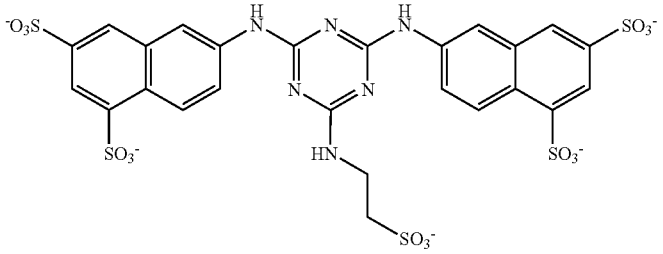
5 $HN^+(n\text{-}C_8H_{17})_3$
E-5)
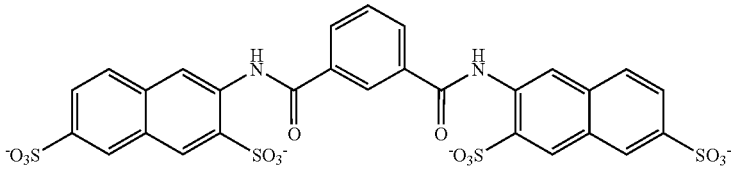
4 $HN^+(n\text{-}C_8H_{17})_3$
E-6)
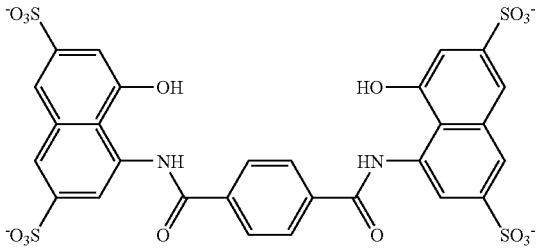
4 $HN^+(n\text{-}C_8H_{17})_3$
E-7)
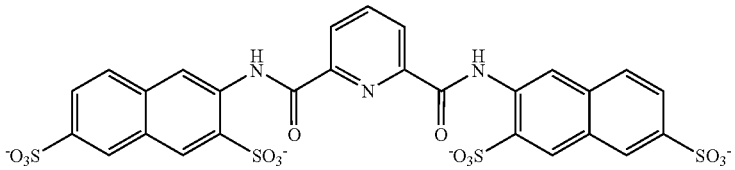
4 $HN^+(n\text{-}C_8H_{17})_3$
E-8)
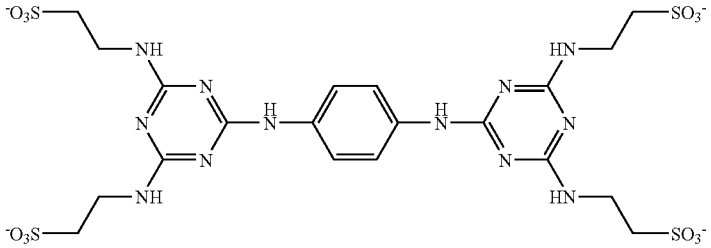
4 $HN^+(n\text{-}C_8H_{17})_3$ -continued

E-9)

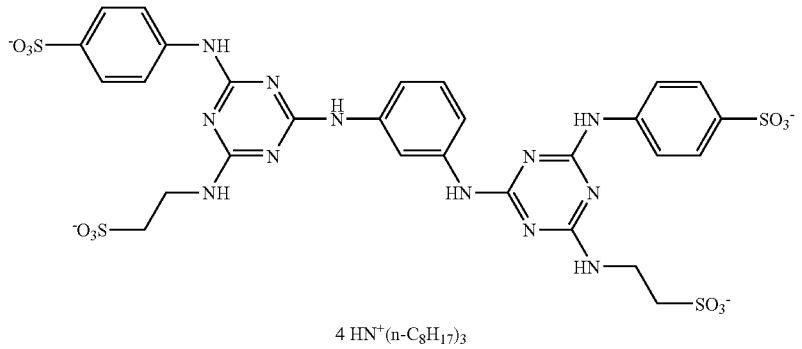

4 $HN^+(n\text{-}C_8H_{17})_3$

E-10)

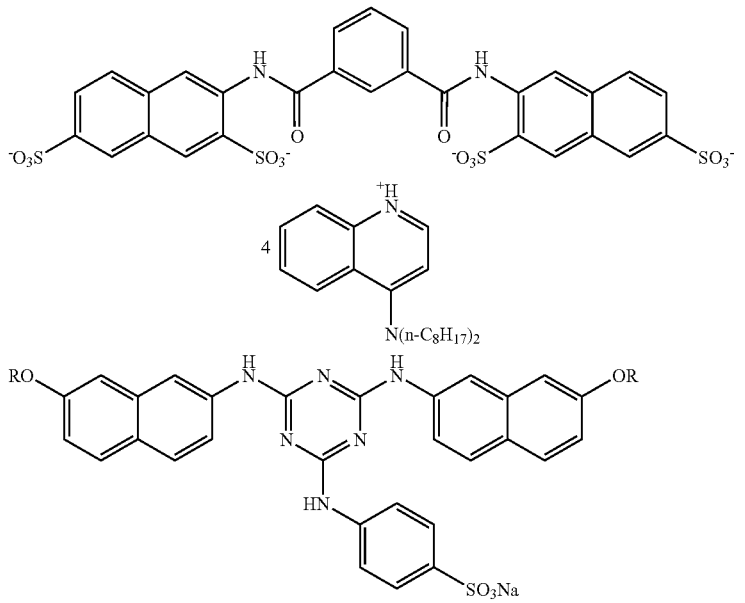

F-1) R=$CH_3$

F-2) R=—$(CH_2)_2O(CH_2)_2OH$

The compound according to the present invention can be synthesized by the methods described in the patents and references referred in the above-mentioned Reference (4), or the synthesis method described in WO97/19916.

When compound according to the present invention has a plurality of asymmetric carbon atoms in its molecule, a plurality of stereoisomers exist for the same structure. The present specification embraces all the possible stereoisomers, and only one of the plurality of stereoisomers may be used, or a mixture of several of them may be used. The compound according to the present invention may be used singly or in combination of two or more kinds thereof. The number and the kind of compounds to be used can be selected appropriately.

The compound according to the present invention may be used together with any method(s) for reducing color-remains or any compound(s) having an effect of reducing color-remains. The method to be used, or the number and the kind of compounds to be contained, may also be selected appropriately.

The compound according to the present invention is especially preferably used in the case of incorporating into a silver halide photographic photosensitive material. Particularly, in this case, an effect of reducing color-remains can be achieved. Further, this case is also preferable in the point that only the residual color of the silver halide photographic photosensitive material in which a dye chromophore according to the present invention is multilayer adsorbed, can be improved.

As mentioned above, it is preferable to incorporate the residual-color-reducing agent in a silver halide photographic photosensitive material in the present invention. Alternatively, it is possible to use an image-forming method wherein a silver halide photographic photosensitive material in which the dye chromophore is multilayer adsorbed (said photosensitive material may or may not contain the residual-color-reducing agent) is processed with a photographic processing solution containing a residual-color-reducing agent according to the present invention, to contact the photosensitive material with the residual-color-reducing agent.

As the processing solution containing the residual-color-reducing agent, any processing solution such as a developing solution, a bleaching solution, a fixing solution, and a washing solution may be used, but the residual-color-reducing agents are preferably contained in a bleaching solution, a fixing solution or a water washing solution, more preferably in a fixing solution or a water washing solution.

As the embodiment (image-forming method) for contacting a residual-color-reducing agent, any other embodiments may be applied. A solution containing the residual-color-reducing agent may be contacted with a silver halide photographic photosensitive material by any method such as atomizing using a splay or a line-jet, coating using a roller or a sheet, adhesion with a sheet, and the same dipping as used in an ordinary photographic processing process. Herein, the term "sheet" means a high-molecular-textile capable of retaining the solution containing the residual-color-reducing agent. A concentration of the solution containing the residual-color-reducing agent is preferably in the range of from 0.005 to 3.0 mol/L, further preferably in the range of from 0.01 to 1.5 mol/L, and furthermore preferably in the range of from 0.02 to 0.5 mol/L. When a processing composition containing the residual-color-reducing agent is used after dilution with water or another processing composition, the concentration of the processing composition is a value of the concentration of a working solution multiplied by a concentration rate.

When a silver halide photographic light-sensitive material containing a compound of the present invention is subjected to a photographic processing, it may be processed with a processing solution containing a known residual-color-reducing agent. Specifically, a processing solution containing a bis(triazinylamino)stylbenedisulfonic acid compound (e.g., a known or commercially available diaminostylbene-based fluorescent bleaching agent) can be used. Preferred examples of the known bis(triazinyldiamino)stylbenedisulfonic acid compound are described in, for example, JP-A-6-329936, JP-A-7-140625, JP-A-10-104809, and JP-A-2001-281823. The commercially available compounds are described in, for example, "Senshoku Note (Notebook on Dyeing)", 19th edition (Shikisensha Co., Ltd.), pp. 165 to 168. Among the products described in this publication, Blankophor BSUliq, Blankophor REU, Tinopal MSP, and Hakkol BRK are preferred. Compounds described in JP-A-3-73948 or U.S. Pat. No. 6,153,364 may be used together.

In the preparation of the silver halide photographic light-sensitive material containing a residual-color-reducing agent according to the present invention, the residual-color-reducing agent compound for use in the present invention may be incorporated in a coating solution in any form such as a solution, an emulsion-dispersion, and a solid fine particle dispersion, to be contained in the light-sensitive material.

As the emulsion-dispersion process, there can be used an oil-in-water type dispersion process in which a compound is dissolved in a high-boiling-point organic solvent (in combination with a low-boiling-point organic solvent as occasion demands), thereby forming a solution, and then the resulting solution is emulsified and dispersed in an aqueous gelatin solution, which is then added to a silver halide emulsion.

Examples of the high-boiling organic solvent that can be used in a water-in-oil dispersion method are described in U.S. Pat. No. 2,322,027. Further, specific examples of a latex dispersion method as one of polymer dispersion methods are described in U.S. Pat. No. 4,199,363, West German Patent (OLS) No. 2,541,274, JP-B-53-41091, and European Patent Application Publication Nos. 0,727,703 and 0,727,704. Further, a dispersion method using a polymer that is soluble in an organic solvent is described in PCT International Publication WO88/723.

Examples of the high-boiling organic solvent that can be used in a water-in-oil dispersion method include phthalic acid esters (e.g., dibutyl phthalate, dioctyl phthalate, di-2-ethylhexyl phthalate), esters of phosphoric acid or phosphonic acid (e.g., triphenyl phosphate, tricresyl phosphate, tri-2-ethylhexyl phosphate), fatty acid esters (e.g., di-2-ethylhexyl succinate, tributyl citrate), benzoic acid esters (e.g., 2-ethylhexyl benzoate, dodecyl benzoate), amides (e.g., N,N-diethyldodecane amide, N,N-dimethylolein amide), alcohols or phenols (e.g., iso-stearyl alcohol, 2,4-di-tert-amyl phenol), anilines (e.g., N,N-dibutyl-2-butoxy-5-tert-octylaniline), chlorinated paraffins, hydrocarbons (e.g., dodecyl benzene, diisopropyl naphthalene), and carboxylic acids (e.g., 2-(2,4-di-tert-amyl phenoxy)butyrate). Further, the high-boiling point organic solvent may be used in combination with an auxiliary solvent having a boiling point of 30° C. or more and 160° C. or less (e.g., ethyl acetate, butyl acetate, methyl ethyl ketone, cyclohexanone, methylcellosolve acetate, and dimethylformamide). The high-boiling organic solvent is preferably used in an amount of 0 to 10 times, more preferably 0 to 4 times, to the compound of the present invention, in terms of mass ratio.

All or a part of the auxiliary solvent may be removed from an emulsified dispersion by means of a vacuum distillation, a noodle washing, an ultrafiltration, or the like, as occasion demands, for the purpose of improving storage stability with the lapse of time in the state of the emulsified dispersion, or inhibiting a fluctuation in photographic properties or improving stability with the lapse of time of the final coating composition in which the emulsified dispersion is mixed with an emulsion.

The average particle size of the oleophilic fine particle dispersion thus obtained is preferably in the range of 0.04 to 0.50 μm, more preferably in the range of 0.05 to 0.30 μm, and most preferably in the range of 0.08 to 0.20 μm. The average particle size can be determined with Coulter submicron particle analyzer model N4 (trade name, manufactured by Coulter Electronics Co., Ltd.) and the like.

Examples of a solid fine particle dispersion method including a method in which a powder of the compound according to the present invention is dissolved in a proper solvent such as water by means of a ball mill, a colloid mill, a vibration ball mill, a sand mill, a jet mill, a roller mill, or an ultrasonic disperser, to prepare the solid fine particle dispersion. In this method, a protective colloids (e.g., polyvinyl alcohol) and a surfactants (e.g., anionic surfactants such as sodium triisopropylnaphtharene sulfonate (a mixture of three compounds different in the substitution position of an isopropyl group each other)) may be used. In the above-mentioned mills, beads such as zirconia are generally used as a dispersion medium. In some cases, Zr and the like eluted from these beads are contaminated into the dispersion. The amount of the eluted material varies depending on the conditions of dispersion, but it is generally in the range of from 1 to 1,000 ppm. There is no problem in practice, when the content of Zr in a photosensitive material is 0.5 mg or less, per 1 g of the silver. Antiseptics (e.g., sodium benzoisothiazolinone) may be incorporated in an aqueous dispersion.

In the present invention, for the purpose of obtaining solid dispersions that have a high S/N ratio and a small grain size, and are aggregation-free, use can be made of a dispersion method in which an aqueous dispersion is converted into a high-speed flow, and then a pressure of the high-speed flow is reduced. A solid-dispersing apparatus and solid dispersion technologies used for conducting the dispersion method are described, for example, in *Bunsan kei reolojii to Bunsanka Gizyutsu* (*Disperse System Rheology and Dispersion technologies*, by Toshio KAJIUCHI and Hiroki USUI, 1991, Shinzansya shuppan Co., Ltd., pp. 357–403) and *Kagakukougaku no shinpo dai* 24 *shyu* (*Advance in Chemical engi-*

*neering, Vol.* 24, edited by Tokai branch of the Society of Chemical Engineers, 1990, Maki Shoten, pp. 184–185), in detail.

The compound reducing a color-remains according to the present invention may be added to not only a silver halide emulsion layer, but also other layers (non-light-sensitive layers such as a subbing layer, an interlayer and a protective layer), in the silver halide photosensitive material. In order to incorporate the compound according to the present invention into a silver halide emulsion layer, they may be directly dispersed into the emulsion of any layers; or they may be dissolved in a single solvent such as water and methanol, or a mixed solvent thereof, to prepare a solution, and then the solution is added to the emulsion. The timing of adding the compound to the emulsion may be any step ranging from preparation of the emulsion to just before coating of the emulsion.

It is preferable that the residual-color-reducing agent of the present invention is dissolved in water, to prepare a solution, and the solution is added to the silver halide emulsion layer at the time of preparation of the emulsion. The addition amount of the residual-color-reducing agent is preferably in the range of from $1\times10^{-5}$ to 1 mol, more preferably in the range of from $1\times10^{-3}$ to $5\times10^{-1}$ mol, per mole of the silver halide.

Two or more kinds of the compounds reducing color-remains according to the present invention may be used in combination. In this case, these compounds may be added to one identical layer, or separate layers.

In the present invention, the dye chromophore for use in the present invention may be present as a partial structure of a dye compound, or may form a dye compound by itself. In the latter case, the dye chromophore means a dye compound. A dye compound containing the dye chromophore is preferably used as a sensitizing dye.

The dye chromophore for use in the present invention is explained in the following chromophore reference (1).

Chromophore Reference (1)

The "chromophore" as used herein is defined in Rikagaku Jiten (Physicochemical Dictionary), p. 1052, 5th ed., Iwanami Shoten (1998) and means an atomic group which works out to a main cause for the absorption band of a molecule. Any chromophore, for example, an atomic group having an unsaturated bond such as C═N or N═N, may be used.

As the chromophore, can be specifically included, for example, cyanine dyes, styryl dyes, hemicyanine dyes, merocyanine dyes (including zero-methine merocyanine (simple merocyanine)), trinuclear merocyanine dyes, tetranuclear merocyanine dyes, rhodacyanine dyes, complex cyanine dyes, complex merocyanine dyes, allopolar dyes, oxonol dyes, hemioxonol dyes, squarium dyes, croconium dyes, azamethine dyes, coumarin dyes, allylidene dyes, anthraquinone dyes, triphenylmethane dyes, azo dyes, azomethine dyes, spiro compounds, metallocene dyes, fluorenone dyes, fulgide dyes, perylene dyes, phenazine dyes, phenothiazine dyes, quinone dyes, indigo dyes, diphenylmethane dyes, polyene dyes, acridine dyes, acridinone dyes, diphenylamine dyes, quinacridone dyes, quinophthalone dyes, phenoxazine dyes, phthaloperylene dyes, porphyrin dyes, chlorophile dyes, phthalocyanine dyes and metal complex dyes.

Among these, preferred are cyanine dyes, styryl dyes, hemicyanine dyes, merocyanine dyes, trinuclear merocyanine dyes, tetranuclear merocyanine dyes, rhodacyanine dyes, complex cyanine dyes, complex merocyanine dyes, allopolar dyes, oxonol dyes, hemioxonol dyes, squarium dyes, croconium dyes and methine chromophores such as azamethine dyes, more preferred are cyanine dyes, merocyanine dyes, trinuclear merocyanine dyes, tetranuclear merocyanine dyes, rhodacyanine dyes and oxonol dyes, still more preferred are cyanine dyes, merocyanine dyes, rhodacyanine dyes and oxonol dyes, particularly preferred are cyanine dyes and merocyanine dyes, and most preferred are cyanine dyes.

The detail of these dyes is described in the following references about dye (2).

References About Dye (2)

The dyes that can be used in the present invention is described in, for example, F. M. Harmer, "Heterocyclic Compounds—Cyanine Dyes and Related Compounds", John Wiley & Sons, New York, London, 1964; D. M. Sturmer, "Heterocyclic Compounds—Special topics in heterocyclic chemistry", chapter 18, section 14, pages 482 to 515, John Wiley & Sons, New York, London, 1977; and Rodd's Chemistry of Carbon Compounds, 2nd. Ed. vol. IV, part B, 1977, chapter 15, pages 369 to 422, Elsevier Science Publishing Company Inc., New York.

In addition, ones described in RD 17643, pages 23 to 24; RD 18716, page 648, right column to page 649, right column; RD 308119, page 996, right column to page 998, right column; and European Patent No. 0565096 A1, page 65, lines 7 to 10 can be preferably use. Further, dyes having a partial structure or a structure represented by formulae or specific examples described in U.S. Pat. No. 5,747,236 (particularly, pages 30 to 39), U.S. Pat. No. 5,994,051 (particularly, pages 32 to 43), and U.S. Pat. No. 5,340,694 (particularly, pages 21 to 58, with the proviso that in the dyes represented by formulae (XI), (XII) and (XIII), the each numbers of $n_{12}$, $n_{15}$, $n_{17}$ and $n_{18}$ are not limited, but an integer of 0 or more (preferably 4 or less)), can be preferably used.

Next, the multilayer adsorption in the present invention is explained. In the present invention, the multilayer adsorption is preferably used with a technique improving a light-adsorption ratio using a spectral sensitizing dye, particularly with a multilayer adsorption technique of a sensitizing dye. The term "multilayer adsorption" means that dye chromophores are adsorbed on the surface of silver halide grains in the form of more than single layer (differently stated, as a lamination layer).

Specifically, examples of the technique include, for example, a method in which, using intermolecular force, sensitizing dyes are adsorbed to the surface of silver halide grains in a larger quantity than a single layer-saturated coating amount, and a method in which, a compound composed of a plurality of dye chromophores (so-called multichromophore dye compound, or connection type dye) (in the compounds, a plurality of dye chromophores are preferably not conjugated) are adsorbed to the surface of silver halide grains, using intermolecular force. These methods are described in the following patents (3) with respect to multilayer adsorption.

Patents (3) with Respect to Multilayer Adsorption

JP-A-10-239789, JP-A-11-133531, JP-A-2000-267216, JP-A-2000-275772, JP-A-2001-75222, JP-A-2001-75247, JP-A-2001-75221, JP-A-2001-75226, JP-A-2001-75223, JP-A-2001-255615, JP-A-2002-23294, JP-A-10-171058, JP-A-10-186559, JP-A-10-197980, JP-A-2000-81678, JP-A-2001-5132, JP-A-2001-166413, JP-A-2002-49113, JP-A-64-91134, JP-A-10-110107, JP-A-10-171058, JP-A-10-226758, JP-A-10-307358, JP-A-10-307359, JP-A-10-310715, JP-A-2000-231174, JP-A-2000-231172, JP-A-

2000-231173, JP-A-2001-356442, European Patent No. 0985965A, European Patent No. 0985964A, European Patent No. 0985966A, European Patent No. 0985967A, European Patent No. 1085372A, European Patent No. 1085373A, European Patent No. 1172688A, European Patent No. 1199595A, and European Patent No. 887700A1

Further, in the present invention, the multilayer adsorption is preferably conducted in combination with the technologies described in JP-A-10-239789, JP-A-2001-75222, and JP-A-10-171058.

The phrase "a dye chromophore is multilayer adsorbed on the surface of the silver halide grains" in the present invention refers to a silver halide emulsion in which a dye chromophore is adsorbed on the surface of silver halide grains in the form of more than single layer. When the saturated adsorption amount per unit surface area that is achieved by a dye that is least in the dye occupation area on the surface of silver halide grains, among dyes added to above-said emulsion, is taken as a single layer-saturated coating amount, the afore-mentioned phrase is used to mean a state in which an adsorption amount of the dye chromophore per unit area is larger than the above-said single layer-saturated coating amount. Besides, when the single layer-saturated coating amount is taken as a standard, the number of adsorption layer means an adsorption amount of the dye chromophore per unit area. In a case of a multi-chromophore dye compound, the occupation area of dyes each comprising an individual dye chromophore having no connection with each other can be taken as a standard. For example, examples thereof include a dye each comprising one dye chromophore in which the connection part is replaced with an alkyl group or an alkyl sulfonic acid group.

Next, examples of the preferred dye for use in multilayer absorption as described in the description of the embodiment for carrying out the invention are shown below. Of course, the present invention is not limited thereto.

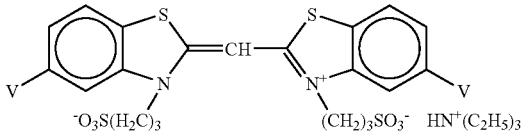

(1)

V = Cl (2)

V = Ph (3)

V = CONHPh (4)

V = Br (5)

V = 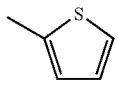

(6)

V = 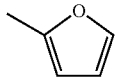

(7)

V = 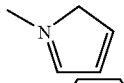

Ph = 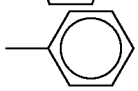

-continued

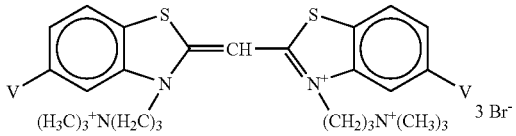

(8)

V = Cl (9)

V = Ph (10)

V = CONHPh (11)

V = Br (12)

V = 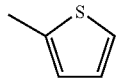

(13)

V = 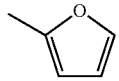

(14)

V = 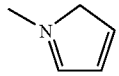

(15)

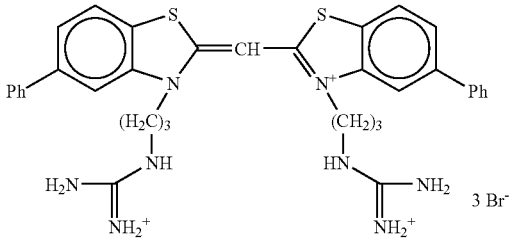

(16)

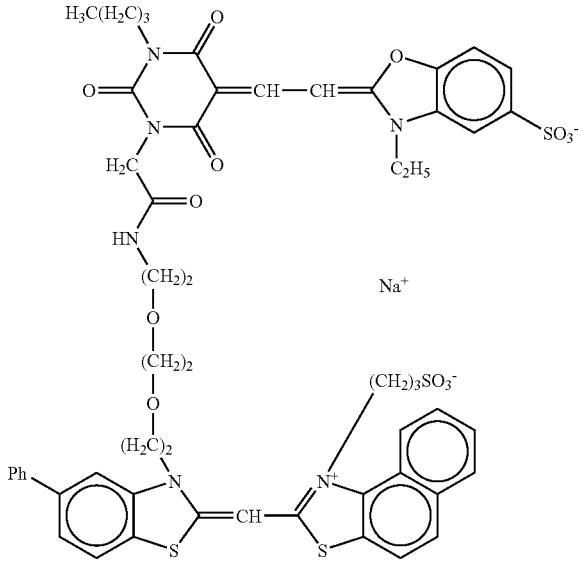

(17)

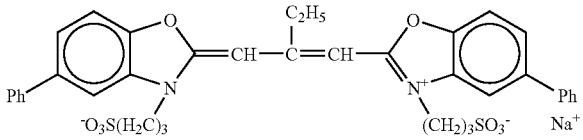

-continued
(18)
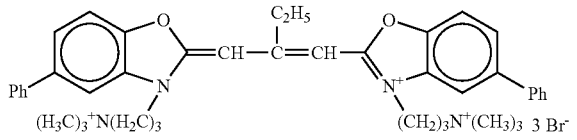
(19)
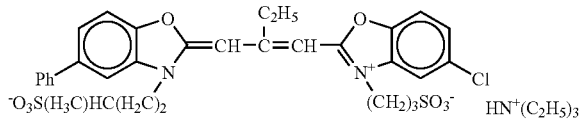
(20)
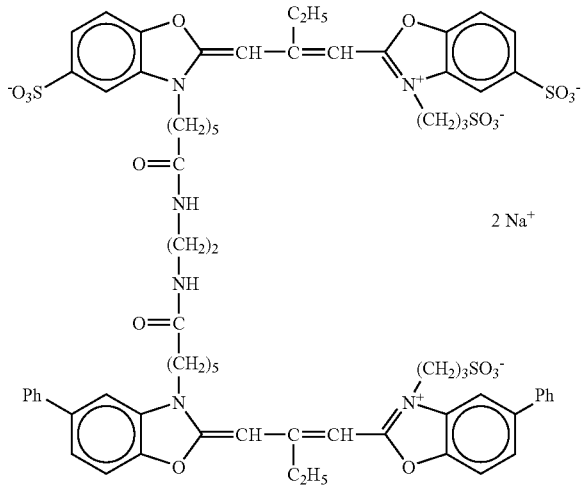
(21)
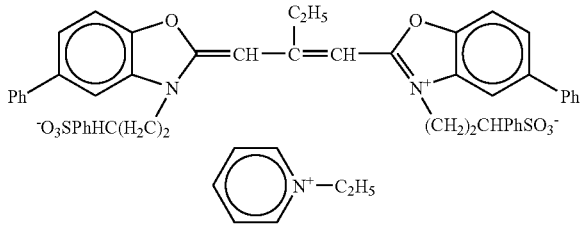
(22)
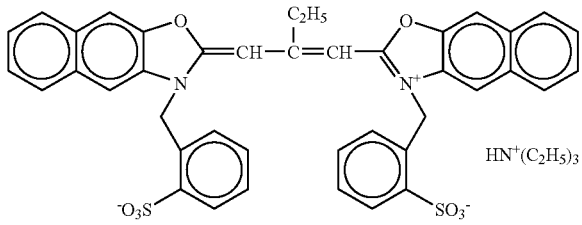
-continued
(23)
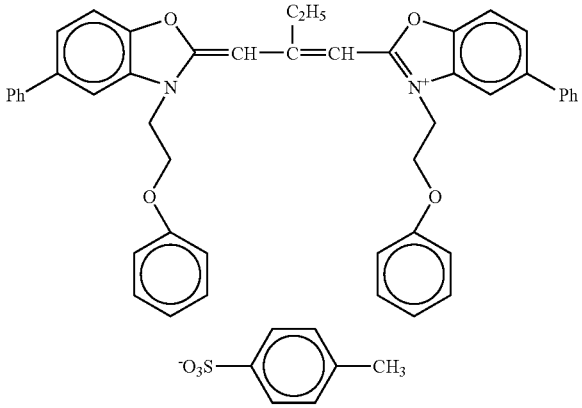
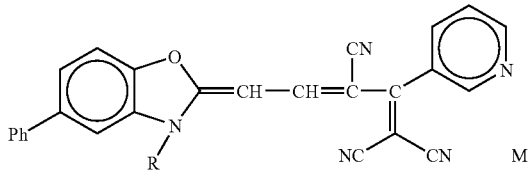
(24)
R = $(CH_2)_3SO_3^-$, M = $HN^+(C_2H_5)_3$
(25)
R = $(CH_2)_3N^+(CH_3)_3$, M = $Br^-$
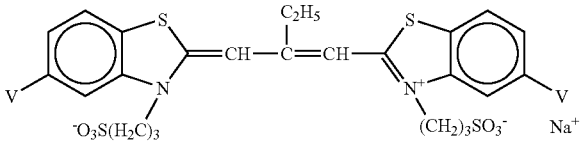
(26)
V = Cl
(27)
V = Ph
(28)
V = CONHPh
(29)
V = Br
(30)
V = 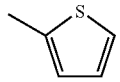
(31)
V = 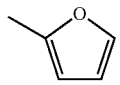
(32)
V = 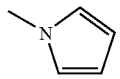
(33)
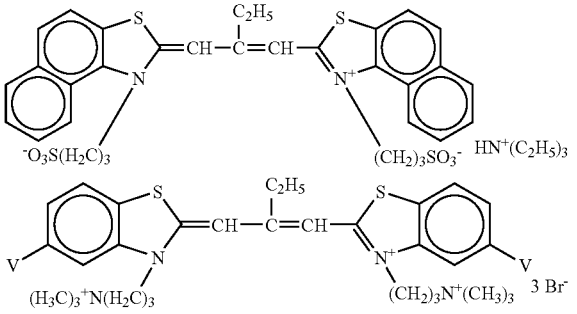

-continued (34)

V = Cl (35)

V = Ph (36)

V = CONHPh (37)

V = Br (38)

V = 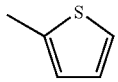

(39)

V = 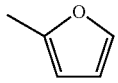

(40)

V = 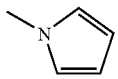

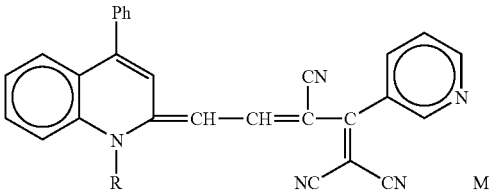

(41)

R = $(CH_2)_3SO_3^-$, M = $HN^+(C_2H_5)_3$ (42)

R = $(CH_2)_4N^+(CH_3)_3$, M = $CH_3SO_3^-$ (43)

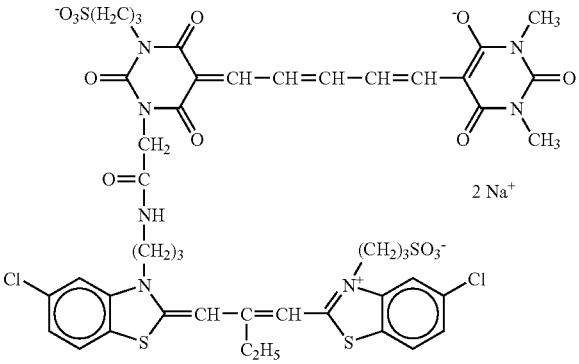

As the dye composing the multilayer adsorption in the present invention, the dyes described in the foregoing Patent (3) with respect to multilayer adsorption may be used.

It is preferable that the compound reducing a residual color according to the present invention (hereinafter, may be simply abbreviated to "the compound of the present invention") interacts with a sensitizing dye by an attractive force. It is further preferable that they are bonded with each other by attraction except for a covalent bond. These cases are explained below.

As the interaction, any attractive force except for a covalent bond may be used. Examples thereof include, for example, van der Waals force (concretely, the force is classified into an orientation force acting between a permanent dipole and another permanent dipole, an induction force acting between a permanent dipole and an induced dipole, and a dispersion force acting between a temporary dipole and an induced dipole), charge transfer force (CT), Coulomb force (electrostatic force), hydrophobic bonding force, hydrogen bonding force, and coordination bonding force. These bonding forces may be used singly or in combination of two or more forces arbitrarily selected from them. Among them, preferred are van der Waals force, charge transfer force, Coulomb force, hydrophobic bonding force and hydrogen bonding force; more preferably van der Waals force, Coulomb force, hydrophobic bonding force and hydrogen bonding force; furthermore preferably van der Waals force and Coulomb force; and especially preferably van der Waals force.

Specifically, for example, a method in which a dye having an aromatic group, or a cationic dye having an aromatic group is used in combination with an anionic dye, described in JP-A-10-239789; a method in which a dye having a polyvalent charge described in JP-A-10-171058 is used; a method in which a dye having a hydrophobic group described in JP-A-10-186559 is used; a method in which a dye having a coordinate bond group described in JP-A-10-197980 is used; a method in which a dye having a trinuclear basic nuclear described in JP-A-2001-5132 is used; a method in which a dye having a particular hydrophilic/hydrophobic property described in JP-A-2001-13614 is used; a method in which a specific intramolecular basic-type dye described in JP-A-2001-75220 is used; a method in which a specific dye except for cyanine dyes described in JP-A-2001-75221 is used; a method in which a dye having an acid dissociating group having specific pKa described in JP-A-2001-152038 is used; a method in which a dye having a specific hydrogen bonding group described in JP-A-2001-166413, JP-A-2001-323180 or JP-A-2001-337409 is used; a method in which a dye having a specific fluorescence quantum efficiency described in JP-A-2001-209143 is used; a method in which a specific discoloring dye described in JP-A-2001-264913 is used; a method in which a dye incorporated in a gel matrix described in JP-A-2001-343720 is used; a method in which a specific infrared dye described in JP-A-2002-23294 is used; a method in which a dye having a specific potential described in JP-A-2002-99053 is used; and a method in which a specific cationic dye described in European Patent No. 0985964, 0985965, 0985966, 0985967, 1085372, 1085373, 1172688 or 1199595.

The strength of the interaction with a sensitizing dye is not particularly limited, as long as it is strong enough to reduce the residual color, but it is preferable that the interaction is strong. The term "they are bonded with each other" means that a dye chromophore is bound by these attractive forces. The term "interaction" means that the compound of the present invention interacts with a sensitizing dye by the attractive force. The energy of the attractive force ($\Delta G$) is preferably 15 kJ/mol or more, more preferably 20 kJ/mol or more, and especially preferably 40 kJ/mol or more. The upper limit thereof is not particularly limited, but preferably 5,000 kJ/mol or less, and more preferably 1,000 kJ/mol or less.

The energy of the attractive force between the compound of the present invention and a sensitizing dye can be estimated by an association constant K, in equilibrium of formation of the association product represented by equation (1) described below, between the compound of the present invention (DA) and a sensitizing dye (dye). Equation (1) is based on the assumption that the compound of the present invention (DA) and the sensitizing dye (dye) reacts in a ratio of 1:1, to form one association product (DA·dye). In many cases, this equation can be used. When the association product is formed in another ratio, the calculating equation also changes. However, since there is no fundamental difference between them, all association products are handled as 1:1 association products in the present invention. The association constant can be calculated according to an ordinary principle of the equilibrium constant that is described in many textbooks (for example, Kouichiro KAYAMA, *Kagaku Netsurikigaku* (*Chemical thermodynamics*), Agune Technical Center (2002)). Examples of the calculation are explained in detail below.

Equation (1)

$$\mathrm{DA} + \mathrm{dye} \overset{K}{\rightleftharpoons} \mathrm{DA{\cdot}dye}$$

Hereinafter, assuming that the concentration of the compound of the present invention that does not take part in formation of the association product is taken as [DA], the concentration of the sensitizing dye that does not take part in formation of the association product is taken as [dye], and the concentration of the association product is taken as [DA·dye], the association constant K is represented by Equation (2).

$$K = \frac{[DA\cdot\mathrm{dye}]}{[DA][\mathrm{dye}]} \quad \text{Equation (2)}$$

Assuming that the total concentration of the compound of the present invention in the solution is taken as $[DA]_0$, and the total concentration of the sensitizing dye in the solution is taken as $[\mathrm{dye}]_0$, Equation (2) is modified as described below.

$$K = \frac{[DA\cdot\mathrm{dye}]}{([\mathrm{dye}]_0 - [DA\cdot\mathrm{dye}])([DA]_0 - [DA\cdot\mathrm{dye}])} \quad \text{Equation (3)}$$

In the case of $[DA]_0 \gg [DA\cdot\mathrm{dye}]$, Equation (3) can be approximated to Equation (4).

$$K = \frac{[DA\cdot\mathrm{dye}]}{([\mathrm{dye}]_0 - [DA\cdot\mathrm{dye}])[DA]_0} \quad \text{Equation (4)}$$

Based on the equation (4), the concentration of the association product [DA·dye] is represented by Equation (5).

$$[DA\cdot\mathrm{dye}] = \frac{[DA]_0 K}{1 + [DA]_0 K}[\mathrm{dye}]_0 \quad \text{Equation (5)}$$

The solution absorption spectrum of the association product (DA·dye) obtained from the compound of the present invention and a sensitizing dye shifts from the solution absorption spectrum of the sensitizing dye alone without addition of the compound of the present invention. Accordingly, the specific wavelength at which an absorption spectrum shifts largely is employed as a measuring wavelength, so that the change of absorbance at the specific wavelength can be measured.

A can be calculated by equation (6), using equation (5), assuming that absorbance at the specific wavelength is taken as A, when a mixture solution containing the compound of the present invention and a sensitizing dye is measured using, for example, a cell having an optical path length of 1 cm.

$$A = \varepsilon_c[DA\cdot\mathrm{dye}] + \varepsilon_s([\mathrm{dye}]_0 - [DA\cdot\mathrm{dye}]) \quad \text{Equation (6)}$$

$$= \left\{\frac{\varepsilon_c[DA]_0 K}{1 + [DA]_0 K} + \frac{\varepsilon_8}{1 + [DA]_0 K}\right\}[\mathrm{dye}]_0$$

In equation (6), $\epsilon_s$ represents a molar extinction coefficient of the sensitizing dye alone at the measuring wavelength, and $\epsilon_c$ represents a molar extinction coefficient of an association product at the measuring wavelength.

Beside, the absorbance $A_0$ of the solution containing only a sensitizing dye at the measuring wavelength is represented by equation (7).

$$A_0 = \varepsilon_s([\mathrm{dye}]_0 - [DA\cdot\mathrm{dye}]) \quad \text{Equation (7)}$$

$$= \frac{\varepsilon_s}{1 + [DA]_0 K}[\mathrm{dye}]_0$$

From equation (6)–equation (7), can be obtained equation (8).

$$A - A_0 = \frac{\varepsilon_c[DA]_0 K[\mathrm{dye}]_0}{1 + [DA]_0 K} \quad \text{Equation (8)}$$

Accordingly, $$\frac{1}{A - A_0} = \frac{1 + [DA]_0 K}{\varepsilon_c[DA]_0 K[\mathrm{dye}]_0} \quad \text{Equation (9)}$$

$$= \frac{1}{\varepsilon_c[\mathrm{dye}]_0 K}\left(\frac{1}{[DA]_0}\right) + \frac{1}{\varepsilon_c[\mathrm{dye}]_0}$$

From equation (9), it can be understood that a reciprocal of the amount of change in absorbance at the measuring wavelength is plotted to a reciprocal of the total concentration of the compound of the present invention in the solution, to obtain a straight line. When a gradient of the straight line is taken as "a", and an intercept of the straight line is taken as "b", respectively, a and b each are represented by equation (10).

$$a = \frac{1}{\varepsilon_c[\mathrm{dye}]_0 K},\ b = \frac{1}{\varepsilon_c[\mathrm{dye}]_0} \quad \text{Equation (10)}$$

$$K = \frac{b}{a}$$

The association constant K can be calculated from a ratio of the intercept to the gradient.

An example of specific measuring conditions for the association constant is described below. As a solvent for use in measurement, a mixed solvent of a solution (minutely adjusted to pH=10.05 with sulfuric acid) obtained by dissolving 38.2 g of potassium carbonate and 4.2 g of sodium bicarbonate in 1 liter of water, and methanol, in a mixture ratio of 3:1, was used. In the solvent, the sensitizing dye 1 described below and the compound of the present invention were dissolved, to become the concentration shown in the following table, to prepare samples.

Sensitizing Dye 1

Sensitizing dye 1

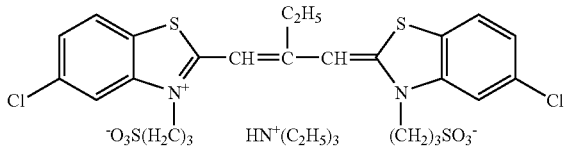

TABLE 1

| Sample No. | Concentration of sensitizing dye 1 ($[dye]_0$) | Total concentration of the compound of the present invention in the solution ($[DA]_0$) | Reciprocal of the total concentration of the compound of the present invention in the solution($1/[DA]_0$) |
|---|---|---|---|
| 1 | $5.0 \times 10^{-6}$ | 0 | — |
| 2 | $5.0 \times 10^{-6}$ | $6.3 \times 10^{-6}$ | $1.59 \times 10^{5}$ |
| 3 | $5.0 \times 10^{-6}$ | $1.25 \times 10^{-5}$ | $8.0 \times 10^{4}$ |
| 4 | $5.0 \times 10^{-6}$ | $3.13 \times 10^{-5}$ | $3.19 \times 10^{4}$ |
| 5 | $5.0 \times 10^{-6}$ | $6.25 \times 10^{-5}$ | $1.6 \times 10^{4}$ |
| 6 | $5.0 \times 10^{-6}$ | $1.25 \times 10^{-4}$ | $8.0 \times 10^{3}$ |

The absorption spectra of respective samples were measured at 25° C. The absorbance at 570 nm of sample 1 is subtracted from each absorbances at 580 nm of samples 2 to 6, and then reciprocals of the thus-obtained values were calculated. The thus-obtained values were plotted to a reciprocal of the total concentration of the compound of the present invention in a solution, to obtain a correlation straight line. Using the straight line, an association constant can be calculated from division of the intercept by the gradient.

The each values of logK of compounds (C-5) and (A-10) of the present invention that were measured under the above-condition were 4.5 and 4.3, respectively.

The value of the above-mentioned logK of the compound of the present invention is preferably in the range of from 1 to 10, more preferably in the range of from 3 to 9, and especially preferably in the range of from 4 to 8.

It is preferable that the hydrophilic/hydrophobic property of the compound of the present invention is identical to that of a sensitizing dye reducing residual color or more hydrophilic than that of the sensitizing dye. However, the compound having two or more sulfo groups is not preferable, because the compound has such a high hydrophilic nature that it dissolves too rapidly from the photosensitive material at the time of photographic processing. Further, the compound having one sulfo group is not preferable, because of its high hydrophilic nature.

The hydrophilic/hydrophobic property can be calculated from the octanol/water partition coefficient (logP) of a compound. A model for calculating an approximate value of logP (hereinafter referred to as logP calculation value) can be used. In the present invention, logP according to the above calculation value is used.

In the present invention, the logP calculation value can be obtained using a CLOGP program of Hansch-Leo (U.S.A. Daylight Chemical Information System Corporation) (version is: algorithm=4.01, and fragment database=17(*3)).

With respect to the compound of the present invention, logP calculation value is preferably from −1 to 10, further preferably from 0 to 8, and especially preferably from 1 to 5.

The logP calculation value of the compound of the present invention is measured taking the condition of neutrality (pH=7) as a standard. Herein, it is assumed that a carboxyl group of the compound of the present invention dissociates in the above-described condition. The logP calculation value of compound (C-5) of the present invention is 3.4.

The pKa value of the compound of the present invention was measured according to the following method. To 100 milliliters (hereinafter, milliliters may be abbreviated to "mL") of a tetrahydrofuran/water solution (mass ratio of 6:4) in which 0.01 mmol of a compound of the present invention dissolved, 0.5 mL of a 1N sodium chloride is added. The resultant solution is titrated with a 0.5N aqueous potassium chloride solution, with stirring in a nitrogen gas atmosphere. Using a titration curve in which a drop amount of the aqueous potassium chloride solution is set at the horizontal axis, and a pH value is set at the longitudinal axis, the pH corresponding to the central position of an inflection point of the titration curve is defined as pKa. When the compound has multiple dissociation sites, there are multiple inflection points, and therefore multiple pKa values can be calculated. Further, the inflection point can also be determined by monitoring the ultraviolet and visible absorption spectra of the compound, to examine a change of the absorption.

As a silver halide emulsion for use in the present invention, for example, silver chloride, silver iodochloride, silver chlorobromide, silver bromide, silver iodobromide, or silver chloro(iodo)bromide emulsions may be used. It is preferable for a rapid processing to use, as a color paper, a silver chloride, silver chlorobromide, silver chloroiodide, or silver chlorobromoiodide emulsion having a silver chloride content of 95 mol % or greater and a silver iodide content of 1.0 mol % or less, and more preferably a silver chloroiodide, or silver chlorobromoiodide emulsion having a silver chloride content of 97 mol % or greater and a silver iodide content of 0.5 mol % or less. Preferred of these silver halide emulsions are those having, in the shell parts of silver halide grains, a silver iodide phase with a silver iodide content of 0.05 to 0.75 mol %, more preferably 0.1 to 0.40 mol % and/or a silver bromide phase with a silver bromide content of 0.05 to 4 mol %, more preferably 0.5 to 3 mol %, per mol of the total silver, in view of high sensitivity and excellent high illumination intensity exposure suitability.

As a color negative film, silver iodobromide, silver iodobromochloride, silver bromochloride, or silver iodochloride is preferable, and silver iodobromide, or silver iodochlorobromide is more preferable. When silver iodochloride is used, silver chloride may be contained therein, but the content of silver chloride is preferably 8 mol % or less, and more preferably 3 mol % or less, or 0 mol %. The content of silver iodide is preferably 20 mol % or less because a coefficient of deviation of the grain size distribution is preferably 25% or less. Reduction in the content of silver iodide makes it easy to minimize a coefficient of deviation of the grain size distribution of a tabular grain emulsion. Particularly, the coefficient of deviation of the grain size distribution of a tabular grain emulsion is preferably 20% or less, and the content of the silver iodide is preferably 10 mol % or less. Regardless the content of the silver iodide, a coefficient of deviation of the intergranular silver iodide content distribution is preferably 20% or less, and especially preferably 10% or less. Further, as the silver iodide distribution in the emulsion, it is preferable that a structure of silver iodide is formed in a grain. In this case, the structure of the silver iodide distribution may be a double structure, a triple structure, a quadruple structure, or larger multilayer structures.

Examples of the silver halide grains in the silver halide emulsion include one having a regular crystal form such as a cube, octahedron, or tetradecahedron; an irregularly crystal form such as a sphere or a tabular shape; or one having a crystal defect such as twin planes, and a complex made up of the foregoing. The silver halide grains are preferably cubic or tetradecahedral crystal grains substantially having {100} planes (these grains may be rounded at the apexes thereof and further may have planes of higher order), or octahedral crystal grains. Alternatively, a silver halide emulsion in which the proportion of tabular grains having an aspect ratio of 2 or more and composed of {100} or {111} planes accounts for 50% or more in terms of the total projected area, can also be preferably used. When the silver halide grain is a tabular grain, a silver halide emulsion in which the proportion of tabular grains having an aspect ratio of 8 or more, more preferably 12 or more accounts for 50% or more in terms of the total projected area, can be further preferably used. The upper limit of the aspect ratio is not particularly restricted, but it is generally 200 or less, preferably 100 or less. The term "aspect ratio" refers to the value obtained by dividing the diameter of the circle having an area equivalent to the projected area of an individual grain by the thickness of the grain. In the present invention, it is preferable to use cubic grains or tabular grains whose main face is a {100} or {111} face.

As for the side face connecting {111} major faces opposite each other, of the tabular grain, 75% or less of the total side face is preferably composed of {111} faces. The phrase "75% or less of the total side face is composed of {111} faces" means that crystallographic faces (for example, {110} face and more higher exponential faces) other than {111} face exist in a tabular grain at a rate of more than 25% of the total side face. If 70% or less of the total side face is composed of {111} face, the effects of the present invention are remarkable. It is possible to make 75% or less of the total side face to be {111} faces by a known method.

Examples of the silver halide solvent that can be used in the present invention include (a) organic thioethers described, for example, in U.S. Pat. Nos. 3,271,157, 3,531,289, and 3,574,628, and JP-A-54-1019 and JP-A-54-158917; (b) thiourea derivatives described, for example, in JP-A-53-82408, JP-A-55-77737, and JP-A-55-2982; (c) silver halide solvents having a thiocarbonyl group between an oxygen atom or a sulfur atom, and a nitrogen atom, as described in JP-A-53-144319; (d) imidazoles described in JP-A-54-100717; (e) ammonia; and (f) thiocyanates. Particularly preferable solvents are thiocyanates, ammonia and tetramethylthiourea. The amount of the solvent to be used varies depending on the type of the solvent, and in the case of thiocyanates, the amount to be used is preferably $1\times10^{31}$ 4 mol or more, but $1\times10^{-2}$ mol or less, per mol of the silver halide.

A method for changing an index of a plane of the side face in a tabular grain emulsion described in European patent No. 515894 or the like can be referred to. In addition, Polyalkyleneoxide compounds described in U.S. Pat. No. 5,252,453 may be also used. As an effective method, an agent for improving index of a plane as described in U.S. Pat. Nos. 4,680,254, 4,680,255, 4,680,256 and 4,684,607 can be used. Ordinary photographic spectral sensitizing dyes can be also used as the agent for improving index of a plane as mentioned above.

In the present invention, tabular grain emulsions may be prepared according to various methods, so long as the above-mentioned requirements are satisfied. The preparation of the tabular grain emulsion fundamentally consists of three steps, namely, nucleation, ripening and growth. In the step of nucleation of the tabular grain emulsion for use in the present invention, it is extremely advantageous to employ a gelatin of low methionine content as described in U.S. Pat. Nos. 4,713,320 and 4,942,120; to carry out nucleation at high pBr as described in U.S. Pat. No. 4,914,014; and to carry out nucleation within a short period of time as described in JP-A-2-222940. In the step of ripening the tabular grain emulsion of the present invention, it is advantageous, in some cases, to carry out ripening in the presence of low-concentration base as described in U.S. Pat. No. 5,254,453, and to carry out ripening at high pH as described in U.S. Pat. No. 5,013,641. In the step of growth of the tabular grain emulsion for use in the present invention, it is extremely advantageous to carry out the growth at a low temperature as described in U.S. Pat. No. 5,248,587; and to employ silver iodide fine particles as described in U.S. Pat. Nos. 4,672,027 and 4,693,964. Further, a method of growing the tabular grain emulsion, in which silver bromide, silver iodobromide or silver chloroiodobromide fine grain emulsion is added, and the mixture is ripened, is also preferably used. The above-mentioned fine grain emulsion can be provided using the agitating apparatus described in JP-A-10-43570.

When the emulsion for use in the present invention is a high silver chloride emulsion containing silver iodide and/or silver bromide, in order to introduce iodide ions and/or bromide ions, an iodide and/or bromide salt solution may be added alone, or such an iodide and/or bromide salt solution may be added in combination with both a silver salt solution and a high chloride salt solution. In the latter case, the iodide and/or bromide salt solution and the high chloride salt solution may be added separately or as a mixed solution of these salts of iodide and/or bromide, and high chloride. The iodide and/or bromide salt is generally added in the form of a soluble salt, such as alkali or alkali earth iodide salt. Alternatively, iodide ions may be introduced by cleaving iodide ions from an organic molecule, as described in U.S. Pat. No. 5,389,508. Further, as another source of iodide ions, fine silver iodide grains may be used. It is preferred that the emulsion for use in the present invention, when it contains silver iodide and silver bromide, has the maximum concentrations of iodide and bromide ions at the surface of the grain, and the iodide and bromide ion concentrations decrease inwardly in the grain, by analysis with the etching/TOF-SIMS method.

When the emulsion for use in the present invention contains a silver bromide localized phase, the emulsion preferably contains a silver bromide-rich layer having a silver bromide content of at least 10 mol %, and the silver bromide localized phase is particularly preferably formed by epitaxial growth of the localized phase having a silver bromide content of at least 10 mol % on the grain surface. It is preferable that the silver bromide content of the silver bromide localized phase is in the range of 1 to 60 mol %, and the silver bromide localized phase is composed of silver having population of 0.1 to 20 mol % to the amount of entire silver constituting silver halide grains; it is more preferable that the silver bromide content is 20 to 50 mol %, and that the silver bromide localized phase is composed of silver having population of 0.5 to 7 mol %; and it is most preferable that silver bromide content is 30 to 40 mol %, and that the silver having population of 1 to 5 mol %. The silver bromide content of the silver bromide-rich layer can be measured and analyzed by a known method. Silver halide grains having a silver iodide-rich layer are also preferable, and those having a silver bromide-rich layer as well as a silver iodide-rich layer are more preferable. It is necessary, from the viewpoints of pressure properties and dependency on the composition of a processing solution, that the silver bromide-rich layer is disposed in the vicinity of the grain surface. The term "the vicinity of the grain surface" refers to the region within ⅕, preferably within 1/10, of the grain size (sphere-equivalent diameter) of the silver halide grain, when measured from the outermost surface. The most preferable disposition of the silver bromide-rich layer is that a silver bromide-localized phase having a silver bromide content of more than 10 mol % and being formed by epitaxial growth is present on the corner portion of a cubic or tetradecahedral silver chloride particle.

The silver bromide-localized phase is doped with complex ions of a metal of the Group VIII, such as iridium (III) chloride, iridium (III) bromide, iridium (IV) chloride, sodium hexachloro iridate (III), potassium hexachloro iridate (IV), hexaamine iridate (IV) salt, trioxalato iridate (III) salt, and trioxalato iridate (IV) salt. The amount of these compounds to be added can be varied in a wide range depending on the purposes, and it is preferably in the range of $10^{-9}$ to $10^{-2}$ mol, per mol of the silver halide.

As the structure of emulsion grains for use in the present invention, triple structure grains consisting of, for example, (silver bromide)/(silver iodobromide)/(silver bromide), and also more multi-structure grains are preferable. The boundary of silver iodide contents between the structures may be definite, or the silver iodide content may change continuously and gradually. Generally, in the measurement of the silver iodide content according to powder X-ray diffraction method, two definite peaks different in the silver iodide content are not observed, but a X-ray diffraction profile like a trail in the direction of the higher silver iodide content is seen.

In the present invention, transition metal ions may be added in the process of formation and/or growth of the silver halide grains, to incorporate the metal ions inside and/or on the surface of the silver halide grains. As the metal ion to be used, a transition metal is preferable. Among these, iron, ruthenium, irridium, osmium, lead, cadmium or zinc is preferable. It is more preferable that these metal ions are used in the form of a six-coordination complex of octahedron-type having ligands. When employing an inorganic compound as a ligand, cyanide ion, halide ion, thiocyanato, hydroxide ion, peroxide ion, azide ion, nitrite ion, water, ammonia, nitrosyl ion, or thionitrosyl ion is preferably used. Such a ligand is preferably coordinated to any metal ion selected from the group consisting of the above-mentioned iron, ruthenium, irridium, osmium, lead, cadmium and zinc. Two or more kinds of these ligands are also preferably used in one complex molecule. Further, an organic compound can also be preferably used as a ligand. Preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in the molecule as an atom which is capable of coordinating to a metal. Most preferred organic compounds are furan, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

Preferable combinations of a metal ion and a ligand are those of iron and/or ruthenium ion and cyanide ion. Preferred of these compounds are those in which the number of cyanide ions accounts for the majority of the coordination number intrinsic to the iron or ruthenium that is the central metal. The remaining sites are preferably occupied by thiocyan, ammonia, water, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. These complexes having cyanide ion ligands are preferably added, during grain formation, in an amount of $1\times10^{-8}$ mol to $1\times10^{-2}$ mol, most preferably $1\times10^{-6}$ mol to $5\times10^{-4}$ mol, per mol of silver. In the case that iridium is used as a central metal, preferable ligands are fluoride, chloride, bromide and iodide ions. Among these ligands, chloride and bromide ions are more preferably used. Specifically, preferable iridium complexes are the following compound: $[IrCl_6]^{3-}$, $[IrCl_6]^{2-}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$, and $[IrBr_3(H_2O)_3]^{+}$. These iridium complexes are preferably added, during grain formation, in an amount of $1\times10^{-10}$ mol to $1\times10^{-3}$ mol, most preferably $1\times10^{-8}$ mol to $1\times10^{-5}$ mol, per mol of silver. In the case that ruthenium and osmium is used as a central metal, nitrosyl ion, thionitrosyl ion, or water molecule along with chloride ion are preferably used as ligands in combination. More preferably, these ligands form a pentachloronitrosyl complex, a pentachlorothionitrosyl complex, or a pentachloroaquo complex. The formation of a hexachloro complex is also preferred. These complexes are preferably added, during grain formation, in an amount of $1\times10^{-10}$ mol to $1\times10^{-6}$ mol, more preferably $1\times10^{-9}$ mol to $1\times10^{-6}$ mol, per mol of silver.

In the silver halide emulsion for use in the present invention, an ordinary dopant that is known to be useful to the silver halide emulsion, may be used. Examples of the ordinary dopant include Fe, Co, Ni, Ru, Rh, Pd, Re, Os, Ir, Pt, Au, Hg, Pb, and Tl. In the present invention, a hexacyano iron (II) complex and a hexacyano ruthenium complex (hereinafter may be referred to as "metal complex") are preferably used.

The metal complexes are preferably added in an amount of $10^{-7}$ mol or more, but $10^{-3}$ mol or less, more preferably $1.0\times10^{-5}$ mol or more, but $5\times10^{-4}$ mol or less, per mol of silver halide.

The metal complex for use in the present invention may be added and incorporated in any step of preparation of silver halide grains, that is, before and after nucleation, growth, physical ripening, or chemical ripening. The metal complex may be separately added and incorporated in several times. However, 50% or more of the total metal complex incorporated in the silver halide grain is preferably located in the layer within a half in terms of silver amount, from the outermost surface of the silver halide grain. On the outer side of the above-mentioned metal complex-containing layer apart from a support, a layer containing no metal complex may be provided.

In the present invention, the above-mentioned complexes are preferably dissolved in water or a proper solvent and added directly to the reaction solution at the time of silver halide grain formation; or added to an aqueous halide solution, an aqueous silver salt solution or other solution for forming silver halide grains, so that they are doped to the inside of the silver halide grains. Furthermore, it is also preferable to employ a method in which a metal complex is incorporated into the silver halide grains by adding and dissolving silver halide fine grains doped with metal complex in advance, and depositing them on another silver halide grains. Further, these methods may be combined, to incorporate the complex into the inside of the silver halide grains.

The hydrogen ion concentration in a reaction solution to which a metal complex is added, is preferably 1 or more, but 10 or less; more preferably 3 or more, but 7 or less, in term of pH.

In the present invention, it is preferable to use a compound useful to increase sensitivity of a silver halide photographic photosensitive material, as described, for example, in EP 1016902 A2, US 2002/0042033A, and U.S. Pat. No. 6,319,660 B1.

In the case where these complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively, they are also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening in the presence of fine grains having complexes incorporated therein to modify the grain surface phase. Further, these methods may be used in combination. Two or more kinds of complexes may be incorporated in the inside of an individual silver halide grain. The halogen composition at the place where the above complex is incorporated is not limited in particular. Accordingly, it is preferable that the complex is incorporated in any of a silver chloride layer, a silver chlorobromide layer, a silver bromide layer, a silver iodochloride layer and a silver iodobromide layer.

The average equivalent-circle diameter of the tabular silver halide grains contained in the emulsion for use in the present invention, is preferably in the range of from 0.1 to 10.0 μm, more preferably in the range of from 0.1 to 5.0 μm. The term "equivalent-circle diameter" means a diameter of a circle having an area equivalent to the projected area of parallel major faces of the grain. The projected area of the grain is obtained by measuring the area on an electron microscopic photograph and correcting through a photographic magnification. In the case of non-tabular grains, the average equivalent-sphere diameter thereof is preferably in the range of from 0.1 to 5.0 μm, more preferably in the range of from 0.6 to 2.0 μm. The term "equivalent-sphere diameter" means a diameter of a sphere having the same volume as the grain. The photographic emulsion in these ranges is most excellent in a relation of sensitivity/granularity ratio. In the case of tabular grains, the average thickness thereof is preferably in the range of from 0.05 to 1.0 μm. The term "average equivalent-circle diameter" means an average value of equivalent-circle diameters of at least 1,000 grains arbitrarily collected from a uniform emulsion. The average thickness is also measured in the same manner as described above. As the silver halide grains in the emulsion for use in the present invention, their grain size distribution may be monodispersion or multidispersion, but the monodispersion is preferred. With respect to the distribution of sizes of these grains, so called monodisperse emulsion having a variation coefficient (the value obtained by dividing the standard deviation of the grain size distribution by the average grain size) of 20% or less, more preferably 15% or less, and further preferably 10% or less, is preferred. For obtaining a wide latitude, it is also preferred to blend the above-described monodisperse emulsions in the same layer, or to form a multilayer structure using the monodisperse emulsions.

In the emulsion for use in the present invention, it is preferable to introduce positive hole-trapping silver nuclei therein by an intentional reduction sensitization. The term "intentional reduction sensitization" means a reduction sensitization carried out by adding a reduction-sensitizing agent. The positive hole-trapping silver nuclei means tiny silver nuclei having a week developing activity. The recombination loss in the process of sensitization can be prevented by the positive hole-trapping silver nuclei, so that sensitivity of the emulsion can be enhanced. The positive hole-trapping silver nuclei can be introduced by a method in which a reduction sensitization is carried out during grain formation of the silver halide emulsion.

The silver halide emulsion for use in the present invention may be subjected to reduction sensitization during grain formation; after grain formation, but before or during chemical sensitization; or after chemical sensitization.

As the reduction sensitization, any one of a method in which a reduction sensitizing agent is added to a silver halide emulsion; a so-called silver ripening method in which a silver is grown or ripened in the low pAg atmosphere with pAg of 1 to 7; and a so-called high-pH ripening method in which growth or ripening is carried out in the high pH atmosphere with pH of 8 to 11, may be selected. Further, two or more of those methods may be used in combination.

The above method in which a reduction-sensitizing agent is added to a silver halide emulsion is preferable from the point that the revel of reduction sensitization can be delicately controlled.

Examples of effective reduction-sensitizing agents include stannous salts, ascorbic acid and its derivatives, amines, polyamines, hydrazine derivatives, formamidine sulfinic acids, thiourea dioxide, silane compounds, borane compounds, dihydroxybenzenes and their derivatives, and hydroxyamines and their derivatives. The reduction-sensitizing agent for use in the present invention may be selected from these compounds, and two or more kinds of compounds may be used in combination. Preferable reduction-sensitizing agents for use in the present invention are stannous chloride, thiourea dioxide, dimethylamine borane, hydroxylamines and their derivatives, dihydroxybenzenes and their derivatives, and ascorbic acid and its derivatives. Of the dihydroxybenzenes and their derivatives, preferable reduction-sensitizing agents are compounds represented by formula (V-1) and/or formula (V-2).

Formula (V-1)

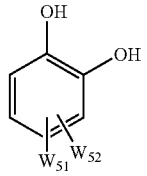

-continued

Formula (V-2)

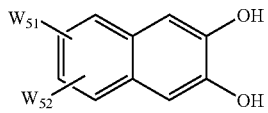

In formula (V-1) and formula (V-2), $W_{51}$, $W_{52}$ each independently represent a sulfo group or a hydrogen atom, providing that at least one of $W_{51}$ and $W_{52}$ is a sulfo group. The sulfo group is generally a water-soluble salt, such as an alkali metal salt (e.g., sodium salt, potassium salt), or an ammonium salt. Specifically, examples of preferable compounds include di-sodium 4,5-dihydroxybenzene-1,3-disulfonate, a 4-sulfocatechol ammonium salt, a 2,3-dihydroxy-7-sulfonaphthalene sodium salt, and a 2,3-dihydroxy-6,7-disulfonaphthalene potassium salt. The most preferable compound is di-sodium 4,5-dihydroxybenzene-1,3-disulfonate. A preferable addition amount of the compound varies, depending on, for example, the temperature, pBr and pH in the addition system; the kind and concentration of a protective colloid agent such as gelatin; and the presence or absence, kind and concentration of a silver halide solvent. The addition amount is generally in the range of from 0.0005 to 0.5 mol, and preferably in the range of from 0.003 to 0.05 mol, per mol of the silver halide.

The hydroxyamines and their derivatives preferable as a reduction-sensitizing agent are compounds represented by formula (A1).

Ra-N(Rb)OH Formula (A1)

In the formula (A1), Ra represents an alkyl group, an alkenyl group, an aryl group, an acyl group, a carbamoyl group, a sulfamoyl group, an alkoxycarbonyl group, an aryloxycarbonyl group, an alkylsulfonyl group, an arylsulfonyl group, or a heterocyclic group. Rb represents a hydrogen atom or a group represented by Ra.

Ra may be further substituted by a substituent. Examples of the substituent include an alkyl group, an alkenyl group, an aryl group, a heterocyclic group, a hydroxy group, an alkoxy group, an aryloxy group, an alkylthio group, an arylthio group, an amino group, an acylamino group, a sulfonamido group, an alkylamino group, an arylamino group, a carbamoyl group, a sulfamoyl group, a sulfo group, a carboxyl group, a halogen atom, a cyano group, a nitro group, a sulfonyl group, an acyl group, an alkoxycarbonyl group, an aryloxycarbonyl group, an acyloxy group, a hydroxyamino group, and the like.

Ra is preferably a heterocyclic group. Examples thereof include 1,3,5-triazine-2-yl, 1,2,4-triazine-3-yl, pyridine-2-yl, pyrazinyl, pyrimidinyl, purinyl, quinolyl, imidazolyl, thiazolyl, oxazolyl, 1,2,4-triazole-3-yl, benzimidazole-2-yl, benzthiazolyl, benzoxazolyl, thienyl, furyl, imidazolidinyl, pyrrolinyl, tetrahydrofuryl, morpholinyl and phosphonoline-2-yl groups.

Rb is preferably a hydrogen atom or an alkyl group, more preferably a hydrogen atom or a methyl group.

Specific examples of the compounds represented by formula (A1) are RS-I to RS-X described below.

RS-I

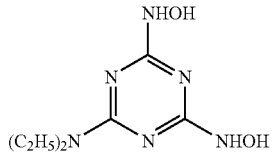

RS-II

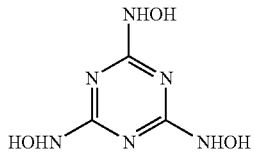

RS-III

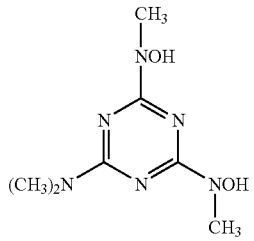

RS-IV

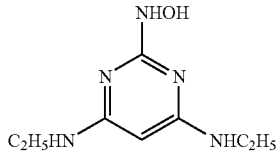

RS-V

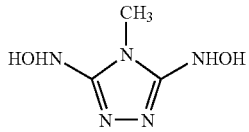

RS-VI

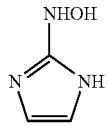

RS-VII

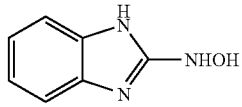

RS-VIII

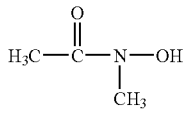

RS-IX

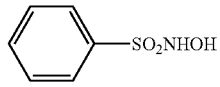

RS-X

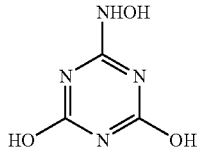

The addition amount of the reduction-sensitizing agent varies depending on the conditions of producing emulsions, and therefore it is necessary to determine an optimal addition amount thereof. A proper addition amount is generally in the range of from $10^{-7}$to $10^{-3}$ mol per mol of the silver halide. A reduction sensitizer may be added during the formation of silver halide grains, in the form of a solution having the reduction sensitizer dissolved in water or such a solvent as alcohols, glycols, ketones, esters, and amides.

The reduction sensitizer may be added to a reaction vessel in advance, but preferably the reduction sensitizer is added at any proper stage during the formation of grains. Alternatively, use can be made of a method in which the reduction sensitizer is added to an aqueous solution of a water-soluble silver salt, or a water-soluble alkali halide in advance, and then silver halide grains are precipitated using these aqueous solutions. Further, a method in which a solution of the reduction sensitizer is added in parts and/or successively for a long period of time during the formation of silver halide grains, is also preferred.

In the present invention, preferably an oxidizing agent for silver is added during the process of the production of the emulsion. The oxidizing agent for silver refers to a compound that acts on metal silver to convert it to silver ions. Particularly useful is a compound that converts quite fine silver grains, which are concomitantly produced during the formation of silver halide grains and during the chemical sensitization, to silver ions. The thus produced silver ions may form a silver salt that is hardly soluble in water, such as a silver halide, silver sulfide, and silver selenide, or they may form a silver salt that is readily soluble in water, such as silver nitrate. The oxidizing agent for silver may be inorganic or organic. Examples of inorganic oxidizing agents include ozone, hydrogen peroxide and its adducts (e.g. $NaBO_2.H_2O_2.3H_2O$, $2NaCO_3.3H_2O_2$, $Na_4P_2O_7.2H_2O_2$, and $2Na_2SO_4.H_2O_2.2H_2O$); oxygen acid salts, such as peroxyacid salts (e.g. $K_2S_2O_8$, $K_2C_2O_6$, and $K_2P_2O_8$), peroxycomplex compounds (e.g. $K_2[Ti(O_2)C_2O_4].3H_2O$, $4K_2SO_4.Ti(O_2)OH.SO_4.2H_2O$, and $Na_3[VO(O_2)(C_2H_4)_2].6H_2O$), permanganates (e.g. $KMnO_4$), and chromates (e.g. $K_2Cr_2O_7$); halogen elements, such as iodine and bromine; perhalates (e.g. potassium periodate), salts of metals having higher valences (e.g. potassium hexacyanoferrate (III)), and thiosulfonates.

Examples of the organic oxidizing agents include quinones, such as p-quinone; organic peroxides, such as peracetic acid and perbenzoic acid; and compounds that can release active halogen (e.g. N-bromosuccinimido, chloramine T, and chloramine B).

Further, preferable examples of the oxidizing agents for use in the present invention include inorganic oxidizing agents selected from ozone, hydrogen peroxide and its adducts, halogen elements, and thiosulfinates; and organic oxidizing agents selected from quinones.

In a preferable embodiment, the above-described reduction sensitization is effected in combination with an oxidizing agent for silver. Use can be made of a method in which reduction sensitization is effected after use of the oxidizing agent, a method in which the oxidizing agent is used after completion of the reduction sensitization, or alternatively a method in which reduction sensitization is effected in the presence of the oxidizing agent. These methods can be used in either the step of grain formation or the step of chemical sensitization.

In the present invention, the positive hole-trapping silver nuclei are preferably formed by adding a reduction-sensitizing agent after adding 50% of the total amount of silver necessary to form grains. More preferably, the positive hole-trapping silver nuclei are formed by adding a reduction-sensitizing agent after adding 70% of the total amount of silver necessary to form grains. It is also possible in the present invention to introduce the positive hole-trapping silver nuclei into the grain surface by adding a reduction-sensitizing agent after completion of grain formation. When a reduction-sensitizing agent is added during grain formation, parts of the formed silver nuclei remain inside the grain, but other parts ooze from the inside to the grain surface, thereby also to form silver nuclei on the grain surface. In the present invention, it is preferred to use the thus-oozed silver nuclei as the positive hole-trapping silver nuclei.

Further, in the present invention, in order to enhance storage stability of the silver halide emulsion, it is also preferred in the present invention to use hydroxamic acid derivatives described in JP-A-11-109576; cyclic ketones having a double bond adjacent to a carbonyl group, both ends of said double bond being substituted with an amino group or a hydroxyl group, as described in JP-A-11-327094 (particularly compounds represented by formula (S1); the description at paragraph Nos. 0036 to 0071 is incorporated herein by reference); sulfo-substituted catecols and hydroquinones described in JP-A-11-143011 (for example, 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and salts thereof); water-soluble reducing agents represented by formula (I), (II), or (III) of JP-A-11-102045.

An interval between twinning planes of the silver halide grains of the present invention is preferably 0.017 μm or less, more preferably 0.007 μm to 0.017 μm, and especially preferably 0.007 μm to 0.015 μm.

At the time of chemical sensitization of the silver halide emulsion of the present invention, a previously prepared silver iodobromide emulsion may be added and dissolved to minimize a fog formation during aging. The addition timing is not limited as long as it is during chemical sensitization. But, it is preferable that, first, a silver iodobromide emulsion is added and dissolved, and subsequently a sensitizing dye and a chemical sensitizing agent are added, in this order. The iodide content of the silver iodobromide emulsion to be used is lower than the surface iodine content of the host grains. The silver iodobromide emulsion to be added is preferably a pure silver bromide emulsion. The grain size of the silver iodobromide emulsion is not particularly limited, so long as the silver iodobromide grains are completely dissolved. But, it is preferably 0.1 μm or less, and more preferably 0.05 μm or less, in terms of equivalent-sphere diameter. The addition amount of the silver iodobromide emulsion varies depending on the host grains to be used, but, basically it is preferably 0.005 to 5 mol %, more preferably 0.1 to 1 mol %, per md of silver.

It is preferable that the light-sensitive material of the present invention contains "a compound whose one-electron oxidation product produced by one-electron oxidation reaction is capable of releasing one or more electrons".

Among these compounds, those selected from the following types 1 and 2 are preferable.

(Type 1)

A compound whose one-electron oxidization product produced by one-electron releasing oxidation reaction is further capable of releasing one or more electrons as a result of a subsequent bond cleavage reaction.

(Type 2)

A compound whose one-electron oxidization product produced by one-electron releasing oxidation reaction is further capable of releasing one or more electrons, after being subjected to a subsequent bond-forming reaction.

First, the compound of type 1 is explained.

As the compound of type 1, examples of the compound whose one-electron oxidization product produced by one-electron oxidation reaction is further capable of releasing one or more electrons as a result of a subsequent bond cleavage reaction, include so-called "one-photon two-electron sensitizing agent" or "de-protonized electron donor sensitizing agent" as described in JP-A-9-211769 (specific examples: compounds PMT-1 to S-37 described in Tables E and F on pages 28 to 32), JP-T-2001-500996 ("JP-T" means searched and published International patent application) (specific examples: compounds 1 to 74, 80 to 87, and 92 to 122), U.S. Pat. Nos. 5,747,235 and 5,747,236, European Patent No. 786692A1 (specific examples: compounds INV1 to 35), European Patent No. 893732A1, and U.S. Pat. Nos. 6,054,260 and 5,994,051. A preferable range of these compounds is the same as that described in the above-cited patent specifications.

Further, as the compound of type 1, examples of the compound whose one-electron oxidization product produced by one-electron oxidation reaction is further capable of releasing one or more electrons as a result of a subsequent bond cleavage reaction, include the compound represented by formula (1) (the same as the formula (1) described in JP-A-2003-114487), formula (2) (the same as the formula (2) described in JP-A-2003-114487), formula (3) (the same as the formula (1) described in JP-A-2003-114488), formula (4) (the same as the formula (2) described in JP-A-2003-114488), formula (5) (the same as the formula (3) described in JP-2003-114488), formula (6) (the same as the formula (1) described in JP-A-2003-75950), formula (7) (the same as the formula (2) described in JP-A-2003-75950), or formula (8) (the same as the formula (1) described in Japanese Patent Application No. 2003-25886). In addition, among compounds capable of causing a reaction represented by chemical reaction formula (1) (the same as the formula (1) described in Japanese Patent Application No. 2003-33446), the compound represented by formula (9) (the same as the formula (3) described in Japanese Patent Application No. 2003-33446) can be also included. A preferable range of these compounds is also the same as that described in the above-cited patent specifications.

The above-mentioned compounds are explained below. The details of these compounds represented by formulae (1) to (11) are described in the above-mentioned literatures and patent application specifications, and the disclosures are incorporated by reference in this specification.

Formula (1)

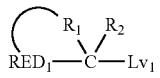

Formula (2)

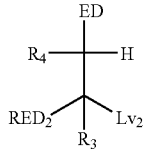

In formulae (1) and (2), $RED_1$ and $RED_2$ each represent a reducing group. $R_1$ represents a non-metallic atom group necessary to form a cyclic structure corresponding to a tetrahydro-form or hexahydro-form of a 5- or 6-membered aromatic ring (including an aromatic heterocyclic ring), together with the carbon atom (C) and the $RED_1$. $R_2$, $R_3$ and $R_4$ each represent a hydrogen atom or a substituent. $Lv_1$ and $Lv_2$ each represent a group capable of being split-off. ED represents an electron-donating group.

Formula (3)

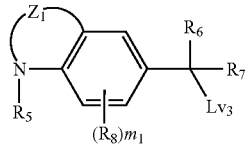

Formula (4)

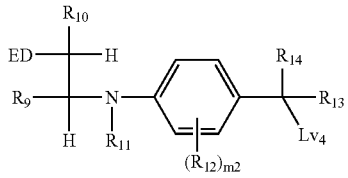

Formula (5)

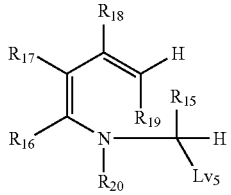

In formulae (3), (4) and (5), $Z_1$ represents an atom group necessary to form a 6-membered ring together with the nitrogen atom and the two carbon atoms of the benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$ and $R_{19}$ each represent a hydrogen atom or a substituent. $R_{20}$ represents a hydrogen atom or a substituent. However, when $R_{20}$ represents a group except for an aryl group, $R_{16}$ and $R_{17}$ bond with each other, to form an aromatic ring or an aromatic heterocyclic ring. $R_8$ and $R_{12}$ each represent a substituent that is substitutive on the benzene ring. m1 represents an integer of 0 to 3. m2 represents an integer of 0 to 4. $Lv_3$, $Lv_4$ and $Lv_5$ each represent a group capable of being split-off. ED represents an electron-donating group.

Formula (6)

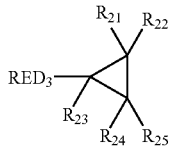

Formula (7)

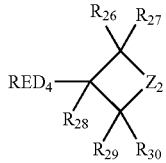

In formulae (6) and (7), $RED_3$ and $RED_4$ each represent a reducing group. $R_{21}$ to $R_{30}$ each represent a hydrogen atom or a substituent. $Z_2$ represents —$CR_{111}R_{112}$—, —$NR_{113}$— or —O—. $R_{111}$ and $R_{112}$ each represent a hydrogen atom or a substituent. $R_{113}$ represents a hydrogen atom, an alkyl group, an aryl group or a heterocyclic group.

Formula (8)

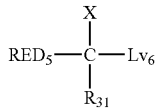

In formulae (8), $RED_5$ represents a reducing group, specifically an arylamino group or a heterocyclic amino group. $R_{31}$ represents a hydrogen atom or a substituent. X represents an alkoxy group, an aryloxy group, a heterocyclic oxy group, an alkylthio group, an arylthio group, a heterocyclic thio group, an alkylamino group, an arylamino group, or a heterocyclic amino group. $Lv_6$ represents a group capable of being split-off, specifically a carboxyl group or a salt thereof, or a hydrogen atom.

Chemical reaction formula (1)

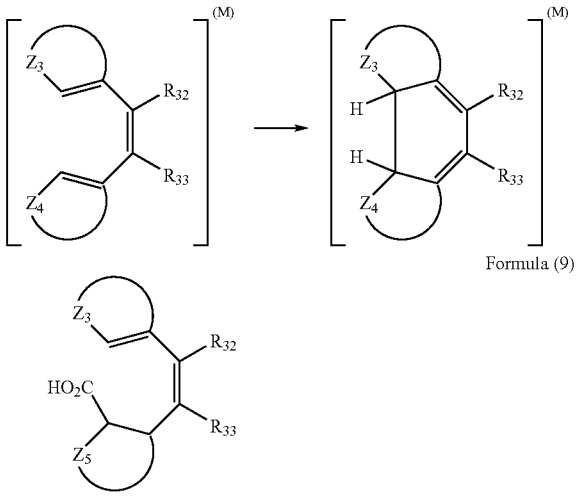

Formula (9)

The compound represented by formula (9) is a compound that causes a bond-forming reaction represented by chemical reaction formula (1) after two-electron oxidation accompanying decarboxylation. In chemical reaction formula (1), $R_{32}$ and $R_{33}$ each represent a hydrogen atom or a substituent. $Z_3$ represents a group necessary to form a 5- or 6-membered heterocyclic group together with C═C. $Z_4$ represents a group necessary to form a 5- or 6-membered aryl group or heterocyclic group together with C═C. M represents a radical, a radical cation or a cation. In formula (9), $R_{32}$, $R_{33}$ and $Z_3$ have the same meanings as those in chemical reaction formula (1). $Z_5$ represents a group necessary to form a 5- or 6-membered cyclic aliphatic hydrocarbon group or heterocyclic group together with C—C.

Next, the compound of type 2 is explained.

As the compound of type 2, examples of the compound whose one-electron oxidization product produced by one-electron oxidation reaction is further capable of releasing one or more electrons as a result of a subsequent bond-forming reaction, include the compound represented by formula (10) (the same as the formula (1) described in JP-A-2003-140287), and the compounds capable of causing a reaction represented by chemical reaction formula (1) (the same as the formula (1) described in Japanese Patent Application No. 2003-33446), and represented by formula (11) (the same as the formula (2) described in Japanese Patent Application No. 2003-33446). A preferable range of these compounds is the same as that described in the above-cited patent specifications.

$RED_6$-Q-Y Formula (10)

In formulae (10), $RED_6$ represents a reducing group to be one-electron oxidized. Y represents a reactive group containing a carbon-carbon double bond site, a carbon-carbon triple bond site, an aromatic group site, or a benzene ring-condensed non-aromatic heterocycle site that is capable of forming a new bond upon a reaction with a one-electron oxidation product of $RED_6$. Q represents a linking group connecting $RED_6$ and Y.

Chemical reaction formula (1)

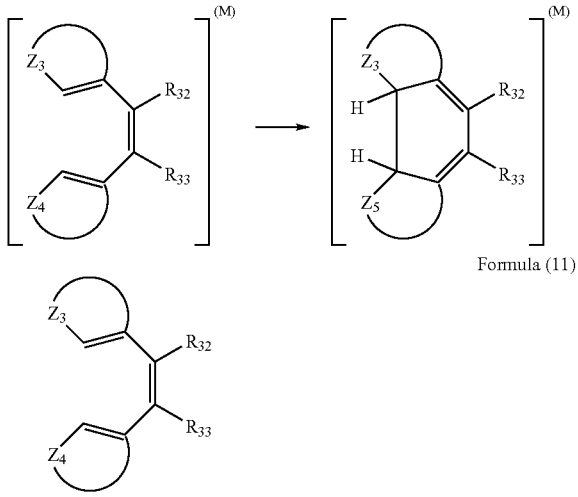

Formula (11)

The compound represented by formula (11) is a compound that causes a bond-forming reaction represented by chemical reaction formula (1) by oxidization. In chemical reaction formula (1), $R_{32}$ and $R_{33}$ each represent a hydrogen atom or a substituent. $Z_3$ represents a group necessary to form a 5- or 6-membered heterocyclic group together with C═C. $Z_4$ represents a group necessary to form a 5- or 6-membered aryl group or heterocyclic group together with C═C. $Z_5$ represents a group necessary to form a 5- or 6-membered cyclic aliphatic hydrocarbon group or heterocyclic group together with C—C. M represents a radical, a radical cation or a cation. In formula (11), $R_{32}$, $R_{33}$, $Z_3$ and $Z_4$ have the same meanings as those in chemical reaction formula (1).

Among the compound of type 1 and 2, "a compound having, in its molecule, an adsorbing group onto silver halide" or "a compound having, in its molecule, a partial structure of a spectral sensitizing dye" is preferable. The adsorbing group onto silver halide refers to groups described in JP-A-2003-156823, from page 16, right column, line 1, to page 17, right column, line 12, as a representative example. The partial structure of a spectral sensitizing dye refers to structures described in the above-mentioned JP-A-2003-156823, from page 17, right column, line 34, to page 18, left column, line 6.

Of the compounds of types 1 and 2, "a compound having, in its molecule, at least one adsorbing group onto silver halide" is more preferable, and "a compound having, in the same molecule, at least two adsorbing groups onto silver halide" is further preferable. When two or more adsorbing groups are present in a single molecule, they may be the same or different.

Preferred examples of the adsorbing group include a mercapto-substituted nitrogen-containing heterocyclic group (e.g., 2-mercaptothiadiazole group, 3-mercapto-1,2,4-triazole group, 5-mercaptotetrazole group, 2-mercapto-1,3,4-oxadiazole group, 2-mercaptobenzoxazole group, 2-mercaptobenzthiazole group, 1,5-dimethyl-1,2,4-triazolium-3-thiolate group), and a nitrogen-containing heterocyclic group having, as a partial structure of the heterocycle, a —NH— group capable of forming imino silver (>NAg) (e.g., benzotriazole group, benzimidazole group, indazole group). Of these groups, 5-mercaptotetrazole group, 3-mercapto-1,2,4-triazole group and benzotriazole group are preferable. Further, 3-mercapto-1,2,4-triazole group and 5-mercaptotetrazole group are most preferable.

As the adsorbing group, the case where two or more mercapto groups are present in the molecule, is also particularly preferable. Herein, the mercapto group (—SH) may be a thion group when the mercapto group can be subjected to tautomerism reaction. Preferable examples of the adsorbing group having two or more mercapto groups as the partial structure (e.g., dimercapto-substituted nitrogen-containing heterocyclic groups) include 2,4-dimercaptopyrimidine group, 2,4-dimercaptotriazine group and 3,5-dimercapto-1,2,4-triazole group.

Further, quarternary salt structures of nitrogen or phosphorus are also preferably used as the adsorbing group. Specific examples of the quaternary salt structure of nitrogen include an ammonio group (e.g., a trialkyl ammonio group, a dialkylaryl (or heteroaryl) ammonio group, an alkyldiaryl (or heteroaryl) ammonio group), and a group containing a nitrogen-containing heterocyclic group having a quaternary nitrogen atom. Specific examples of the quaternary salt structure of phosphorus include a phosphonio group (e.g., a trialkyl phosphonio group, a dialkylaryl (or heteroaryl) phosphonio group, an alkyldiaryl (or heteroaryl) phosphonio group, a triaryl (or heteroaryl) phosphonio group). It is more preferable to use a quaternary salt structure of nitrogen, furthermore preferable to use a 5- or 6-membered nitrogen-containing heterocyclic group having a quaternary nitrogen atom. Particularly preferably, pyridinio group, quinolinio group and isoquinolinio group are used. These nitrogen-containing heterocyclic groups having a quaternary nitrogen atom may have any substituent.

Examples of a counter anions of the quaternary salt include a halogen ion, a carboxylate ion, a sulfonate ion, a sulfate ion, a perchlorate ion, a carbonate ion, a nitrate ion, $BF_4^-$, $PF_6^-$ and $Ph_4B^-$. When a group having a negative charge such as a carboxylate group exists in the molecule, the quaternary nitrogen atom may form an inner salt together with the group having a negative charge. As counter anions that is not in the molecule, chlorine ion, bromine ion and methane sulfonate ion are particularly preferable.

A preferable structure of the compounds of type 1 or 2 having a quarternary salt structure of nitrogen or phosphorus as the adsorbing group, is represented by formula (X).

$$(P\text{-}Q_1\text{-})_i\text{-}R(\text{-}Q_2\text{-}S)_j \qquad \text{Formula (X)}$$

In formula (X), P and R each independently represent a quarternary salt structure of nitrogen or phosphorus that is not a partial structure of the sensitizing dye. $Q_1$ and $Q_2$ each independently represent a linking group, specifically a single bond, an alkylene group, an arylene group, a heterocyclic group, —O—, —S—, —$NR_N$—, —C(═O)—, —$SO_2$—, —SO—, or —P(═O)— solely or combination thereof. Herein, $R_N$ represents a hydrogen atom, an alkyl group, an aryl group, or a heterocyclic group. S represents a residual group of the compound of type 1 or type 2 from which one atom is eliminated. i and j each represent an integer of 1 or more, and they are selected so that i plus j become in the range of 2 to 6. It is preferable that i is 1 to 3, and j is 1 to 2; more preferably i is 1 or 2, and j is 1; and especially preferably i is 1, and j is 1. The compound represented by formula (X) has preferably the total carbon atoms of 10 to 100, more preferably 10 to 70, furthermore preferably 11 to 60, and especially preferably 12 to 50.

The compounds of type 1 or type 2 for use in the present invention may be used in anytime of during preparation of emulsions or production of photosensitive materials. For example, they may be used at the time of grain formation, desalting stage or chemical sensitization, or before coating. Further, these compounds may be added in parts during these stages. The timing of addition is preferably after completion of grain formation and before desalting stage, during chemical sensitization (just before starting of chemical sensitization and just after completion thereof), or before coating; and more preferably during chemical sensitization, or before coating.

It is preferable that the compounds of type 1 or type 2 for use in the present invention are dissolved in a water-soluble solvent, such as water, methanol, and ethanol, or a mixed solvent thereof, to prepare a solution; and then the solution is added. When the compound is dissolved in water, if the solubility of the compound in water tends to increase at a high or low pH, the compound may be dissolved in water at a high or low pH, to prepare a solution, thereby adding the solution.

The compounds of type 1 or type 2 for use in the present invention are preferably used in an emulsion layer. However, they may be added to a protective layer and an interlayer, in addition to an emulsion layer, so as to disperse them at a time of coating process. The timing of adding the compound of the present invention may be before or after a sensitizing dye. The amount of the compound contained in a silver halide emulsion layer is preferably $1\times10^{-9}$ to $5\times10^{-2}$ mol, and more preferably from $1\times10^{-8}$ to $2\times10^{-3}$ mol, per mol of silver halide.

Spectral sensitization is carried out to impart a spectral sensitivity in a desired light wavelength region to the emulsion of each layers in the photosensitive material of the present invention. As examples of spectral sensitizing dyes for use in spectral sensitization of the blue, green, or red region, preferred are cyanine dyes, merocyanine dyes, rhodacyanine dyes, trinuclear merocyanine dyes, quadrinuclear merocyanine dyes, allopolar dyes, hemicyanine dyes and styryl dyes. Further preferred are cyanine dyes, merocyanine dyes and rhodacyanine dyes. Cyanine dyes are particularly preferable. Details of these dyes are described in F. M. Hamer, *Heterocyclic Compounds—Cyanine Dyes and Related Compounds,* John Wiley & Sons, New York, London, 1964; D. M. Sturmer, *Heterocyclic Compounds—Special topics in heterocyclic chemistry,* The Chapter 18, Section 14, pp. 482 to 515, John Wiley & Sons, New York, London, 1977; and *Rodd's Chemistry of Carbon Compounds,* 2nd Ed. vol. IV, part B, 1977, The Chapter 15, pp. 369 to 422, Elsevier Science Publishing Company Inc., New York.

In addition to the above explanation, dyes described in Research Disclosure (RD) 17643, pp. 23 to 24, RD 18716, page 648, right column to page 649, right column, RD 308119, page 996, right column to page 998, right column, and European Patent Application Publication No. 0565096, page 65, lines 7 to 10, can be preferably used. Further, sensitizing dyes represented by general formula and their specific examples described in U.S. Pat. No. 5,747,236 (particularly pages 30 to 39) and U.S. Pat. No. 5,340,694 (particularly pages 21 to 60, in which, in the sensitizing dyes shown by (XI), (XII) or (XIII), the numbers of each $n_{12}$, $n_{15}$, $n_{17}$ and $n_{18}$ are not limited, but they are an integer of 0 (zero) or more (preferably 4 or less)) are also preferably used.

As a spectral sensitization method, one described in JP-A-62-215272, from page 22, right upper column to page 38 is preferably used. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength, temperature dependency of exposure, and the like. On the other hand, it is preferable that the silver halide emulsion grains having a high silver bromide content are sensitized by known cyanine dyes.

These sensitizing dyes can be used singly or in combination, and a combination of these sensitizing dyes is often used, particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,303,377, 3,769,301, 3,814,609, 3,837,862, and 4,026,707, British Patent Nos. 1,344,281 and 1,507,803, JP-B-43-4936, JP-B-53-12375, JP-A-52-110618 and JP-A-52-109925.

In the present invention, preferably in the second embodiment of the present invention, together with the sensitizing dye, a dye having no spectral sensitizing action itself, or a substance that does not substantially absorb visible light and that exhibits supersensitization, may be included in the emulsion.

A supersensitizing agent useful for spectral sensitization according to the present invention (e.g., pyrimidylamino compounds, triazynylamino compounds, azolium compounds, aminostyryl compounds, aromatic organic acid-formaldehyde condensates, azaindene compounds and cadmium salts) and a combination of said supersensitizing agent and a sensitizing dye are described, for example, in U.S. Pat. Nos. 3,511,664, 3,615,613, 3,615,632, 3,615,641, 4,596,767, 4,945,038, 4,965,182, 4,965,182, 2,933,390, 3,635,721, 3,743,510, 3,617,295 and 3,635,721. As to usage thereof, methods described in the above-mentioned patents are also preferable.

As a time when the sensitizing dyes of the present invention (and also other sensitizing dyes and supersensitizing agents) is added to a silver halide emulsion, it may be any time of the processes for preparation of emulsions that has been recognized to be useful. In the present invention, preferably in the first embodiment of the present invention, addition of the sensitizing dye is, most commonly, carried out after completion of chemical sensitization, but before coating. However, the sensitizing dye may be simultaneously added together with a chemical sensitizer to carry out spectral sensitization and chemical sensitization at the same time, as described in U.S. Pat. Nos. 3,628,969 and 4,225,666. Besides, as described in JP-A-58-113928, the sensitizing dye may be added prior to chemical sensitization, or alternatively the sensitizing dye may be added before completion of formation of precipitation of silver halide grains, to start spectral sensitization. Further, as taught in the U.S. Pat. No. 4,225,666, it is possible that the above-mentioned compounds may be separately added, namely a part of these compounds is added prior to chemical sensitization and the others are added after chemical sensitization. The sensitizing dye may be added in any stage during grain formation of silver halide, as exemplified by the method disclosed in U.S. Pat. No. 4,183,756. In the present invention, preferable in the second embodiment of the present invention, they may be added in any time or process before coating of the emulsion, for example, during grain formation of silver halide or/and a time of before desalting, during desalting and/or a time of from after desalting to before start of chemical ripening, as disclosed, for example, in U.S. Pat. Nos. 2,735,766, 3,628,960, 4,183,756, 4,225,666, JP-A-58-184142 and JP-A-60-196749; and a time of just before or during chemical ripening, or a time of from after chemical ripening to before coating, as disclosed in JP-A-58-113920 and the like. Further, as disclosed in U.S. Pat. No. 4,225,666 and JP-A-58-7629, one kind of compound or a plurality of compounds having different structures from each other in combination may be dividedly added, for example, during grain formation step, and during chemical ripening step or after completion of chemical ripening; or alternatively before or during chemical ripening, and after chemical ripening. The kind of the compounds and combination thereof to be dividedly added may be also changed in the course of separate addition.

In the first embodiment of the present invention, the amount of these spectral sensitizing dyes to be added is in a wide range in accordance with the occasion, but preferably in the range of from $0.5\times10^{-6}$ to $1.0\times10^{-2}$ mol per mol of the silver halide. For silver halide grains having a high silver chloride content, the addition amount of these spectral sensitizing dyes is preferably in the range of from $1.0\times10^{-6}$ to $5.0\times10^{-3}$ mol per mol of the silver halide, whereas for silver halide grains having a high silver bromide content, the addition amount is preferably $5.0\times10^{-4}$ mol or more per mol of silver halide. For silver halide grains having an average grain size of from 1.0 to 3.0 μm, the addition amount of these spectral sensitizing dyes is more effective in the range of from $2.0\times10^{-4}$ to $5.0\times10^{-3}$ mol per mol of silver halide.

In the second embodiment of the present invention, the addition amount of the sensitizing dyes of the present invention (and also other sensitizing dyes and a supersensitizing agent) varies depending on the shape and the size of the silver halide grains, and may be in any addition amount. However, the addition amount is preferably in the range of from $1\times10^{-8}$ mol to 1 mol, more preferably in the range of from $1\times10^{-6}$ mol to $1\times10^{-2}$ mol, per mol of the silver halide. For example, in the case where the grain size of the silver halide is in the range of 0.2 to 1.3 μm, the addition amount is preferably in the range of from $2\times10^{-6}$ mol to $3.5\times10^{-3}$ mol, more preferably in the range of from $7.5\times10^{-6-6}$ mol to $1.5\times10^{-3}$ mol, per mol of the silver halide.

However, in the case of multilayer adsorption of the dye chromophore, it is necessary to add the required amount of the dyes.

The sensitizing dyes according to the present invention (and also other sensitizing dyes and supersensitizing agents) may be directly dispersed into an emulsion. Alternatively, after they are dissolved in an arbitrary solvent such as methyl alcohol, ethyl alcohol, methyl cellosolve, acetone, water and pyridine, or a mixed solvent thereof, the solution may be added to an emulsion. At this time, bases and acids, or additives such as surfactants may be incorporated in the solution. Ultrasonic wave may be used for the dissolution. To add the compound to an emulsion, for example, after the compound is dissolved in a volatile organic solvent, the resulting solution is dispersed into a hydrophilic colloid to form a dispersion, and then the dispersion is added to the emulsion, as described, for example, in U.S. Pat. No. 3,469,987; after the compound is dispersed into an aqueous solvent and the dispersion is added to the emulsion, as described, for example, in JP-B-46-24185; after the compound is dissolved into a surfactant, the resulting solution is added to the emulsion, as described, for example, in U.S. Pat. No. 3,822,135; after the compound is dissolved using a red-shift inducing compound, the solution is added to the emulsion, as described, for example, in JP-A-51-74624; or after the compound is dissolved into an acid substantially free of water, the solution is added to the emulsion, as described, for example, in JP-A-50-80826. As other methods of adding the compound to an emulsion, those methods as described, for example, in U.S. Pat. Nos. 2,912,343, 3,342,605, 2,996,287 and 3,429,835 also may be used.

The silver halide grains for use in the present invention, preferably in the first embodiment of the present invention, may be subjected, in the process of producing a silver halide emulsion, to at least one of a chalcogen sensitization such as sulfur sensitization and selenium sensitization, noble metal sensitization such as gold sensitization and palladium sensitization, and reduction sensitization. Two or more kinds of sensitizing methods are preferably used in combination. Various types of emulsions can be prepared depending on the time for conducting the chemical sensitization. There are emulsions in which chemical sensitization nuclei are contained inside the grains, or in a shallow location that is shallow from the grain surface, and foamed on the grain surface. For the emulsion for use in the present invention, the location of chemical sensitization nuclei may be determined depending on the purposes. It is preferable that at least one kind of chemical sensitization nuclei are formed in the vicinity of the grain surface. For grains having a high silver chloride content, gold-sensitized grains are particularly preferable, because gold sensitization is able to further minimize a fluctuation of photographic performances that are attained upon scanning exposure using a laser beam or the like.

The preferred chemical sensitization which can be performed in the present invention is chalcogen sensitization, noble metal sensitization or a combination thereof. As described in T. H. James, The Theory of the Photographic Process, 4th ed., Macmillan, 1977, pp. 67–76, the chemical sensitization may be performed using active gelatin. Furthermore, as described in Research Disclosure (RD), Vol. 120, April, 1974, 12008; RD, Vol. 34, June, 1975, 13452, U.S. Pat. Nos. 2,642,361, 3,297,446, 3,772,031, 3,857,711, 3,901,714, 4,266,018 and 3,904,415 and British Patent No. 1,315,755, the chemical sensitization may be performed using sulfur, selenium, tellurium, gold, platinum, palladium, iridium or a combination of two or more of these sensitizing dyes at a pAg of 5 to 10, a pH of 5 to 8 and a temperature of 30 to 80° C., as described in JP-A-62-215272, page 18, right lower column to page 22, right upper column. In the noble metal sensitization, a noble metal salt such as gold, platinum, palladium or iridium may be used, and particularly, gold sensitization, palladium sensitization and a combination thereof are preferred.

In order to conduct gold sensitization, various inorganic gold compounds, gold (I) complexes having an inorganic ligand, and gold (I) compounds having an organic ligand may be used. Inorganic gold compounds, such as chloroauric acid or salts thereof; and gold (I) complexes having an inorganic ligand, such as dithiocyanate gold compounds (e.g., potassium dithiocyanatoaurate (I)), and dithiosulfate gold compounds (e.g., trisodium dithiosulfatoaurate (I)), are preferably used. As the gold (I) compounds having an organic ligand, the bis gold (I) mesoionic heterocycles described in JP-A-4-267249, for example, gold (I) tetrafluoroborate bis(1,4,5-trimethyl-1,2,4-triazolium-3-thiolate), the organic mercapto gold (I) complexes described in JP-A-11-218870, for example, potassium bis(1-[3-(2-sulfonatobenzamido)phenyl]-5-mercaptotetrazole potassium salt) aurate (I) pentahydrate, and the gold (I) compound with a nitrogen compound anion coordinated therewith described in JP-A-4-268550, for example, gold (I) bis (1-methylhydantoinate) sodium salt tetrahydrate may be used. Also, the gold (I) thiolate compound described in U.S. Pat. No. 3,503,749, the gold compounds described in JP-A-8-69074, JP-A-8-69075 and JP-A-9-269554, and the compounds described in U.S. Pat. Nos. 5,620,841, 5,912,112, 5,620,841, 5,939,245, and 5,912,111 may be used.

Further, in the present invention, it is possible to use a colloidal gold sulfide. A method of producing the colloidal gold sulfide is described in, for example, Research Disclosure (RD), No. 37154, Solid State Ionics, Vol. 79, pp. 60 to 66, 1995, and Compt. Rend. Hebt. Seances Acad. Sci. Sect. B, Vol. 263, p. 1328, 1996. Colloidal gold sulfide having various grain sizes are applicable, and even those having a grain diameter of 50 nm or less are also usable. The amount of these compounds to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, per mol of silver halide.

The palladium compound means salts of divalent or tetravalent palladium salt. A preferable palladium compound is represented by $R_2PdX_6$ or $R_2PdX_4$, wherein R represents a hydrogen atom, an alkali metal atom, or an ammonium group; and X represents a halogen atom, i.e. a chlorine atom, a bromine atom, or an iodine atom. Specifically, $K_2PdCl_4$, $(NH_4)_2PdCl_6$, $NaPdCl_4$, $(NH_4)_2PdCl_4$, $Li_2PdCl_4$, $Na_2PdCl_6$, or $K_2PdBr_4$ is preferable. Preferably, a gold compound and a palladium compound are used in combination with a thiocyanate or a selenocyanate.

Preferably the emulsion for use in the present invention is used in combination with gold sensitization. A preferable amount of the gold sensitizing agent is $1\times10^{-7}$ to $5\times10^{-3}$ mol, and more preferably $5\times10^{-7}$ to $5\times10^{-4}$ mol, per mol of the silver halide. A preferable amount of the palladium compound is in the range of $1\times10^{-3}$ to $5\times10^{-7}$ mol per mol of the silver halide. A preferable amount of the thiocyan compound and the selenocyan compound is in the range of $5\times10^{-2}$ to $1\times10^{-6}$ mol per mol of the silver halide.

Examples of the sulfur sensitizer which can be used include hypo, thiourea-based compounds, rhodanine-based compounds and sulfur-containing compounds described in U.S. Pat. Nos. 3,857,711, 4,266,018 and 4,054,457. The chemical sensitization may also be performed in the presence of a so-called chemical sensitization aid. Useful chemical sensitization aids are compounds known to suppress fogging and at the same time, elevate the sensitivity in the process of chemical sensitization, such as azaindene, azapyridazine and azapyrimidine. Examples of the chemical sensitization aid modifier are described in U.S. Pat. Nos. 2,131,038, 3,411,914 and 3,554,757, JP-A-58-126526 and Duffin, Shashin Nyuzai Kagaku (Photographic Emulsion Chemistry), supra, pp. 138–143.

The amount of a sulfur-sensitizing agent to be employed for the silver halide grains for use in the present invention, is preferably in the range of from $1\times10^{-4}$to $1\times10^{-7}$ mol, and more preferably from $1\times10^{-5}$ to $5\times10^{-7}$ mol, per mol of the silver halide.

Further, as one of preferable sensitizing methods for the emulsion used in the present invention, selenium sensitization can be included. In the selenium sensitizing, known unstable selenium compounds, such as colloidal metal selenium, selenoureas (e.g., N,N-dimethylselenourea, N,N-diethylselenourea), selenoketones, and selenoamides can be used. In some cases, it is preferable to use selenium sensitization in combination with sulfur sensitization or noble metal sensitization.

The silver halide emulsion of the present invention, preferably the second embodiment of the present invention, is preferably subjected to selenium sensitization or gold sensitization, more preferably selenium sensitization.

The selenium sensitizer for use in the present invention, preferably in the second embodiment of the present invention, may be a selenium compound disclosed in Patent Publications that have been known. The selenium sensitization is generally performed by adding a labile and/or non-labile selenium compound and stirring the emulsion at a high temperature, preferably at a temperature 40° C. or more, for a predetermined time. Preferable examples of the labile selenium compound include the compounds described in JP-B-44-15748, JP-B-43-13489, JP-A-4-25832, JP-A-4-109240, JP-A-4-324855 and the like.

Specific examples of the labile selenium compound include, for example, isoselenocyanates (e.g. aliphatic isoselenocyanates such as allyl isoselenocyanate), selenoureas, selenoketones, selenoamides, selenocarboxylic acid (e.g. 2-selenopropionic acid, 2-selenobutyric acid), selenoesters, diacylselenides (e.g. bis(3-chloro-2,6-dimethoxybenzoyl) selenide), selenophosphates, phosphine selenides, and colloidal metal selenium.

The above-mentioned preferable types of labile selenium compounds are not cited for restriction. A person skilled in the art generally understands that, with regard to a labile selenium compound as a sensitizer for a photographic emulsion, a structure of the compound is not important as long as the selenium is labile, and the organic moiety of a selenium sensitizer molecule has no function other than that of allowing selenium to be present in a labile form in an emulsion. In the present invention, a labile selenium compound defined by such a broad concept is advantageously used.

With regard to the non-labile selenium compound, compounds described in JP-B-46-4553, JP-B-52-34492 and JP-B-52-34491 can be used. Specific examples of the non-labile selenium compound include selenious acid, potassium selenocyanide, selenazoles, quaternary salts of selenazoles, diaryl selenides, diaryl diselenides, dialkyl selenides, dialkyl diselenides, 2-selenazolidindione, 2-selenooxazolidinthione, and derivatives thereof.

These selenium sensitizers are dissolved in solely water, an organic solvent such as methanol and ethanol, or in a mixture of these solvents, and then the resultant is added at the time of chemical sensitization. Preferably, the selenium sensitizer is added before the start of chemical sensitization. The selenium-sensitizing agent may be used singly, or in combination of two or more kinds thereof. A combination of a labile selenium compound and non-labile selenium compound is preferably used.

The addition amount of a selenium-sensitizing agent that can be used in the present invention, preferably in the second embodiment of the present invention, varies depending on the activity of the selenium-sensitizing agent to be used, the kind of silver halide, the size of silver halide, the ripening temperature and the ripening time, but preferably in the range of from $2\times10^{-6}$ mol to $5\times10^{-6}$ mol per mol of the silver halide. The temperature of chemical sensitization using a selenium-sensitizing agent is preferably in 40° C. or higher but 80° C. or lower. The values of pAg and pH are arbitrarily selected. For example, as for the pH, the effects of the present invention can be obtained in the wide range such as from 4 to 9.

The above-described selenium sensitization is more effectively carried out in the presence of a silver halide solvent.

Examples of the silver halide solvent that can be used in the present invention include (a) organic thioethers described, for example, in U.S. Pat. Nos. 3,271,157, 3,531,289 and 3,574,628, JP-A-54-1019 and JP-A-54-158917, (b) thiourea derivatives described in JP-A-53-82408, JP-A-55-77737, and JP-A-55-2982, (c) silver halide solvents having a thiocarbonyl group between an oxygen atom or a sulfur atom, and a nitrogen atom, as described in JP-A-53-144319, (d) imidazoles described in JP-A-54-100717, (e) sulfites, and (f) thiocyanates.

Particularly preferable silver halide solvents are thiocyanates and tetramethylthiourea. The amount of the solvent to be used varies depending on the type of the solvent, but the amount thereof is preferably $1\times10^{-4}$ mol or more, but $1\times10^{-2}$ mol or less, per mol of the silver halide.

In the present invention, preferably in the second embodiment of the present invention, the gold sensitizing agent for use in the gold sensitization may have the oxidation number of gold of monovalent or trivalent. In addition, gold compounds ordinarily used as a gold sensitizing agent may be used. Typical examples of the gold sensitizing agent include chloroauric acid salts, potassium chloroaurate, auric trichloride, potassium auric thiocyanate, potassium iodoaurate, tetracyanoauric acid, ammonium auro thiocyanate, pyridyl trichlorogold, gold sulfide and gold selenide. The amount of the gold sensitizing agent to be used varies depending on various conditions, but, as a standard, the amount thereof is preferably $1\times10^{-7}$ mol or more, but $5\times10^{-5}$ mol or less, per mol of the silver halide.

In the chemical sensitization of the emulsion according to the present invention, preferably the second embodiment of the present invention, desirably sulfur sensitization is used in combination.

The sulfur sensitization is generally carried out by adding a sulfur sensitizer and stirring the resulting emulsion for a certain period at a high temperature, preferably at 40° C. or higher.

In the above sulfur sensitization, known sulfur sensitizers can be used. Examples thereof include thiosulfates, ally thiocarbamidethiourea, allyl isothiocyanate, cystine, p-toluenethiosulfonates, and rhodanine. In addition, sulfur sensitizers described in U.S. Pat. Nos. 1,574,944, 2,410,689, 2,278,947, 2,728,668, 3,501,313 and 3,656,955, German Patent No. 1,422,869, JP-B-56-24937, and JP-A-55-45016 can be used.

The amount of the sulfur sensitizer to be added is suitably an amount sufficient to effectively increase the sensitivity of the emulsion. That amount varies in a substantially wide range depending on various conditions, such as the pH, the temperature, and the size and type of the silver halide grains, and preferably the amount is $1\times10^{-7}$ mol or more but $5\times10^{-5}$ mol or less, per mol of the silver halide.

In the present invention, preferably in the first embodiment of the present invention, a thiocyanate is preferably added before adding the above-mentioned spectral sensitizing dye and chemical sensitizing agent, preferably after grain formation, and more preferably after completion of the desalting process. Preferably, the thiocyanate is further added during chemical sensitization. In this case, the thiocyanate is added two times. As the thiocyanate, for example, potassium thiocyanate, sodium thiocyanate, ammonium thiocyanate, or the like is used. Generally, the thiocyanate is added in a form dissolved in an aqueous solution or a water-soluble solvent. The addition amount of the thiocyanate is preferably in the range of $1\times10^{-5}$ to $1\times10^{-2}$ mol, more preferably $5\times10^{-5}$ to $5\times10^{-3}$ mol, per mol of the silver halide.

In the present invention, preferably in the first embodiment of the present invention, in some cases, a method wherein a chalcogenide compound is added during the preparation of the emulsion, as described in U.S. Pat. No. 3,772,031, is also useful. In addition to S, Se, and Te, a cyanate, a thiocyanate, a selenocyanate, a carbonate, a phosphate, or an acetate may be present.

The emulsion for use in the present invention, preferably in the first embodiment of the present invention, is preferably prepared in the presence of a water-soluble radical scavenger. The radical scavenger is a compound that is able to substantially discolor Galvinoxyl (to reduce absorbance at 430 nm). Discoloration of Galvinoxyl is determined by mixing 0.05 $mmoldm^{-3}$ of ethanol solution of Galvinoxyl and 2.5 $mmoldm^{-3}$ ethanol solution of a testing compound at 25° C., and measuring aging change of absorbance of the mixture at 430 nm, according to a stopped-flow method. The radical scavenge rate of the radical scavenger refers to a discoloring rate constant of the Galvinoxyl calcurated by the above-described method. Preferred radical scavenge rate is 0.01 $mmols^{-1}dm^{-3}$ or more, and further preferably 0.1 to 10 $mmols^{-1}dm^{-3}$. The above-mentioned measuring method is described in *Microchemical Journal* 31, pp. 18–21 (1985) and *Bunkoh Kenkyu* (*Spectroscopic Studies*), Vol. 19, No. 6, item 321 (1970).

Water solubility of the above-mentioned radical scavenger is represented by partition coefficient in the n-octanol/water system, that is defined by the following formula:

$$\log P=\log\{(Rs)_{octanol}/(Rs)_{water}\}.$$

In the formula, (Rs) represents a concentration of the radical scavenger; and $(Rs)_{octanol}$ and $(Rs)_{water}$ each represent the concentration in n-octanol and the concentration in water. The term "water-soluble" herein is used to mean that the above-described logP value is less than 1. The partition coefficient can be calculated by a method described in *Journal of Medicinal Chemistry,* Vol. 18, No. 9, pp. 865–868 (1975).

Examples of the radical scavenger for use in the present invention, preferably in the first embodiment of the present invention, include water-soluble compounds selected from, for example, phenol-series compounds described in JP-A-7-72599, and hydroxyamine-series compounds represented by formulae (A-I)-(A-III) described in JP-A-8-76311 and U.S. Pat. No. 5,719,007, formula (S2) described in JP-A-10-10668, formula (S1) described in JP-A-11-15102, and formula (S1) described in JP-A-10-90819.

Specific examples of the water-soluble radical scavenger are shown below, but the present invention should not be construed as being limited thereto.

RS-1

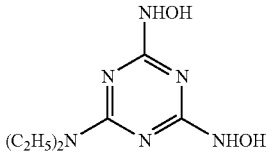

-continued

RS-2

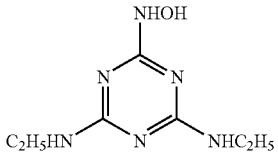

RS-3

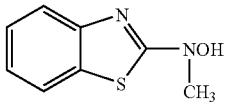

RS-4

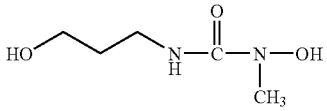

RS-5

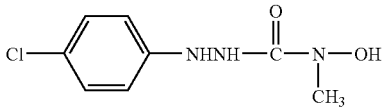

The water-soluble radical scavengers are preferably added during the preparation of emulsions, and may be added in any process of the emulsion preparation. Examples of the process include the grain-formation process of the silver halide, before start of the desalting process, the desalting process, before start of the chemical ripening, the chemical ripening process, and the process before completion of the preparation of emulsions. Further, they may be added separately in several processes. Preferably they are added before, during and after chemical sensitization.

A preferable addition amount of the water-soluble radical scavenger varies widely depending on the above-mentioned addition methods and the kinds of the compound to be added, but it is generally in the range of $5\times10^{-6}$ to 0.5 mol, more preferably $1\times10^{-5}$ to 0.005 mol, per mol of the light-sensitive silver halide. Two or more kinds of the above-mentioned radical scavenger may be used in combination. The radical scavengers may be added in a form solved in a water-soluble solvent such as water, methanol and ethanol, in a form solved in a mixture of these solvents. Alternatively, they may be added by emulsion dispersion. When a radical scavenger is dissolved in water, the radical scavenger in which solubility in water increases in high or low pH, may be dissolved in water at a high pH or a low pH, and then added. Further, a surface active agent may be used together with a radical scavenger.

In the present invention, preferably in the second embodiment of the present invention, as the silver halide in a photographic emulsion that is in charge of a photosensitive mechanism, any one of silver bromide, silver iodobromide, silver chlorobromide, silver iodide, silver iodochloride, silver iodobromochloride and silver chloride, may be used. To construct a stable adsorption structure, a halogen composition of the outermost surface of the emulsion contains preferably 0.1 mol % or more, more preferably 1 mol % or more, especially preferably 5 mol % or more of iodide.

The emulsion that can be preferably used in the photosensitive material of the present invention, preferably of the second embodiment of the present invention, relates to an emulsion comprising silver iodobromide, silver bromide, or silver chloroiodobromide tabular grains.

Of these photosensitive materials of the present invention, preferably in the second embodiment of the present invention, a preferred color photosensitive materials is a color photosensitive material comprising a plurality of silver halide emulsion layers that comprises unit photosensitive layers whose color sensitivities are substantially identical but whose sensitivities are different, and in which 50% or more of the total projected area of the silver halide grains in at least one of emulsion layers having the highest sensitivity among silver halide emulsion layers constituting each unit photosensitive layers are tabular silver halide grains (hereinafter these grains are also referred to as tabular grains). In the present invention, preferably in the second embodiment of the present invention, an average aspect ratio of the tabular grains is preferably 2 or more, further preferably 8 or more, especially preferably 12 or more, and most preferably 15 or more.

In the tabular grains, the aspect ratio means a ratio of a diameter to a thickness of the silver halide. In other words, the aspect ratio is a value obtained by dividing the diameter by the thickness of individual silver halide grains. The term "diameter" is used to mean the diameter of a circle having an area equal to the projected area of the grain, when the silver halide grains are observed by means of a microscope or an electron microscope. Besides, the term "average aspect ratio" in this specification means an average value of aspect ratios of total tabular grains in an emulsion.

As one example of a method of measuring the aspect ratio, there is a method in which transmission electron microphotograph of each grain is taken using a replica method, to find the equivalent-circle diameter of an individual grain and the thickness of the individual grain. In this case, the thickness is calculated from the length of the shadow of the replica.

A shape of the tabular grains for use in the present invention, preferably in the second embodiment of the present invention, is usually hexagonal. The term "hexagonal" shape means that the shape of a main plane of the tabular grains is hexagonal, and an adjacent side ratio (maximum side length/minimum side length) thereof is 2 or less. The adjacent side ratio is preferably 1.6 or less, more preferably 1.2 or less. The lowest limit is 1.0, as a matter of course. In high aspect ratio grains, the number of triangular tabular grains increases in the tabular grains. The triangular tabular grains occur in the case where Ostwald ripening excessively proceeds. In order to obtain substantially hexagonal tabular grains, it is preferable to shorten the ripening time as much as possible. For this purpose, it is necessary to increase a rate of tabular grains by nucleation. As described by Saitoh in JP-A-63-11928, it is preferable, for increasing probability of occurrence of hexagonal tabular grains, that one of or both of an aqueous silver ion solution and an aqueous bromide ion solution contain(s) gelatin, when silver ions and bromide ions are added to a reaction solution by a double jet process.

The hexagonal tabular grains incorporated in the photosensitive material of the present invention, preferably of the second embodiment of the present invention, are formed via nucleation, Ostwald ripening and growth process. Each of these processes is important for restraining a spread of grain size distribution. However, because it is impossible, in the later process, to reduce the spread of size distribution having already occurred in the above process, attention must be given so that the size distribution does not spread in the first nucleation step. In the nucleation step, a relation of a nucleus-forming time and a temperature of a reaction solution for addition of silver ions and bromide ions to the reaction solution by a double jet process thereby to generate precipitates is important. As described by Saitoh in JP-A-63-92942, the temperature of a reaction solution at the time of nucleation is preferably in the range of from 20° C. to 45° C. for enhancement of mono-dispersion property. In addition, as described by Zola et al in JP-A-2-222940, a preferable temperature at the time of nucleation is 60° C. or less.

For the purpose of obtaining monodispersed tabular grains with a high aspect ratio, a gelatin is further added during grain formation in some case. As gelatin used at this time, it is preferable to use a chemically modified gelatin described in JP-A-10-148897 and JP-A-11-143002. The chemically modified gelatin is a gelatin comprising having at least two carboxyl groups newly introduced by chemical modification of amino groups in a gelatin. As the chemically modified gelatin, a trimellitated gelatin is preferably used, and a succinated gelatin is also preferably used. The gelatin is preferably added before growth process. More preferably it is added just after nucleation. The addition amount of the gelatin is preferably 60% or more, more preferably 80% or more, and especially preferably at 90% or more, based on the mass of entire dispersion media during grain formation.

The tabular grain emulsion used in the present invention, preferably in the second embodiment of the present invention, comprises silver iodobromide, silver bromide or silver chloroiodobromide. The tabular grain emulsion may contain silver chloride, but the content of the silver chloride is preferably 8 mol % or less, more preferably 3 mol % or less, and most preferably 0 mol %. A coefficient of variation of grain size distribution of the tabular grain emulsion is preferably 30 mol % or less. Therefore, the content of silver iodide is preferably 20 mol % or less. Reduction in the content of silver iodide makes it easy to reduce the variation coefficient of distribution of circle-equivalent diameter of the tabular grain emulsion. Particularly, the coefficient of variation of grain size distribution of the tabular grain emulsion is preferably 20% or less, and the content of the silver iodide is preferably 10 mol % or less.

The tabular grain emulsion preferably has a structure of silver iodide distribution inside the grains. In this case, the structure of the silver iodide distribution may be a two-fold structure, a three-fold structure, a four-fold or more structure.

In the present invention, it is preferable that tabular grains have dislocation lines. Dislocation lines of tabular grains can be observed by a direct method using a transmission-type electron microscope at low temperatures, as described, for example, by J. F. Hamilton in Phot. Sci. Eng., 11, 57 (1967), or by T. Shiozawa in J. Soc. Phot. Sci. Japan, 3, 5, 213 (1972). That is, silver halide grains, carefully taken out from the emulsion in such a way that pressure is not applied to generate dislocations in the grains, are placed on a mesh for electron microscope observation and are observed by the transmission method, with the sample cooled to prevent it from suffering damage (e.g. print-out) by the electron beam. In this case, the greater the thickness of the grains is, the more difficult it is for the electron beam to be transmitted. Therefore clearer observation can be effected using an electron microscope of a high-pressure type (200 kV or over for grains having a thickness of 0.25 μm). From the photograph of the grains obtained in this way, the locations and the number of dislocation lines of the individual grains, seen in the direction vertical to the principal planes, can be found.

The number of dislocation lines of the tabular grains of the present invention is preferably 10 or more, and more preferably 20 or more, per grain on average. When the dislocation lines exist in a crowded condition, or are viewed as being crossed with each other, it is sometimes difficult to exactly count the number of dislocation lines per grain. However, it is possible to count them with such accuracy as identifying about 10, 20, or 30 lines, even in these cases, which can be clearly distinguished from there being only several dislocation lines present. The average number of dislocation lines per grain is determined by counting the number of dislocation lines with respect to 100 grains or more, and then averaging them in number. In some cases, it is observed that several hundreds of dislocation lines exist.

The dislocation lines can be introduced into, for example, an outer surface or its vicinity of a tabular grain. In this case, the dislocations are almost perpendicular to the outer surface, and dislocation lines are generated in a direction from a position away from the center of the tabular grain by a distance that is x % of a length between the center and an edge (outer surface), to the outer surface. A value of x is preferably 10 or more, but less than 100, more preferably 30 or more, but less than 99, and most preferably 50 or more, but less than 98. In this case, a shape that is obtained by connecting positions at which dislocation lines start is close to a similar figure of the grain, but is not always a completely similar figure, i.e., sometimes the shape is distorted. A dislocation of this type is not viewed in a center region of the grain. The direction of dislocation lines is crystallographically about the direction of (211), but sometimes the dislocation lines extend in a zigzag manner, or cross each other.

Further, the tabular grain may have the dislocation lines almost uniformly at all through the outer surface or at a localized region on the outer surface. That is, taking hexangular tabular silver halide grains as an example, the dislocation lines may be limited to only a vicinity of 6 apices, or to only a vicinity of 1 apex among the 6 apices. On the contrary, the dislocation lines can be limited to only the sides excluding a vicinity of the 6 apices.

Further, the dislocation lines may be formed over the region including a center of two parallel main planes of the tabular grain. When the dislocation lines are formed all over the region of the main planes, a direction of the dislocation lines, when viewed from the direction perpendicular to the main plane, is usually crystallographically almost the direction of (211), but sometimes the direction is of (110) or at random. Furthermore, each length of the dislocation lines is also random. Therefore, some dislocation lines are observed as a short line on the main plane, and other dislocation lines are observed as a long line extending to the side (outer surface). Some dislocation lines are straight, but many others extend in a zigzag manner. Further, in many cases, they are crossed each other. The position of dislocation lines may be limited to on the outer surface, the main plane, or a localized region as mentioned above, or the dislocation lines may be formed at a combination thereof. That is to say, the dislocation lines may exist simultaneously on both the outer surface and the main plane.

The dislocation line in the present invention, preferably in the first embodiment of the present invention is described in more detail below.

After suddeny adding a silver iodide fine grain emulsion to a tabular grain emulsion, silver bromide or silver iodobromide grains are grown to introduce dislocation lines thereto. The growth of silver bromide or silver iodobromide grains may be started before or at the same time as the addition of a silver iodide fine grain emulsion, preferably after addition of a silver iodide fine grain emulsion. The time from addition of a silver iodide fine grain emulsion to start of the growth of silver bromide or silver iodobromide grains, is preferably 10 minutes or less but 1 second or more, more preferably 5 minutes or less but 3 seconds or more, and furthermore preferably 1 minute or less. This time is preferably as short as possible, and preferably before start of growth of silver bromide or silver iodobromide.

It is preferable that silver bromide growths after addition of a silver iodide fine grain emulsion. In the case of silver iodobromide, the content of silver iodide is preferably 3 mol % or less, to a layer to be grown after addition of a silver iodide fine grain emulsion. When the total amount of silver in the finished tabular grain emulsion is taken as 100, the relative amount of silver in the layer to be grown after addition of a silver iodide fine grain emulsion is preferably 5 or more but 50 or less, and most preferably 10 or more but 30 or less. The temperature, pH, and pAg when the layer is formed, is not limited in particular, generally the temperature is 40° C. or more but 90° C. or less and the pH is 2 or more but 9 or less, more preferably the temperature is 50° C. or more 80° C. or less, and the pH is 3 or more but 7 or less. Referring to the pBr, it is preferred, in the present invention, that pBr at the end of formation of said layer is higher than that at the time of beginning of formation of said layer. It is preferable that the pBr at the beginning of formation of said layer is 2.9 or less, and that the pBr at the end of formation of said layer is 1.7 or more; further preferable that the pBr at the beginning of formation of said layer is 2.5 or less, and that the pBr at the end of formation of said layer is 1.9 or more; and furthermore preferable that the pBr at the beginning of formation of said layer is 2.3 or less but 1 or more, and that the pBr at the end of formation of said layer is 2.1 or more but 4.5 or less. In the present invention, dislocation lines are preferably introduced according to the above-mentioned methods.

The dislocation line in the present invention, preferably in the second embodiment of the present invention, is described in more detail below.

In order to introduce dislocation lines to the tabular grains, specific high-silver iodide phases can be formed in an internal portion of the grains. The high-silver iodide phase herein referred to may include discontinuous high-silver iodide regions. Specifically, such tabular grains can be obtained by the steps of preparing substrate grains, and then forming a high-silver iodide phase on the substrate grains, followed by covering them with a layer having a silver iodide content lower than that of the high-silver iodide layer. The silver iodide content of the tabular substrate grains is lower than that of the high-silver iodide phase, and it is preferably from 0 to 20 mol %, more preferably from 0 to 15 mol %.

The "high-silver iodide phase in an internal portion of the grain" in the present specification referred to means a silver halide solid solution containing silver iodide. Preferred silver halides are silver iodide, silver iodobromide, and silver chloroiodobromide, and more preferably silver iodide and silver iodobromide (silver iodide content is 10 to 40 mol % to the silver halide contained in the high-silver iodide) in this case. In order to form a high-silver iodide phase in an internal selective position of the grain (hereinafter referred to as an internal high-silver iodide phase), i.e., an edge or a corner of the substrate grains, it is desirable that such localization can be controlled by conditions for forming the substrate grains and the internal high-silver iodide layers and for forming a phase covering the outer side thereof. Of the conditions for forming the substrate grains, there can be recited pAg (the cologarithm of silver ion concentration); a presence or absence, a kind, and an amount of a silver halide solvent; and temperature as an important factor. It is possible to selectively form the internal high-silver iodide phase at the vicinity of corners of the substrate grains, by adjusting pAg to 8.5 or less, and more preferably to 8 or less, when later internal high-silver iodide phases are growing.

On the other hand, internal high-silver iodide phases can be formed on the edges of the substrate grains, by adjusting pAg to 8.5 or more, and more preferably 9 or more, when the substrate grains are growing. The threshold value of the pAg varies up and down depending on temperature; and the presence or absence, the kind, and the amount of the silver halide solvent. For example, when thiocyanate is used as a silver halide solvent, the threshold of the pAg inclines upward. The pAg at the terminal stage of the growth is particularly important as a pAg when the substrate grains are growing. On the other hand, even when the pAg at the step of the growth is out of the above given value, the selective location of the internal high-silver iodide phase can be controlled by adjusting the pAg to the above given value after the substrate grains have grown, followed by ripening. In this case, ammonia, amine compounds, thiourea derivatives, and thiocyanate salts are useful as a silver halide solvent. The internal high-silver iodide phase can be formed by a so-called conversion method.

In this method, during a grain formation process, halide ions having a lower solubility of salt forming silver ion than that of silver halide that forms a grain or a portion close to the surface of grain at this time, are added. In the present invention, an amount of the halide ions having a lower solubility to be added is preferably larger than a value (associated with a halide composition) with respect to a surface area of the grain at this time. For example, during grain formation, KI is preferably added in an amount larger than a certain value with respect to a surface area of a silver halide grain at this time. Specifically, iodide salt is preferably added in an amount of $8.2\times10^{-5}$ mol/$m^2$ or more.

A more preferable method of producing an internal high-silver iodide phase is to simultaneously add a silver salt aqueous solution and an aqueous solution of a halide salt containing an iodide salt.

For instance, a $AgNO_3$ aqueous solution is added simultaneously with a KI aqueous solution, according to a double jet method. In this method, there may be a difference in addition-starting time and/or addition-terminating time between the KI aqueous solution and the $AgNO_3$ aqueous solution. The molar ratio of the $AgNO_3$ aqueous solution to be added to the KI aqueous solution is preferably 0.1 or more, more preferably 0.5 or more, and further preferably 1 or more. The total addition molar amount of the $AgNO_3$ aqueous solution may be a region wherein silver is excessive compared to an amount of a halogen ion in the system and an iodine ion to be added. Preferably, the pAg value at the time when an aqueous solution of a halide containing an iodine ion is added with a silver salt aqueous solution according to a double jet method, declines with the addition period involved according to the double jet method. The pAg value at the time when an addition starts is preferably 6.5 or more but 13 or less, and more preferably 7.0 or more but 11 or less. On the other hand, the pAg value when the addition is terminated is most preferably from 6.5 to 10.0.

When the above-mentioned methods are preformed, the solubility of the silver halide in the mixed system is preferably as low as possible. Accordingly, the temperature of the mixed system at the time when a high-silver iodide phase is formed, is preferably 30° C. or more but 70° C. or less, and more preferably 30° C. or more but 70° C. or less.

Further preferably, the internal high-silver iodide phase can be formed by adding a fine-grain silver iodide or a fine-grain silver iodobromide, or a fine-grain silver chloroiodido, or a fine-grain silver chloroiodobromide. The addition of fine-grain silver iodide is particularly preferred. The grain size of these fine grains is generally 0.01 μm or more but 0.1 μm or less. However, it is possible to use fine grains having a grain size of 0.01 μm or less, or 0.1 μm or more. These fine-grain silver halide grains can be prepared with reference to methods described in JP-A-1-183417, JP-A-2-44335, JP-A-1-183644, JP-A-1-183645, JP-A-2-43534, and JP-A-2-43535. An internal high-silver iodide phase can be formed by adding these fine-grain silver halides, and then ripening. The above-mentioned silver halide solvent may be used in order to solve the fine grains by ripening. All of these fine grains added are not necessary to be instantly solved and consumed; rather it is adequate if they are completely solved and consumed by the time when the final grains have been formed.

The location of internal high-silver iodide phases, when measured from a center of a hexangle, etc., formed by a projection of the grain, preferably exists in a range of 5 mol % or more, but less than 100 mol %; more preferably 20 mol % or more, but less than 95 mol %; and particularly preferably 50 mol % or more, but less than 90 mol %, with respect to the silver amount of the entire grain. The amount of silver halide that constitutes the internal high-silver iodide phase is preferably 50 mol % or less, and more preferably 20 mol % or less, of the silver amount of the entire grain. The above-mentioned amounts with respect to the high-silver iodide phase are based on a recipe for the production of silver halide emulsions, rather than on the values observed by a measurement according to several analytical methods of a halide composition of the final grains. This is because the internal high-silver iodide phase in the final grains often vanishes during a recrystallization step or the like in shelling process. The above-mentioned silver amount refers to the production method.

Accordingly, the internal silver iodide phase formed to introduce dislocation lines into the final grains is often difficult to observe as a definite layer, even though the dislocation lines in the final grains can be easily observed according to the above-mentioned methods, since the silver halide composition at the boundary successively varies. The halogen composition of the grains can be identified by a combination of X-ray diffraction, an EPMA (also called as an XMA) method (in which silver halide grains are scanned by an electron beam to detect a silver halide composition), an ESCA (also called as an XPS) method (in which X rays are radiated to perform spectroscopy for photoelectrons emitted from the grain surface), and the like.

The silver iodide content of an outer phase with which an internal high-silver iodide phase is covered, should be lower than that of the internal high-silver iodide phase, preferably such silver iodide content is to the silver halide amount contained in the external phase covering the internal phase.

The temperature and the pAg to be used for the formation of external phases covering internal high-silver iodide phases are arbitrary, but a preferable temperature is 30° C. or more, but 80° C. or less; and most preferably 35° C. or more, but 70° C. or less. A preferable pAg is 6.5 or more, but 11.5 or less. Use of the above-mentioned silver halide solvent is sometimes preferred, and the most preferred silver halide solvent is a thiocyanate salt.

Further as another method of introducing dislocation lines into tabular grains, there is a method by use of an iodide ion-releasing agent as described in JP-A-6-11782. This method is also preferably used.

It is also possible to introduce dislocation lines properly using this method and the afore-mentioned method of introducing dislocation lines in combination.

The variation coefficient of intergranular iodine distribution of silver halide grains contained in the photosensitive material of the present invention, preferably of the second embodiment of the present invention, is preferably 20% or less, more preferably 15% or less, and especially preferably 10% or less. In the case that the variation coefficient of iodine content distribution of individual silver halides is larger than 20%, it is not preferable. Because hard gradation is not obtained and reduction of sensitivity induced by pressure becomes larger.

As the method of producing silver halide grains having a narrow intergranular iodine distribution contained in the photosensitive material of the present invention, preferably of the second embodiment of the present invention, any known methods such as a method in which fine particles is added as described in JP-A-1-183417, and a method in which an iodide ion-releasing agent is used as described in JP-A-2-68538, may be used singly or in combination thereof.

The coefficient of variation of intergranular iodine distribution of silver halide grains for use in the present invention, preferably in the second embodiment of the present invention, is preferably 20% or less. As the most preferable method of making the intergranular iodine distribution to be monodisperse, a method described in JP-A-3-213845 may be used. That is, silver halide fine grains having a silver iodide content of 95 mol % or more are formed by mixing an aqueous solution of a water-soluble silver salt with an aqueous solution of a water-soluble halide (containing 95 mol % or more of iodide ions) in a mixer provided outside a reaction vessel. And then, immediately after forming said fine grains, they are applied to the reaction vessel, thereby, a monodispersed intergranular iodine distribution can be attained. Herein, the term "reaction vessel" means a vessel in which nucleation and/or crystal growth of silver halide tabular grains are carried out.

As a method of adding the silver halide grains prepared in the mixer and preparation means for use therein, the following three techniques as described in JP-A-3-213845 can be used:

(1) After forming fine grains in a mixer, they are immediately added to a reaction vessel;
(2) A strong and efficient mixing is conducted in a mixer; and
(3) Injection of an aqueous solution of a protective colloid into a mixer.

The protective colloid used in the above (3) may be injected singly into a mixer. Alternatively, an aqueous solution of a halide salt or an aqueous silver nitrate solution, in which the protective colloid is contained, may be injected into a mixer. A concentration of the protective colloid is 1 mass % or more, preferably in the range of from 2 to 5 mass %. Examples of a polymer compound that acts as a protective colloid for silver halide grains for use in the present invention, include polyacrylamide polymers, amino polymers, polymers having a thioether group, polyvinyl alcohol, acrylic acid polymers, polymers having hydroxy quinoline, celluloses, starch, acetal, polyvinyl pyrrolidone, and terpolymers. However, a low-molecular-weight gelatin is preferably used. A weight-average molecular weight of the low-molecular-weight gelatin is preferably 30,000 or less, and more preferably 10,000 or less.

The temperature of grain formation at the time when silver halide fine grains are prepared is preferably 35° C. or less, especially preferably 25° C. or less. The temperature of a reaction vessel in which the silver halide fine grains are added is 50° C. or more, preferably 60° C. or more, and furthermore preferably 70° C. or more.

The grain size of silver halide fine grains obtained according to the present invention can be measured directly observing the grains on a mesh by means of a transmission-type electron microscope. The size of the fine grains for use in the present invention, preferably in the second embodiment of the present invention, is preferably 0.3 μm or less, more preferably 0.1 μm or less, especially preferably 0.01 μm or less. The silver halide fine grains may be added simultaneously with other halide ions or silver ions. Alternatively, the silver halide fine grains may be added singly. The silver halide fine grains are mixed in the range of from 0.005 mol % to 20 mol %, preferably in the range of from 0.01 mol % to 10 mol %, based on the entire silver halides.

The silver iodide content of individual silver halide grains can be measured by a composition analysis of the individual silver halide grain using X-ray micro analyzer. The measurement of a silver iodide content of the individual grain is described, for example, in European Patent No. 147,868. Even though there is sometimes a relation between the silver iodide content Yi (mol %) of individual grain and an equivalent-sphere diameter Xi (μm) of individual grain, and there is sometimes no relation between them, but it is preferable that there is no relation between them. The structure relating to the silver halide composition of the grains for use in the present invention can be confirmed, for example, by a combination of X-ray diffraction, EPMA method (a method of detecting a silver halide composition by scanning of silver halide grains with electron beams), and ESCA method (a method of spectroscopic analyzing photoelectrons discharged from the grain surface upon X-ray radiation).

The coefficient of variation of intergranular iodine distribution is a value determined by the steps of: the silver iodide contents of at least 100, more preferably 200, and especially preferably 300 or more of emulsion grains are measured, to obtain the standard deviation of the silver iodide content and the average silver iodide content; and the coefficient of variation are calculated using the following relation:

$$(\text{Standard deviation}/\text{Average silver iodide content})\times 100=\text{Coefficient of variation}$$

The halogen composition of the grain surface can be measured usually according to the ESCA method.

In the present invention, preferably in the second embodiment of the present invention, in addition to the above-mentioned tabular grains, regular grains such cubic, octahedral and tetradecahedral grains, and irregular twin grains may be used.

The silver halide photographic photosensitive material of the present invention is suitable for black-and-white photographic papers, black-and-white negative films, roentgen films, color negative films, color positive films, color reversal films, color reversal photographic papers, color photographic papers and the like. In addition, this is also preferable for a film unit with a lens, as described in JP-B-2-32615 and JU-B-3-39784 ("JU-B" means examined an Japanese utility model publication).

Suitable supports that can be used in the present invention, are described, for example, in the afore-mentioned RD. No. 17643, page 28; RD. No. 18716, from page 647 right column to page 648 left column; and RD. No. 307105, page 879.

Other conventionally known photographic materials and additives may be used in the silver halide photographic light-sensitive material of the present invention. For example, as a photographic support, a transmissive type support and a reflective type support may be used. As the transmissive type support, it is preferred to use transparent supports, such as a cellulose nitrate film, and a transparent film of polyethyleneterephthalate; or a polyester of 2,6-naphthalenedicarboxylic acid (NDCA) and ethylene glycol (EG), or a polyester of NDCA, terephthalic acid and EG, provided thereon with an information-recording layer such as a magnetic layer. As the reflective type support, it is especially preferable to use a reflective support having a substrate laminated thereon with a plurality of polyethylene layers or polyester layers (water-proof resin layers or laminate layers), at least one of which contains a white pigment such as titanium oxide.

In the present invention, a more preferable reflective support for use is a support having a paper substrate provided with a polyolefin layer having fine holes, on the side to which silver halide emulsion layers are to be provided. The polyolefin layer may be composed of multi-layers. In this case, it is more preferable for the support to be composed of a fine hole-free polyolefin (e.g., polypropylene, polyethylene) layer adjacent to a gelatin layer on the same side as the silver halide emulsion layers, and a fine hole-containing polyolefin (e.g., polypropylene, polyethylene) layer closer to the paper substrate. The density of the multi-layer or single-layer of polyolefin layer(s) existing between the paper substrate and photographic constituting layers is preferably in the range of 0.40 to 1.0 g/ml (hereinafter, "ml" may be referred to as "mL"), and more preferably in the range of 0.50 to 0.70 g/ml. Further, the thickness of the multi-layer or single-layer of polyolefin layer(s) existing between the paper substrate and photographic constituting layers is preferably in the range of 10 to 100 μm, and more preferably in the range of 15 to 70 μm. Further, the ratio of thickness of the polyolefin layer(s) to the paper substrate is preferably in the range of 0.05 to 0.2, and more preferably in the range 0.1 to 0.5.

Further, it is also preferable for enhancing rigidity of the reflective support, to provide a polyolefin layer on the side of the foregoing paper substrate opposite to the side of the photographic constituting layers, i.e., on the back surface of the paper substrate. In this case, it is preferable that the polyolefin layer on the back surface be polyethylene or polypropylene, the surface of which is matted, with the polypropylene being more preferable. The thickness of the polyolefin layer on the back surface is preferably in the range of 5 to 50 μm, and more preferably in the range of 10 to 30 μm, and further the density thereof is preferably in the range of 0.7 to 1.1 g/mL. As to the reflective support for use in the present invention, preferable embodiments of the polyolefin layer to be provided on the paper substrate include those described in JP-A-10-333277, JP-A-10-333278, JP-A-11-52513, JP-A-11-65024, and European Patent Nos. 0880065 and 0880066.

It is preferred for the above-mentioned waterproof resin layer to contain a fluorescent brightening agent. A fluorescent brightening agent may be dispersed in a hydrophilic colloid layer of the light-sensitive material. As the fluorescent brightening agent, preferred are bezoxazole-series agents, coumarine-series agents and pyrazoline-series agents, and more preferred are bezoxazolyl naphthalene-series agents and bezoxazolyl stilbene-series agents. The amount of the fluorescent brightening agent to be used is not particularly limited, and preferably in the range of 1 to 100 $mg/m^2$. When the fluorescent brightening agent is mixed with the waterproof resin, a mixing ratio of the fluorescent brightening agent to the waterproof resin is preferably in the range of 0.0005 to 3 mass %, more preferably in the range of 0.001 to 0.5 mass %, based on the resin. Further, a transmissive type support or the foregoing reflective type support each having coated thereon a hydrophilic colloid layer containing a white pigment may be used as the reflective type support. Furthermore, a reflective type support having a mirror plate reflective metal surface or a secondary diffusion reflective metal surface may be employed as the reflective type support.

As the support for use in the light-sensitive material according to the present invention, a support of the white polyester type, or a support provided with a white pigment-containing layer on the same side as the silver halide emulsion layer, may be adopted for display use. Further, it is preferable for improving sharpness that an antihalation layer is provided on the silver halide emulsion layer coating side or the reverse side of the support. In particular, it is preferable that the transmission density of support is adjusted to the range of 0.35 to 0.8 so that a display may be enjoyed by means of both transmitted and reflected rays of light.

In the light-sensitive material according to the present invention, in order to improve, e.g., sharpness of an image, a dye (particularly an oxonole-series dye) that can be discolored by processing, as described in European Patent Application Publication No. 0,337,490, pages 27 to 76, is preferably added to the hydrophilic colloid layer such that an optical reflection density at 680 nm in the light-sensitive material is 0.70 or more. It is also preferable to add 12% by mass or more (more preferably 14% by mass or more) of titanium oxide that is surface-treated with dihydric to tetrahydric alcohols (e.g., trimethylolethane) and the like to a water-proof resin layer of the support.

The light-sensitive material according to the present invention preferably contains, in their hydrophilic colloid layers, dyes (particularly oxonole dyes and cyanine dyes) that can be discolored by processing, as described in European Patent Application Publication No. 0337490, pages 27 to 76, in order to prevent irradiation or halation or enhance safelight safety, and the like. Further, dyes described in European Patent Application Publication No. 0819977 are also preferably used in the present invention.

Among these water-soluble dyes, some deteriorate color separation or safelight safety when used in an increased amount. Preferable examples of the dye which can be used and which does not deteriorate color separation include water-soluble dyes described in JP-A-5-127324, JP-A-5-127325 and JP-A-5-216185.

In the present invention, it is possible to use a colored layer which can be discolored during processing, in place of the water-soluble dye, or in combination with the water-soluble dye. The colored layer that can be discolored with a processing, to be used, may contact with an emulsion layer directly, or indirectly through an interlayer containing an agent for preventing color-mixing during processing, such as gelatin and hydroquinone. The colored layer is preferably provided as a lower layer (closer to a support) with respect to the emulsion layer which develops the same primary color as the color of the colored layer. It is possible to provide colored layers independently, each corresponding to respective primary colors. Alternatively, only some layers selected from them may be provided. In addition, it is possible to provide a colored layer subjected to coloring so as to match a plurality of primary-color regions. About the optical reflection density of the colored layer, it is preferred that, at the wavelength which provides the highest optical density in a range of wavelengths used for exposure (a visible light region from 400 nm to 700 nm for an ordinary printer exposure, and the wavelength of the light generated from the light source in the case of scanning exposure), the optical density is 0.2 or more but 3.0 or less, more preferably 0.5 or more but 2.5 or less, and particularly preferably 0.8 or more but 2.0 or less.

The colored layer may be formed by a known method. For example, there are a method in which a dye in a state of a dispersion of solid fine particles is incorporated in a hydrophilic colloid layer, as described in JP-A-2-282244, from page 3, upper right column to page 8, and JP-A-3-7931, from page 3, upper right column to page 11, left under column; a method in which an anionic dye is mordanted in a cationic polymer; a method in which a dye is adsorbed onto fine grains of silver halide or the like and fixed in the layer; and a method in which a colloidal silver is used as described in JP-A-1-239544. As to a method of dispersing fine-powder of a dye in solid state, for example, JP-A-2-308244, pages 4 to 13 describes a method in which fine particles of dye which is at least substantially water-insoluble at the pH of 6 or less, but at least substantially water-soluble at the pH of 8 or more, are incorporated. The method of mordanting anionic dyes in a cationic polymer is described, for example, in JP-A-2-84637, pages 18 to 26. U.S. Pat. Nos. 2,688,601 and 3,459,563 disclose a method of preparing a colloidal silver for use as a light absorber. Among these methods, preferred are the methods of incorporating fine particles of dye and of using a colloidal silver.

The color photographic printing paper preferably has at least one yellow color-forming silver halide emulsion layer, at least one magenta color-forming silver halide emulsion layer, and at least one cyan color-forming silver halide emulsion layer. Generally, these silver halide emulsion layers are in the order, from the support, of the yellow color-forming silver halide emulsion layer, the magenta color-forming silver halide emulsion layer, and the cyan color-forming silver halide emulsion layer. However, another layer arrangement which is different from the above, may be adopted.

A yellow coupler-containing silver halide emulsion layer may be disposed at any position on a support. However, in the case where silver halide tabular grains are contained in the yellow coupler-containing layer, it is preferable that the yellow coupler-containing layer be positioned more apart from a support than at least one of a magenta coupler-containing silver halide emulsion layer and a cyan coupler-containing silver halide emulsion layer. Further, it is preferable that the yellow coupler-containing silver halide emulsion layer is positioned most apart from a support than other silver halide emulsion layers, from the viewpoint of color-development acceleration, desilvering acceleration, and reducing residual color due to a sensitizing dye. Further, it is preferable that the cyan coupler-containing silver halide emulsion layer is disposed in the middle of other silver halide emulsion layers, from the viewpoint of reducing blix fading. On the other hand, it is preferable that the cyan coupler-containing silver halide emulsion layer is the lowest layer, from the viewpoint of reducing light fading. Further, each of the yellow-color-forming layer, the magenta-color-forming layer and the cyan-color-forming layer may be composed of two or three layers. It is also preferable that a color forming layer is formed by disposing a silver halide emulsion-free layer containing a coupler in adjacent to a silver halide emulsion layer, as described in, for example, JP-A-4-75055, JP-A-9-114035, JP-A-10-246940, and U.S. Pat. No. 5,576,159.

Preferred examples of silver halide emulsions and other materials (additives or the like) applied to the present invention, photographic constitutional layers (arrangement of the layers or the like), and processing methods for processing the photographic materials and additives for processing are disclosed in JP-A-62-215272, JP-A-2-33144 and European Patent Application Publication No. 0,355,660. Particularly, those disclosed in European Patent Application Publication No. 0,355,660 are preferably used. Further, it is also preferred to use silver halide color photographic light-sensitive materials and processing methods thereof described in JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641 and European Patent Application Publication No. 0520457.

In particular, as the above-described reflective support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizers), the cyan, magenta, and yellow couplers and the emulsifying and dispersing methods thereof, the dye image preservability-improving agents (stain inhibitors and anti-fading agents), the dyes (coloring layers), the kinds of gelatin, the layer structure of the light-sensitive material, and the film pH of the light-sensitive material, those described in the patent publications as shown in the following tables 2 and 3 are particularly preferably used in the present invention.

TABLE 2

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptoheterocyclic compounds) |

TABLE 2-continued

| Element | JP-A-7-104448 | JP-A-7-77775 | JP-A-7-301895 |
|---|---|---|---|
| Chemical sensitizing methods (Chemical sensitizers) | Column 74, line 45 to Column 75, line 6 | Column 47, lines 7 to 17 | Column 81, lines 9 to 17 |
| Spectrally sensitizing methods (Spectral sensitizers) | Column 75, line 19 to Column 76, line 45 | Column 47, line 30 to Column 49, line 6 | Column 81, line 21 to Column 82, line 48 |
| Cyan couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88, lines 32 to 46 |
| Emulsifying and dispersing methods of couplers | Column 71, line 3 to Column 72, line 11 | Column 61, lines 36 to 49 | Column 87, lines 35 to 48 |

TABLE 3

| Element | JP-A-7-104448 | JP-A-7-77775 | JP-A-7-301895 |
|---|---|---|---|
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring agents) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive materials | Column 39, lines 11 to 26 | Column 44, lines 2 to 35 | Column 31, line 38 to Column 32, line 33 |
| pH of coated film of light-sensitive material | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing solution | Column 88, line 19 to Column 89, line 22 | | |

As cyan, magenta and yellow couplers which can be used in the present invention, in addition to the above mentioned ones, those disclosed in JP-A-62-215272, page 91, right upper column, line 4 to page 121, left upper column, line 6, JP-A-2-33144, page 3, right upper column, line 14 to page 18, left upper column, bottom line, and page 30, right upper column, line 6 to page 35, right under column, line 11, European Patent Application Publication No. 0355,660, page 4, lines 15 to 27, page 5, line 30 to page 28, bottom line, page 45, lines 29 to 31, page 47, line 23 to page 63, line 50, are also advantageously used.

Further, it is preferred for the present invention to add compounds represented by formula (II) or (III) in WO 98/33760 and compounds represented by formula (D) in JP-A-10-221825.

These compounds are further concretely described below.

As the cyan coupler which can be used in the present invention, pyrrolotriazole-series couplers are preferably used, and couplers represented by any of formulae (I) and (II) in JP-A-5-313324 and couplers represented by formula (I) in JP-A-6-347960, and exemplified couplers described in these publications are particularly preferred. Further, phenol-series or naphthol-series cyan couplers are also preferred. For example, cyan couplers represented by formula (ADF) described in JP-A-10-333297. are preferred.

As cyan couplers other than the foregoing cyan couplers, there are pyrroloazole-type cyan couplers described in European Patent No. 0 488 248 and European Patent Application Publication No. 0 491 197 (A1), 2,5-diacylamino phenol couplers described in U.S. Pat. No. 5,888,716, pyrazoloazole-type cyan couplers having an electron-withdrawing group or a group bonding via hydrogen bond at the 6-position, as described in U.S. Pat. Nos. 4,873,183 and 4,916,051, and particularly preferably pyrazoloazole-type cyan couplers having a carbamoyl group at the 6-position, as described in JP-A-8-171185, JP-A-8-311360 and JP-A-8-339060.

In addition, it can be used a diphenylimidazole-series cyan coupler described in JP-A-2-33144; as well as a 3-hydroxypyridine-series cyan coupler (particularly a 2-equivalent coupler formed by allowing a 4-equivalent coupler of a coupler (42), to have a chlorine splitting-off group, and couplers (6) and (9), enumerated as specific examples are particularly preferable) described in European Patent Application Publication No. 0333185 A2; a cyclic active methylene-series cyan coupler (particularly couplers 3, 8, and 34 enumerated as specific examples are particularly preferable) described in JP-A-64-32260; a pyrrolopyrazole cyan coupler described in European Patent Application Publication No. 0456226; and a pyrroloimidazole-type cyan coupler described in European Patent No. 0484909.

The magenta couplers that can be used in the present invention are 5-pyrazolone-series magenta couplers and pyrazoloazole-series magenta couplers such as those described in the above-mentioned known documents in the above tables. Among these, preferred are pyrazolotriazole couplers in which a secondary or tertiary alkyl group is directly bonded to the 2-, 3- or 6-position of the pyrazolotriazole ring, such as those described in JP-A-61-65245; pyrazoloazole couplers having a sulfonamido group in its molecule, such as those described in JP-A-61-65246; pyrazoloazole couplers having an alkoxyphenylsulfonamido ballasting group, such as those described in JP-A-61-147254; and pyrazoloazole couplers having an alkoxy or aryloxy group at the 6-position, such as those described in European Patent Nos. 226849 A and 294785 A, in view of the hue and stability of image to be formed therefrom and color-forming property of the couplers.

Particularly as the magenta coupler, pyrazoloazole couplers represented by formula (M-I) described in JP-A-8-122984 are preferred. The descriptions of paragraph Nos. 0009 to 0026 of the patent publication JP-A-8-122984 are entirely applied to the present invention and therefore are incorporated in the specification of this application as a part thereof by reference. In addition, pyrazoloazole couplers having a steric hindrance group at both the 3- and 6-positions, as described in European Patent Nos. 854384 and 884640, can also be preferably used.

Further, as yellow couplers, preferably used in the present invention are acylacetamide-type yellow couplers in which the acyl group has a 3-membered to 5-membered cyclic structure, such as those described in European Patent Application Publication No. 0447969; malondianilide-type yellow couplers having a cyclic structure, as described in European Patent Application Publication No. 0482552; and acylacetamide yellow couplers having a dioxane structure such as those described in U.S. Pat. No. 5,118,599, in addition to the compounds described in the above-mentioned tables. Above all, acylacetamide-type yellow couplers in which the acyl group is an 1-alkylcyclopropane-1-carbonyl group, and malondianilide-type yellow couplers in which one anilide constitutes an indoline ring are especially preferably used. These couplers may be used singly or as combined.

It is preferred that couplers for use in the present invention, are pregnated into a loadable latex polymer (as described, for example, in U.S. Pat. No. 4,203,716) in the presence (or absence) of the high-boiling-point organic solvent described in the foregoing table, or they are dissolved in the presence (or absence) of the foregoing high-boiling-point organic solvent with a polymer insoluble in water but soluble in an organic solvent, and then emulsified and dispersed into an aqueous hydrophilic colloid solution.

Examples of the water-insoluble but organic solvent-soluble polymer which can be preferably used, include the homo-polymers and co-polymers as disclosed in U.S. Pat. No. 4,857,449, from column 7 to column 15 and WO 88/00723 pamphlet, from page 12 to page 30. The use of methacrylate-series or acrylamide-series polymers, especially acrylamide-series polymers are preferable in view of color-image stabilization and the like.

In the photosensitive material of the present invention, it is preferable to use the above-mentioned compounds in combination with a compound having at least three heteroatoms, described in JP-A-2000-194085 and JP-A-2003-156823.

In the present invention, known color mixing-inhibitors may be used. Among these compounds, those described in the following patent publications are preferred. For example, high molecular weight redox compounds described in JP-A-5-333501; phenidone- or hydrazine-series compounds as described in WO 98/33760 pamphlet and U.S. Pat. No. 4,923,787 and the like; and white couplers as described in JP-A-5-249637, JP-A-10-282615, German Patent Application Publication No. 19629142 A1 and the like, may be used. Particularly, in order to accelerate developing speed by increasing the pH of a developing solution, redox compounds described in German Patent Application Publication No. 19618786, European Patent Application Publication Nos. 839623 and 842975, German Patent Application Publication No. 19806846 and French Patent Application Publication No. 2760460, are also preferably used.

In the present invention, as an ultraviolet ray absorbent, it is preferred to use compounds having a high molar extinction coefficient and a triazine skeleton. For example, those described in the following patent publications can be used.

For example, use can be made of those described, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19739797A, European Patent No. 711804 A and JP-T-8-501291, and the like.

As a binding agent or a protective colloid which can be used in the photosensitive material of the present invention, gelatin is used advantageously. Hydrophilic colloids other than gelatin may be used singly or in combination with the gelatin. Examples of such hydrophilic colloids which can be used, include proteins, such as gelatin derivatives, graft polymers of gelatin and other polymers, albumin, and casein; cellulose derivatives, such as hydroxyethyl cellulose, carboxymethyl cellulose, and cellulose sulfate esters; sugar derivatives, such as sodium alginate, and starch derivatives; and various kinds of synthetic hydrophilic high molecular materials, such as homo- or co-polymers of polyvinyl alcohol, a partial acetal of polyvinyl alcohol, poly-N-vinyl pyrrolidone, polyacrylic acid, polymethacrylic acid, polyacryl amide, polyvinyl imidazole, polyvinyl pyrazole and the like.

As the gelatin, in addition to lime-processed gelatin, acid-processed gelatin, and enzyme-processed gelatin described in Bull. Soc. Sci. Photo. Japan, No. 16, page 30 (1966), can be used. Further a hydrolyzate or enzymolyzate of gelatin can also be used. It is preferable for the gelatin that the content of heavy metals, such as Fe, Cu, Zn and Mn, included as impurities, be reduced to 5 ppm or below, more preferably 3 ppm or below. Further, the amount of calcium contained in the light-sensitive material is preferably 20 $mg/m^2$ or less, more preferably 10 $mg/m^2$ or less, and most preferably 5 $mg/m^2$ or less.

In the present invention, it is preferred to add an antibacterial (fungi-preventing) agent and antimold agent, as described in JP-A-63-271247, in order to destroy various kinds of molds and bacteria which propagate in a hydrophilic colloid layer and deteriorate the image.

Further, the pH of the coating film of the light-sensitive material is preferably in the range of 4.0 to 7.0, more preferably in the range of 4.0 to 6.5.

An emulsion for use in the present invention is preferably washed with water to desalt, and followed by dispersion into a newly prepared protective colloid. The washing temperature is varied in accordance with a purpose, but the temperature is preferably selected in the range of from 5 to 50° C. The pH at the time of washing can be also selected in accordance with a purpose, but the pH is preferably selected in the range of from 2 to 10, more preferably in the range of from 3 to 8. The pAg at the time of washing can be also selected in accordance with a purpose, but the pAg is preferably selected in the range of from 5 to 10. The washing methods may be selected from a noodle washing method, a dialysis method using a semi-permeable membrane, a centrifugal separating method, a coagulation precipitating method, and an ion-exchange method. As the coagulation precipitating method, there can be selected from a method using a sulfate, a method using an organic solvent, a method using a water-soluble polymer, and a method using a gelatin derivative.

As an emulsion for use in the present invention, it is preferred to use oxidants to silver other than oxoacid salts of halogen in the process of producing the emulsion. However, the positive hole-capturing silver nuclei produced by reduction sensitization of the grain surface are necessary to remain so that the sensitivity/fog ratio becomes optimum in view of a photographic performance. Particularly, a compound that is able to convert tiny silver nuclei that are by-produced in the processes of chemical sensitization and formation of silver halide grains, and that do not contribute to enhancement of sensitivity, but cause to increase fog into silver ions. Herein, the thus-produced silver ion may form a silver salt that is hardly soluble in water, such as silver halide, silver sulfide, and silver selenide, or they may form a silver salt that is easily soluble in water, such as silver nitrate. Preferable oxidants are inorganic oxidants such as thiosulfonate salts, and organic oxidants such as quinones.

In the present invention, a surface-active agent may be added to the light-sensitive material, in view of improvement in coating-stability, prevention of static electricity from being occurred, and adjustment of the charge amount. As the surface-active agent, there are anionic, cationic, betaine and nonionic surfactants. Examples thereof include those described in JP-A-5-333492. As the surface-active agent for use in the present invention, a fluorine-containing surface-active agent is preferred. Particularly, a fluorine-containing surface-active agents is preferably used. The amount of the surface-active agent to be added to the light-sensitive material is not particularly limited, but generally in the range of $1\times10^{-5}$ to 1 g/m$^2$, preferably in the range of $1\times10^{-4}$ to $1\times10^{-1}$ g/m$^2$, and more preferably in the range of $1\times10^{-3}$ to $1\times10^{-2}$ g/m$^2$.

These fluorine-containing surface-active agent may be used singly or in combination with known another surface-active agent. The fluorine-containing surfactant is preferably used in combination with known another surface-active agent.

The light-sensitive material for use in the present invention can preferably be used, in a scanning exposure system using a cathode ray tube (CRT), in addition to the printing system using a usual negative printer. The cathode ray tube exposure apparatus is simpler and more compact, and therefore less expensive than an apparatus using a laser. Further, optical axis and color (hue) can easily be adjusted.

In a cathode ray tube which is used for image-wise exposure, various light-emitting materials which emit a light in the spectral region, are used as occasion demands. For example, any one of red-light-emitting materials, green-light-emitting materials, blue-light-emitting materials, or a mixture of two or more of these light-emitting materials may be used. The spectral regions are not limited to the above red, green and blue, and fluorophoroes which can emit a light in a region of yellow, orange, purple or infrared can be used. Particularly, a cathode ray tube which emits a white light by means of a mixture of these light-emitting materials, is often used.

In the case where the light-sensitive material has a plurality of light-sensitive layers each having different spectral sensitivity distribution from each other and also the cathode ray tube has a fluorescent substance which emits light in a plurality of spectral regions, exposure to a plurality of colors may be carried out at the same time. Namely, a plurality of color image signals may be input into a cathode ray tube, to allow light to be emitted from the surface of the tube.

Alternatively, a method in which an image signal of each of colors is successively input and light of each of colors is emitted in order, and then exposure is carried out through a film capable of cutting a color other than the emitted color, i.e., a surface successive exposure, may be used. Generally, among these methods, the surface successive exposure is preferred from the viewpoint of high quality enhancement, because a cathode ray tube having a high resolving power can be used.

The light-sensitive material for use in the present invention can preferably be used in the digital scanning exposure system using monochromatic high density light, such as a gas laser, a light-emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a solid state laser or a semiconductor laser, to make a system more compact and inexpensive. In particular, to design a compact and inexpensive apparatus having a longer duration of life and high stability, use of a semiconductor laser is preferable; and it is preferred that at least one of exposure light sources would be a semiconductor laser.

When such a scanning exposure light source is used, the maximum spectral sensitivity wavelength of the light-sensitive material of the present invention can be arbitrarily set up in accordance with the wavelength of a scanning exposure light source to be used. Since oscillation wavelength of a laser can be made half, using a SHG light source obtainable by a combination of a nonlinear optical crystal with a semiconductor laser or a solid state laser using a semiconductor as an excitation light source, blue light and green light can be obtained. Accordingly, it is possible to have the spectral sensitivity maximum of a light-sensitive material in normal three wavelength regions of blue, green and red.

The exposure time in such a scanning exposure is defined as the time necessary to expose the size of the picture element with the density of the picture element being 400 dpi, and preferred exposure time is $10^{-4}$ sec or less and more preferably $10^{-6}$ sec or less.

The scanning exposure system that can preferably be used for the present invention is described in detail in the patent publications as shown in the above table.

With respect to the processing of the photographic material of the present invention, processing materials and processing methods, as disclosed in JP-A-2-207250, from page 26, right under column, line 1 to page 34, right upper column, line 9, and JP-A-4-97355, from page 5, left upper column, line 17 to page 18, right under column, line 20, can be preferably applied. Further, as preservatives which are used in the developing solution, compounds described in the patent publications as shown in the above table can be preferably used.

The present invention is preferably applied to a light-sensitive material having rapid processing suitability.

Herein, the term "color-developing time" as used herein means a period of time required from the beginning of dipping a light-sensitive material into a color developing solution until the light-sensitive material is dipped into a blix solution in the subsequent processing step. In the case where a processing is carried out using, for example, an autoprocessor, the color developing time is the sum total of a time in which a light-sensitive material has been dipped in a color developing solution (so-called "time in the solution") and a time in which the light-sensitive material has left the solution and been conveyed in air toward a bleach-fixing bath in the step subsequent to color development (so-called "time in the air"). Likewise, the term "blix time" as used herein means a period of time required from the beginning of dipping a light-sensitive material into a blix solution until the light-sensitive material is dipped into a washing bath or a stabilizing bath in the subsequent processing step. Further, the term "washing or stabilizing time" as used herein means a period of time required from the beginning of dipping a light-sensitive material into a washing solution or a stabilizing solution until the end of the dipping toward a drying step (so-called "time in the solution").

In the case that a rapid processing is carried out using a color paper for use in the present invention, the color developing time is preferably 60 seconds or less, more preferably 50 seconds or less but 6 seconds or more, and furthermore preferably 30 seconds or less but 6 seconds or more. Similarly, the blix time is preferably 60 seconds or less, more preferably 50 seconds or less but 6 seconds or more, and furthermore preferably 30 seconds or less but 6 seconds or more. Besides, the washing or stabilizing time is preferably 150 seconds or less, more preferably 130 seconds or less but 6 seconds or more.

Examples of a development method applicable to the light-sensitive material for use in the present invention after exposure, include a conventional wet system, such as a development method using a developing solution containing an alkali agent and a developing agent, and a development method wherein a developing agent is incorporated in the light-sensitive material and an activator solution, e.g., a developing agent-free alkaline solution is employed for the development, as well as a heat development system using no processing solution. In particular, the activator method is preferred over the other methods, because the processing solutions contain no developing agent, thereby it enables easy management and handling of the processing solutions and reduction in waste disposal load to make for environmental preservation.

Examples of the preferable developing agents or their precursors incorporated in the light-sensitive materials in the case of adopting the activator method, include the hydrazine-type compounds described in, for example, JP-A-8-234388, JP-A-9-152686, JP-A-9-152693, JP-A-9-211814 and JP-A-9-160193.

Further, the processing method in which the photographic material reduced in the amount of silver to be applied undergoes the image amplification processing using hydrogen peroxide (intensification processing), can be employed preferably. In particular, it is preferable to apply this processing method to the activator method. Specifically, the image-forming methods utilizing an activator solution containing hydrogen peroxide, as disclosed in JP-A-8-297354 and JP-A-9-152695 can be preferably used.

Although the processing with an activator solution is generally followed by a desilvering step in the activator method, the desilvering step can be omitted in the case of applying the image amplification processing method to photosensitive materials having a reduced silver amount. In such a case, washing or stabilization processing can follow the processing with an activator solution to result in simplification of the processing process. On the other hand, when the system of reading the image information from photosensitive materials by means of a scanner or the like is employed, the processing form requiring no desilvering step can be applied, even if the photosensitive materials are those having a high silver amount, such as photosensitive materials for shooting.

As the processing materials and processing methods of the activator solution, desilvering solution (bleach/fixing solution), washing solution and stabilizing solution, for use in the present invention, known ones can be used. Preferably, those described in *Research Disclosure,* Item 36544, pp. 536–541 (September 1994), and JP-A-8-234388 can be used in the present invention.

It is preferred to use a band stop filter, as described in U.S. Pat. No. 4,880,726, when the photosensitive material of the present invention is subjected to exposure with a printer. Color mixing of light can be excluded and color reproducibility is remarkably improved by the above means.

In the present invention, a yellow microdot pattern may be previously pre-exposed before giving an image information, to thereby perform a copy restraint, as described in European Patent Application Publication Nos. 0789270 and 0789480.

In the photographic emulsion used in the present invention, various compounds can be incorporated for the purpose of preventing fogging during the process of the production of the light-sensitive material, during the storage of the light-sensitive material, or during the photographic processing, or for the purpose of stabilizing the photographic performance. That is, compounds known as antifoggants or stabilizers can be added, such as thiazoles including benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole); mercaptopyrimidines; mercaptotriazines; thioketo compounds, such as oxazolinthione; azaindenes, such as triazaindenes, tetraazaindenes (particularly 4-hydroxy-substituted-1,3,3a,7-tetraazaindenes), and pentaazaindenes. For examples, those described in U.S. Pat. Nos. 3,954,474 and 3,982,947, and JP-B-52-28660, can be used. A preferable compound is a compound described in JP-A-63-212932. In accordance with various purposes, the antifoggant and the stabilizer can be added at various times, for example, before the formation of the grains, during the formation of the grains, after the formation of the grains, in the step of washing with water, at the time of dispersion after the washing with water, before the chemical sensitization, during the chemical sensitization, after the chemical sensitization, and before the application. In addition to the case wherein the antifoggant and the stabilizer are added during the preparation of the emulsion, so that the antifogging effect and the stabilizing effect, which are their essential effects, may be achieved, they can be used for various other purposes, for example, for controlling the habit of the crystals, for making the grain size small, for reducing the solubility of the grains, for controlling the chemical sensitization, and for controlling the arrangement of the dyes.

Photographic processing and technologies such as arrangement of layers, silver halide emulsions, dye-forming couplers, functional couplers such as DIR couplers, various kinds of additives and the like that can be used in the silver halide photographic photosensitive material capable of applying the present invention, are described in European Patent Application Publication No. 0565096 (published on Oct. 13, 1993) and publications referred to therein. Each item and its corresponding portion of the description are listed below.

11. Latent image formation type of emulsion: page 62, line 54 to page 63, line 5
12. Physical ripening and chemical ripening of emulsion: page 63, lines 6 to 9
13. Use of mixed emulsion: page 63, lines 10 to 13
14. Fogged emulsion: page 63, lines 14 to 31
15. Non-light sensitive emulsion: page 63, lines 32 to 43
16. Coating amount of silver: page 63, lines 49 to 50
17. Photographic additives: These are described in Research Disclosure (RD) Item No. 17643 (December, 1978), RD Item No. 18716 (November, 1979), RD Item No. 307105 (November, 1989) and RD Item No. 308119 (December, 1989). Each item and its relating portion of the description are set forth below. (In the first embodiment of the present invention, RD Item No. 17643, RD Item No. 18716 and RD Item No. 307105 are preferably applied to the present invention. In the second embodiment of the present invention, RD Item No. 17643, RD Item No. 18716 and RD Item No. 308119 are preferably applied to the present invention.)

TABLE 4

| | Kind of Additive | RD 17643 | RD 18716 | RD 307105 | RD 308119 |
|---|---|---|---|---|---|
| (1) | Chemical sensitizers | p.23 | p.648 right column | p.866 | p.996 |
| (2) | Sensitivity-enhancing agents | | p.648 right column | | |
| (3) | Spectral sensitizers and Supersensitizers | pp.23–24 | p.648, right column–p.649, right column | pp.866–868 | 996, right–998, right |
| (4) | Brightening agents | p.24 | p.647 right column | p.868 | 998, right |
| (5) | Antifogging agents and Stabilizers | pp.24–25 | p.649 right column | pp.868–870 | 998, right–1000, right |
| (6) | Light absorbers, Filter dyes, and UV Absorbers | pp.25–26 | p.649, right column–p.650, left column | p.873 | 1003, left–1003, right |
| (7) | Anti-stain agent | p.25 right column | p.650, left column–right column | p.872 | 1002, right |
| (8) | Dye image stabilizers | p.25 | p.650 left column | p.872 | 1002, right |
| (9) | Hardeners | p.26 | p.651 left column | pp.874–875 | 1004, right–1005, left |
| (10) | Binders | p.26 | p.651 left column | pp.873–874 | 1003, right–1004, right |
| (11) | Plasticizers and Lubricants | p.27 | p.650 right column | p.876 | 1006, left–1006, right |
| (12) | Coating aids and Surfactants | pp.26–27 | p.650 right column | pp.875–876 | 1005, left–1006, left |
| (13) | Antistatic agents | p.27 | p.650 right column | pp.876–877 | 1006, right–1007, left |
| (14) | Matting agents | | | pp.878–879 | 1008, left–1009, left |

1. Layer composition: page 61, lines 23 to 35, and page 61, line 41 to page 62, line 14
2. Interlayer: page 61, lines 36 to 40
3. Inter layer effect-imparting layer: page 62, lines 15 to 18
4. Halogen composition of silver halide: page 62, lines 21 to 25
5. Crystal habit of silver halide grains: page 62, lines 26 to 30
6. Size of silver halide grains: page 62, lines 31 to 34
7. Production method of emulsion: page 62, lines 35 to 40
8. Grain size distribution of silver halide: page 62, lines 41 to 42
9. Tabular grains: page 62, lines 43 to 46
10. Inner structure of grains: page 62, lines 47 to 53
18. Formaldehyde scavenger: page 64, lines 54 to 57
19. Mercapto-series antifogging agent: page 65, lines 1 to 2
20. Releasing agent of fogged agent and the like: page 65, lines 3 to 7
21. Dye: page 65, lines 7 to 10
22. Whole color couplers: page 65, lines 11 to 13
23. Yellow, magenta and cyan coupler: page 65, lines 14 to 25
24. Polymer coupler: page 65, lines 26 to 28
25. Diffusible dye-forming coupler: page 65, lines 29 to 31
26. Colored coupler: page 65, lines 32 to 38
27. Whole functional couplers: page 65, lines 39 to 44
28. Releasing coupler of bleach accelerator: page 65, lines 45 to 48

29. Releasing coupler of development accelerator: page 65, lines 49 to 53
30. Other DIR coupler: page 65, line 54 to page 66, line 4
31. Method of dispersing couplers: page 66, lines 5 to 28
32. Antiseptics and anti-molding agent: page 66, lines 29 to 33
33. Kind of photosensitive material: page 66, lines 34 to 36
34. Film thickness and swelling rate of light-sensitive layer: page 66, lines 40 to page 67, line 1
35. Backing layer: page 67, lines 3 to 8
36. Whole development processing: page 67, lines 9 to 11
37. Developing solution and developing agent: page 67, lines 12 to 30
38. Additives of developing solution: page 67, lines 31 to 44
39. Reversal processing: page 67, lines 45 to 56
40. Aperture efficiency of processing solution: page 67, line 57 to page 68, line 12
41. Developing time: page 68, lines 13 to 15
42. Blix, bleaching and fixing: page 68, line 16 to page 69, line 31
43. Automatic processing apparatus: page 69, lines 32 to 40
44. Washing with water, rinse and stabilization: page 69, line 41 to page 70, line 18
45. Replenishment and reuse of processing solution: page 70, lines 19 to 23
46. Developing agent-incorporated photosensitive material: page 70, lines 24 to 33
47. Processing temperature for development: page 70, lines 34 to 38
48. Application to films with lens: page 70, lines 39 to 41

As a material for giving rise to the inter layer effect, a compound which releases a development inhibitor or its precursor by reacting with the oxidized form of a developing agent, which is prepared by development, is used. Examples of the compound are a DIR (development inhibitor releasing) coupler, DIR-hydroquinone, and a coupler which releases DIR-hydroquinone or its precursor. For a development inhibitor having a high diffusibility, the development inhibiting effect can be obtained regardless of the position of the donor layer in a multilayered interlayer arrangement. However, a development inhibiting effect in an unintended direction also occurs. To correct this effect, therefore, it is preferable to make the donor layer generate a color (e.g., to make the donor layer generate the same color as that of a layer which undergoes the influence of the undesired development inhibiting effect). To obtain the spectral sensitivity of the photosensitive material of the present invention, it is preferable that the donor layer providing an inter layer effect generates coloring of magenta.

Further, it is preferred to use a bleaching solution containing 2-pyridine carboxylic acid or 2,6-pyridine dicarboxylic acid, ferric salts such as ferric nitrate, and persulfates described in European Patent No. 602600. When such bleaching solution is used, it is preferred to set a stopping process and a washing process with water between color development process and bleaching process. Organic acids such as acetic acid, succinic acid and maleic acid are preferably used in a stopping solution. Further, for the purposes of pH adjustment and bleach fogging, such bleaching solution preferably contains organic acids such as acetic acid, succinic acid, maleic acid, glutaric acid and adipic acid in the range of from 0.1 to 2 mol/liter (hereinafter, the term "liter" may be also mentioned as "L", and, similarly, the term "milliliter" may be mentioned as "mL").

The reflection (support) type silver halide color photographic photosensitive material for use in the present invention is preferably used in combination with the exposure and development systems described in the following known materials. Example of the above-described development system include the automatic print and development system described in JP-A-10-333253, the photosensitive material conveying apparatus described in JP-A-2000-10206, a recording system including the image reading apparatus described in JP-A-11-215312, exposure systems with the color image recording method described in JP-A-11-88619 and JP-A-10-202950, a digital photo print system including the remote diagnosis method described in JP-A-10-210206, and a photo print system including the image recording apparatus described in Japanese Patent Application No. 10-159187.

Typically, as color-development processing when defining hue and the white background in the present invention, there is a method in which a process is carried out using a processing solution obtained after a sample of the light-sensitive material is imagewisely exposed from a negative film having an average density by using a mini-lab "PP350" (trade name) manufactured by Fuji Photo Film Co., Ltd. and a CP48S Chemical (trade name) as a processing agent, and continuous processing is carried out until the volume of a color-developer replenisher becomes twice the volume of a tank of a color developing solution.

The chemical as the processing agent may be CP45X, or CP47L, manufactured by Fuji Photo Film Co., Ltd., or RA-100, RA-4, manufactured by Eastman Kodak Co. (each trade name), or the like without any problem.

In the case that the light-sensitive material of the present invention is a permeable type color photographic light-sensitive material, at least one light-sensitive layer may be provided on a support. A typical example is a silver halide photographic light-sensitive material having, on the support, at least one light-sensitive layer composed of plural silver halide emulsion layers which have substantially the same color sensitivity but different light sensitivities. The light-sensitive layer is a unit light-sensitive layer that has a color sensitivity to any of blue light, green light and red light. In a multi-layer silver halide color photographic light-sensitive material, such unit light-sensitive layers are generally arranged in the order of a red-sensitive layer, a green-sensitive layer and a blue-sensitive layer from the support side. However, according to the intended use, this order of arrangement can be reversed. Alternatively, the layers may be arranged such that sensitive layers sensitive to the same color can sandwich another sensitive layer sensitive to a different color. Non-light-sensitive layers can be formed as an interlayer between the silver halide light-sensitive layers, or as the uppermost layer or the lowermost layer. These non-light-sensitive layers can contain couplers, DIR compounds, and color-mixing inhibitors to be described below. Each of the silver halide emulsion layers constituting unit photosensitive layers, respectively, can preferably take a two-layer constitution composed of a high-sensitive emulsion layer and a low-sensitive emulsion layer, as described in DE 1,121,470 or GB Patent No. 923,045. Generally, they are preferably arranged such that the sensitivities are decreased toward the support. As described, for example, in JP-A-57-112751, JP-A-62-200350, JP-A-62-206541, and JP-A-62-206543, a low-sensitive emulsion layer may be placed away from the support, and a high-sensitive emulsion layer may be placed nearer to the support.

A specific example of the order includes an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH, stated from the side most away from the support.

As described in JP-B-55-34932, an order of a blue-sensitive layer/GH/RH/GL/RL stated from the side most away from the support is also possible. Further as described in JP-A-56-25738 and JP-A-62-63936, an order of a blue-sensitive layer/GL/RL/GH/RH stated from the side most away from the support is also possible.

Further, as described in JP-B-49-15495, an arrangement is possible wherein the upper layer is a silver halide emulsion layer highest in sensitivity, the intermediate layer is a silver halide emulsion layer lower in sensitivity than that of the upper layer, the lower layer is a silver halide emulsion layer further lower in sensitivity than that of the intermediate layer, so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity, as described in JP-A-59-202464.

Further, for example, an order of a high-sensitive emulsion layer/low-sensitive emulsion layer/medium-sensitive emulsion layer, or an order of a low-sensitive emulsion layer/medium-sensitive emulsion layer/high-sensitive emulsion layer stated from the side away from support can be taken. In the case of four layers or more layers, the arrangement can be varied as above.

In order to improve color reproduction, as described in U.S. Pat. Nos. 4,663,271, 4,705,744, and 4,707,436, and JP-A-62-160448 and JP-A-63-89850, it is preferable to form a donor layer (CL), which has a spectral sensitivity distribution different from that of a principal (main) light-sensitive layer, such as BL, GL and RL, and which has an inter-layer effect, in a position adjacent or in close proximity to the principal light-sensitive layer.

In the present invention, preferably in the second embodiment of the present invention, as a means for improvement of color reproduction, the use of an interlayer-depression effect is preferable.

As the silver halide grains that are used in the layer providing an inter layer effect to a red-sensitive layer, there is no particular limitation on their size and shape. However, so-called tabular grains having a high aspect ratio, monodispersion emulsions having a uniform grain size, and silver iodobromide grains having a layered structure of iodine or preferably used. Further, for enlargement of exposure latitude, it is preferred that two or more kinds of emulsions having different grain sizes from each other are mixed.

The donor layer providing an inter layer effect to the red-sensitive layer may be coated in any position on a support. However, the donor layer is provided nearer the support than the blue-sensitive layer, and further from the support than the red-sensitive layer. More preferably, the donor layer is provided nearer the support than the yellow filter layer.

It is furthermore preferable that the donor layer providing an inter layer effect to the red-sensitive layer is provided nearer the support than the green-sensitive layer, and further from the support than the red-sensitive layer. Most preferably, the donor layer is provided adjacent to one side of the green-sensitive layer which is more adjacent to the support than the other side. Herein, the term "adjacent" means that any layer such as an interlayer does not exist.

The layer providing an inter layer effect to the red-sensitive layer may be composed of a plurality of layers. In this case, these layers may be adjacent to each other, or may be separated from each other.

In the present invention, solid dispersion dyes as described in JP-A-11-305396 may be used.

The silver halide for use in the present invention is preferably silver iodobromide, silver iodochloride, or silver iodochlorobromide, each of which has a silver iodide of about 30 mol % or less. Particularly preferred are silver iodobromide, or silver iodochlorobromide, each of which has a silver iodide of about 2 mol % to about 10 mol %.

The silver halide grains in the photographic emulsion may have a regular crystal form, such as a cubic shape, an octahedral shape, and a tetradecahedral shape, or a irregular crystal shape, such as spherical shape or a tabular shape, or they may have a crystal defect, such as twin planes, or they may have a composite crystal form of these.

As a grain size of the silver halide, fine grains having a diameter of about 0.2 μm or less may be used. Alternatively large-size grains having a projected area diameter of up to about 10 μm may be used. A polydispersed emulsion or a monodispersed emulsion may be used.

The silver halide photographic emulsions that can be used in the present invention may be prepared, for example, by the methods described in Research Disclosure (RD) No. 17643 (December 1978), pp. 22–23, "I. Emulsion preparation and types", and ibid. No. 18716 (November 1979), p. 648, and ibid. No. 307105 (November, 1989), pp. 863–865; the methods described by P. Glafkides, in Chemie et Phisique Photographiques, Paul Montel (1967), by G. F. Duffin, in Photographic Emulsion Chemistry, Focal Press (1966), and by V. L. Zelikman et al., in Making and Coating Photographic Emulsion, Focal Press (1964).

Monodispersed emulsions described in U.S. Pat. Nos. 3,574,628, and 3,655,394, and U.K. Patent No. 1,413,748 are also preferable.

Tabular grains having an aspect ratio of about 3 or more can also be used, in the present invention. Further, tabular grains having an aspect ratio of about 3 or more may be used in the present invention. Particularly, for improvement in aging storability, it is possible to use emulsions in which 50% or more of the total projected area of grains are occupied by silver halide tabular grains having an aspect ratio of 8 or more.

The upper limit of the aspect ratio is not particularly limited, but it is preferably 30 or less. The tabular grains may be prepared easily, according to the methods described by Gutoff, in Photographic Science and Engineering, Vol. 14, pp. 248–257 (1970); U.S. Pat. Nos. 4,434,226, 4,414,310, 4,433,048, and 4,439,520, and U.K. Patent No. 2,112,157.

As to the crystal structure, a uniform structure, a structure in which the internal part and the external part have different halogen compositions, and a layered structure may be acceptable. Silver halides differing in composition may be joined with each other by epitaxial junction, and, for example, a silver halide may be joined with a compound other than silver halides, such as, silver rhodanate and lead oxide. Also, a mixture of grains having various crystal forms may be used.

Although the aforementioned emulsion may be any one of a surface latent image-type that forms a latent image primarily on the grain surface, an internal latent image-type that forms a latent image inside of a grain, and another type of emulsion that forms a latent image both on the surface and inside of the grain; but it must be a negative type emulsion in any case. Among the internal latent image type emulsions, an emulsion of a core/shell-type internal latent image-type emulsion, as described in JP-A-63-264740 may be used, and the preparation method of this emulsion is described in JP-A-59-133542. The thickness of the shell of this emulsion is preferably 3 to 40 nm, and particularly preferably 5 to 20 nm, though it differs depending on development processing or the like.

As the silver halide emulsion, generally, those subjected to physical ripening, chemical ripening, and spectral sensitization are used. Additives in these steps are described in RD Nos. 17643, 18716, and 307105. Its relevant parts are listed in a table described above.

In the light-sensitive material of the present invention, it is possible to mix, in a single layer, two or more types of emulsions different in at least one of characteristics of a light-sensitive silver halide emulsion, i.e., a grain size, a grain size distribution, halogen composition, grain shape, and sensitivity.

In the present invention, it is preferable to apply surface-fogged silver halide grains described in U.S. Pat. No. 4,082,553, internally fogged silver halide grains described in U.S. Pat. No. 4,626,498 and JP-A-59-214852, or colloidal silver, in light-sensitive silver halide emulsion layers and/or substantially non-light-sensitive hydrophilic colloid layers. The internally or surface-fogged silver halide grain means a silver halide grain which can be subjected to development uniformly (non image-wise) regardless of whether it exists at a non-exposed portion or an exposed portion of the light-sensitive material. A method of preparing the internally or surface-fogged silver halide grain is described in U.S. Pat. No. 4,626,498 and JP-A-59-214852. Silver halides that form the internal nuclei of an internally fogged core/shell-type silver halide grain may have different halogen compositions. As the internally or surface-fogged silver halide, any of silver chloride, silver chlorobromide, silver iodobromide and silver chloroiodobromide can be used. The average grain size of these fogged silver halide grains is preferably 0.01 to 0.75 μm, and particularly preferably 0.05 to 0.6 μm. The grain shape may be a regular grain shape. Although the emulsion may be a polydisperse emulsion, it is preferably a monodisperse emulsion (in which at least 95% in mass or in number of silver halide grains have grain diameters falling within a range of ±40% of the average grain diameter).

In the present invention, it is preferable to use non-light-sensitive fine grain silver halide. The non-light-sensitive fine grain silver halide is a silver halide fine grain which is not sensitive to light during imagewise exposure for obtaining a dye image, and is not substantially developed during processing. These silver halide fine grains are preferably not fogged in advance. In the fine grain silver halide, the content of silver bromide is 0 to 100 mol %. The fine grain silver halide may contain silver chloride and/or silver iodide, if necessary. The fine grain silver halide preferably contains silver iodide of 0.5 to 10 mol %. The average grain diameter (the average value of circle equivalent diameter of projected area) of the fine grain silver halide is preferably 0.01 to 0.5 μm, more preferably 0.02 to 0.2 μm.

The fine grain silver halide may be prepared by the same procedure as that for a conventional light-sensitive silver halide. The surfaces of each silver halide grain need not be optically sensitized nor spectrally sensitized. However, before the silver halide grains are added to a coating solution, it is preferable to add known stabilizers such as triazole-series compounds, azaindene-series compounds, benzothiazolium-series compounds, mercapto-series compounds and zinc compounds. Colloidal silver may be added to this fine grain silver halide-containing layer.

In the light-sensitive material of the present invention, the coating amount of silver is preferable 6.0 g/m$^2$ or less, and most preferably 4.5 g/m$^2$ or less.

In the light-sensitive material of the present invention, various dye-forming couplers may be used. The following couplers are particularly preferred. Yellow coupler: a coupler represented by formula (I) or (II) in European Patent No. 502,424A; a coupler represented by formula (1) or (2) in European Patent No. 513,496A (especially, Y-28 on page 18); a coupler represented by formula (I) in claim 1 in European Patent No. 568,037A; a coupler represented by formula (I) in lines 45 to 55 in column 1 in U.S. Pat. No. 5,066,576; a coupler represented by formula (I) in paragraph 0008 in JP-A-4-274425; a coupler described in claim 1 on page 40 in European Patent Application Publication No. 498,381 (especially, D-35 on page 18); a coupler represented by formula (Y) on page 4 in European Patent Application Publication No. 447,969 (especially, Y-1 (page 17), and Y-54 (page 41)); a coupler represented by any of formulas (II) to (IV) in lines 36 to 58 in column 7 in U.S. Pat. No. 4,476,219 (especially, II-17, -19 (column 17), II-24 (column 19)).

Magenta coupler: L-57 (page 11, right and lower column), L-68 (page 12, right and lower column), L-77 (page 13, right and lower column) in JP-A-3-39737; [A-4]-63 (page 134), [A-4]-73, -75 (page 139) in European Patent No. 456,257; M-4, -6 (page 26), M-7 (page 27) in European Patent No. 486,965; M-45 (page 19) in European Patent No. 571,959A; (M-1) (page 6) in JP-A-5-204106; M-22 in paragraph [0237] in JP-A-4-362631.

Cyan coupler: CX-1, 3, 4, 5, 11, 12, 14, 15 (pages 14 to 16) in JP-A-4-204843; C-7, 10 (page 35), 34, 35 (page 37), (I-1), (I-17) (pages 42 to 43) in JP-A-4-43345; a coupler represented by formula (Ia) or (Ib) in Claim 1 in JP-A-6-67385.

Polymer coupler: P-1, P-5 (page 11) in JP-A-2-44345.

Preferable examples of couplers, which form a color dye having a suitable diffusive property, include those described in U.S. Pat. No. 4,366,237, GB Patent No. 2,125,570, European Patent No. 96,873B, and DE Patent No. 3,234,533.

As couplers for compensating unnecessary absorption of color dye, yellow-colored cyan couplers represented by the formula (CI), (CII), (CIII) or (CIV) described on page 5 in European Patent Application Publication No. 456,257A1 (particularly YC-86, on page 84), yellow-colored magenta couplers ExM-7 (page 202), EX-1 (page 249) and Ex-7 (page 251) described in the same EP publication, magenta-colored cyan couplers CC-9 (column 8) and CC-13 (column 10) described in U.S. Pat. No. 4,833,069, and colorless masking couplers represented by the formula (A) described in Claim 1 in WO92/11575 pamphlet (particularly, the exemplified compounds on page 36 to page 45) and (2) (on column 8) of U.S. Pat. No. 4,837,136, are preferable.

Examples of the coupler releasing a photographically useful group include the followings:

Development inhibitor releasing compounds: compounds represented by the formula (I), (II), (III) or (IV) described in European Patent Application Publication No. 378,236, page 11 (particularly T-101 (page 30), T-104 (page 31), T-113 (page 36), T-131 (page 45), T-144 (page 51) and T-158 (page 58)), compounds represented by the formula (I) in European Patent Application Publication No. 436,938, page 7 (particularly, D-49 (page 51)), compounds represented by the formula (1) in European Patent No. 568,037A (particularly, (23) (page 11)) and compounds represented by any one of the formulas (I), (II) and (III) in European Patent Application Publication No. 440,195, page 5 to page 6 (particularly, I-(1) on page 29); Bleaching-accelerator-releasing compounds: compounds represented by the formula (I) or (I') described in European Patent Application Publication No. 310125, page 5 (particularly (60) and (61) on page 61) and compounds represented by the formula (I) in Claim 1 in JP-A-6-59411 (particularly, (7) (page 7)); Ligand-releasing compounds: compounds represented by LIG-X described in Claim 1 in U.S. Pat. No. 4,555,478 (particularly, compounds described in column 12, lines 21 to 41); Leuco dye-releasing compounds: compounds 1 to 6 in U.S. Pat. No. 4,749,641, columns 3 to 8; Fluorescent dye-releasing compounds: compounds represented by COUP-DYE in Claim 1 in U.S. Pat. No. 4,774,181 (particularly compounds 1 to 11 in columns 7 to 10); Compounds, which release a development accelerator or fogging agent: compounds represented by the formula (1), (2) or (3) in U.S. Pat. No. 4,656,123, column 3 (particularly, (I-22) in column 25) and ExZK-2 in European Patent Application Publication No. 450,637, page 75, line 36 to line 38; and Compounds which release a group that becomes a dye only after being spilt-off: compounds represented by the formula (I) in Claim 1 in U.S. Pat. No. 4,857,447 (particularly, Y-1 to Y-19 in columns 25 to 36).

As additives other than the coupler, the following ones are preferable.

Dispersion media for an oil-soluble organic compound: P-3, 5, 16, 19, 25, 30, 42, 49, 54, 55, 66, 81, 85, 86 and 93 (page 140 to page 144) in JP-A-62-215272; Latex for impregnation of oil-soluble organic compound: latex described in U.S. Pat. No. 4,199,363; Scavengers for an oxidized product of a developing agent: compounds represented by the formula (I) in U.S. Pat. No. 4,978,606, column 2, line 54 to line 62 (particularly I-(1), (2), (6), (12) (columns 4 to 5)) and compounds represented by the formula in U.S. Pat. No. 4,923,787, column 2, line 5 to line 10 (particularly Compound 1 (column 3); Stain preventive agents: compounds represented by one of the formulae (I) to (III) in European Patent No. 298321A, page 4, line 30 to line 33 (particularly, I-47, 72, III-2, 27 (page 24 to page 48)); Anti-fading agents: A-6, 7, 20, 21, 23, 24, 25, 26, 30, 37, 40, 42, 48, 63, 90, 92, 94 and 164 (page 69 to page 118) in European Patent No. 298321A, II-1 to III-23 in U.S. Pat. No. 5,122,444, columns 25 to 38 (particularly, III-10), I-1 to III-4 in European Patent No. 471347A, page 8 to page 12 (particularly, II-2), and A-1 to 48 in U.S. Pat. No. 5,139,931, columns 32 to 40 (particularly A-39 and 42); Materials for reducing the amount to be used of a color development-enhancing agent or color contamination preventive agent: I-1 to II-15 in European Patent No. 411324A, page 5 to page 24 (particularly, I-46); Formalin scavengers: SCV-1 to 28 in European Patent No. 477932A, page 24 to page 29 (particularly SCV-8); Hardener: H-1, 4, 6, 8 and 14 in JP-A-1-214845 in page 17, compounds (H-1 to H-54) represented by any one of the formulae (VII) to (XII) in U.S. Pat. No. 4,618,573, columns 13 to 23, compounds (H-1 to 76) represented by the formula (6) in JP-A-2-214852, page 8, lower right (particularly, H-14), and compounds described in claim 1 in U.S. Pat. No. 3,325,287; Development-inhibitor precursors: P-24, 37, 39 (page 6 to page 7) in JP-A-62-168139 and compounds described in claim 1 of U.S. Pat. No. 5,019,492 (particularly 28 and 29 in column 7); Antiseptics and mildew-proofing agents: I-1 to III-43 in U.S. Pat. No. 4,923,790, columns 3 to 15 (particularly II-1, 9, 10 and 18 and III-25); Stabilizers and antifoggants: I-1 to (14) in U.S. Pat. No. 4,923,793, columns 6 to 16 (particularly, I-1, 60, (2) and (13)), and compounds 1 to 65 in U.S. Pat. No. 4,952,483, columns 25 to 32 (particularly, 36); Chemical sensitizers: triphenylphosphine selenide and compound 50 in JP-A-5-40324; Dyes: a-1 to b-20 on page 15 to page 18 (particularly, a-1, 12, 18, 27, 35, 36, b-5) and compounds V-1 to 23 on pages 27 to 29, (particularly, V-1) in JP-A-3-156450, F-I-1 to F-II-43 in European Patent No. 445627A, page 33 to page 55 (particularly F-I-11 and F-II-8), III-1 to 36 in European Patent No. 457153A, page 17 to page 28 (particularly III-1 and 3), microcrystal dispersions of Dye-1 to 124 in WO88/04794 Pamphlet, 8 to 26, compounds 1 to 22 in European Patent No. 319999A, page 6 to page 11 (particularly, compound 1), compounds D-1 to 87 (page 3 to page 28) represented by any one of the formulae (1) to (3) in European Patent No. 519306A, compounds 1 to 22 (columns 3 to 10) represented by the formula (I) in U.S. Pat. No. 4,268,622, and compounds (1) to (31) (columns 2 to 9) represented by the formula (I) in U.S. Pat. No. 4,923,788; and UV absorbers: compounds (18b) to (18r) and 101 to 427 (page 6 to page 9) represented by the formula (1) in JP-A-46-3335, compounds (3) to (66) (page 10 to page 44) represented by the formula (I), compounds HBT-1 to 10 (page 14) represented by the formula (III) in European Patent No. 520938A and compounds (1) to (31) (columns 2 to 9) represented by the formula (1) in European Patent No. 521823A.

In the light-sensitive material of the present invention, the sum of the film thicknesses of all hydrophilic colloidal layers on the side provided with the emulsion layers is preferably 28 μm or less, more preferably 23 μm or less, further preferably 18 μm or less, and particularly preferably 16 μm or less. The film swelling rate $T_{1/2}$ is preferably 30 seconds or less, and more preferably 20 seconds or less. $T_{1/2}$ is defined as the time required until the film thickness reaches ½ the saturated film thickness which is 90% of the maximum swelled film thickness attained when the film is processed with a color-developing solution at 30° C. for 3 minutes and 15 seconds. The term "film thickness" means a film thickness measured under controlled humid conditions of 25° C. and a relative humidity of 55% (2 days). $T_{1/2}$ can be measured using a swellometer of the type described by A. Green et al. in Photogr. Sci. Eng., Vol. 19, 2, page 124 to page 129. $T_{1/2}$ can be regulated by adding a hardener to a gelatin used as a binder, or by changing aging conditions after coating. The rate of swelling is preferably 150 to 400%. Here, the rate of swelling can be calculated from the maximum swelled film thickness under the above-described condition by the following equation:

$$[\{(\text{Maximum swelled film thickness})-(\text{Film thickness})\}/(\text{Film thickness})]\times 100.$$

In the light-sensitive material of the present invention, hydrophilic colloid layers (referred to as backing layers) having a total dried film thickness of 2 to 20 μm are preferably formed on the side opposite to the side having emulsion layers. The backing layers preferably contain the aforementioned light absorbents, filter dyes, ultraviolet absorbents, antistatic agents, film hardeners, binders, plasticizers, lubricants, coating aids, and surfactants. The swell ratio of the backing layer is preferably 150 to 500%.

The light-sensitive materials of the present invention can be developed by ordinary methods described in the above-mentioned RD No. 17643, pp. 28 to 29, RD No. 18716, page 615, left to right columns, and RD No. 307105, pp. 880 to 881.

Next, color negative film processing solutions for use in the present invention will be described below.

Compounds described in JP-A-4-121739, from page 9, upper right column, line 1, to page 11, lower left column, line 4, can be used in a color developer for use in the present invention. As a color developing agent used when particularly rapid processing is to be performed, 2-methyl-4-[N-ethyl-N-(2-hydroxyethyl)amino]aniline, 2-methyl-4-[N-ethyl-N-(3-hydroxypropyl)amino]aniline, and 2-methyl-4-[N-ethyl-N-(4-hydroxybutyl)amino]aniline are preferable.

The use amount of these color-developing agents is preferably 0.01 to 0.08 mol, more preferably 0.015 to 0.06 mol, and especially preferably 0.02 to 0.05 mol per liter of a color developer. Also, a replenisher of a color developer preferably contains a color-developing agent at concentration 1.1 to 3 times, particularly 1.3 to 2.5 times the above concentration.

As a preservative of a color developer, hydroxylamine can be extensively used. When higher preservability is necessary, the use of a hydroxylamine derivative having a substituent such as an alkyl group, a hydroxyalkyl group, a sulfoalkyl group, and a carboxyalkyl group is preferable. Specific examples thereof include N,N-di-(sulfoethyl)hydroxylamine, monomethylhydroxylamine, dimethylhydroxylamine, monoethylhydroxylamine, diethylhydroxylamine, and N,N-di(carboxylethyl)hydroxylamine. Of these, N,N-di-(sulfoethyl)hydroxylamine is particularly preferable. Although these derivatives can be used together with hydroxylamine, it is preferable to use one or two types of these derivatives instead of hydroxylamine.

The use amount of a preservative is preferably 0.02 to 0.2 mol, more preferably 0.03 to 0.15 mol, and further preferably 0.04 to 0.1 mol per liter. As in the case of a color-developing agent, a replenisher preferably contains a preservative at concentration 1.1 to 3 times the concentration of a mother solution (processing tank solution).

A color developer contains sulfite as an agent for preventing an oxide of a color-developing agent from changing into tar. The use amount of this sulfite is preferably 0.01 to 0.05 mol, more preferably 0.02 to 0.04 mol per liter. Sulfite is preferably used in a replenisher at concentration 1.1 to 3 times the above concentration.

The pH of a color developer is preferably 9.8 to 11.0, and more preferably 10.0 to 10.5. In a replenisher, the pH is preferably set to be higher by 0.1 to 1.0 than the above values. To stably maintain such a pH, a known buffer agent such as carbonate, phosphate, sulfosalicylate, or bolate is used.

The replenishment rate of a color developer is preferably 80 to 1,300 ml per $m^2$ of a light-sensitive material. However, the replenishment rate is preferably smaller in order to reduce environmental-pollution-load. For example, the replenishment rate is preferably 80 to 600 ml, and more preferably 80 to 400 ml per $m^2$.

The bromide ion concentration in a color developer is usually 0.01 to 0.06 mol per liter. However, this bromide ion concentration is preferably set at 0.015 to 0.03 mol per liter for the purpose of suppressing fog to improve discrimination with maintaining sensitivity, and of improving graininess at the same time. To set the bromide ion concentration in this range, it is only necessary to add bromide ion calculated by the following equation, to a replenisher. When C takes a negative value, however, no bromide ions are preferably added to a replenisher.

$$C=(A-W)/V$$

in which

C: a bromide ion concentration (mol/L) in a color developer replenisher

A: a target bromide ion concentration (mol/L) in a color developer

W: an amount (mol) of bromide ions dissolving into a color developer from a light-sensitive material when 1 $m^2$ of the light-sensitive material is color-developed V: a replenishment rate (L) of a color developer replenisher to 1 $m^2$ of a light-sensitive material As a method of increasing the sensitivity when the replenishment rate is decreased or high bromide ion concentration is set, it is preferable to use a development accelerator such as pyrazolidones represented by 1-phenyl-3-pyrazolidone, and 1-phenyl-2-methyl-2-hydroxymethy-3-pyrazolidone, or a thioether compound represented by 3,6-dithia-1,8-octanediol.

Compounds and processing conditions described in JP-A-4-125558, from page 4, lower left column, line 16, to page 7, lower left column, line 6, can be applied to a processing solution having a bleaching capacity in the present invention.

The bleaching agent preferably has an oxidation-reduction potential of 150 mV or more. Preferable specific examples of the bleaching agent are described in JP-A-5-72694 and JP-A-5-173312. In particular, 1,3-diaminopropane tetraacetic acid and a ferric complex salt of a compound shown as specific example 1 in JP-A-5-173312, page 7, are preferable.

Further, to improve the biodegradability of a bleaching agent, it is preferable to use a ferric complex salt of a compound described in JP-A-4-251845, JP-A-4-268552, European Patent Nos. 588,289 and 591,934, and JP-A-6-208213, as a bleaching agent. The concentration of these bleaching agents is preferably 0.05 to 0.3 mol per liter of a solution having a bleaching capacity. In particular, to reduce the amount of discharge to the environment, the concentration is preferably designed to be 0.1 to 0.15 mol per liter of the solution having a bleaching capacity. When the solution having a bleaching capacity is a bleaching solution, preferably 0.2 to 1 mol, and more preferably 0.3 to 0.8 mol of a bromide is added per liter.

A replenisher of the solution having a bleaching capacity basically contains components at concentrations calculated by the following equation. This makes it possible to maintain the concentrations in a mother solution constant.

$$CR=CT\times(V1+V2)/V1+CP$$

In which

CR: concentration of a component in a replenisher

CT: concentration of a component in a mother solution (processing tank solution)

CP: concentration of a component consumed during processing

V1: a replenishment rate (ml) of a replenisher having a bleaching capacity per $m^2$ of a light-sensitive material V2: an amount (ml) of carryover from a preceding bath by $m^2$ of a light-sensitive material Additionally, a bleaching solution preferably contains a pH buffering agent, and particularly preferably, it contains a dicarboxylic acid with little odor, such as succinic acid, maleic acid, malonic acid, glutaric acid, and adipic acid. Also, the use of known bleaching accelerators described in JP-A-53-95630, RD No. 17129, and U.S. Pat. No.3,893,858 is preferable.

It is preferable to replenish 50 to 1,000 ml of a bleaching replenisher to a bleaching solution, per $m^2$ of a light-sensitive material. The replenishment rate is more preferably 80 to 500 ml, and further preferably 100 to 300 ml per $m^2$ of a light-sensitive material. Conducting aeration of a bleaching solution is also preferable.

Compounds and processing conditions described in JP-A-4-125558, from page 7, lower left column, line 10, to page 8, lower right column, line 19, can be applied to a processing solution having a fixing capacity.

To improve the fixing speed and preservability, the compound represented by formula (I) or (II) described in JP-A-6-301169 is preferably added, singly or in combination, to a processing solution with a fixing capacity. To improve preservability, the use of sulfinic acid, including p-toluenesulfinate, described in JP-A-1-224762 is also preferable.

To improve the desilvering characteristics, ammonium is preferably used as cation, in a solution with a bleaching capacity or a solution with a fixing capacity. However, the amount of ammonium is preferably reduced, or not used at all, to reduce environmental pollution. In the bleaching, bleach-fixing, and fixing steps, it is particularly preferable to perform jet stirring described in JP-A-1-309059.

The replenishment rate of a replenisher in the bleach-fixing, or fixing step is preferably 100 to 1,000 ml, more preferably 150 to 700 ml, and particularly preferably 200 to 600 ml per $m^2$ of a light-sensitive material.

In the bleach-fixing, or fixing step, an appropriate silver collecting apparatus is preferably installed either in-line or off-line to collect silver. When such an apparatus is installed in-line, processing can be performed while the silver concentration in a solution is reduced, and as a result of this, the replenishment rate can be reduced. It is also preferable to install such an apparatus off-line to collect silver and reuse the residual solution as a replenisher.

The bleach-fixing, or fixing step can be performed using a plurality of processing tanks, and these tanks are preferably piped in a cascade manner to form a multistage counter flow system. To balance the size of a processor, two-tank cascade system is generally efficient. The processing time ratio of the preceding tank to the subsequent tank is preferably (0.5:1) to (1:0.5), and particularly preferably (0.8:1) to (1:0.8).

In a bleach-fixing, or fixing solution, the presence of a free chelating agent, which is not a metal complex, is preferable to improve the preservability. As these chelating agents, the use of the biodegradable chelating agents previously described in connection to a bleaching solution is preferable.

Contents described in aforementioned JP-A-4-125558, from page 12, lower right column, line 6, to page 13, lower right column, line 16, can be applied to the washing with water and stabilization steps. From the viewpoint of the safety of the working environment, it is preferable to use azolylmethylamines described in European Patent Nos. 504,609 and 519,190 or N-methylolazoles described in JP-A-4-362943, instead of formaldehyde, in a stabilizer, and to make a magenta coupler two-equivalent so that a solution of surfactant containing no image stabilizing agent such as formaldehyde can be used.

To reduce adhesion of dust to a magnetic recording layer coated on a light-sensitive material, a stabilizer described in JP-A-6-289559 can be preferably used.

The replenishment rate of washing with water and a stabilizer is preferably 80 to 1,000 ml, more preferably 100 to 500 ml, and further preferably 150 to 300 ml per $m^2$ of a light-sensitive material, to maintain the washing and stabilization functions and at the same time reduce the waste liquors for environmental conservation. In a processing performed with such a replenishment rate, it is preferable to prevent the propagation of bacteria and mildew by using known mildew-proofing agents such as thiabendazole, 1,2-benzoisothiazoline-3-one, and 5-chloro-2-methylisothiazoline-3-one, antibiotics such as gentamicin, and water deionized by an ion exchange resin or the like. It is more effective to use deionized water together with a mildew-proofing agent or an antibiotic.

The replenishment rate of a solution in a washing water tank or stabilizer tank is preferably reduced by a reverse osmosis membrane treatment described in JP-A-3-46652, JP-A-3-53246, JP-A-355542, JP-A-3-121448, and JP-A-3-126030. A reverse osmosis membrane used in this treatment is preferably a low-pressure reverse osmosis membrane.

In the processing that is used in the present invention, it is particularly preferable to perform evaporation correction of the processing solution as described in JIII Journal of Technical Disclosure No. 94-4992. In particular, a method of performing correction on the basis of (formula-1) on page 2, by using temperature and humidity information of an environment in which a processor is set, is preferable. Water for use in this evaporation correction is preferably taken from the washing water replenishment tank. If this is the case, deionized water is preferably used as the washing replenishing water.

Processing agents described in aforementioned JIII Journal of Technical Disclosure No. 94-4992, from page 3, right column, line 15, to page 4, left column, line 32, are preferably used in the present invention. As a processor used with these processing agents, a film processor described on page 3, right column, lines 22 to 28, is preferable.

Specific examples of processing agents, automatic processors, and evaporation correction methods suited to practicing the present invention are described in aforementioned JIII Journal of Technical Disclosure No. 94-4992, from page 5, right column, line 11, to page 7, right column, last line.

Processing agents used in the present invention can be supplied in any form such as a liquid agent having the concentration as it is to be used, a concentrated liquid agent, granules, powder, tablets, paste, and emulsion. Examples of such processing agents are a liquid agent contained in a low-oxygen permeable vessel as described in JP-A-63-17453, vacuum-packed powders and granules described in JP-A-4-19655 and JP-A-4-230748, granules containing a water-soluble polymer described in JP-A-4-221951, tablets described in JP-A-51-61837 and JP-A-6-102628, and a paste described in JP-T-57-500485. Although any of these processing agents can be preferably used, the use of a liquid adjusted to have the concentration as it is to be used, in advance, is preferable for the sake of convenience in use.

As a vessel for containing these processing agents, polyethylene, polypropylene, polyvinylchloride, polyethyleneterephthalate, nylon and the like, are used singly or as a composite material. These materials are selected in accordance with the level of necessary oxygen permeability. For a readily oxidizable solution such as a color developer, a low-oxygen permeable material is preferable. More specifically, polyethyleneterephthalate or a composite material of polyethylene and nylon is preferable. A vessel made of any of these materials preferably has a thickness of 500 to 1,500 μm and is preferably adjusted to have oxygen permeability of 20 $ml/m^2 \cdot 24$ hrs·atom or less.

Next, color reversal film processing solution used in the present invention will be described below.

Processing for a color reversal film is described in detail in Aztech Ltd., Kochi Gijutsu No. 6 (1991, Apr. 1), from page 1, line 5, to page 10, line 5, and from page 15, line 8, to page 24, line 2, and any of the contents can be preferably applied.

In a color reversal film processing, an image-stabilizing agent is contained in a control bath or a final bath. Preferable examples of such an image-stabilizing agent are formalin, sodium formaldehyde-bisulfite, and N-methylolazoles. Sodium formaldehyde-bisulfite, and N-methylolazoles are preferable in terms of preserving working environment, and N-methyloltriazole is particularly preferable as N-methylolazoles. The contents pertaining to a color developer, bleaching solution, fixing solution, and washing water described in the color negative film processing can be preferably applied to the color reversal film processing.

Preferable examples of color reversal film processing agents containing the above contents are an E-6 (trade name) processing agent manufactured by Eastman Kodak Co. and a CR-56 (trade name) processing agent manufactured by Fuji Photo Film Co., Ltd.

Next, a magnetic recording layer preferably used in the present invention is explained.

The magnetic recording layer preferably used in the present invention refers to a layer provided by coating a base with an aqueous or organic solvent coating solution containing magnetic particles dispersed in a binder.

To prepare the magnetic particles, use can be made of a ferromagnetic iron oxide, such as $\gamma Fe_2O_3$, Co-coated $\gamma Fe_2O_3$, Co-coated magnetite, Co-containing magnetite, ferromagnetic chromium dioxide, a ferromagnetic metal, a ferromagnetic alloy, hexagonal Ba ferrite, Sr ferrite, Pb ferrite, and Ca ferrite. A Co-coated ferromagnetic iron oxide, such as Co-coated $\gamma Fe_2O_3$, is preferable. The shape of the magnetic particles may be any of a needle shape, a rice grain shape, a spherical shape, a cubic shape, a tabular shape, and the like. The specific surface area of the magnetic particles is preferably 20 $m^2/g$ or more, and particularly preferably 30 $m^2/g$ or more, in terms of $S_{BET}$.

The saturation magnetization ($\sigma s$) of the ferromagnetic material is preferably $3.0\times10^{-4}$ to $3.0\times10^{5}$ A/m, and particularly preferably $4.0\times10^{4}$ to $2.5\times10^{5}$ A/m. The ferromagnetic particles may be surface-treated with silica and/or alumina or an organic material. The surface of the magnetic particles may be treated with a silane coupling agent or a titanium coupling agent, as described in JP-A-6-161032. Further, magnetic particles whose surface is coated with an inorganic or organic material, as described in JP-A-4-259911 and JP-A-5-81652, can be used.

As the binder that can be used for the magnetic particles, as described in JP-A-4-219569, a thermoplastic resin, a thermosetting resin, a radiation-setting resin, a reactive resin, an acid-degradable polymer, an alkali-degradable polymer, a biodegradable polymer, a natural polymer (e.g. a cellulose derivative and a saccharide derivative), and a mixture of these can be used. The above resins have a Tg of −40 to 300° C. and a mass-average molecular weight of 2,000 to 1,000,000. Examples of the binder include vinyl copolymers, cellulose derivatives, such as cellulose diacetates, cellulose triacetates, cellulose acetate propionates, cellulose acetate butylates, and cellulose tripropionates; acrylic resins, and polyvinyl acetal resins. Gelatin is also preferable. Cellulose di(tri)acetates are particularly preferable. To the binder may be added an epoxy-, aziridine-, or isocyanate-series crosslinking agent, to harden the binder. Examples of the isocyanate-series crosslinking agent include isocyanates, such as tolylene diisocyanate, 4,4'-diphenylmethane diisocyanate, hexamethylene diisocyanate, and xylylene diisocyanate; reaction products of these isocyanates with polyalcohols (e.g. a reaction product of 3 mol of tolylene diisocyanate with 1 mol of trimethylolpropane); and polyisocyanates produced by condensation of these isocyanates. Those are described, for example, in JP-A-6-59357.

The method of dispersing the foregoing magnetic material in the foregoing binder is preferably one as described in JP-A-6-35092, in which method use is made of a kneader, a pin-type mill, an annular-type mill, and the like, which may be used alone or in combination. A dispersant described in JP-A-5-088283 and other known dispersants can be used. The thickness of the magnetic recording layer is generally 0.1 to 10 μm, preferably 0.2 to 5 μm, and further preferably 0.3 to 3 μm. The mass ratio of the magnetic particles to the binder is preferably from (0.5:100) to (60:100), and more preferably from (1:100) to (30:100). The coating amount of the magnetic particles is generally 0.005 to 3 $g/m^2$, preferably 0.01 to 2 $g/m^2$, and more preferably 0.02 to 0.5 $g/m^2$. The transmission yellow density of the magnetic recording layer is preferably 0.01 to 0.50, more preferably 0.03 to 0.20, and particularly preferably 0.04 to 0.15. The magnetic recording layer can be provided to the undersurface of the photographic base by coating or printing through all parts or in a striped fashion. To apply the magnetic recording layer, use can be made of an air doctor, blade, air knife, squeezing, impregnation, reverse roll, transfer roll, gravure, kiss, cast, spraying, dipping, bar, extrusion, or the like. A coating solution described, for example, in JP-A-5-341436 is preferable.

The magnetic recording layer may be provided with functions, for example, of improving lubricity, of regulating curling, of preventing electrification, of preventing adhesion, and of abrading a head, or it may be provided with another functional layer that is provided with these functions. An abrasive in which at least one type of particles comprises aspherical inorganic particles having a Mohs hardness of 5 or more, is preferable. The aspherical inorganic particles preferably comprise a fine powder of an oxide, such as aluminum oxide, chromium oxide, silicon dioxide, titanium dioxide and silicon carbide; a carbide, such as silicon carbide and titanium carbide; diamond, or the like. The surface of these abrasives may be treated with a silane coupling agent or a titanium coupling agent. These particles may be added to the magnetic recording layer, or they may form an overcoat (e.g. a protective layer and a lubricant layer) on the magnetic recording layer. As a binder that can be used at that time, the above-mentioned binders can be used, and preferably the same binder as mentioned for the magnetic recording layer is used. Light-sensitive materials having a magnetic recording layer are described in U.S. Pat. Nos. 5,336,589, 5,250,404, 5,229,259, and 5,215,874, and European Patent No. 466,130.

A polyester support that is preferably used in the present invention will be described below. Details of the polyester support, as well as details of light-sensitive materials, processing, cartridges, and examples described later, are, for example, described in JIII Journal of Technical Disclosure No. 94-6023 (Japan Institute of Invention & Innovation, Mar. 15, 1994).

Polyester for use in the present invention is formed from a diol and an aromatic dicarboxylic acid as essential components. Examples of the aromatic dicarboxylic acid are 2,6-, 1,5-, 1,4-, and 2,7-naphthalene dicarboxylic acids, terephthalic acid, isophthalic acid, and phthalic acid. Examples of the diol are diethyleneglycol, triethyleneglycol, cyclohexanedimethanol, bisphenol A, and bisphenol. Examples of the polymer are homopolymers such as polyethyleneterephthalate, polyethylenenaphthalate, and polycyclohexanedimethanol terephthalate. Polyester containing 50 to 100 mol % of 2,6-naphthalenedicarboxylic acid is particularly preferable. Polyethylene-2,6-naphthalate is particularly preferable among the above polymers. The average molecular weight is generally in the range of about 5,000 and 200,000. The Tg of the polymer for use in the present invention is generally 50° C. or higher, preferably 90° C. or higher.

The polyester base is heat-treated at a heat treatment temperature of generally 40° C. or over, but less than the Tg, and preferably at a heat treatment temperature of the (Tg−20° C.) or more, but less than the Tg, so that it will hardly have core set curl. The heat treatment may be carried out at a constant temperature in the above temperature range, or it may be carried out with cooling. The heat treatment time is preferably 0.1 hour or more, but 1,500 hours or less, and further preferably 0.5 hour or more, but 200 hours or less. The heat treatment of the base may be carried out with the base rolled, or it may be carried out with it being conveyed in the form of web. The surface of the base may be made rough (unevenness, for example, by applying electroconductive inorganic fine-particles, such as $SnO_2$ and $Sb_2O_5$), so that the surface state may be improved. Further, it is desirable to provide, for example, a rollette (knurling) at the both ends for the width of the base (both right and left ends towards the direction of rolling) to increase the thickness only at the ends, so that a trouble of deformation of the base will be prevented. The trouble of deformation of the support means that, when a support is wound on a core, on its second and further windings, the support follows unevenness of its cut edge of the first winding, deforming its flat film-shape. These heat treatments may be carried out at any stage after the production of the base film, after the surface treatment, after the coating of a backing layer (e.g. with an antistatic agent and a slipping agent), and after coating of an undercoat, with preference given to after coating of an antistatic agent.

Into the polyester may be blended (kneaded) an ultraviolet absorber. Further, prevention of light piping can be attained by blending dyes or pigments commercially available for polyesters, such as Diaresin (trade name) manufactured by Mitsubishi Kasei Ltd., and Kayaset (trade name) manufactured by Nippon Kayaku Co., Ltd.

These supports are preferably subjected to a surface treatment, in order to achieve strong adhesion between the support and a photosensitive-material-constituting layer. For the above-mentioned surface treatment, various surface-activation treatments can be used, such as a chemical treatment, a mechanical treatment, a corona discharge treatment, a flame treatment, an ultraviolet ray treatment, a high-frequency treatment, a glow discharge treatment, an active plasma treatment, a laser treatment, a mixed acid treatment, and an ozone oxidation treatment. Among the surface treatments, an ultraviolet ray irradiation treatment, a flame treatment, a corona treatment, and a grow treatment are preferable.

With respect to the undercoating, a single layer or two or more layers may be used. As the binder for the undercoat layer, for example, copolymers produced by using, as a starting material, a monomer selected from among vinyl chloride, vinylidene chloride, butadiene, methacrylic acid, acrylic acid, itaconic acid, maleic anhydride, and the like, as well as polyethylene imines, epoxy resins, grafted gelatins, nitrocelluloses, and gelatins, can be mentioned. As compounds that can swell the base, resorcin and p-chlorophenol can be mentioned. As gelatin hardening agents in the undercoat layer, chrome salts (e.g. chrome alum), aldehydes (e.g. formaldehyde and glutaraldehyde), isocyanates, active halogen compounds (e.g. 2,4-dichloro-6-hydroxy-s-triazine), epichlorohydrin resins, active vinyl sulfone compounds, and the like can be mentioned. $SiO_2$, $TiO_2$, inorganic fine particles, or polymethyl methacrylate copolymer fine particles (0.01 to 10 μm) may be included as a matting agent.

Further, in the present invention, an antistatic agent is preferably used. As the antistatic agent, polymers containing a carboxylic acid, a carboxylate, or a sulfonate; cationic polymers, and ionic surface-active compounds can be mentioned.

Most preferable antistatic agents are fine particles of at least one crystalline metal oxide selected from the group consisting of ZnO, $TiO_2$, $SnO_2$, $Al_2O_3$, $In_2O_3$, $SiO_2$, MgO, BaO, $MoO_3$, and $V_2O_5$, and having a specific volume resistance of $10^7$ Ω·cm or less, and more preferably $10^5$ Ω·cm or less and a particle size of 0.001 to 1.0 μm, or fine particles of their composite oxides (Sb, P, B, In, S, Si, C, and the like); as well as fine particles of the above metal oxides in the form of a sol, or fine particles of composite oxides of these. The content thereof in the light-sensitive material is preferably 5 to 500 mg/m$^2$, and particularly preferably 10 to 350 mg/m$^2$. The ratio of the amount of the electroconductive crystalline oxide or its composite oxide to the amount of the binder is preferably from 1/300 to 100/1, and more preferably from 1/100 to 100/5.

A light-sensitive material of the present invention preferably has a slip property. Slip agent-containing layers are preferably formed on both the sides of a light-sensitive-layer side and a back-layer side. A preferable slip property is 0.25 or less but 0.01 or more as a coefficient of kinetic friction. This represents a value obtained when a sample is transferred against stainless steel sphere of 5 mm in diameter, at a speed of 60 cm/min (25° C., 60% RH). In this evaluation, a value of nearly the same level is obtained when the surface of a light-sensitive layer is used as a partner material in place of the stainless steel sphere.

Examples of a slip agent that can be used in the present invention are polyorganosiloxane, higher fatty acid amide, higher fatty acid metal salt, and ester of higher fatty acid and higher alcohol. As the polyorganosiloxane, it is possible to use, e.g., polydimethylsiloxane, polydiethylsiloxane, polystyrylmethylsiloxane, or polymethylphenylsiloxane. A layer to which the slip agent is added, is preferably the outermost emulsion layer or a backing layer. Polydimethylsiloxane and ester having a long-chain alkyl group are particularly preferable.

The light-sensitive material of the present invention preferably contains a matting agent. This matting agent can be added to either the emulsion side or back side, and especially preferably added to the outermost layer of the emulsion layer side. The matting agent can be either soluble or insoluble in processing solution, and the use of both types of matting agents is preferable. Preferable examples are polymethylmethacrylate grains, poly (methylmethacrylate/methacrylic acid=9/1 or 5/5 (molar ratio)) grains, and polystyrene grains. The grain diameter is preferably 0.8 to 10 μm, and a narrow grain diameter distribution is preferable. It is preferable that 90% or more of all grains have grain diameters 0.9 to 1.1 times the average grain diameter. To increase the matting property, it is preferable to simultaneously add fine grains with a grain size of 0.8 μm or smaller. Examples are polymethylmethacrylate grains (0.2 μm), poly (methylmethacrylate/methacrylic acid=9/1 (molar ratio), 0.3 μm) grains, and polystyrene grains (0.25 μm), and colloidal silica grains (0.03 μm).

A support that can be used in the present invention can be made according to, for example, the method in Example 1 described in JP-A-2001-281815

Next, a film magazine (patrone) used in the present invention is described below. The main material of the magazine for use in the present invention may be a metal or synthetic plastic.

Preferable plastic materials are polystyrenes, polyethylenes, polypropylenes, polyphenyl ethers, and the like. Further, the magazine for use in the present invention may contain various antistatic agents, and preferably carbon black, metal oxide particles; nonionic, anionic, cationic, and betaine-series surface-active agents, polymers, or the like can be used. These antistatic magazines are described in JP-A-1-312537 and JP-A-1-312538. In particular, the resistance of the magazine at 25° C. and 25% RH is preferably $10^{12}$ Ω or less. Generally, plastic magazines are made of plastics with which carbon black or a pigment has been kneaded, to make the magazines screen light. The size of the magazine may be size 135, which is currently used, and, to make cameras small, it is effective to change the diameter of the 25-mm cartridge of the current size 135, to 22 mm or less. Preferably the volume of a case of the magazine is 30 $cm^3$ or less, and more preferably 25 $cm^3$ or less. The mass of the plastic to be used for the magazine or the magazine case is preferably 5 to 15 g.

Further, the magazine may be one in which a spool is rotated to deliver a film. Also the structure may be such that the forward end of a film is housed in the magazine body, and by rotating a spool shaft in the delivering direction for the film, the forward end of the film is delivered out from a port of the magazine. These magazines are disclosed in U.S. Pat. Nos. 4,834,306, and 5,226,613. A photographic film for use in the present invention may be a so-called raw film, which is before being subjected to development, and may be a photographic film after being processed. Further, a raw film and a photographic film after development may be housed in the same new magazine or in different magazines.

The color photographic light-sensitive material of the present invention can be advantageously used also as a negative film for advanced photo system (hereinafter referred to as AP system). Examples of the film include a film, manufactured by making a film into AP system format and housing it into a cartridge for exclusive use, such as NEXIA A, NEXIA F, and NEXIA H (each trade name, ISO 200/100/400 in that order) manufactured by Fuji Photo Film Co., Ltd. (hereinafter referred to as Fuji Film). These cartridge films for AP system are used after being loaded into cameras for AP system, such as EPION series (e.g. EPION 300Z (trade name)) manufactured by Fuji Film. The color photographic light-sensitive material of the present invention is also preferable for use in a film unit with a lens, such as Fuji Color UTSURUNDESU Super Slim and, UTSURUNDESU ACE 800 (each trade name) manufactured by Fuji Film.

A film thus photographed is printed through the following steps in a mini Lab system.

(1) Reception (an exposed cartridge film is received from a customer)

(2) Detaching step (the film is transferred from the cartridge to an intermediate cartridge for development steps)

(3) Film development (4) Reattaching step (the developed negative film is returned to the original cartridge)

(5) Printing (prints of three types C, H, and P, and an index print are continuously automatically printed on color paper [preferably SUPER FA8 (trade name) manufactured by Fuji Film])

(6) Collation and shipment (the cartridge and the index prints are collated by an ID number, and shipped together with the prints)

As these systems, Fuji Film MINILAB CHAMPION SUPER FA-298, FA-278, FA-258 and FA-238, and Fuji Film DIGITAL LAB SYSTEM FRONTIER (each trade name) are preferable. Examples of a film processor for MINILAB CHAMPION are FP922AL, FP562B, FP562B AL, FP362B, and FP362B AL (each trade name), and recommended processing chemicals are FUJI COLOR JUST-IT CN-16L and CN-16Q (each trade name). Examples of a printer processor are PP3008AR, PP3008A, PP1828AR, PP1828A, PP1258AR, PP1258A, PP728AR, and PP728A (each trade name), and recommended processing chemicals are FUJI COLOR JUST-IT CP-47L and CP-40FAII (each trade name). In FRONTIER SYSTEM, Scanner & Image Processor SP-1000 and Laser Printer & Paper Processor LP-1000P or Laser Printer LP-1000W (each trade name) are used. Both a detacher used in the detaching step and a reattacher used in the reattaching step are preferably DT200/DT100 and AT200/AT100 (each trade name) manufactured by Fuji Film, respectively.

The AP system can also be enjoyed by PHOTO JOY SYSTEM whose main component is Digital Image Workstation ALADDIN 1000 (trade name) manufactured by Fuji Film. For example, a developed AP system cartridge film is directly loaded into Aladdin 1000 (trade name), or image information of a negative film, positive film, or print is input to Aladdin 1000 by 35-mm Film Scanner FE-550 (trade name) or Flat Head Scanner PE-550 (trade name). Obtained digital data can be easily processed and edited. This data can be printed out by Digital Color Printer NC-550AL (trade name) using a photo-fixing heat-sensitive color printing system or PICTROGRAPHY 3000 (trade name) using a laser exposure thermal development transfer system, or by existing laboratory equipment through a film recorder. Aladdin 1000 can also output digital information directly to a floppy (registered trademark) disk or zip disk, or to CD-R via a CD writer.

In a home, a user can enjoy photographs on a TV set, simply by loading a developed AP system cartridge film into Photo Player AP-1 (trade name) manufactured by Fuji Film. Image information can also be continuously input to a personal computer with a high speed, by loading a developed AP system cartridge film into Photo Scanner AS-1 (trade name) manufactured by Fuji Film. Photo Vision FV-10 or FV-5 (each trade name) manufactured by Fuji Film can be used to input a film, print, or three-dimensional object, to a personal computer. Furthermore, image information recorded in a floppy (registered trademark) disk, zip disk, CD-R, or hard disk can be variously processed on a personal computer by using Application Software Photo Factory (trade name) manufactured by Fuji Film. Digital Color Printer NC-2 or NC-2D (trade names) using a photo-fixing heat-sensitive color printing system manufactured by Fuji Film is suited to outputting high quality prints from a personal computer.

To keep developed AP system cartridge films, FUJICOLOR POCKET ALBUM AP-5 POP L, AP-1 POP L, AP-1 POP KG, or CARTRIDGE FILM 16 (each trade name) is preferable.

The silver halide emulsions prepared according to the present invention can be used for either a color photographic light-sensitive material or a black-and-white photographic light-sensitive material. Examples of the color photographic light-sensitive material include color printing paper, film for color photographing, color reversal film and color instant film, and examples of the black-and-white photographic light-sensitive material include film for general photographing, X-ray film, film for medical diagnosis, film for printing light-sensitive material and the like.

In the field of film for medical diagnosis and film for printing light-sensitive material, the exposure can be efficiently performed using a laser image setter or a laser imager.

The technique in these fields is described in JP-A-7-287337, JP-A-4-335342, JP-A-5-313289, JP-A-8-122954 and JP-A-8-292512.

Also, heat-developable photosensitive materials can be preferably used in the present invention. For example, a material having a light-sensitive layer comprising a binder matrix having dispersed therein a catalytic activity amount of photocatalyst (e.g., silver halide), a reducing agent, a reducible silver salt (e.g., organic silver salt) and, if desired, a color toning agent for controlling the color of silver, is known. Examples thereof include those described in U.S. Pat. Nos. 3,152,904, 3,457,075, 2,910,377 and 4,500,626, JP-B-43-4924, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898, JP-A-11-352627, JP-A-6-130607, JP-A-6-332134, JP-A-6-332136, JP-A-6-347970, JP-A-7-261354 and JP-A-2000-89436.

The method for exposing the silver halide photographic light-sensitive material of the present invention is described below.

Exposure for obtaining a photographic image may be performed using an ordinary method. More specifically, any of various known light sources can be used, such as natural light (sunlight), tungsten lamp, fluorescent lamp, mercury vapor lamp, xenon arc lamp, carbon arc lamp, xenon flash lamp, laser, LED and CRT. Also, the photographic light-sensitive material may be exposed by light emitted from a phosphor excited by an electron beam, an X-ray, a γ (gamma) ray or an α (alpha) ray.

In the present invention, a laser light source is sometimes preferably used. Examples of the laser ray include those using a helium-neon gas, an argon gas, a krypton gas or a carbon dioxide gas as the laser oscillation medium, those using a solid such as ruby and cadmium as the oscillation medium, a liquid laser and a semiconductor laser. Unlike light usually used for illumination and the like, these laser rays are coherent light having sharp directivity with uniform phase and single frequency and therefore, the silver halide photographic light-sensitive material exposed using such a laser ray as a light source must have spectral properties coincided with the oscillation wavelength of the laser to be used. Among the above-described lasers, use of a semiconductor laser is preferred.

The silver halide photographic photosensitive material of the present invention has such excellent effects that generation of stain (residual color) resulting from sensitizing dyes remaining in the photosensitive material after processing can be reduced, and such residual-color-reducing effect can be maintained stably in a processing solution exhausted owing to aging or a running processing.

According to the present invention, it is possible to obtain a silver halide photographic photosensitive material with high sensitivity and less residual color after photographic processing. Further, according to the processing method and the image-forming method of the present invention, it is possible to process the photosensitive material without generation of residual color after photographic processing.

The present invention will be described in more detail based on the following examples, but the present invention is not limited thereto.

EXAMPLES

Example-1

Preparation of Sample 101

(i) Preparation of Triacetyl Cellulose Film

A triacetyl cellulose film was prepared following an ordinary solution casting method, including steps of dissolving triacetyl cellulose (13% by mass) in dichloromethane/methanol=92/8 (mass ratio), adding prasticizers of triphenyl phosphate and biphenyldiphenylphosphate (mass ratio 2:1) to the triacetyl cellulose solution so that the total content of the prasticizers became 14 mass % of triacetyl cellulose, and then forming a film from the resultant solution according to a band method. The dry thickness of a support was 97 μm.

(ii) Composition of Undercoat Layer

The two surfaces of the above-described triacetyl cellulose film were coated with the following undercoat solution. The number corresponding to each ingredient indicates mass of the ingredient contained in 1 liter of the undercoat solution.

| | |
|---|---|
| Gelatin | 10.0 g |
| Salicylic acid | 0.5 g |
| Glycerin | 4.0 g |
| Acetone | 700 mL |
| Methanol | 200 mL |
| Dichloromethane | 80 mL |
| Formaldehyde | 0.1 mg |
| Water to make | 1.0 L |

(iii) Coating of Backing Layers

The following backing layers were coated on one side of the support provided with undercoat.

| | |
|---|---|
| First Layer | |
| Binder: Acid-processed gelatin (isoelectric point 9.0) | 1.00 g |
| Polymer latex P-2 (av. particle diameter 0.1 μm) | 0.13 g |
| Polymer latex P-4 (av. particle diameter 0.2 μm) | 0.23 g |
| Ultraviolet ray absorbent U-1 | 0.030 g |
| Ultraviolet ray absorbent U-2 | 0.010 g |
| Ultraviolet ray absorbent U-3 | 0.010 g |
| Ultraviolet ray absorbent U-4 | 0.020 g |
| High-boiling organic solvent Oil-2 | 0.030 g |
| Surface active agent W-2 | 0.010 g |
| Surface active agent W-4 | 3.0 mg |
| Second Layer | |
| Binder: Acid-processed gelatin (isoelectric point 9.0) | 3.10 g |
| Polymer latex: P-4 (av. particle diameter 0.2 μm) | 0.11 g |
| Ultraviolet ray absorbent U-1 | 0.030 g |
| Ultraviolet ray absorbent U-3 | 0.010 g |
| Ultraviolet ray absorbent U-4 | 0.020 g |
| High-boiling organic solvent Oil-2 | 0.030 g |
| Surface active agent W-2 | 0.010 g |
| Surface active agent W-4 | 3.0 mg |

-continued

| | |
|---|---|
| Dye D-2 | 0.10 g |
| Dye D-10 | 0.12 g |
| Potassium sulfate | 0.25 g |
| Calcium chloride | 0.5 mg |
| Sodium hydroxide | 0.03 g |
| Third Layer | |
| Binder: Acid-processed gelatin (isoelectric point 9.0) | 3.30 g |
| Surface active agent W-2 | 0.020 g |
| Potassium sulfate | 0.30 g |
| Sodium hydroxide | 0.03 g |
| Fourth Layer | |
| Binder: Lime-processed gelatin (isoelectric point 5.4) | 1.15 g |
| Copolymer of methacrylic acid and methyl methacrylate (1:9) (av. particle diameter 2.0 μm) | 0.040 g |
| Copolymer of methacrylic acid and methyl methacrylate (6:4) (av. particle diameter 2.0 μm) | 0.030 g |
| Surface active agent W-2 | 0.060 g |
| Surface active agent W-1 | 7.0 mg |
| Hardener H-1 | 0.23 g |

(iv) Coating of Light-sensitive Emulsion Layers

The surface of the support on the side opposite to the backing layer, was coated with light-sensitive emulsion layers having the following compositions to produce a sample 101. The number corresponding to each ingredient indicates the addition amount per $m^2$. Note that the effect of the compound added is not limited to the use of the compound described below.

As the gelatin described below, a gelatin having a molecular weight (mass average molecular weight) of 100,000 to 200,000 was used. As the contents of main metal ions contained in the gelatin, potassium was in the range of from 2,500 to 3,000 ppm, iron was in the range of from 1 to 7 ppm, and sodium was in the range of from 1,500 to 3,000 ppm.

In addition, a gelatin having a calcium-content of 1,000 ppm or less was also used in combination.

The organic compounds to be incorporated in each layer were prepared in the form of the emulsion-dispersion containing gelatin (W-2, W-3 and W-4 were used as surface active agents). Further, light-sensitive emulsions and yellow colloidal silver were also prepared in the form of the gelatin-dispersion, respectively. In order to prepare a coating solution, these dispersions were mixed so as to become the addition amounts described below. The thus-prepared coating solution was used for coating. Cpd-H, Cpd-O, Cpd-P, Cpd-Q, Dyes D-1, D-2, D-3, D-5, D-6, D-8, D-9, D-10, H-1, P-3, and F-1 to F-9 were solved respectively in water, or a proper water-miscible organic solvent, such as methanol, dimethylformamide, ethanol and dimethylaceto amide, and they were added to the coating solution of each layer.

The gelatin density (mass of gelatin solid content/volume of coating solution) of the thus-prepared each layer was in the range of from 2.5% to 15.0%. The pH of each coating solution was in the range of from 5.0 to 8.5. In the coating solution for the layers containing silver halide, the value of pAg under the conditions having adjusted to be the pH of 6.0 and the temperature of 40° C. respectively, was in the range of from 7.0 to 9.5.

After coating, layers on a support were dried in a multi-stage drying process in which a temperature was kept in the range of from 10° C. to 45° C., to obtain a sample.

| | | |
|---|---|---|
| First layer: Anti-halation Layer | | |
| Black colloidal silver | | 0.20 g |
| Gelatin | | 2.20 g |
| Compound Cpd-B | | 0.010 g |
| Ultraviolet absorber U-1 | | 0.050 g |
| Ultraviolet absorber U-3 | | 0.020 g |
| Ultraviolet absorber U-4 | | 0.020 g |
| Ultraviolet absorber U-5 | | 0.010 g |
| Ultraviolet absorber U-2 | | 0.070 g |
| Compound Cpd-F | | 0.020 g |
| Compound Cpd-R | | 0.020 g |
| Compound Cpd-S | | 0.020 g |
| High boiling organic solvent Oil-2 | | 0.020 g |
| High boiling organic solvent Oil-6 | | 0.020 g |
| High boiling organic solvent Oil-8 | | 0.020 g |
| Dye D-4 | | 1.0 mg |
| Dye D-8 | | 1.0 mg |
| Fine crystal solid dispersion of Dye E-1 | | 0.05 g |
| Second layer: Intermediate layer | | |
| Gelatin | | 0.40 g |
| Compound Cpd-F | | 0.050 g |
| High boiling organic solvent Oil-6 | | 0.010 g |
| Third layer: Light-sensitive emulsion layer | | |
| Emulsion R | Silver | 0.20 g |
| Emulsion S | Silver | 0.10 g |
| Fine grain silver iodide emulsion (av. sphere-equivalent diameter 0.05 μm, cubic) | Silver | 0.050 g |
| Gelatin | | 0.5 g |
| Compound Cpd-M | | 0.030 g |
| High boiling organic solvent Oil-6 | | 0.030 g |
| High boiling organic solvent Oil-7 | | 5.0 mg |
| Dye D-7 | | 4.0 mg |
| Fourth layer: Intermediate layer | | |
| Gelatin | | 1.50 g |
| Compound Cpd-M | | 0.10 g |
| Compound Cpd-F | | 0.030 g |
| Compound Cpd-D | | 0.010 g |
| Compound Cpd-K | | 3.0 mg |
| Ultraviolet absorber U-6 | | 0.010 g |
| High boiling organic solvent Oil-6 | | 0.010 g |
| High boiling organic solvent Oil-3 | | 0.010 g |
| High boiling organic solvent Oil-4 | | 0.010 g |
| Fifth layer: Low-sensitivity red-sensitive emulsion layer | | |
| Emulsion A | Silver | 0.15 g |
| Emulsion B | Silver | 0.10 g |
| Emulsion C | Silver | 0.15 g |
| Yellow colloidal silver | Silver | 1.0 mg |
| Gelatin | | 0.60 g |
| Coupler C-1 | | 0.15 g |
| Coupler C-2 | | 7.0 mg |
| Coupler C-9 | | 2.0 mg |
| Ultraviolet absorber U-2 | | 3.0 mg |
| Compound Cpd-D | | 1.0 mg |
| Compound Cpd-J | | 2.0 mg |
| High boiling organic solvent Oil-5 | | 0.050 g |
| High boiling organic solvent Oil-10 | | 0.010 g |
| Sixth layer: Middle-sensitivity red-sensitive emulsion layer | | |
| Emulsion C | Silver | 0.20 g |
| Emulsion D | Silver | 0.15 g |
| Silver bromide emulsion, with inner part of which was fogged (cube, av. sphere-equivalent diameter of 0.11 μm) | Silver | 0.010 g |
| Gelatin | | 0.60 g |
| Coupler C-1 | | 0.15 g |
| Coupler C-2 | | 7.0 mg |
| Compound Cpd-D | | 1.5 mg |
| High boiling organic solvent Oil-5 | | 0.050 g |
| High boiling organic solvent Oil-10 | | 0.010 g |
| Compound Cpd-T | | 2.0 mg |

-continued

| | | |
|---|---|---|
| Seventh layer: High-sensitivity red-sensitive emulsion layer | | |
| Emulsion E | Silver | 0.15 g |
| Emulsion F | Silver | 0.20 g |
| Gelatin | | 1.50 g |
| Coupler C-1 | | 0.70 g |
| Coupler C-2 | | 0.025 g |
| Coupler C-3 | | 0.020 g |
| Coupler C-8 | | 3.0 mg |
| Ultraviolet absorber U-1 | | 0.010 g |
| High boiling organic solvent Oil-5 | | 0.25 g |
| High boiling organic solvent Oil-9 | | 0.050 g |
| High boiling organic solvent Oil-10 | | 0.10 g |
| Compound Cpd-D | | 5.0 mg |
| Compound Cpd-L | | 1.0 mg |
| Compound Cpd-T | | 0.020 g |
| Additive P-1 | | 0.010 g |
| Additive P-3 | | 0.030 g |
| Eighth layer: Intermediate layer | | |
| Gelatin | | 0.50 g |
| Additive P-2 | | 0.10 g |
| Dye D-5 | | 0.020 g |
| Dye D-9 | | 6.0 mg |
| Compound Cpd-I | | 0.020 g |
| Compound Cpd-O | | 3.0 mg |
| Compound Cpd-P | | 5.0 mg |
| High boiling organic solvent Oil-6 | | 0.050 g |
| Ninth layer: Intermediate layer | | |
| Yellow colloidal silver | Silver | 3.0 mg |
| Gelatin | | 1.00 g |
| Additive P-2 | | 0.05 g |
| Compound Cpd-A | | 0.050 g |
| Compound Cpd-D | | 0.030 g |
| Compound Cpd-M | | 0.10 g |
| High boiling organic solvent Oil-3 | | 0.010 g |
| High boiling organic solvent Oil-6 | | 0.10 g |
| Tenth layer: Low-sensitivity green-sensitive emulsion layer | | |
| Emulsion G | Silver | 0.15 g |
| Emulsion H | Silver | 0.15 g |
| Emulsion I | Silver | 0.15 g |
| Gelatin | | 1.00 g |
| Coupler C-4 | | 0.080 g |
| Coupler C-5 | | 0.050 g |
| Compound Cpd-B | | 0.010 g |
| Compound Cpd-G | | 2.5 mg |
| Compound Cpd-K | | 2.0 mg |
| High boiling organic solvent Oil-2 | | 0.020 g |
| High boiling organic solvent Oil-5 | | 0.020 g |
| Additive P-1 | | 5.0 mg |
| Eleventh layer: Middle-sensitivity green-sensitive emulsion layer | | |
| Emulsion I | Silver | 0.10 g |
| Emulsion J | Silver | 0.20 g |
| Gelatin | | 0.50 g |
| Coupler C-4 | | 0.10 g |
| Coupler C-5 | | 0.050 g |
| Coupler C-6 | | 0.010 g |
| Compound Cpd-B | | 0.020 g |
| Compound Cpd-U | | 8.0 mg |
| High boiling organic solvent Oil-2 | | 0.010 g |
| High boiling organic solvent Oil-5 | | 0.020 g |
| Additive P-1 | | 0.010 g |
| Twelfth layer: High-sensitivity green-sensitive emulsion layer | | |
| Emulsion K | Silver | 0.40 g |
| Silver bromide emulsion, with inner part of which was fogged (cube, av. sphere-equivalent diameter of 0.11 μm) | Silver | 5.0 mg |
| Gelatin | | 1.20 g |
| Coupler C-4 | | 0.60 g |
| Coupler C-5 | | 0.30 g |

-continued

| | | |
|---|---|---|
| Coupler C-7 | | 0.10 g |
| Compound Cpd-B | | 0.030 g |
| Compound Cpd-U | | 0.030 g |
| Additive P-4 | | 0.10 g |
| Thirteenth layer: Yellow filter layer | | |
| Yellow colloidal silver | Silver | 2.0 mg |
| Gelatin | | 1.0 g |
| Compound Cpd-C | | 0.010 g |
| Compound Cpd-M | | 0.020 g |
| High boiling organic solvent Oil-1 | | 0.020 g |
| High boiling organic solvent Oil-6 | | 0.020 g |
| Fine crystal solid dispersion of Dye E-2 | | 0.25 g |
| Fourteenth layer: Light-sensitive emulsion layer | | |
| Emulsion T | Silver | 0.20 g |
| Gelatin | | 0.40 g |
| Coupler C-1 | | 5.0 mg |
| Coupler C-2 | | 0.5 mg |
| High boiling organic solvent Oil-5 | | 2.0 mg |
| Compound Cpd-Q | | 0.20 g |
| Dye D-6 | | 4.0 mg |
| Fifteenth layer: Low-sensitivity blue-sensitive emulsion layer | | |
| Emulsion L | Silver | 0.10 g |
| Emulsion M | Silver | 0.10 g |
| Emulsion N | Silver | 0.10 g |
| Gelatin | | 0.80 g |
| Coupler C-8 | | 0.030 g |
| Coupler C-9 | | 0.030 g |
| Coupler C-10 | | 0.30 g |
| Compound Cpd-B | | 0.015 g |
| Compound Cpd-I | | 8.0 mg |
| Compound Cpd-K | | 1.0 mg |
| Ultraviolet absorber U-5 | | 0.015 g |
| Additive P-4 | | 0.020 g |
| Sixteenth layer: Middle-sensitivity blue-sensitive emulsion layer | | |
| Emulsion N | Silver | 0.20 g |
| Emulsion O | Silver | 0.20 g |
| Gelatin | | 0.80 g |
| Coupler C-8 | | 0.030 g |
| Coupler C-9 | | 0.030 g |
| Coupler C-10 | | 0.30 g |
| Compound Cpd-B | | 0.010 g |
| Compound Cpd-E | | 0.020 g |
| Compound Cpd-N | | 2.0 mg |
| Ultraviolet absorber U-5 | | 0.015 g |
| Additive P-1 | | 0.020 g |
| Seventeenth layer: High-sensitivity blue-sensitive emulsion layer | | |
| Emulsion P | Silver | 0.20 g |
| Emulsion Q | Silver | 0.15 g |
| Gelatin | | 2.00 g |
| Coupler C-8 | | 0.10 g |
| Coupler C-9 | | 0.15 g |
| Coupler C-10 | | 1.10 g |
| Coupler C-3 | | 0.010 g |
| High boiling organic solvent Oil-5 | | 0.020 g |
| Compound Cpd-B | | 0.060 g |
| Compound Cpd-D | | 3.0 mg |
| Compound Cpd-E | | 0.020 g |
| Compound Cpd-F | | 0.020 g |
| Compound Cpd-N | | 5.0 mg |
| Ultraviolet absorber U-5 | | 0.060 g |
| Additive P-1 | | 0.010 g |
| Eighteenth layer: First protective layer | | |
| Gelatin | | 0.70 g |
| Ultraviolet absorber U-1 | | 0.020 g |
| Ultraviolet absorber U-5 | | 0.030 g |
| Ultraviolet absorber U-2 | | 0.10 g |
| Compound Cpd-B | | 0.030 g |
| Compound Cpd-O | | 5.0 mg |
| Compound Cpd-A | | 0.030 g |
| Compound Cpd-H | | 0.20 g |

-continued

| | | |
|---|---|---|
| Dye D-1 | | 8.0 mg |
| Dye D-2 | | 0.010 g |
| Dye D-3 | | 0.010 g |
| High boiling organic solvent Oil-3 | | 0.040 g |
| Nineteenth layer: Second protective layer | | |
| Colloidal silver | Silver | 2.5 mg |
| Fine grain silver iodobromide emulsion (av. grain diameter of 0.06 μm, AgI content of 1 mol %) | Silver | 0.10 g |
| Gelatin | | 0.80 g |
| Ultraviolet absorber U-2 | | 0.030 g |
| Ultraviolet absorber U-5 | | 0.030 g |
| High boiling organic solvent Oil-3 | | 0.010 g |
| Twentieth layer: Third protective layer | | |
| Gelatin | | 1.00 g |
| Polymethyl methacrylate (av. particle diameter of 1.5 μm) | | 0.10 g |
| Copolymer of methyl methacrylate and methacrylic acid (6:4) (av. particle diameter, 1.5 μm) | | 0.15 g |

-continued

| | |
|---|---|
| Silicone oil SO-1 | 0.20 g |
| Surface active agent W-1 | 0.020 g |
| Surface active agent W-2 | 0.040 g |

Further, to all emulsion layers, in addition to the above-described components, additives F-1 to F-9 were added. Further, to each layer, in addition to the above-described components, a gelatin hardener H-1 and surface active agents W-2, W-3, and W-4 for coating and emulsifying, were added.

Further, as antifungal and antibacterial agents, phenol, 1,2-benzisothiazoline-3-one, 2-phenoxyethanol, phenetylalcohol, and p-hydroxybenzoic acid butyl ester were added.

The thickness of a coating film at the dry state of the thus-prepared sample 101 was 25.8 μm. The swelling rate of the coating film, when swelled with distilled water at 25° C., was 1.78 times.

TABLE 5

Silver iodobromide emulsions used in Sample 101

| Emulsion | Characteristics | Average sphere-equivalent diameter (μm) | Variation coefficient (%) | Average AgI content (%) | Halogen composition structure of silver halide grains | AgI content at grain surface (%) | Other characteristics (1) | (2) | (3) | (4) | (5) |
|---|---|---|---|---|---|---|---|---|---|---|---|
| A | Monodisperse tetradecahedral grains | 0.18 | 10 | 3.5 | Threefold structure | 2.5 | ○ | ○ | | ○ | |
| B | Monodisperse (111) tabular grains Average aspect ratio 3.0 | 0.20 | 10 | 2.5 | Fourfold structure | 2.5 | | | ○ | | ○ |
| C | Monodisperse (111) tabular grains Average aspect ratio 4.5 | 0.32 | 11 | 1.8 | Threefold structure | 0.1 | | ○ | | ○ | ○ |
| D | Monodisperse (111) tabular grains Average aspect ratio 6.0 | 0.32 | 21 | 4.8 | Threefold structure | 2.0 | | ○ | | ○ | ○ |
| E | Monodisperse (111) tabular grains Average aspect ratio 6.0 | 0.48 | 12 | 2.0 | Fourfold structure | 1.3 | | ○ | | | |
| F | Monodisperse (111) tabular grains Average aspect ratio 8.0 | 0.65 | 12 | 1.6 | Threefold structure | 0.6 | | ○ | ○ | | ○ |
| G | Monodisperse cubic grains | 0.14 | 9 | 3.5 | Fourfold structure | 0.3 | ○ | | ○ | ○ | |

(Other characteristics)

(1): A reduction sensitizer was added during formation of grains.

(2): A selenium sensitizer was used as an after-ripening chemical.

(3): A rhodium salt was added during formation of grains.

(4): After completion of after-ripening, silver nitrate in an amount of 10% in terms of the silver molar ratio relative to the emulsion grains at the time, and potassium bromide in an equimolar amount to the silver nitrate, were added to form shells.

(5): The presence of 10 or more dislocation lines/grain on average per 1 particle was observed under a transmission electron microscope.All the photosensitive emulsions were after-ripened using sodium thiosulfate, potassium thiocyanate and sodium chloroaurate. Further, an iridium salt was added as necessary during formation of grains. Chemically modified gelatin whose amino groups had been partially converted into phthalic amide was added to the emulsions B, C, E, H, J, N, Q, R, S, and T when the emulsions were prepared.

TABLE 6

(Continued to Table 5)

Silver iodobromide emulsions used in Sample 101

| Emulsion | Characteristics | Average sphere-equivalent diameter (μm) | Variation coefficient (%) | Average AgI content (%) | Halogen composition structure of silver halide grains | AgI content at grain surface (%) | Other characteristics (1) | (2) | (3) | (4) | (5) |
|---|---|---|---|---|---|---|---|---|---|---|---|
| H | Monodisperse cubic grain | 0.22 | 12 | 1.9 | Fourfold structure | 0.7 | | ○ | | | ○ |
| I | Monodisperse (111) tabular grains Average aspect ratio 4.0 | 0.35 | 12 | 3.5 | Fivefold structure | 1.5 | ○ | ○ | | ○ | ○ |
| J | Monodisperse (111) tabular grains Average aspect ratio 7.0 | 0.40 | 21 | 2.0 | Fourfold structure | 2.2 | | ○ | | ○ | ○ |
| K | Monodisperse (111) tabular grains Average aspect ratio 8.5 | 0.65 | 13 | 1.7 | Threefold structure | 1.3 | ○ | ○ | ○ | | ○ |
| L | Monodisperse tetradecahedral grains | 0.30 | 9 | 7.5 | Threefold structure | 0.8 | | | ○ | | ○ |
| M | Monodisperse tetradecahedral grains | 0.30 | 9 | 7.5 | Threefold structure | 2.5 | | ○ | | ○ | |
| N | Monodisperse (111) tabular grains Average aspect ratio 3.0 | 0.35 | 13 | 2.1 | Fivefold structure | 4.0 | ○ | ○ | ○ | | |

(Other characteristics)

(1): A reduction sensitizer was added during formation of grains.

(2): A selenium sensitizer was used as an after-ripening chemical.

(3): A rhodium salt was added during formation of grains.

(4): After completion of after-ripening, silver nitrate in an amount of 10% in terms of the silver molar ratio relative to the emulsion grains at the time, and potassium bromide in an equimolar amount to the silver nitrate, were added to form shells.

(5): The presence of 10 or more dislocation lines/grain on average per 1 particle was observed under a transmission electron microscope. All the photosensitive emulsions were after-ripened using sodium thiosulfate, potassium thiocyanate and sodium chloroaurate-.Further, an iridium salt was added as necessary during formation of grains. Chemically modified gelatin whose amino groups had been partially converted into phthalic amide was added to the emulsions B, C, E, H, J, N, Q, R, S, and T when the emulsions were prepared.

TABLE 7

(Continued to Table 6)

Silver iodobromide emulsions used in Sample 101

| Emulsion | Characteristics | Average sphere-equivalent diameter (μm) | Variation coefficient (%) | Average AgI content (%) | Halogen composition structure of silver halide grains | AgI content at grain surface (%) | Other characteristics (1) | (2) | (3) | (4) | (5) |
|---|---|---|---|---|---|---|---|---|---|---|---|
| O | Monodisperse (111) tabular grains Average aspect ratio 5.0 | 0.45 | 9 | 2.5 | Fourfold structure | 1.0 | | ○ | ○ | ○ | ○ |
| P | Monodisperse (111) tabular grains Average aspect ratio 9.0 | 0.70 | 21 | 2.8 | Threefold structure | 0.5 | ○ | ○ | | | ○ |
| Q | Monodisperse (111) tabular grains Average aspect ratio 9.0 | 0.85 | 8 | 1.0 | Fourfold structure | 0.5 | ○ | ○ | | | ○ |
| R | Monodisperse (111) tabular grains Average aspect ratio 5.0 | 0.40 | 15 | 8.0 | Fourfold structure | 4.0 | ○ | ○ | | | ○ |
| S | Monodisperse (111) tabular grains Average aspect ratio 4.0 | 0.70 | 13 | 12.5 | Fourfold structure | 3.0 | | ○ | ○ | | ○ |
| T | Monodisperse (111) tabular grains Average aspect ratio 4.0 | 0.45 | 13 | 10.5 | Fourfold structure | 2.8 | ○ | ○ | | | ○ |

(Other characteristics)

(1): A reduction sensitizer was added during formation of grains.

(2): A selenium sensitizer was used as an after-ripening chemical.

(3): A rhodium salt was added during formation of grains.

(4): After completion of after-ripening, silver nitrate in an amount of 10% in terms of the silver molar ratio relative to the emulsion grains at the time, and potassium bromide in an equimolar amount to the silver nitrate, were added to form shells.

(5): The presence of 10 or more dislocation lines/grain on average per 1 particle was observed under a transmission electron microscope. All the photosensitive emulsions were after-ripened using sodium thiosulfate, potassium thiocyanate and sodium chloroaurate-.Further, an iridium salt was added as necessary during formation of grains. Chemically modified gelatin whose amino groups had been partially converted into phthalic amide was added to the emulsions B, C, E, H, J, N, Q, R, S, and T when the emulsions were prepared.

TABLE 8

| Emulsion | Added sensitizing dye | Added amount per 1 mol of silver halide (g) | Stage when a sensitizing dye was added |
|---|---|---|---|
| A | S-1 | 0.01 | After after-ripening |
| | S-2 | 0.20 | Before after-ripening |
| | S-3 | 0.02 | Before after-ripening |
| | S-8 | 0.08 | Before after-ripening |
| | S-13 | 0.05 | Before after-ripening |
| B | S-2 | 0.20 | Before after-ripening |
| | S-8 | 0.08 | Before after-ripening |
| | S-13 | 0.05 | Before after-ripening |
| | S-14 | 0.01 | Before after-ripening |
| C | S-2 | 0.20 | Before after-ripening |
| | S-8 | 0.08 | Before after-ripening |
| | S-13 | 0.20 | Before after-ripening |
| D | S-2 | 0.20 | After after-ripening |
| | S-3 | 0.05 | After after-ripening |
| | S-8 | 0.08 | Before after-ripening |
| | S-13 | 0.25 | Before after-ripening |
| E | S-1 | 0.01 | Before after-ripening |
| | S-2 | 0.25 | Before after-ripening |
| | S-8 | 0.05 | Before after-ripening |
| | S-13 | 0.25 | After after-ripening |
| F | S-2 | 0.25 | Before after-ripening |
| | S-3 | 0.02 | Before after-ripening |
| | S-8 | 0.05 | Before after-ripening |
| G | S-4 | 0.33 | After after-ripening |
| | S-5 | 0.05 | After after-ripening |
| | S-12 | 0.1 | After after-ripening |
| H | S-4 | 0.25 | Before after-ripening |
| | S-5 | 0.05 | After after-ripening |
| | S-9 | 0.10 | Before after-ripening |
| | S-14 | 0.02 | After after-ripening |

TABLE 9

| Emulsion | Added sensitizing dye | Added amount per 1 mol of silver halide (g) | Stage when a sensitizing dye was added |
|---|---|---|---|
| I | S-4 | 0.3 | Before after-ripening |
| | S-9 | 0.2 | Before after-ripening |
| | S-12 | 0.1 | Before after-ripening |
| J | S-4 | 0.35 | Before after-ripening |
| | S-5 | 0.05 | After after-ripening |
| | S-12 | 0.1 | Before after-ripening |
| K | S-4 | 0.3 | Before after-ripening |
| | S-9 | 0.05 | Before after-ripening |
| | S-12 | 0.1 | Before after-ripening |
| | S-14 | 0.02 | Before after-ripening |
| L, M | S-6 | 0.1 | After after-ripening |
| | S-10 | 0.2 | After after-ripening |
| | S-11 | 0.05 | After after-ripening |
| N | S-6 | 0.05 | After after-ripening |
| | S-7 | 0.05 | After after-ripening |
| | S-10 | 0.25 | After after-ripening |
| | S-11 | 0.05 | After after-ripening |
| O | S-10 | 0.4 | After after-ripening |
| | S-11 | 0.15 | After after-ripening |
| P | S-6 | 0.05 | After after-ripening |
| | S-7 | 0.05 | After after-ripening |
| | S-10 | 0.3 | Before after-ripening |
| | S-11 | 0.1 | Before after-ripening |
| Q | S-6 | 0.05 | Before after-ripening |
| | S-7 | 0.05 | Before after-ripening |
| | S-10 | 0.2 | Before after-ripening |
| | S-11 | 0.25 | Before after-ripening |
| R | S-15 | 0.35 | After after-ripening |
| | S-4 | 0.15 | After after-ripening |
| S | S-15 | 0.30 | After after-ripening |
| | S-4 | 0.20 | After after-ripening |
| | S-10 | 0.05 | Before after-ripening |
| T | S-6 | 0.05 | Before after-ripening |
| | S-10 | 0.30 | Before after-ripening |

C-1

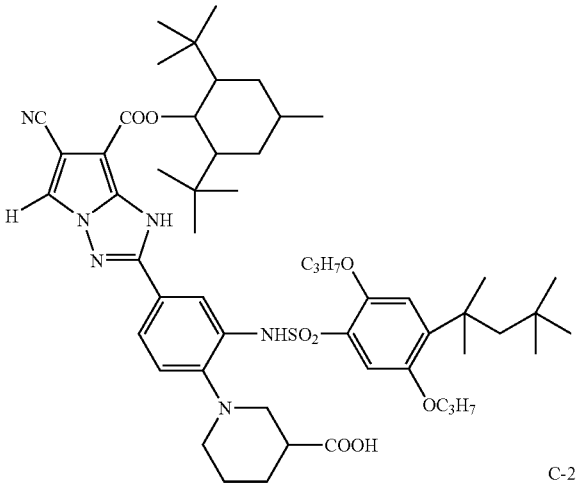

C-2

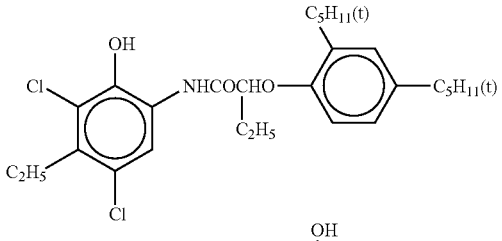

C-3

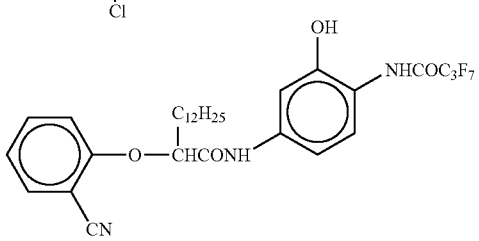

C-4

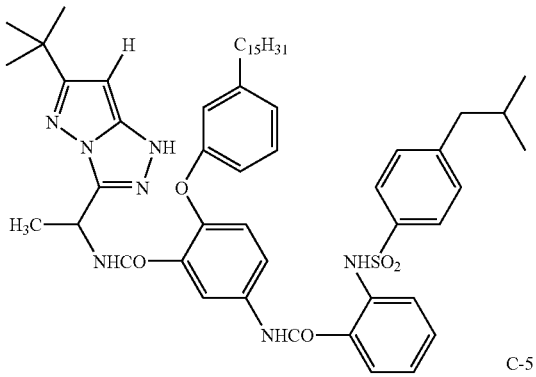

C-5

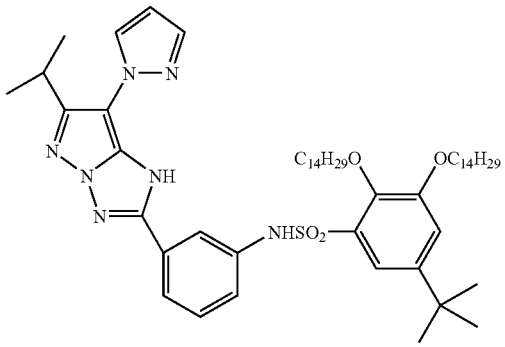

-continued
C-6
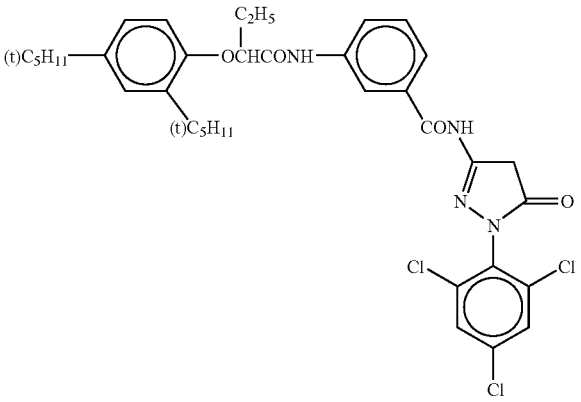
-continued
C-7
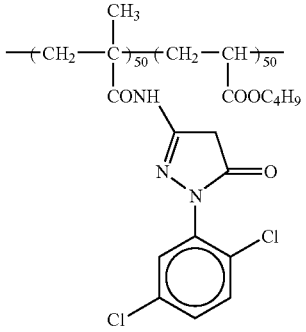
"( )$_{50}$" represents % by mass.
Average molecular weight: about 25,000
C-8
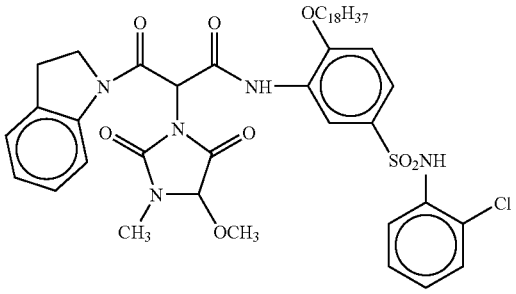
C-9
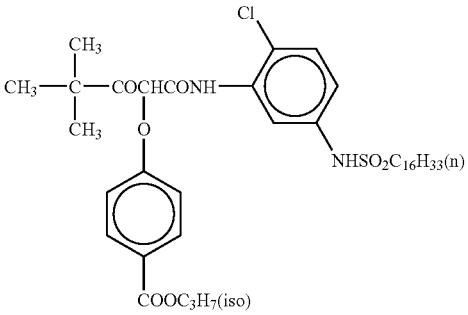
C-10
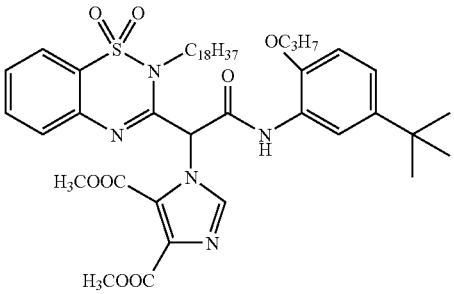
Oil-1
Tri-n-hexyl phosphate
Oil-2
Tricresyl phosphate
Oil-3
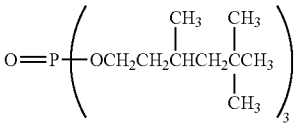
Oil-4
Tricyclohexyl phosphate
Oil-5
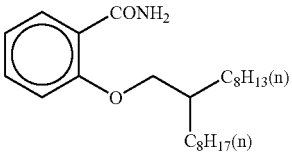

-continued
Oil-6
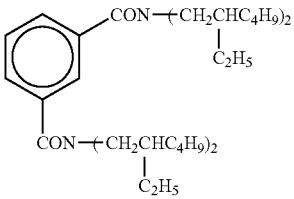
Oil-7
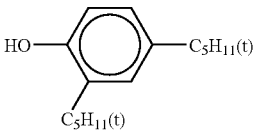
Oil-8
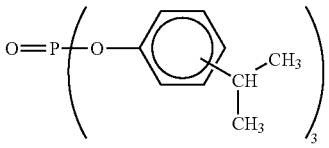
(Mixture of isomers)
Oil-9
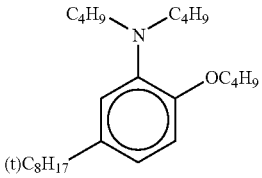
Oil-10
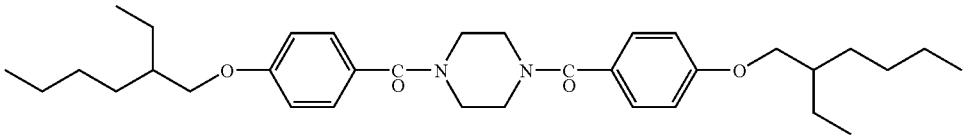
Cpd-A
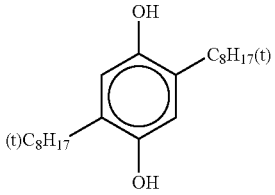
Cpd-B
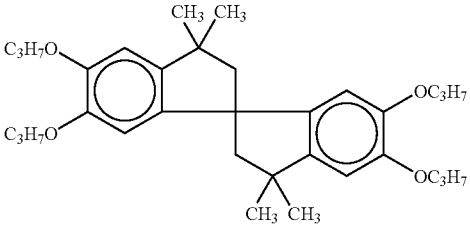
Cpd-C
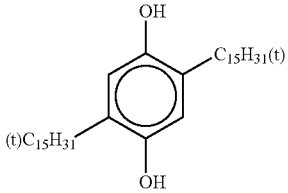
Cpd-D
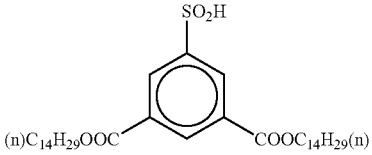
Cpd-E
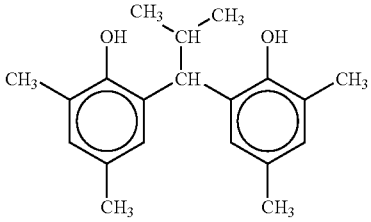
Cpd-F
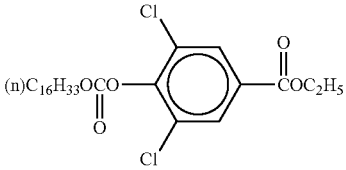
Cpd-G
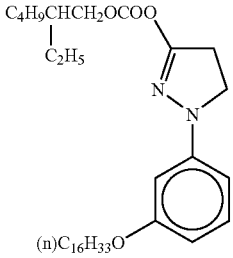
Cpd-H
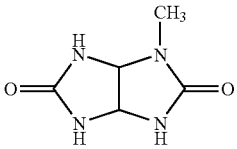

-continued
Cpd-I
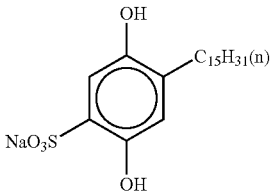
Cpd-J
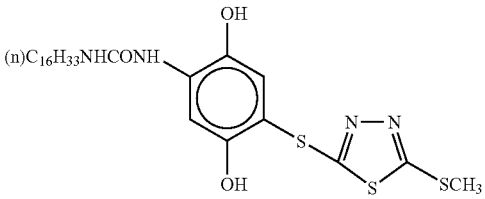
Cpd-K
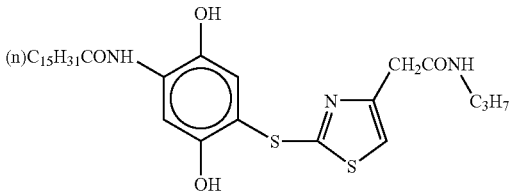
Cpd-L
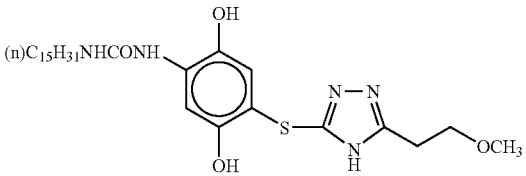
Cpd-M
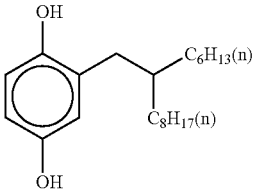
Cpd-N
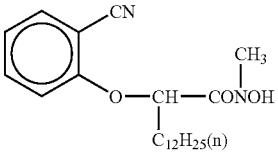
Cpd-O
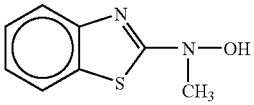
Cpd-P
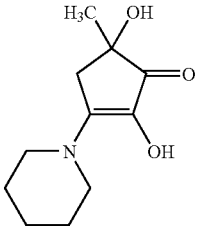
Cpd-Q
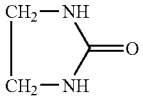
Cpd-R
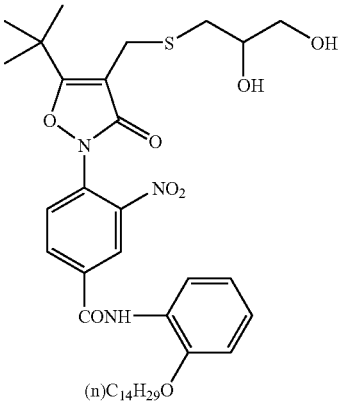
Cpd-S
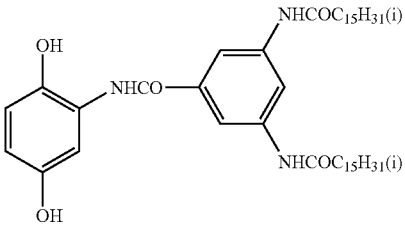
Cpd-T
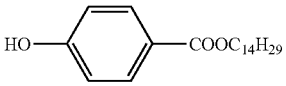

-continued
Cpd-U
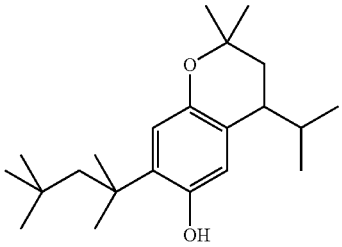
U-1
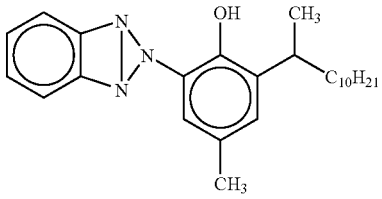
U-2
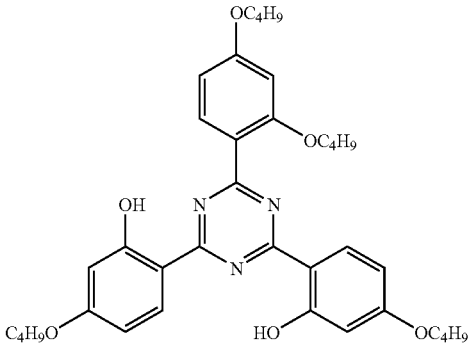
U-3
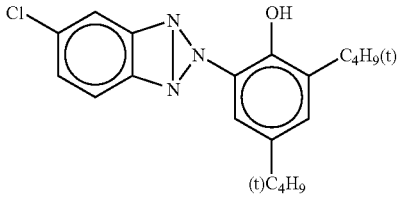
U-4
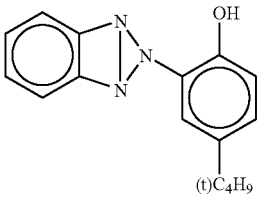
U-5
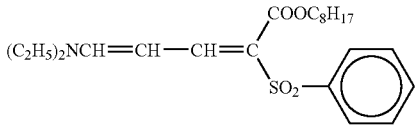
U-6
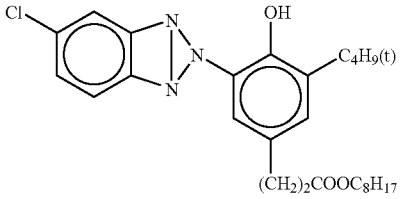
S-1
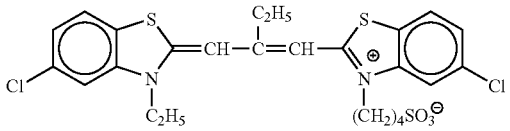
S-2
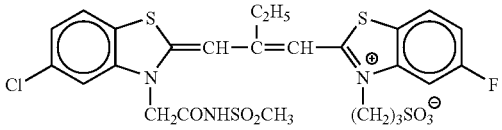
S-3
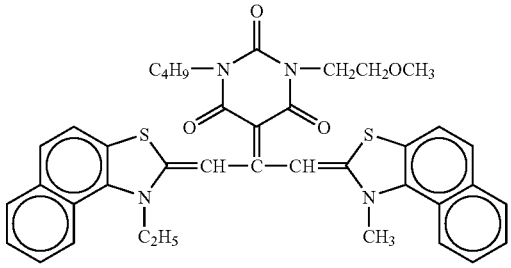
S-4
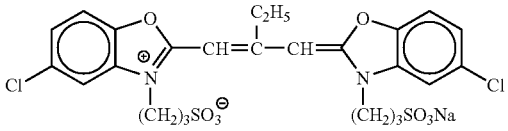
S-5
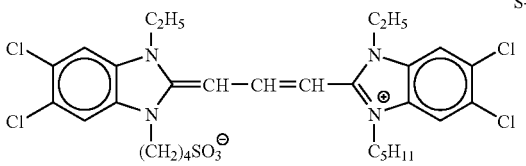

-continued
S-6
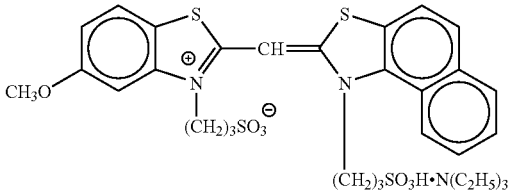
S-7
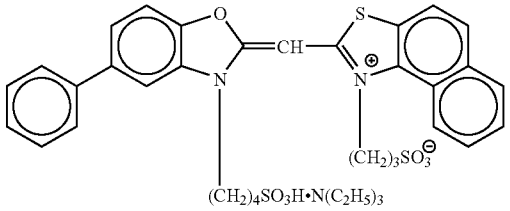
S-8
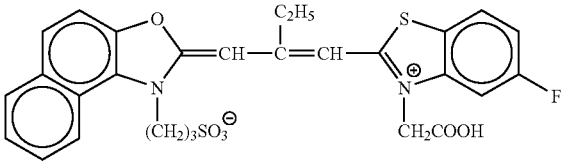
S-9
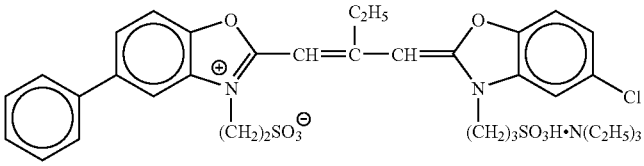
S-10
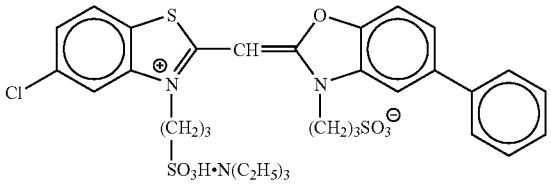
S-11
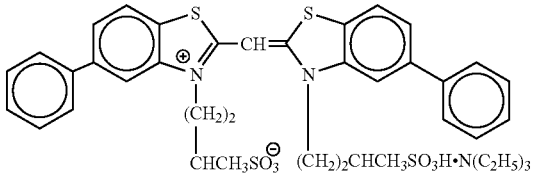
S-12
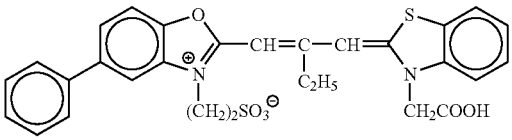
S-13
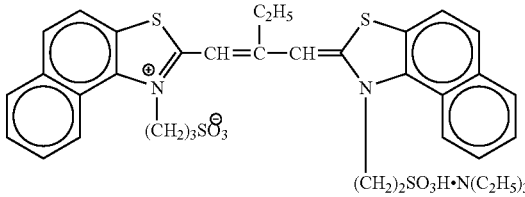
S-14
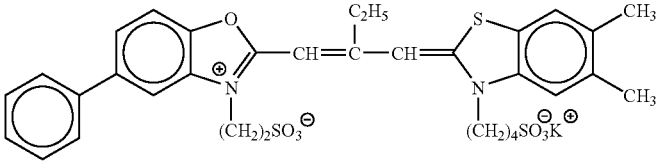
S-15
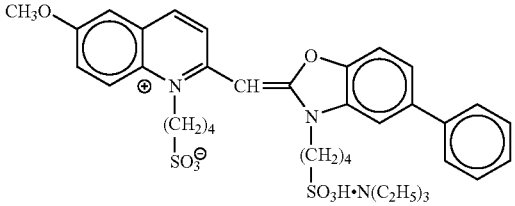
D-1
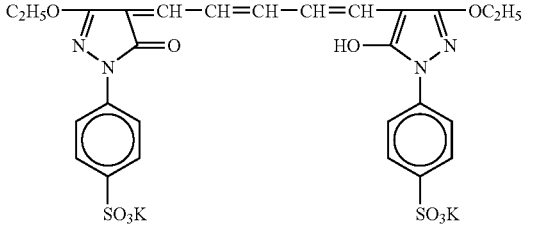

-continued
D-2
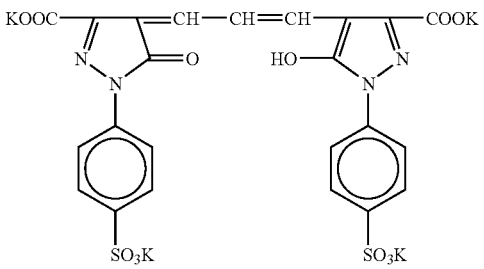
D-3
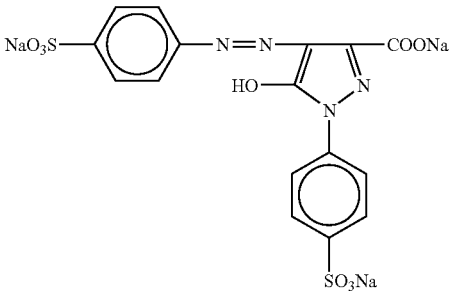
D-4
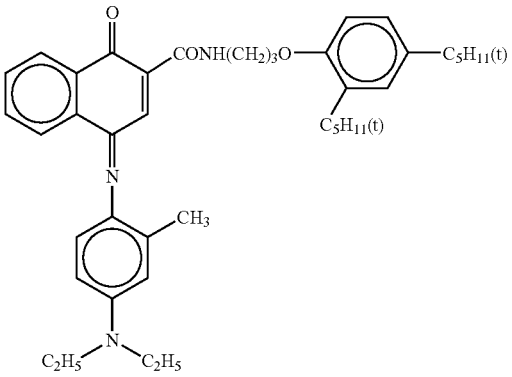
D-5
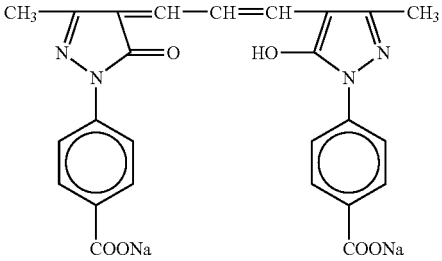
D-6
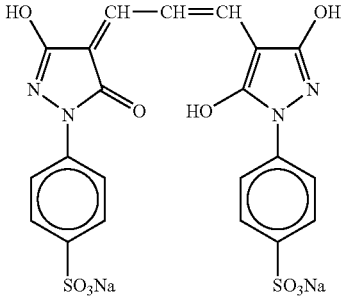
D-7
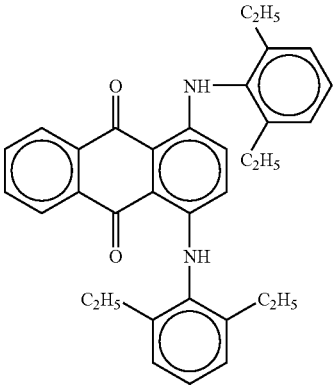
D-8
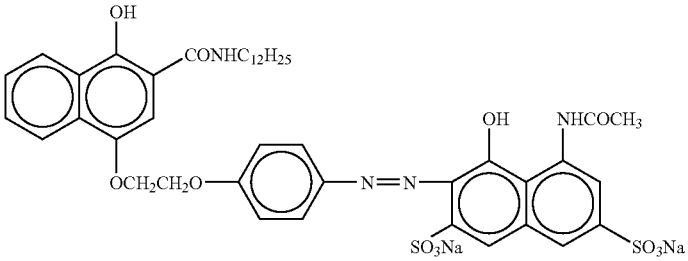

-continued
D-9
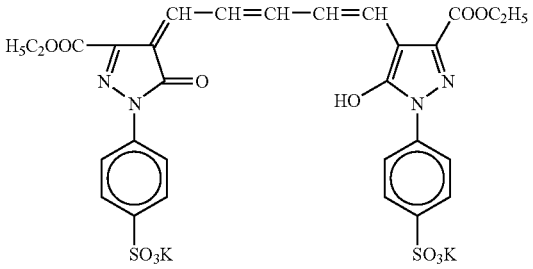
D-10
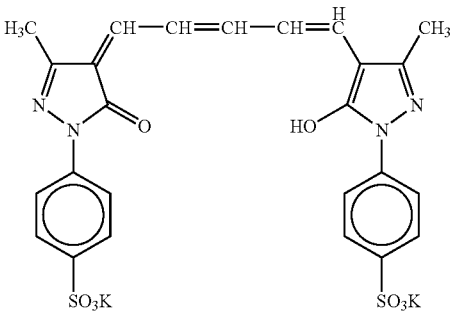
E-1
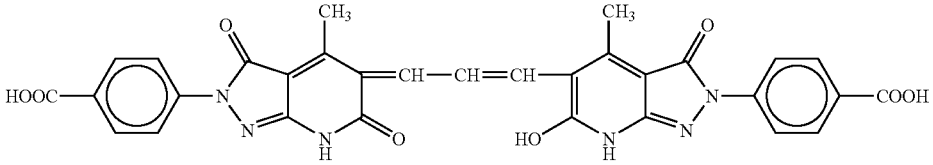
E-2
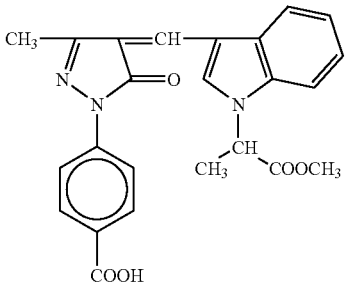
H-1
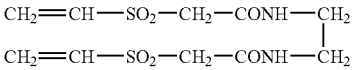
W-1
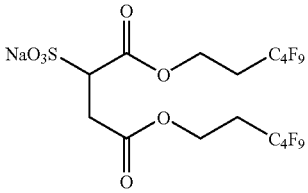
W-2
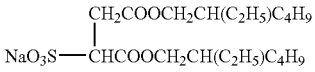
W-3
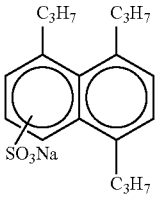
W-4
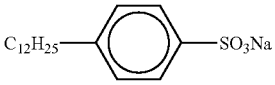
P-1
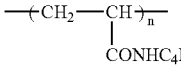
(n = 100~1000)
P-2
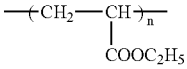
(n = 100~1000)
P-3
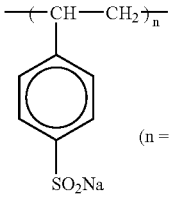
(n = 100~1000)
P-4
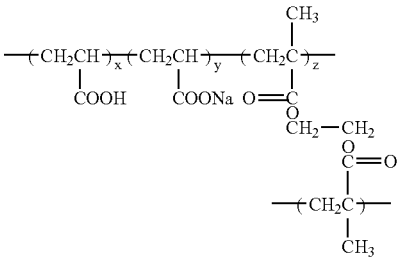
x:y:z = 42.5:7.5:50

-continued

F-1

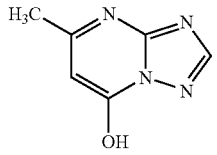

F-2

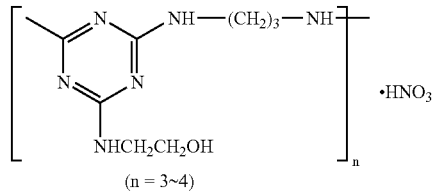

F-3

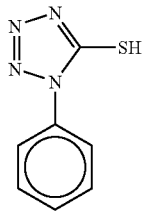

F-4

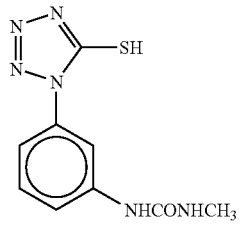

F-5

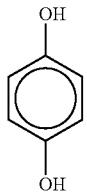

F-6

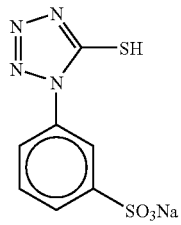

F-7

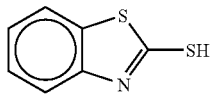

F-8

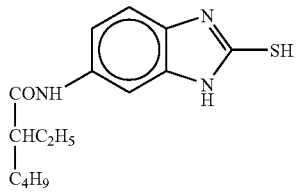

F-9

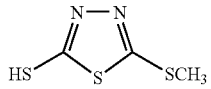

SO-1

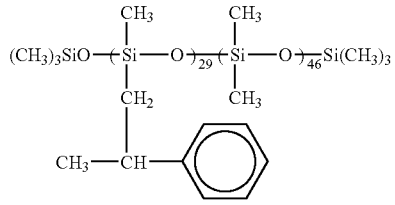

Preparation of Dispersion of Organic Solid Dispersed Dye

Preparation of Dispersion of Dye E-1

To a wet cake of Dye E-1 (the net amount of E-1: 270 g), 100 g of Pluronic F88 (trade name, block copolymer of ethyleneoxide/propyleneoxide) manufactured by BASF, and water were added and stirred. Water was added so as to give a total amount of 4,000 g. Next, to the Ultra Viscomill (UVM-2 (trade name)), manufactured by AIMEX Corporation, filled with 1,700 ml of zirconia beads having an average grain diameter of 0.5 mm, the resultant slurry was added and ground for 2 hours under the conditions of about 10 m/sec of round speed and 0.5 liter/min of discharge amount. The beads were filtered away to obtain a dispersion of the dye. Water was added to the dispersion so that the dye density was diluted to 3%. Then, for the purpose of stabilization, the dispersion was heated at 90° C. for 10 hours. An average particle diameter of these dye fine particles was 0.30 μm. The range of the distribution of the particle diameter (standard deviation of particle diameter×100/average particle diameter) was 20%.

Preparation of Solid Dispersion of Dye E-2

To 1,400 g of a wet cake of Dye E-2 containing 30 mass % of water, water and 270 g of W-3 were added and stirred. Water was added so that a slurry containing 40 mass % of E-2 was obtained. Next, to a grinding machine, Ultra Viscomill (UVM-2 (trade name)) manufactured by AIMEX Corporation, filled with 1,700 ml of zirconia beads having an average grain size of 0.5 mm, the resultant slurry was added and ground for 8 hours under the conditions of about 10 m/sec of round speed and 0.5 liter/min of discharge amount. Thus, a solid fine particle dispersion of Dye E-2 was obtained. This dispersion was diluted with an ion exchanged water to 20 mass %, to obtain solid fine particle dispersion. Note that the average particle size was 0.15 μm.

The following processing step was referred to as (Processing-A).

In the evaluation, a running processing was performed by processing an unexposed Sample 101 and an entirely exposed Sample 101 in proportion of 1:1, until an accumulated replenisher amount was four times the tank volume, and then the dispersion was used.

| Processing step | Time | Temperature | Tank volume | Replenisher amount |
|---|---|---|---|---|
| 1st development | 6 min | 38° C. | 12 liters | 2,200 ml/m$^2$ |
| 1st water-washing | 2 min | 38° C. | 4 liters | 7,500 ml/m$^2$ |
| Reversal | 2 min | 38° C. | 4 liters | 1,100 ml/m$^2$ |
| Color-development | 6 min | 38° C. | 12 liters | 2,200 ml/m$^2$ |
| Pre-bleaching | 2 min | 38° C. | 4 liters | 1,100 ml/m$^2$ |
| Bleaching | 6 min | 38° C. | 12 liters | 220 ml/m$^2$ |
| Fixing | 4 min | 38° C. | 8 liters | 1,100 ml/m$^2$ |
| 2nd water-washing | 4 min | 40° C. | 8 liters | 7,500 ml/m$^2$ |
| Final-rinsing | 1 min | 25° C. | 2 liters | 1,100 ml/m$^2$ |

Compositions of each processing solution used were as follows:

| [1st development solution] | Tank solution | Replenisher |
|---|---|---|
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Hydroquinone/potassium monosulfonate | 20 g | 20 g |
| Potassium carbonate | 15 g | 20 g |
| Sodium bicarbonate | 12 g | 15 g |
| 1-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 mL | 1,000 mL |
| pH | 9.65 | 9.65 |

Was adjusted pH by using sulfuric acid or potassium hydroxide.

| [Reversal solution] (Both tank solution and replenisher) | |
|---|---|
| Pentasodium nitrilo-N,N,N-trimethylenephosphonate | 3.0 g |
| Stannous chloride dihydrate | 1.0 g |
| Sodium hydroxide | 8 g |
| Glacial acetic acid | 15 ml |
| Water to make | 1,000 ml |
| pH | 6.00 |

Was adjusted pH by using acetic acid or sodium hydroxide.

| [Color-development solution] | Tank solution | Replenisher |
|---|---|---|
| Pentasodium nitrilo-N,N,N-trimethylenephosphonate | 2.0 g | 2.0 g |

-continued

| [Color-development solution] | Tank solution | Replenisher |
|---|---|---|
| Sodium sulfite | 7.0 g | 7.0 g |
| Trisodium phosphate 12-hydrate | 25 g | 25 g |
| Potassium bromide | 1.0 g | — |
| Potassium iodide | 50 mg | — |
| Sodium hydroxide | 10.0 g | 10.0 g |
| Cytrazinic acid | 0.5 g | 0.5 g |
| N-Ethyl-N-(β-methanesulfonamidoethyl)-3-methyl-4-aminoaniline.3/2 sulfate.monohydrate | 9.0 g | 10.0 g |
| 3,6-Dithiaoctane-1,8-diol | 0.6 g | 0.7 g |
| Water to make | 1,000 ml | 1,000 ml |
| pH | 11.85 | 12.00 |

Was adjusted pH by using sulfuric acid or potassium hydroxide.

| [Pre-bleaching solution] | Tank Solution | Repleisher |
|---|---|---|
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde-sodium bisulfite adduct | 25 g | 25 g |
| Water to make | 1,000 ml | 1,000 ml |
| pH | 6.30 | 6.10 |

Was adjusted pH by using acetic acid or sodium hydroxide.

| [Bleaching solution] | Tank solution | Replenisher |
|---|---|---|
| Disodium ethylenediaminetetraacetate dihydrate | 2.0 g | 4.0 g |
| Iron (III) ammonium ethylenediaminetetraacetate dihydrate | 120 g | 240 g |
| Potassium bromide | 100 g | 200 g |
| Ammonium nitrate | 10 g | 20 g |
| Water to make | 1,000 ml | 1,000 ml |
| pH | 5.70 | 5.50 |

Was adjusted pH by using nitric acid or sodium hydroxide.

| [Fixing Solution] (Both tank solution and replenisher) | |
|---|---|
| Ammonium thiosulfate | 80 g |
| Sodium sulfite | 5.0 g |
| Sodium bisulfite | 5.0 g |
| Water to make | 1,000 ml |
| pH | 6.60 |

Was adjusted pH by using acetic acid or aqueous ammonia.

| [Stabilizing solution] | Tank solution | Replenisher |
|---|---|---|
| 1,2-Benzoisothiazolin-3-one | 0.02 g | 0.03 g |
| Polyoxyethylene-p-monononyl phenyl ether | 0.3 g | 0.3 g |

-continued

| [Stabilizing solution] | Tank solution | Replenisher |
|---|---|---|
| (av. polymerization degree: 10) | | |
| Polymaleic acid | 0.1 g | 0.15 g |
| (av. molecular weight: 2,000) | | |
| Water to make | 1,000 ml | 1,000 ml |
| pH | 7.0 | 7.0 |

(2) Preparation of Samples 102 to 105

Samples 102 to 105 were prepared in a manner that the residual-color-reducing agents for use in the present invention were added to the first layer in a concentration of 0.8 mmol/$m^2$, as shown in Table 10 below.

(3) Evaluation

The thus-prepared photosensitive material samples were subjected to light-exposure corresponding to a highlight portion, and the above-mentioned processing was carried out.

After the processing, U-3500 Model Spectrophotometer, (trade name) manufactured by Hitachi Ltd., was used, to measure the absorbance of the respective processed samples at 540 nm.

The results are shown in Table 10.

TABLE 10

| Sample No. | Residual color-decreasing agent | Results D(540 nm) | Results ΔD | Remarks |
|---|---|---|---|---|
| 101 | Not added | 0.186 | — | Comparative Example |
| 102 | E-1) | 0.178 | 0.008 | This invention |
| 103 | E-2) | 0.175 | 0.011 | This invention |
| 104 | E-3) | 0.171 | 0.015 | This invention |
| 105 | E-5) | 0.170 | 0.016 | This invention |

In Table 10, D(540 nm) represents absorbance at 540 nm, and ΔD represents the difference between absorbance when the residual color-decreasing agent is added, and the absorbance when the agent is not added. When the D(540 nm) is smaller or ΔD is larger, the residual color-decreasing effect is larger.

As is apparent from Table 10, it seems that the residual-color-reducing agents for use in the present invention exhibit a residual-color-reducing effect.

Example-2

Samples 202 to 212 were prepared in the same manner as sample 101 in Example 1, except that the compounds were added as follows.

TABLE 11

Composition of Samples

| Sample | | Added compound | Addition method | Addition layer |
|---|---|---|---|---|
| 101 | Comparative example | None | — | — |
| 202 | This invention | A-2 | The compound was added to a coating solution as an aqueous solution. | First layer (0.2 g) |
| 203 | This invention | A-2 | The compound was added to a coating solution as a solid dispersion. | First layer (0.2 g) |
| 204 | This invention | A-2 | The compound was added to a coating solution as a solid dispersion. | Fourth layer (0.1 g)<br>Ninth layer (0.1 g) |
| 205 | This invention | A-2 | The compound was added to a coating solution as a solid dispersion. | Second layer (0.3 g)<br>Thirteenth layer (0.1 g) |
| 206 | This invention | C-13<br>Cpd-S<br>Oil-8 | The compounds was added to a coating solution as an emulsion dispersion.<br>(W-3 was used for emulsion dispersion) | First layer (C-13: 0.3 g,<br>Cpd-S: 0.3 g,<br>Oil-8: 0.4 g) |
| 207 | This invention | B-10 | The compound was added to a coating solution as an aqueous solution. | First layer (0.2 g) |
| 208 | This invention | B-10 | The compound was added to a coating solution as a solid dispersion. | First layer (0.2 g) |
| 209 | This invention | B-10 | The compound was added to a coating solution as a solid dispersion. | Fourth layer (0.1 g)<br>Ninth layer (0.1 g) |
| 210 | This invention | B-21<br>Cpd-S<br>Oil-8 | The compounds was added to a coating solution as an emulsion dispersion.<br>(W-3 was used for emulsion dispersion) | First layer (B-21: 0.3 g,<br>Cpd-S: 0.3 g,<br>Oil-8: 0.4 g) |
| 211 | This invention | B-11 | The compound was added to a coating solution as a solid dispersion. | Fourth layer (0.1 g)<br>Ninth layer (0.1 g)<br>Thirteenth layer (0.05 g) |
| 212 | This invention | B-15 | The compound was added to a coating solution as a solid dispersion. | Fifth layer (0.1 g)<br>Tenth layer (0.1 g) |

The solid dispersion was prepared as follows.

A mixture of 5.0 g of the compound and 0.5 g of a dispersing agent W-3 in 100 ml of water was placed together with 900 g of zirconia beads (av. Particle diameter was 0.3 mm) in a container having 1.5 liter of capacity. The mixture was dispersed at 1500 rpm for 48 hours using a sand grinder mill (Model TSG-1/8G-4U manufactured by AIMEX Corporation). An average sphere-equivalent diameter of the resulting dispersion was 0.60 μm.

To the solid dispersion used in sample 211, in addition to the dispersing agent W-3, a dispersing agent B-1 was added so as to become 8% by mass based on the compound.

Further, in case of the compound of the present invention to be added in the form of an aqueous solution thereof, sodium hydroxide of 1.2 times as much as the amount necessary to neutralize all acid groups belonging to said compound was added thereto, to prepare the aqueous solution.

(Evaluation of Samples)

A coloring on a white background was evaluated in the same manner as in Example 1, except that a temperature of the second washing in (Development processing A) described above was changed to 15° C.

TABLE 12

| Evaluation results | | |
|---|---|---|
| Sample | | Absorbance at 540 nm |
| 101 | Comparative example | 0.260 |
| 202 | This invention | 0.232 |
| 203 | This invention | 0.215 |
| 204 | This invention | 0.214 |
| 205 | This invention | 0.208 |
| 206 | This invention | 0.210 |
| 207 | This invention | 0.215 |
| 208 | This invention | 0.202 |
| 209 | This invention | 0.198 |
| 210 | This invention | 0.200 |
| 211 | This invention | 0.205 |
| 212 | This invention | 0.203 |

As is seen in the above table, further advantageous results were obtained by incorporating in a photosensitive material as a solid dispersion or a precursor of the compound represented by formula (I).

Example-3

Sample 101 of Example 10 in JP-A-2003-114504 was exactly copied, and this sample was designated as sample 301. To the sample 301, the compounds of the present invention were added as shown in Table 13 to prepare samples 302 to 305.

TABLE 13

| Constitution of Samples | | | | |
|---|---|---|---|---|
| Sample | | Added compound | Addition method | Added amount (per $m^2$) |
| 301 | Comparative example | None | — | — |
| 302 | This invention | A-2 | The compound was added to a coating solution as an aqueous solution. | Second layer (0.2 g) |
| 303 | This invention | A-2 | The compound was added to a coating solution as a solid dispersion. | Second layer (0.2 g) |
| 304 | This invention | B-10 | The compound was added to a coating solution as an aqueous solution. | Second layer (0.2 g) |
| 305 | This invention | B-10 | The compound was added to a coating solution as a solid dispersion. | First layer (0.2 g) |
| 306 | This invention | B-10 | The compound was added to a coating solution as a solid dispersion. | Third layer (0.1 g)<br>Seventh layer (0.1 g) |

Unexposed samples 301 to 306 were processed according to the processing process described in Example 10 of JP-A-2003-114504, except for changing a washing temperature to 20° C. In Table 14, density at 560 nm of all samples are shown in terms of a difference from the density at 560 nm of sample 301. When the value is smaller, the residual sensitizing dye is small, which is preferable.

TABLE 14

| Sample | | Density different at 560 nm |
|---|---|---|
| 301 | Comparative example | 0 (Standard) |
| 302 | This invention | −0.062 |
| 303 | This invention | −0.100 |
| 304 | This invention | −0.085 |
| 305 | This invention | −0.110 |
| 306 | This invention | −0.115 |

As is seen in the above table, preferable results were obtained using the compounds of the present invention.

Example-4

Sample 401 and samples 411 to 422 were prepared in the same manner as sample 101 and samples 201 to 212, except for replacing Emulsions A to T with Emulsions A2 to T2, respectively.

TABLE 15

Constitution of emulsions A2 to G2 (these all emulsion were composed of silver iodobromide grains)

| Emulsion | Characteristics | Average sphere-equivalent diameter (μm) | Variation coefficient (%) | Average AgI content (%) | Halogen composition structure of silver halide grains | AgI content at grain surface (%) | Other characteristics (1) | (2) | (3) | (4) | (5) | (6) |
|---|---|---|---|---|---|---|---|---|---|---|---|---|
| A2 | Monodisperse (111) tabular grains Average aspect ratio 11.0 | 0.27 | 18 | 3.0 | Threefold structure | 2.5 | | ○ | | | | ○ |
| B2 | Monodisperse (111) tabular grains Average aspect ratio 13.0 | 0.30 | 20 | 3.3 | Twofold structure | 1.5 | | ○ | ○ | | | ○ |
| C2 | Monodisperse (111) tabular grains Average aspect ratio 14.0 | 0.32 | 19 | 3.5 | Threefold structure | 2.1 | | ○ | | | | ○ |
| D2 | Monodisperse (111) tabular grains Average aspect ratio 16.0 | 0.35 | 18 | 3.0 | Threefold structure | 0.9 | | ○ | | | | ○ |
| E2 | Monodisperse (111) tabular grains Average aspect ratio 12.0 | 0.55 | 17 | 2.3 | Threefold structure | 0.8 | | ○ | | | ○ | |
| F2 | Monodisperse (111) tabular grains Average aspect ratio 20.0 | 0.66 | 20 | 2.0 | Threefold structure | 1.0 | | ○ | | | | ○ |
| G2 | Monodisperse (111) tabular grains Average aspect ratio 4.0 | 0.25 | 15 | 3.0 | Threefold structure | 1.8 | ○ | | | ○ | | |

(Other characteristics)
(1): A reduction sensitizer was added during formation of grains.
(2): A selenium sensitizer was used as an after-ripening chemical.
(3): A rhodium salt was added during formation of grains.
(4): After completion of after-ripening, silver nitrate in an amount of 10% in terms of the silver molar ratio relative to the emulsion grains at the time, and potassium bromide in an equimolar amount to the silver nitrate, were added to form shells.
(5): The presence of 10 or more dislocation lines/grain per 1 particle on average was observed under a transmission electron microscope. All the photosensitive emulsions were after-ripened using sodium thiosulfate, potassium thiocyanate and sodium chloroaurate.Further, an iridium salt was added as necessary during formation of grains. Chemically modified gelatin whose amino groups had been partially converted into phthalic amide was added to the emulsions B, C, E, H, J, N, Q, R, S and T when the emulsions were prepared.
(6): Grains in which at least one of apexes in tabular grains comprised a protuberance.

TABLE 16

(Continued to Table 15)

Constitution of emulsions H2 to N2 (these all emulsion were composed of silver iodobromide grains)

| Emulsion | Characteristics | Average sphere-equivalent diameter (μm) | Variation coefficient (%) | Average AgI content (%) | Halogen composition structure of silver halide grains | AgI content at grain surface (%) | Other characteristics (1) | (2) | (3) | (4) | (5) | (6) |
|---|---|---|---|---|---|---|---|---|---|---|---|---|
| H2 | Monodisperse (111) tabular grains Average aspect ratio 15.0 | 0.27 | 13 | 4.0 | Twofold structure | 2.9 | | ○ | ○ | | | ○ |
| I2 | Monodisperse (111) tabular grains Average aspect ratio 18.0 | 0.30 | 15 | 3.7 | Twofold structure | 2.5 | ○ | ○ | | | | ○ |
| J2 | Monodisperse (111) tabular grains Average aspect ratio 21.0 | 0.42 | 14 | 2.8 | Threefold structure | 1.9 | | ○ | | | | ○ |
| K2 | Monodisperse (111) tabular grains Average aspect ratio 18.0 | 0.63 | 20 | 1.8 | Threefold structure | 1.5 | | ○ | | | | ○ |
| L2 | Monodisperse (111) tabular grains Average aspect ratio 16.0 | 0.28 | 18 | 2.2 | Threefold structure | 2.8 | ○ | | ○ | | | ○ |
| M2 | Monodisperse (111) tabular grains Average aspect ratio 15.0 | 0.30 | 15 | 3.5 | Threefold structure | 2.5 | | ○ | | | | ○ |
| N2 | Monodisperse (111) tabular grains Average aspect ratio 14.0 | 0.35 | 18 | 3.0 | Threefold structure | 1.5 | | ○ | | | | ○ |

(Other characteristics)
(1): A reduction sensitizer was added during formation of grains.
(2): A selenium sensitizer was used as an after-ripening chemical.
(3): A rhodium salt was added during formation of grains.
(4): After completion of after-ripening, silver nitrate in an amount of 10% in terms of the silver molar ratio relative to the emulsion grains at the time, and potassium bromide in an equimolar amount to the silver nitrate, were added to form shells.
(5): The presence of 10 or more dislocation lines/grain per 1 particle on average was observed under a transmission electron microscope. All the photosensitive emulsions were after-ripened using sodium thiosulfate, potassium thiocyanate and sodium chloroaurate.Further, an iridium salt was added as necessary during formation of grains. Chemically modified gelatin whose amino groups had been partially converted into phthalic amide was added to the emulsions B, C, E, H, J, N, Q, R, S and T when the emulsions were prepared.
(6): Grains in which at least one of apexes in tabular grains comprised a protuberance.

TABLE 17

(Continued to Table 16)

Constitution of emulsions O2 to T2 (these all emulsion were composed of silver iodobromide grains)

| Emulsion | Characteristics | Average sphere-equivalent diameter (μm) | Variation coefficient (%) | Average AgI content (%) | Halogen composition structure of silver halide grains | AgI content at grain surface (%) | Other characteristics (1) | (2) | (3) | (4) | (5) | (6) |
|---|---|---|---|---|---|---|---|---|---|---|---|---|
| O2 | Monodisperse (111) tabular grains Average aspect ratio 20.0 | 0.45 | 15 | 2.7 | Fourfold structure | 1.7 | ○ | ○ | | | | ○ |
| P2 | Monodisperse (111) tabular grains Average aspect ratio 11.0 | 0.70 | 15 | 1.3 | Fivefold structure | 1.8 | ○ | ○ | | ○ | ○ | |
| Q2 | Monodisperse (111) tabular grains Average aspect ratio 13.0 | 0.80 | 18 | 2.5 | Threefold structure | 4.0 | ○ | ○ | | | | ○ |
| R2 | Monodisperse (111) tabular grains Average aspect ratio 8.0 | 0.45 | 15 | 8.8 | Fourfold structure | 1.7 | ○ | ○ | | | ○ | |
| S2 | Monodisperse (111) tabular grains Average aspect ratio 11.0 | 0.65 | 14 | 7.5 | Fivefold structure | 1.8 | ○ | ○ | | ○ | ○ | |
| T2 | Monodisperse (111) tabular grains Average aspect ratio 18.0 | 0.50 | 18 | 10.5 | Threefold structure | 3.0 | ○ | ○ | | | | ○ |

(Other characteristics)
(1): A reduction sensitizer was added during formation of grains.
(2): A selenium sensitizer was used as an after-ripening chemical.
(3): A rhodium salt was added during formation of grains.
(4): After completion of after-ripening, silver nitrate in an amount of 10% in terms of the silver molar ratio relative to the emulsion grains at the time, and potassium bromide in an equimolar amount to the silver nitrate, were added to form shells.
(5): The presence of 10 or more dislocation lines/grain per 1 particle on average was observed under a transmission electron microscope. All the photosensitive emulsions were after-ripened using sodium thiosulfate, potassium thiocyanate and sodium chloroaurate.Further, an iridium salt was added as necessary during formation of grains. Chemically modified gelatin whose amino groups had been partially converted into phthalic amide was added to the emulsions B, C, E, H, J, N, Q, R, S and T when the emulsions were prepared.
(6): Grains in which at least one of apexes in tabular grains comprised a protuberance.

TABLE 18

Spectral sensitization of Emulsions A2 to P2

| Emulsion | Added sensitizing dye | Added amount per 1 mol of silver halide (g) | Stage when a sensitizing dye was added |
|---|---|---|---|
| A2 | S-1 | 1.00 | After after-ripening |
| | S-2 | 0.30 | Before after-ripening |
| | S-3 | 0.30 | Before after-ripening |
| B2 | S-1 | 1.20 | Before after-ripening |
| | S-2 | 0.30 | Before after-ripening |
| | S-3 | 0.20 | Before after-ripening |
| C2 | S-1 | 1.00 | Before after-ripening |
| | S-2 | 0.40 | Before after-ripening |
| | S-3 | 0.20 | Before after-ripening |
| D2 | S-1 | 1.30 | After after-ripening |
| | S-2 | 0.40 | After after-ripening |
| | S-3 | 0.10 | Before after-ripening |
| E2 | S-1 | 1.40 | Before after-ripening |
| | S-2 | 0.50 | Before after-ripening |
| | S-3 | 0.20 | Before after-ripening |
| F2 | S-1 | 1.40 | Before after-ripening |
| | S-2 | 0.60 | Before after-ripening |
| | S-3 | 0.20 | Before after-ripening |
| G2 | S-4 | 0.90 | After after-ripening |
| | S-5 | 0.20 | After after-ripening |
| H2 | S-4 | 1.20 | Before after-ripening |
| | S-5 | 0.30 | After after-ripening |

TABLE 19

(Continued to 18)

| Emulsion | Added sensitizing dye | Added amount per 1 mol of silver halide (g) | Stage when a sensitizing dye was added |
|---|---|---|---|
| I2 | S-4 | 1.40 | Before after-ripening |
| | S-5 | 0.20 | Before after-ripening |
| J2 | S-4 | 1.40 | Before after-ripening |
| | S-5 | 0.20 | After after-ripening |
| | S-6 | 0.20 | After after-ripening |
| K2 | S-4 | 1.30 | Before after-ripening |
| | S-5 | 0.30 | Before after-ripening |
| | S-6 | 0.20 | Before after-ripening |
| L2, M2 | S-6 | 0.20 | After after-ripening |
| | S-7 | 0.20 | After after-ripening |
| | S-8 | 1.00 | After after-ripening |
| N2 | S-6 | 0.20 | After after-ripening |
| | S-7 | 0.20 | After after-ripening |
| | S-8 | 1.10 | After after-ripening |
| O2 | S-7 | 0.30 | After after-ripening |
| | S-8 | 1.50 | After after-ripening |
| P2 | S-6 | 0.06 | After after-ripening |
| | S-7 | 0.30 | After after-ripening |
| | S-8 | 1.40 | After after-ripening |
| Q2 | S-6 | 0.10 | Before after-ripening |
| | S-7 | 0.20 | Before after-ripening |
| | S-8 | 1.30 | Before after-ripening |
| R2 | S-4 | 0.80 | After after-ripening |
| | S-6 | 0.70 | After after-ripening |
| S2 | S-4 | 0.80 | After after-ripening |
| | S-6 | 0.60 | Before after-ripening |
| T2 | S-7 | 0.10 | Before after-ripening |
| | S-8 | 1.30 | Before after-ripening |

Sample 401 and samples 411 to 422 were evaluated in the same manner as in Example 1. The samples of the present invention gave good results.

Example-5

Another Samples were prepared in the same manner as samples 101 and 203 in Table 11 of Example 2, except that the following sensitizing dyes were further added to the silver halide emulsion of the 7th layer to multilayer adsorb the sensitizing dyes onto the silver halide. The samples were evaluated in the same manner as Example 2. As is seen from Table 20 described below, it is understood that deterioration of residual color owing to multilayer adsorption of sensitizing dyes can be remarkably improved by using the sample of the present invention.

The following dyes were coated, as a second layer, so as to be a ratio of 1:1 of the sensitizing dyes (SS-1) and (SS-2).

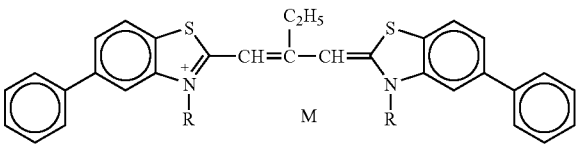

(SS-1): $R=(CH_2)_3SO_3^-$, $M=HN^+(C_2H_5)_3$
(SS-2): $R=(CH_2)_3N^+(CH_3)_3$, $M=3Br^-$

TABLE 20

| Sample | | Absorbance at 540 nm |
|---|---|---|
| The same sample as sample 101, except that sensitizing dyes in the 7th layer were multilayer adsorbed. | Comparative example | 0.550 |
| The same sample as sample 203, except that sensitizing dyes in the 7th layer were multilayer adsorbed. | This invention | 0.425 |

Example 6

Preparation of Silver Bromide Octahedral Emulsion (Emulsion A) and Silver Bromide Tabular Emulsions (Emulsion B and Emulsion C)

To a reaction vessel, 1000 ml of water, 25 g of deionized bone gelatin, 15 ml of a 50% $NH_4NO_3$ aqueous solution and 7.5 ml of a 25% $NH_3$ aqueous solution were added, and well stirred while keeping the reaction temperature at 50° C. Thereafter, 750 ml of a 1N silver nitrate aqueous solution and a 1 mol/L of potassium bromide aqueous solution were added to the mixture over 50 minutes, while keeping the silver potential during reaction at −40 mV. The thus-obtained silver bromide grains were octahedral and had an sphere equivalent diameter of 0.846±0.036 μm. The resulting emulsion was cooled, and desalted using an ultrafiltration process. Further, 95 g of deionized bone gelatin and 430 ml of water were added to the resultant, and then the pH and pAg of the solution were adjusted to 6.5 and 8.3 at 50° C., respectively. The resulting emulsion was ripened at 55° C. for 50 minutes with potassium thiocyanate, chloroauric acid and sodium thiosulfate so as to become an optimal sensitivity. The thus-obtained emulsion was referred to as Emulsion A.

To a solution of 6.4 g of potassium bromide and 6.2 g of a low molecular gelatin having an average molecular weight of 15,000 dissolved in 1.2 liter of water, 8.1 ml of a 16.4% silver nitrate aqueous solution and 7.2 ml of a 23.5% potassium bromide aqueous solution were added according to a double jet process over 10 seconds while keeping a temperature of 30° C. A 11.7% gelatin aqueous solution was further added to the solution, and the temperature of the solution was increased to 75° C., to ripen for 40 minutes. Thereafter, 370 ml of a 32.2% silver nitrate aqueous solution and a 20% potassium bromide aqueous solution were added over 10 minutes, while keeping the silver potential at −20 mV. After physical ripening for 1 minute, the temperature of the solution was cooled to 35° C. Thus, a monodispersed pure silver bromide tabular emulsion (specific gravity: 1.15) having an average projected area diameter of 2.32 μm, a thickness of 0.09 μm and 15.1% in terms of coefficient of variation of diameter was obtained. Thereafter, the emulsion was desalted according to a ultrafiltration method. While keeping the temperature at 40° C., 45.6 g of gelatin, 10 ml of a 1 mol/L sodium hydroxide aqueous solution, 167 ml of water and 1.66 ml of 35% phenoxyethanol were added to the emulsion, and then the pAg and the pH of the solution were adjusted to 8.3 and 6.20, respectively. The resulting emulsion was ripened at 55° C. for 50 minutes with potassium thiocyanate, chloroauric acid and sodium thiosulfate so as to become an optimal sensitivity. The thus-obtained emulsion was referred to as Emulsion B.

Beside, the same emulsion as Emulsion B except that said emulsion was chemically sensitized with potassium thiocyanate, chloroauric acid, pentafluorophenyl-diphenyphosphine selenide and sodium thiosulfate in place of potassium thiocyanate, chloroauric acid and sodium thiosulfate, was referred to as Emulsion C.

Taking the occupation area of the dye as 80 $Å^2$, single-layer saturated coated amounts of Emulsion A, Emulsion B and Emulsion C was $5.4\times10^{-4}$ mol/mol Ag, $1.42\times10^{-3}$ mol/mol Ag, and $1.42\times10^{-3}$ mol/mol Ag respectively.

While keeping the temperature of the thus-obtained emulsions at 50° C., dyes shown in Table 21 were added.

The addition amounts and the addition methods are described below.

Samples 11 and 12: After 10 minutes from addition of $5.4\times10^{-4}$mol/mol Ag of (19), $5.4\times10^{-4}$ mol/mol Ag of (18) was added, and further 10 minutes later $5.4\times10^{-4}$ mol/mol Ag of (17) was added.

Samples 13, 14, 15 and 16: After 10 minutes from addition of $1.42\times10^{-4}$ mol/mol Ag of (19), $1.42\times10^{-4}$ mol/mol Ag of (18) was added, and further 10 minutes later $1.42\times10^{-4}$ mol/mol Ag of (17) was added.

Note that the sensitizing dyes were used in the form of fine solid dispersions prepared by the method described in JP-A-11-52507. That is, 0.8 parts by mass of sodium nitrate and 3.2 parts by mass of sodium sulfate were dissolved in 43 parts by mass of ion-exchange water. 13 parts by mass of the sensitizing dyes were added, and the resultant material was dispersed at 60° C. for 20 minutes by using a dissolver blade at 2,000 rpm, thereby obtaining a solid dispersion of the sensitizing dye.

The adsorption amount of the dye was measured as follows. A liquid emulsion of the coating solution (4) was subjected to a centrifugal sedimentation at 10,000 rpm for 10 minutes. After the resulting precipitate was freeze-dried, 0.05 g of the precipitates were solved in a mixture of 25 ml of a 25% aqueous solution of sodium thiosulfate and ethanol so as to make the net volume of 50 ml. The resulting solution was analyzed by a high performance liquid chromatography, thereby to determine densities of the dye and the compound. The number of the adsorption layer relating to the total sum of dye chromophores was calculated from the thus-obtained adsorption amount of dye and the afore-mentioned single-layer saturated coated amount.

The light absorption intensity per unit area was measured as follows. The emulsion for a coating solution of (4) was coated to a small thickness on a slide glass and the transmission spectrum and reflection spectrum of individual grains were determined using a microspectrophotometer MSP65 manufactured by Karl Zweiss K. K. by the following method to determine the absorption spectrum. The area where grains were not present was used as the reference for the transmission spectrum, and the reference for the reflection spectrum was obtained by measuring silicon carbide of which reflectance is known. The measured area was a circular aperture part having a diameter of 1 μm. After adjusting the position not to allow the aperture part to overlap the contour of a grain, the transmission spectrum and the reflection spectrum were measured in the wave number region from 10,000 $cm^{-1}$ (1,000 nm) to 28,000 $cm^{-1}$ (357 nm). The absorption spectrum was determined from the absorption factor A which is 1−T (transmittance)−R (reflectance). Using the absorption factor A' obtained by subtracting the absorption of silver halide, −Log(1−A') was integrated to the wave number ($cm^{-}$) and the value obtained was halved and used as a light absorption intensity per unit area. The integration range was from 10,000 to 28,000 $cm^{-1}$. At this time, the light source used was a tungsten lamp and the light source voltage was 8 V. In order to minimize the damage of the dye by the light irradiation, a monochromator in the primary side was used and the wavelength distance and the slit width were set to 2 nm and 2.5 nm, respectively. The absorption spectrum and the light absorption intensity were determined on 200 grains.

(4) Preparation of Coating Sample

The above-obtained emulsions and the emulsified product (the emulsified product prepared from the coupler, B-1, tricresyl phosphate and an aqueous gelatin solution) were mixed for 60 minutes. Thereafter, the emulsion layer and the protective layer each having the composition as shown in Table 21 were coated on a triacetyl cellulose film support provided with an under layer. In addition, samples 12, 14 and 16 were prepared in the same manner as mentioned above, except that a dispersion of residual-color-reducing agent (A-1) was further added in an amount of $1\times10^{-4}$ mol/$m^2$.

Dispersion of (A-1) was dispersed according to the following method. That is, 22 ml of water, 3 ml of 5% aqueous solution of sodium p-octylphenoxyethoxy-ethanesulfonate, and a 0.5 g of 5% aqueous solution of p-octylphenoxypolyoxyethylene ether (polymerization degree 10) were added to a 700 ml of pot mill, and 5.0 g of (A-1) and 500 ml of zirconium oxide beads (diameter 1 mm) were further added thereto, and then the mixture was dispersed for 2 hours. For the dispersion, a BO-type vibration ball mill, manufactured by Chuo Koki Co., Ltd., was employed. After the dispersion, the mixture was taken out and added to 8 g of a 12.5% aqueous gelatin solution, and then the beads were removed by filtration, to obtain a gelatin dispersion of (A-1). The average diameter of the fine particles was 0.45 μm.

TABLE 21

| Coating condition of the emulsion | |
|---|---|
| (1) Emulsion layer | |
| Emulsion . . . | Emulsions A, B and C (With respect to dyes to be used, see Table 22.) (Silver $2.1\times10^{-2}$ mol/$m^2$) |
| Coupler | ($1.5\times10^{-3}$ mol/$m^2$) |

TABLE 21-continued

| Coating condition of the emulsion | |
|---|---|
| 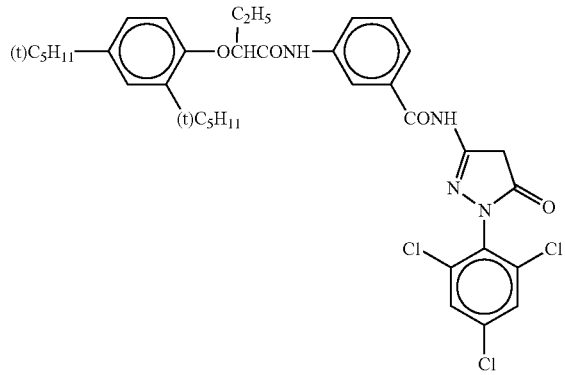 | |
| B-1 | (0.47 g/$m^2$) |
| 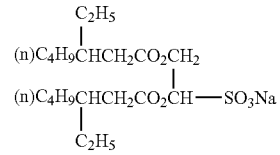 | |
| Tricresyl phosphate | (1.10 g/$m^2$) |
| Gelatin | (2.30 g/$m^2$) |
| (A-1) | |
| (2) Protective layer | |
| 2,4-dichloro-6-hydroxy-s-triazine sodium salt | (0.08 g/$m^2$) |
| Gelatin | (1.80 g/$m^2$) |

To these samples, sensitometric exposure (1/100 second) was carried out using a tungsten lamp (color temperature 2,854K) with Fuji gelatin filter SC-50 (manufactured by Fuji Photo Film Co., Ltd) for minus-blue exposure which was used to stimulate a dye side as a color filter, to cut a light of 500 nm or shorter. The exposed samples were subjected to the color development processing as described below.

Processing method

| Steps | Processing Time | Processing Temperature | Replenisher Amount | Tank Volume |
|---|---|---|---|---|
| Color Development | 2 min 45 sec | 38° C. | 33 ml | 20 liter |
| Bleaching | 6 min 30 sec | 38° C. | 25 ml | 40 liter |
| Washing | 2 min 10 sec | 24° C. | 1200 ml | 20 liter |
| Fixing | 4 min 20 sec | 38° C. | 25 ml | 30 liter |
| Washing (1) | 1 min 05 sec | 24° C. | Counter current piping system from (2) to (1) | 10 liter |
| Washing (2) | 1 min 00 sec | 24° C. | 1200 ml | 10 liter |
| Stabilization | 1 min 05 sec | 38° C. | 25 ml | 10 liter |
| Drying | 4 min 20 sec | 55° C. | | |

Note:
Replenishing amount per 35 mm in width per meter in length.

The compositions of the processing solutions are described below.

| | Mother solution (g) | Replenisher (g) |
|---|---|---|
| (Color Developer) | | |
| Diethylenetriamine-pentaacetic acid | 1.0 | 1.1 |
| 1-Hydroxyethylidene-1,1-diphosphonic acid | 3.0 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate salt | 2.4 | 2.8 |
| 4-[N-Ethyl-N-β-hydroxyethylamino]-2-methylaniline sulfate salt | 4.5 | 5.5 |
| Water to make | 1.0 liter | 1.0 liter |
| pH | 10.05 | 10.05 |
| (Bleaching Solution) | | |
| Fe (III) sodium ethylenediamineteraacetate trihydrate | 100.0 | 120.0 |
| Disodium ethylenediaminetetraacetate | 10.0 | 11.0 |
| Ammonium bromide | 140.0 | 160.0 |
| Ammonium nitrate | 30.0 | 35.0 |
| Aqueous ammonia (27%) | 6.5 ml | 4.0 ml |
| Water to make | 1.0 liter | 1.0 liter |
| pH | 6.0 | 5.7 |
| (Fixing Solution) | | |
| Sodium ethylenediaminetetraacetate | 0.5 | 0.7 |
| Sodium sulfite | 7.0 | 8.0 |
| Sodium bisulfite | 5.0 | 5.5 |
| Ammonium thiosulfate aqueous solution (70%) | 170.0 ml | 200.0 ml |
| Water to make | 1.0 liter | 1.0 liter |
| pH | 6.7 | 6.6 |
| (Stabilizer) | | |
| Formalin (37%) | 2.0 ml | 3.0 ml |
| Polyoxyethylene-p-monononylphenylether (average polymerization degree: 10) | 0.3 | 0.45 |
| Disodium ethylenediaminetetraacetate | 0.05 | 0.08 |
| Water to make | 1.0 liter | 1.0 liter |
| pH | 5.8–8.0 | 5.8–8.0 |

The processed samples were each determined on the density through a green filter and evaluated on the sensitivity. The sensitivity is defined as a reciprocal of the exposure amount necessary for giving a density 0.2 higher than the fog density. The sensitivity of Sample 12 is shown by a relative value to the sensitivity of Sample 101 which was taken as 100. The sensitivity of Sample 14 is shown by a relative value to the sensitivity of Sample 13 which was taken as 100. The sensitivity of Sample 16 is shown by a relative value to the sensitivity of Sample 15 which was taken as 100. The emulsions used in each samples and the sensitivity determined for each samples are shown in Table 22.

In addition, to evaluate the residual color of the sensitizing dyes after processing, the samples shown in Table 22 were processed in the same manner as described above, but for omitting exposure, and the residual color of the processed samples in the wavelength range of from 480 nm to 580 nm was evaluated. The results are shown in Table 22. The residual color of Sample 12 is shown by a relative value of the absorption area owing to the residual color in the wavelength range of from 480 nm to 580 nm, to the absorption area owing to the residual color of Sample 11 in the wavelength range of from 480 nm to 580 nm which was taken as 100. Similarly, the residual color of Sample 14 is shown by a relative value to the residual color of Sample 13 which was taken as 100, and the residual color of Sample 16 is shown by a relative value to the residual color of Sample 15 which was taken as 100.

TABLE 22

| Sample | Emulsion | (A-1) | Sensitivity | Residual color | Note |
|---|---|---|---|---|---|
| 11 | A | None | 100 (Standard) | 100 (Standard) | Comparative example |
| 12 | A | Presence | 99 | 65 | This invention |
| 13 | B | None | 100 (Standard) | 100 (Standard) | Comparative example |
| 14 | B | Presence | 100 | 49 | This invention |
| 15 | C | None | 100 (Standard) | 100 (Standard) | Comparative example |
| 16 | C | Presence | 101 | 45 | This invention |

It can be seen from Table 22 that the samples of the present invention showed almost the same sensitivity as the samples for comparison, and moreover the samples of the present invention were remarkably improved in residual color as compared to the samples for comparison.

The number of the dye adsorption layer was almost same among the Samples 11, 12, 13, 14, 15 and 16, namely 2.45, 2.44, 2.45, 2.45, 2.45 and 2.46 in this order. Further, with respect to the Samples 15 and 16, the light absorption strength of the liquid emulsion was measured. The results were almost same, namely the light absorption strength of the comparison Sample 15 was 213, whereas the light absorption strength of the Sample 16 of the present invention was 214.

Further it can be seen from the comparison of Emulsions A, B and C that the samples of the present invention are tabular grains, and show more excellent residual-color-reducing effect, and moreover selenium-sensitized emulsions show particularly excellent performance. Further, various kinds of tabular grains having various aspect ratios were prepared in the same manner as Emulsion B, except for controlling the silver potential. The same evaluation led to the conclusion that the use of tabular grains having an aspect ratio of 2 or more, and moreover 8 or more shows particularly excellent performance.

Example 7

The Sample 15 of Example 6 was processed in the same manner as in Example 6, except that 0.025 g of (A-10) was added to the replenisher, and 0.02 g of (A-10) was added to the mother solution, of a fixing solution. When the sensitivity of the Sample 15 was taken as 100 (standard), the sensitivity of the thus-obtained Sample 15A was equal to 100. Further, when the residual color of the Sample 15 was taken as 100 (standard) the residual color of the sample 15A was 88, which was improved.

Example 8

The same evaluation as in Example 6 was conducted with respect to the series of the color negative photographic material of Example 1 described in JP-A-11-305369, the color reversal photographic material of Example 1 described in JP-A-7-92601 and JP-A-11-160828, the color paper photographic material of Example 1 described in JP-A-6-347944, the instant photographic material of Example 1 described in JP-A-2000-284442, the printing photographic material of Example 1 described in JP-A-8-292512, the X-ray photographic material of Example 1 described in JP-A-8-122954, and the heat-developable photographic materials of Example 5 described in JP-A-2000-122206, Example 1 described in JP-A-2001-281785 (Japanese Patent Application 2000-89436) and Example 1 described in JP-A-6-130607. The results showed the same effects as in Example 6.

Having described our invention as related to the present embodiments, it is our intention that the invention not be limited by any of the details of the description, unless otherwise specified, but rather be construed broadly within its spirit and scope as set out in the accompanying claims.

This nonprovisional application claims priority under 35 U.S.C. § 119 (a) on Patent Application No. 2002-323127 filed in Japan on Nov. 6, 2002, and Patent Application No. 2003-65565 filed in Japan on Mar. 11, 2003, which are herein incorporated by reference.

We claim:

1. A silver halide photographic photosensitive material adapted for imagewise exposure followed by development processing, said photosensitive material prior to processing with a processing solution comprising at least one compound represented by the following formula (I):

$$A_1\text{-}(X_1)n_1\text{-}B_1\text{-}(X_2)n_2\text{-}A_2\ Mdmd \qquad \text{Formula (I)}$$

wherein, in formula (I), $A_1$ and $A_2$ each are a naphthyl group having at least one carboxy group; $B_1$ represents an atomic group having a π electron; $X_1$ and $X_2$ each represent a linking group; $n_1$ and $n_2$ each represent 0 or 1; Md represents a counter ion for balancing a charge; and md represents a number of 0 or more required for neutralizing a charge on the molecule.

2. A silver halide photographic photosensitive material adapted for imagewise exposure followed by development processing, said photosensitive material prior to processing with a processing solution comprising at least one compound represented by the following formula (IV):

$$A_1\text{-}X_1\text{-}L\text{-}X_2\text{-}A_2 \qquad \text{Formula (IV)}$$

wherein, in formula (IV), $A_1$ and $A_2$ each are a substituted or unsubstituted naphthyl group; L represents a divalent group derived from compounds having a π electron; and $X_1$ and $X_2$ each represent a divalent linking group.

3. A silver halide photographic photosensitive material adapted for imagewise exposure followed by development processing, said photosensitive material prior to processing with a processing solution comprising at least one compound represented by the following formula (I):

$$A_1\text{-}(X_1)n_1\text{-}B_1\text{-}(X_2)n_2\text{-}A_2\ Mdmd \qquad \text{Formula (I)}$$

wherein, in formula (I), $A_1$ and $A_2$ each are a substituted or unsubstituted naphthyl group; $B_1$ represents an atomic group having a π electron; $X_1$ and $X_2$ each represent a linking group; $n_1$ and $n_2$ each represent 0 or 1; Md represents a counter ion for balancing a charge; and md represents a number of 0 or more required for neutralizing a charge on the molecule; and wherein the at least one silver halide emulsion incorporated in the silver halide photographic photosensitive material contains dye chromophores being multilayer-adsorbed on the surface of silver halide grains.

* * * * *